US011969048B2

(12) United States Patent
Connell et al.

(10) Patent No.: US 11,969,048 B2
(45) Date of Patent: Apr. 30, 2024

(54) STACKED CUSHIONING ARRANGEMENT FOR SOLE STRUCTURE

(71) Applicant: NIKE, Inc., Beaverton, OR (US)

(72) Inventors: Jeremy L. Connell, Hillsboro, OR (US); Karen S. Dimoff, Portland, OR (US); Emily Farina, Beaverton, OR (US); Joel Ryp Greenspan, Portland, OR (US); Stefan E. Guest, Portland, OR (US); Derek Haight, Beaverton, OR (US); Olivier Henrichot, Tigard, OR (US); Helene Hutchinson, Portland, OR (US); Geng Luo, Portland, OR (US); Krissy Yetman, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 155 days.

(21) Appl. No.: 17/113,952

(22) Filed: Dec. 7, 2020

(65) Prior Publication Data

US 2021/0085026 A1 Mar. 25, 2021

Related U.S. Application Data

(63) Continuation of application No. 15/886,571, filed on Feb. 1, 2018, now Pat. No. 11,000,093.

(Continued)

(51) Int. Cl.

*A43B 13/18* (2006.01)
*A43B 13/12* (2006.01)

(Continued)

(52) U.S. Cl.

CPC ..... *A43B 13/186* (2013.01); *A43B 13/12* (2013.01); *A43B 13/125* (2013.01);

(Continued)

(58) Field of Classification Search

CPC ..... A43B 13/10; A43B 13/12; A43B 13/41; A43B 13/42; A43B 13/127; A43B 13/183;

(Continued)

(56) References Cited

U.S. PATENT DOCUMENTS 3,841,005 A * 10/1974 Cox ..... A43B 13/42 36/76 C
4,271,606 A * 6/1981 Rudy ..... A43B 13/20 36/32 R (Continued)

FOREIGN PATENT DOCUMENTS

EP 1386553 A1 2/2004
JP 3990329 B2 10/2007

OTHER PUBLICATIONS

European Patent Office (ISA), International Search Report and Written Opinion for PCT Application No. PCT/US2018/016488, dated Apr. 30, 2018.

(Continued)

*Primary Examiner* — Megan E Lynch
(74) *Attorney, Agent, or Firm* — Honigman LLP; Matthew H. Szalach; Jonathan P. O'Brien

(57) ABSTRACT

A sole structure for an article of footwear is provided. The sole structure includes an outsole having a ground-engaging surface and an upper surface formed on an opposite side of the outsole than the ground-engaging surface. A first cushion is disposed proximate to a medial side of the sole structure and includes a first fluid-filled chamber attached to the upper surface of the outsole and a second fluid-filled chamber attached to the first fluid-filled chamber and disposed between the first fluid-filled chamber and the upper. A second cushion is disposed proximate to a lateral side of the sole structure and includes a third fluid-filled chamber attached to the upper surface of the outsole and a fourth (Continued)

fluid-filled chamber attached to the third fluid-filled chamber and disposed between the third fluid-filled chamber and the upper. The second cushion is fluidly isolated from the first cushion.

14 Claims, 58 Drawing Sheets

Related U.S. Application Data

(60) Provisional application No. 62/543,780, filed on Aug. 10, 2017, provisional application No. 62/517,129, filed on Jun. 8, 2017, provisional application No. 62/453,406, filed on Feb. 1, 2017.

(51) Int. Cl.
*A43B 13/14* (2006.01)
*A43B 13/32* (2006.01)

(52) U.S. Cl.
CPC ..... *A43B 13/127* (2013.01); *A43B 13/148* (2013.01); *A43B 13/183* (2013.01); *A43B 13/187* (2013.01); *A43B 13/188* (2013.01); *A43B 13/189* (2013.01); *A43B 13/32* (2013.01)

(58) Field of Classification Search
CPC ... A43B 13/185; A43B 13/186; A43B 13/188; A43B 13/189
See application file for complete search history.

(56) References Cited

U.S. PATENT DOCUMENTS 4,614,046 A 9/1986 Dassler
4,887,367 A * 12/1989 Mackness ..... A43B 1/0018 36/35 B
5,179,791 A * 1/1993 Lain ..... A43B 13/41 36/43
6,354,020 B1 * 3/2002 Kimball ..... A43B 13/203 36/35 B
7,779,558 B2 * 8/2010 Nishiwaki ..... A43B 13/189 36/27
9,516,919 B2 12/2016 Ernst et al.
2003/0000108 A1 * 1/2003 Kita ..... A43B 13/12 36/28
2003/0000109 A1 * 1/2003 Kita ..... A43B 13/188 36/31
2004/0049946 A1 * 3/2004 Lucas ..... A43B 1/0009 36/28
2004/0181970 A1 * 9/2004 Covatch ..... A43B 7/1445 36/28
2005/0000115 A1 * 1/2005 Kimura ..... A43B 13/026 36/142
2005/0022425 A1 * 2/2005 Brown ..... A43B 7/12 36/25 R
2005/0268488 A1 * 12/2005 Hann ..... A43B 13/16 36/27
2005/0268490 A1 * 12/2005 Foxen ..... A43B 13/189 36/28
2006/0137228 A1 * 6/2006 Kubo ..... A43B 13/12 36/31
2007/0101617 A1 * 5/2007 Brewer ..... A43B 7/08 36/103
2008/0052965 A1 * 3/2008 Sato ..... A43B 13/026 36/103
2009/0100705 A1 * 4/2009 Cook ..... A43B 13/026 36/28
2009/0113758 A1 * 5/2009 Nishiwaki ..... A43B 13/10 36/28
2009/0172971 A1 * 7/2009 Peikert ..... A43B 13/12 12/146 B
2009/0241373 A1 * 10/2009 Kita ..... A43B 13/143 36/44
2010/0005684 A1 * 1/2010 Nishiwaki ..... A43B 13/20 36/28
2010/0107444 A1 * 5/2010 Aveni ..... A43B 13/189 36/35 B
2010/0251565 A1 * 10/2010 Litchfield ..... A43B 13/189 36/35 B
2010/0307028 A1 * 12/2010 Teteriatnikov ..... A43B 13/145 36/108
2011/0302809 A1 * 12/2011 Kim ..... A43B 13/187 36/103
2012/0042539 A1 * 2/2012 Miner ..... A43B 13/16 12/146 B
2012/0174432 A1 * 7/2012 Peyton ..... A43B 13/188 36/31
2012/0246969 A1 * 10/2012 Baum ..... A43B 13/181 36/27
2013/0199057 A1 * 8/2013 Hurd ..... A43B 13/184 36/88
2014/0075777 A1 3/2014 Bruce et al.
2014/0075778 A1 * 3/2014 Bruce ..... A43B 13/10 36/29
2014/0075779 A1 * 3/2014 Bruce ..... A43B 7/148 36/29
2014/0202031 A1 * 7/2014 Seo ..... A43B 13/127 36/28
2014/0259747 A1 * 9/2014 Baudouin ..... A43B 13/141 36/28
2015/0327624 A1 * 11/2015 Grott ..... A43B 13/122 36/91
2016/0058122 A1 * 3/2016 Foxen ..... A43B 13/181 36/28
2016/0058123 A1 * 3/2016 Peyton ..... A43B 13/141 36/25 R
2016/0073732 A1 * 3/2016 Ernst ..... B29D 35/128 36/28
2016/0120263 A1 * 5/2016 Cortez ..... A43B 3/0063 36/29
2016/0278476 A1 * 9/2016 Stien ..... A43B 13/12
2016/0360831 A1 * 12/2016 Bruce ..... A43B 13/383
2017/0095033 A1 4/2017 Farina et al.
2017/0095034 A1 4/2017 Dupre et al.
2017/0280816 A1 10/2017 Lyden
2017/0325543 A1 * 11/2017 Iuchi ..... A43B 13/186
2018/0000196 A1 * 1/2018 Lovell ..... A43B 7/148
2018/0125148 A1 * 5/2018 Elder ..... A43B 13/122

OTHER PUBLICATIONS

European Patent Office (ISA), International Preliminary Report on Patentability for PCT Application No. PCT/US2018/016488, dated Aug. 15, 2019.
USPTO, Non-Final Office Action for U.S. Appl. No. 16/543,825, dated Jan. 13, 2020.
USPTO, Non-Final Office Action for U.S. Appl. No. 15/886,571, dated May 18, 2020.
Korean Intellectual Property Office, Notice of Allowance for KR Application No. 10-2019-7025176, dated Apr. 23, 2020.
United States Patent and Trademark Office, Office Action for U.S. Appl. No. 16/543,825, dated May 22, 2020.
United States Patent and Trademark Office, Non-Final Office Action for U.S. Appl. No. 16/879,209 dated Jul. 9, 2021.
United States Patent and Trademark Office, Final Office Action for U.S. Appl. No. 16/879,357 dated Oct. 26, 2021.
United States Patent and Trademark Office, Final Office Action for U.S. Appl. No. 16/879,209 dated Oct. 22, 2021.
United States Patent and Trademark Office, Non-Final Office Action for U.S. Appl. No. 16/879,357 dated Jul. 13, 2021.

* cited by examiner

STACKED CUSHIONING ARRANGEMENT FOR SOLE STRUCTURE

CROSS REFERENCE TO RELATED APPLICATIONS

This application is a Continuation of U.S. application Ser. No. 15/886,571, filed Feb. 1, 2018, which claims priority under 35 U.S.C. § 119(e) to U.S. Provisional Application 62/453,406, filed on Feb. 1, 2017, U.S. Provisional Application 62/517,129, filed on Jun. 8, 2017, and U.S. Provisional Application 62/543,780, filed on Aug. 10, 2017. The disclosures of these prior applications are considered part of the disclosure of this application and are hereby incorporated by reference in their entireties.

FIELD

The present disclosure relates generally to articles of footwear and more particularly to a sole structure for an article of footwear.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhancing traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole and/or a sockliner located within a void proximate to the bottom portion of the upper.

Midsoles using polymer foam materials are generally configured as a single slab that compresses resiliently under applied loads, such as during walking or running movements. Generally, single-slab polymer foams are designed with an emphasis on balancing cushioning characteristics that relate to softness and responsiveness as the slab compresses under gradient loads. Polymer foams providing cushioning that is too soft will decrease the compressibility and the ability of the midsole to attenuate ground-reaction forces after repeated compressions. Conversely, polymer foams that are too hard and, thus, very responsive, sacrifice softness, thereby resulting in a loss in comfort. While different regions of a slab of polymer foam may vary in density, hardness, energy return, and material selection to balance the softness and responsiveness of the slab as a whole, creating a single slab of polymer foam that loads in a gradient manner from soft to responsive is difficult to achieve.

DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
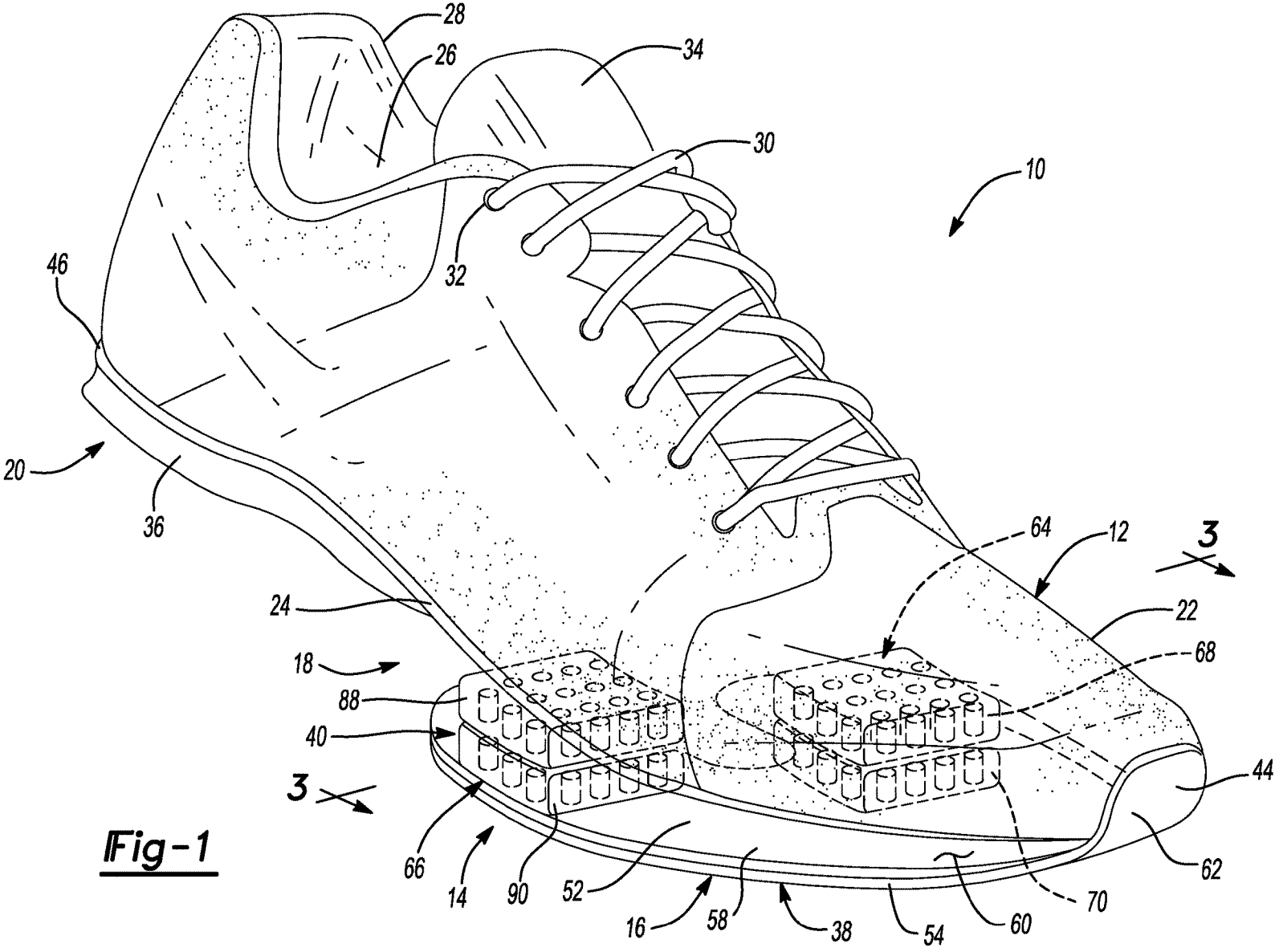
FIG. 1 is a perspective view of an article of footwear incorporating a sole structure in accordance with the principles of the present disclosure.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the figures, a sole structure for an article of footwear having an upper is provided. The sole structure includes an outsole having a ground-engaging surface and an upper surface formed on an opposite side of the outsole than the ground-engaging surface. A midsole is provided and includes an upper portion and a lower portion. The lower portion is attached to the outsole and includes a first segment extending from a forefoot region of the upper portion in a direction toward a heel region of the upper portion and a second segment extending from the heel region of the upper portion in a direction toward the forefoot region of the upper portion, the second segment being spaced apart from the first segment along a longitudinal axis of the midsole by a gap. At least one plate extends from the midsole into the gap, and a cushion is disposed in the gap of the midsole and joined to the plate.

Implementations of the disclosure may include one of more of the following optional features. In some examples, a first end of the plate is joined to the first segment of the midsole, a second end of the plate is joined to the second segment of the midsole, and an intermediate portion of the plate extends through the gap from the first end to the second end and is joined to the cushion.

The first end of the plate may be embedded within the first segment of the midsole and the second end of the plate may be embedded within the second segment of the midsole. In some examples, a first end of the plate is disposed between the upper portion of the midsole and the first segment of the midsole, and a second end of the first plate is disposed between the upper portion of the midsole and the second segment of the midsole.

In some implementations, the intermediate portion of the plate is disposed between the cushion and the upper portion of the midsole. Here, the cushion may include a first cushion disposed proximate to a medial side of the sole structure having a first fluid-filled chamber disposed between the plate and the outsole, and a second cushion disposed proximate to a lateral side of the sole structure having a second fluid-filled chamber disposed between the plate and the outsole. The second cushion may be fluidly isolated from the first cushion.

In other implementations the cushion may be disposed between intermediate portion of the plate and the upper portion of the midsole. Here, the cushion comprises a first cushion disposed proximate to a medial side of the sole structure and including a first fluid-filled chamber disposed between upper portion of the midsole and the intermediate portion of the plate, and a second cushion disposed proximate to a lateral side of the sole structure and including a second fluid-filled chamber disposed between the upper portion of the midsole and the intermediate portion of the plate, the second cushion being fluidly isolated from the first cushion.

The plate may include a first plate disposed between the upper portion of the midsole and the cushion and a second plate extending from the lower portion of the midsole and disposed between the cushion and the outsole. Optionally, at least one of the first plate and the second plate is formed of carbon fiber.

In another aspect of the disclosure, a sole structure for an article of footwear having an upper is provided. The sole structure comprises an outsole having a ground-engaging surface and an upper surface formed on an opposite side of the outsole than the ground-engaging surface. The sole structure further includes a midsole having an upper portion and a lower portion. The lower portion is attached to the outsole and includes a first segment extending from a forefoot region of the upper portion in a direction toward a heel region of the upper portion and a second segment extending from the heel region of the upper portion in a direction toward the forefoot region of the upper portion, the second segment being spaced apart from the first segment along a longitudinal axis of the midsole by a gap. A cushion is disposed in the gap of the midsole and includes a first cushion disposed proximate to a medial side of the sole structure, and a second cushion disposed proximate to a lateral side of the sole structure. The second cushion is isolated from the first cushion. A first plate is joined to each of the first segment of the midsole, the second segment of the midsole, and the cushion.

Implementations of the disclosure may include one of more of the following optional features. In some implementations, the cushion comprises the first cushion including a first fluid-filled chamber disposed between the first plate and the outsole, and the second cushion disposed proximate to a lateral side of the sole structure includes a second fluid-filled chamber disposed between the first plate and the outsole. The second cushion is fluidly isolated from the first cushion. In some examples, at least one of the first fluid-filled chamber and the second fluid-filled chamber includes a tensile member disposed therein.

In some implementations, the least one of the first fluid-filled chamber and the second fluid-filled chamber includes a tensile member disposed therein. The first fluid-filled chamber may be aligned with the second fluid-filled chamber in a direction extending from a medial side to a lateral side of the sole structure.

In some configurations, the sole structure includes a second plate spaced apart from the first plate and having a first end joined to the first segment of the midsole, a second end joined to the second segment of the midsole, and an intermediate portion joined to the cushion, such that the cushion is disposed between the first plate and the second plate. Optionally, the second plate is formed of carbon fiber. Here, the cushion comprises the first cushion including a first fluid-filled chamber disposed between the first plate and the second plate and a second fluid-filled chamber disposed between the second plate and the outsole, and the second cushion including a third fluid-filled chamber disposed between the first plate and the second plate and a fourth fluid-filled chamber disposed between the second plate and the outsole, such that the second cushion is fluidly isolated from the first cushion.

Optionally, the sole structure further comprises a third plate disposed between the cushion and the outsole. The third plate is joined to each of the first segment of the midsole and the cushion. At least one of the second plate and the third plate may include a cutout formed between the first segment and the cushion.

In some examples, the first end of the second plate includes a first notch defining a first pair of tabs, and the second end of the second plate includes a second notch defining a second pair of tabs, the first pair of tabs embedded in the first segment of the lower portion of the midsole and the second pair of tabs embedded in the second segment of the lower portion of the midsole.

In another aspect of the disclosure, a sole structure for an article of footwear having an upper is provided. The sole structure includes an outsole having a ground-engaging surface and an upper surface formed on an opposite side of the outsole than the ground-engaging surface. A first cushion is disposed proximate to a medial side of the sole structure and includes a first fluid-filled chamber attached to the upper surface of the outsole and a second fluid-filled chamber attached to the first fluid-filled chamber and disposed between the first fluid-filled chamber and the upper. A second cushion is disposed proximate to a lateral side of the sole structure and includes a third fluid-filled chamber attached to the upper surface of the outsole and a fourth fluid-filled chamber attached to the third fluid-filled chamber and disposed between the third fluid-filled chamber and the upper. The second cushion is fluidly isolated from the first cushion.

Implementations of the disclosure may include one of more of the following optional features. In some implementations, the first segment is formed along a first side surface, the second segment is formed in the first region of the ground-engaging surface, and the third segment 15 formed along a second side surface.

In one configuration, the first fluid-filled chamber may be fluidly isolated from the second fluid-filled chamber and the third fluid-filled chamber may be fluidly isolated from the fourth fluid-filled chamber. Further, the first cushion may be spaced apart and separated from the second cushion.

The first cushion may be disposed closer to an anterior end of the sole structure than the second cushion. A third cushion may be disposed between the second cushion and a posterior end of the sole structure. The third cushion may include a fifth fluid-filled chamber attached to the upper surface of the outsole and a sixth fluid-filled chamber attached to the fifth fluid-filled chamber and disposed between the fifth fluid-filled chamber and the upper.

The outsole may include an outsole plate member forming the upper surface and a series of traction elements extending from the outsole plate member at the ground-engaging surface. In one configuration, the traction elements are formed from a resilient material. In another configuration, the traction elements are formed from a compressible material. In yet another configuration, the traction elements are formed from a rigid material. Regardless of the construction of the traction elements, the outsole plate member may be formed from a rigid material.

A plate member may extend from an anterior end of the sole structure toward a posterior end. The first cushion and the second cushion may be disposed between the plate member and the upper surface of the outsole.

In one configuration, at least one of the first fluid-filled chamber, the second fluid-filled chamber, the third fluid-filled chamber, and the fourth fluid-filled chamber includes a tensile member disposed therein.

The first cushion may form a first bulge in the ground-engaging surface and the second cushion may form a second bulge in the ground-engaging surface. The first bulge may be offset from the second bulge in a direction extending substantially parallel to a longitudinal axis of the sole structure.

In one configuration, the first fluid-filled chamber may be aligned with the second fluid-filled chamber. Further, the third fluid-filled chamber may be aligned with the fourth fluid-filled chamber.

The outsole may extend from the second cushion to an anterior end of the sole structure. A cushioning element may be disposed between the upper surface of the outsole and the upper. The cushioning element may be disposed between the anterior end of the sole structure and the first cushion. In one configuration, the cushioning element is formed from foam. Further, the cushioning element may taper in a direction toward the anterior end of the sole structure.

In another configuration, a sole structure for an article of footwear having an upper is provided. The sole structure includes an outsole having a ground-engaging surface and an upper surface formed on an opposite side of the outsole than the ground-engaging surface. A first cushion is disposed proximate to a medial side of the sole structure and includes a first fluid-filled chamber attached to the upper surface of the outsole and a second fluid-filled chamber attached to the first fluid-filled chamber and disposed between the first fluid-filled chamber and the upper. A second cushion is disposed proximate to a lateral side of the sole structure and includes a third fluid-filled chamber attached to the upper surface of the outsole and a fourth fluid-filled chamber attached to the third fluid-filled chamber and disposed between the third fluid-filled chamber and the upper. The second cushion is offset from the first cushion in a direction extending substantially parallel to a longitudinal axis of the sole structure.

In one configuration, the first fluid-filled chamber may be fluidly isolated from the second fluid-filled chamber and the third fluid-filled chamber may be fluidly isolated from the fourth fluid-filled chamber. Further, the first cushion may be spaced apart and separated from the second cushion.

The first cushion may be disposed closer to an anterior end of the sole structure than the second cushion. A third cushion may be disposed between the second cushion and a posterior end of the sole structure. The third cushion may include a fifth fluid-filled chamber attached to the upper surface of the outsole and a sixth fluid-filled chamber attached to the fifth fluid-filled chamber and disposed between the fifth fluid-filled chamber and the upper.

The outsole may include an outsole plate member forming the upper surface and a series of traction elements extending from the outsole plate member at the ground-engaging surface. In one configuration, the traction elements are formed from a resilient material. In another configuration, the traction elements are formed from a compressible material. In yet another configuration, the traction elements are formed from a rigid material. Regardless of the construction of the traction elements, the outsole plate member may be formed from a rigid material.

A plate member may extend from an anterior end of the sole structure toward a posterior end. The first cushion and the second cushion may be disposed between the plate member and the upper surface of the outsole.

In one configuration, at least one of the first fluid-filled chamber, the second fluid-filled chamber, the third fluid-filled chamber, and the fourth fluid-filled chamber includes a tensile member disposed therein.

The first cushion may form a first bulge in the ground-engaging surface and the second cushion may form a second bulge in the ground-engaging surface.

In one configuration, the first fluid-filled chamber may be aligned with the second fluid-filled chamber. Further, the third fluid-filled chamber may be aligned with the fourth fluid-filled chamber.

The outsole may extend from the second cushion to an anterior end of the sole structure. A cushioning element may be disposed between the upper surface of the outsole and the upper. The cushioning element may be disposed between the anterior end of the sole structure and the first cushion. In one configuration, the cushioning element is formed from foam. Further, the cushioning element may taper in a direction toward the anterior end of the sole structure.

In another aspect of the disclosure, a sole structure for an article of footwear having an upper comprises an outsole having a ground-engaging surface and an upper surface formed on an opposite side of the outsole than the ground-engaging surface. A midsole of the sole structure is attached to the outsole and includes an upper portion and a lower portion defining a gap. The lower portion includes a first segment extending from a forefoot region of the upper portion and a second segment extending from a heel region of the upper portion. A cushion is disposed in the gap of the midsole, a first plate is disposed between the cushion and the upper portion of the midsole, and a second plate is joined to the first segment of the midsole and to the cushion.

In some examples, the cushion comprises a first cushion disposed proximate to a medial side of the sole structure and including a first fluid-filled chamber disposed between the first plate and the second plate and a second fluid-filled chamber disposed between the second plate and the outsole, and a second cushion disposed proximate to a lateral side of the sole structure and including a third fluid-filled chamber disposed between the first plate and the second plate and a fourth fluid-filled chamber disposed between the second plate and the outsole, the second cushion being fluidly isolated from the first cushion.

A first end of the second plate may be joined to the first segment of the midsole and a second end of the second plate may be joined to the second segment of the midsole. In some examples the first end of the second plate is embedded within the first segment of the midsole. In some examples the second end of the second plate is embedded within the second segment of the midsole. In other examples the second end of the second plate is joined to a forefoot-facing sidewall of the second segment.

A first end of the first plate may be disposed between the upper portion of the midsole and the first segment of the midsole, and a second end of the first plate may disposed between the upper portion of the midsole and the first segment of the midsole.

In some examples, the second plate includes a concave intermediate portion having a radius of constant curvature from an anterior-most point to a metatarsophalangeal point of the sole structure.

Alternatively, the cushion may comprise a first cushion disposed proximate to a medial side of the sole structure and including a first fluid-filled chamber attached to the first plate and a second fluid-filled chamber attached to the first fluid-filled chamber and disposed between the first fluid-filled chamber and the second plate. The cushion may further comprise a second cushion disposed proximate to a lateral side of the sole structure and including a third fluid-filled chamber attached to the first plate and a fourth fluid-filled chamber attached to the third fluid-filled chamber and disposed between the third fluid-filled chamber and the second plate, the second cushion being fluidly isolated from the first cushion.

The second plate may extend from the first segment of the midsole to the second segment of the midsole. A first end of the second plate may be joined to an anterior end of the first segment and a second end of the second plate may be embedded within the second segment of the midsole.

An intermediate portion of the second plate is curved upward, and may include a damper disposed intermediate the cushion and the second segment of the midsole. The damper is configured to minimize a transfer of torsional forces from the intermediate portion to the second segment.

The midsole may further include a rib extending between the first segment and the second segment and laterally bisecting the cushion.

With reference to FIGS. 1-7, an article of footwear 10 is provided and includes an upper 12 and a sole structure 14 attached to the upper 12. The article of footwear 10 may be divided into one or more regions. The regions may include a forefoot region 16, a mid-foot region 18, and a heel region 20. The forefoot region 16 may correspond with toes and joints connecting metatarsal bones with phalanx bones of a foot. The mid-foot region 18 may correspond with an arch area of the foot while the heel region 20 may correspond with rear portions of the foot, including a calcaneus bone. The article of footwear 10 may additionally include a medial side 22 and a lateral side 24 that correspond with opposite sides of the article of footwear 10 and extend through the regions 16, 18, 20.

The upper 12 includes interior surfaces that define an interior void 26 that receives and secures a foot for support on the sole structure 14. An ankle opening 28 in the heel region 20 may provide access to the interior void 26. For example, the ankle opening 28 may receive a foot to secure the foot within the void 26 and facilitate entry and removal of the foot from and to the interior void 26. In some examples, one or more fasteners 30 extend along the upper 12 to adjust a fit of the interior void 26 around the foot while concurrently accommodating entry and removal of the foot therefrom. The upper 12 may include apertures 32 such as eyelets and/or other engagement features such as fabric or mesh loops that receive the fasteners 30. The fasteners 30 may include laces, straps, cords, hook-and-loop, or any other suitable type of fastener.

The upper 12 may additionally include a tongue portion 34 that extends between the interior void 26 and the fasteners 30. The upper 12 may be formed from one or more materials that are stitched or adhesively bonded together to form the interior void 26. Suitable materials of the upper 12 may include, textiles, foam, leather, and synthetic leather. The materials may be selected and located to impart properties of durability, air-permeability, wear-resistance, flexibility, and comfort to the foot while disposed within the interior void 26.

The sole structure 14 is attached to the upper 12 and provides the article of footwear 10 with support and cushioning during use. Namely, the sole structure 14 attenuates ground-reaction forces caused by the article of footwear 10 striking the ground during use. Accordingly, and as set forth below, the sole structure 14 may incorporate one or more materials having energy absorbing characteristics to allow the sole structure 14 to minimize the impact experienced by a user when wearing the article of footwear 10.

The sole structure 14 may include a midsole 36, an outsole 38, and one or more cushions or cushioning arrangements 40 disposed generally between the midsole 36 and the outsole 38. In addition, the sole structure 14 may include a plate 42 that extends from an anterior end 44 of the article of footwear 10 towards a posterior end 46. In one configuration, the plate 42 is attached directly to the upper 12. In another configuration, the plate 42 is attached to the upper 12 via a strobel 48, as shown in FIGS. 2-6. While the plate 42 may be directly attached to the upper 12 or may be attached to the upper 12 via a strobel 48, the plate 42 will be hereinafter described and shown as being attached to the upper 12 via a strobel 48.

With continued reference to FIGS. 2-7, the midsole 36 is shown as extending from the anterior end 44 of the article of footwear 10 to the posterior end 46. The midsole 36 may be formed from an energy absorbing material such as, for example, polymer foam. In one configuration, the midsole 36 opposes the strobel 48 of the upper 12 such that the plate 42 extends between the midsole 36 and the strobel 48. The midsole 36 may extend at least partially onto an upper surface 50 of the upper 12 (FIG. 3) such that the midsole 36 covers a junction of the upper 12 and the strobel 48.

Forming the midsole 36 from an energy-absorbing material such as polymer foam allows the midsole 36 to attenuate ground-reaction forces caused by movement of the article of footwear 10 over ground during use. In addition to absorbing forces associated with use of the article of footwear 10, the midsole 36 may serve to attach the plate 42 to the upper 12 via the strobel 48. A suitable adhesive (not shown) may be used to attach the plate 42 to one or both of the midsole 36 and the strobel 48. Alternatively, the plate 42 may be attached to the midsole 36 by molding a material of the midsole 36 directly to the plate 42. For example, the plate 42 may be disposed within a cavity of a mold (not shown) used to form the midsole 36. Accordingly, when the midsole 36 is formed (i.e. by foaming a polymer material), the material of the midsole 36 is joined to the material of the plate 42, thereby forming a unitary structure having both the midsole 36 and the plate 42.

While the plate 42 is described and shown as being disposed between the upper 12 and the midsole 36, the plate 42 could alternatively be embedded within the material of the midsole 36. For example, the plate 42 may be encapsulated by the midsole 36 such that a portion of the midsole 36 extends between the plate 42 and the upper 12 and another portion of the midsole 36 extends between the plate 42 and the outsole 38. Further yet, the plate 42 could be disposed within the midsole 36 but not be fully encapsulated. For example, the plate 42 could be visible around a perimeter of the midsole 36 while a portion of the midsole 36 extends between the plate 42 and the upper 12 and another portion of the midsole 36 extends between the plate 42 and the outsole 38.

Regardless of the particular location of the plate 42 relative to the midsole 36, the plate 42 may be formed from a relatively rigid material. For example, the plate 42 may be formed from a non-foamed polymer material or, alternatively, from a composite material containing fibers such as carbon fibers. Forming the plate 42 from a relatively rigid material allows the plate 42 to distribute forces associated with use of the article footwear 10 when the article of footwear 10 strikes a ground surface, as will be described in greater detail below.

Regardless of the materials used to form the plate 42, the plate 42 may be a so-called "full-length plate" that extends from the anterior end 44 to the posterior end 46. Allowing the plate 42 to extend from the anterior end 44 to the posterior end 46 causes the plate 42 to extend from the forefoot region 16 through the mid-foot region 18 and to the heel region 20. While the plate 42 may be a full-length plate that extends from the forefoot region 16 to the heel region 20, the plate 42 could alternatively extend through only a portion of the sole structure 14. For example, the plate 42 may extend from the anterior end 44 of the article of footwear 10 to the mid-foot region 18 without extending fully through the mid-foot region 18 and into the heel region 20.

As shown in FIG. 1, the outsole 38 is spaced apart from the midsole 36 to define a cavity 52 there between. The outsole 38 may include a ground-engaging surface 54 and a top surface 56 formed on an opposite side of the outsole 38 than the ground-engaging surface 54. The outsole 38 may be formed from a resilient material such as, for example, rubber that provides the article of footwear 10 with a ground-engaging surface 54 that provides traction and durability. The ground-engaging surface 54 may include one or more traction elements 55 (FIG. 7) that extend from the ground-engaging surface 54 to provide the article of footwear 10 with increased traction during use.

The outsole 38 may additionally include an outsole plate 58 that is attached to the top surface 56. As with the plate 42, the outsole plate 58 may be formed from a relatively rigid material such as, for example, a non-foamed polymer or a composite material containing fibers such as carbon fibers. The outsole plate 58 may include a surface 60 that opposes the midsole 36 and defines at least a portion of the cavity 52. The outsole 38 may be attached to the upper 12 at a tab 62 that is attached or otherwise bonded to the upper 12 at the anterior end 44, as shown in FIG. 1.

Figure 2:
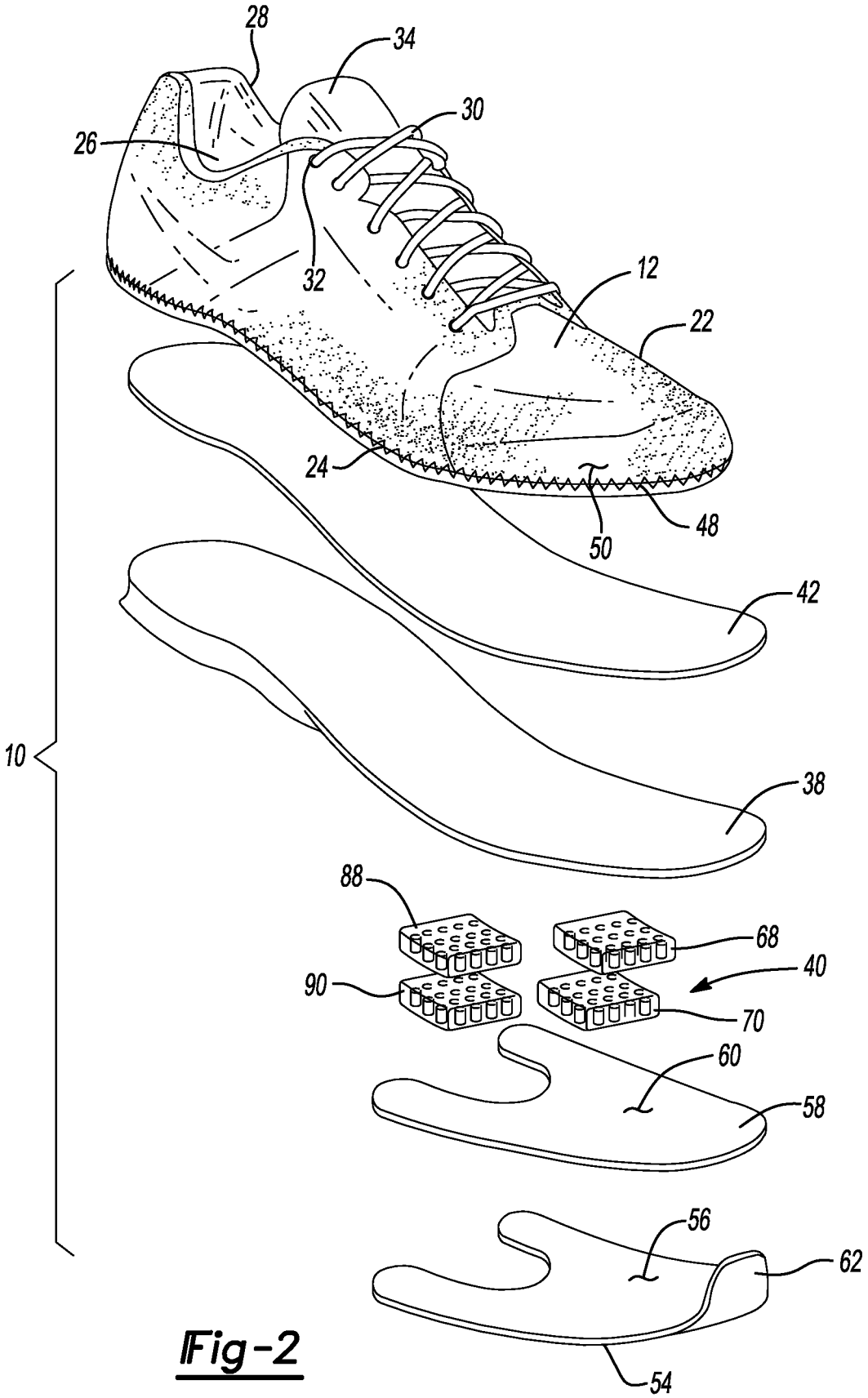
FIG. 2 is an exploded view of the article of footwear of FIG. 1.
Figure 3:
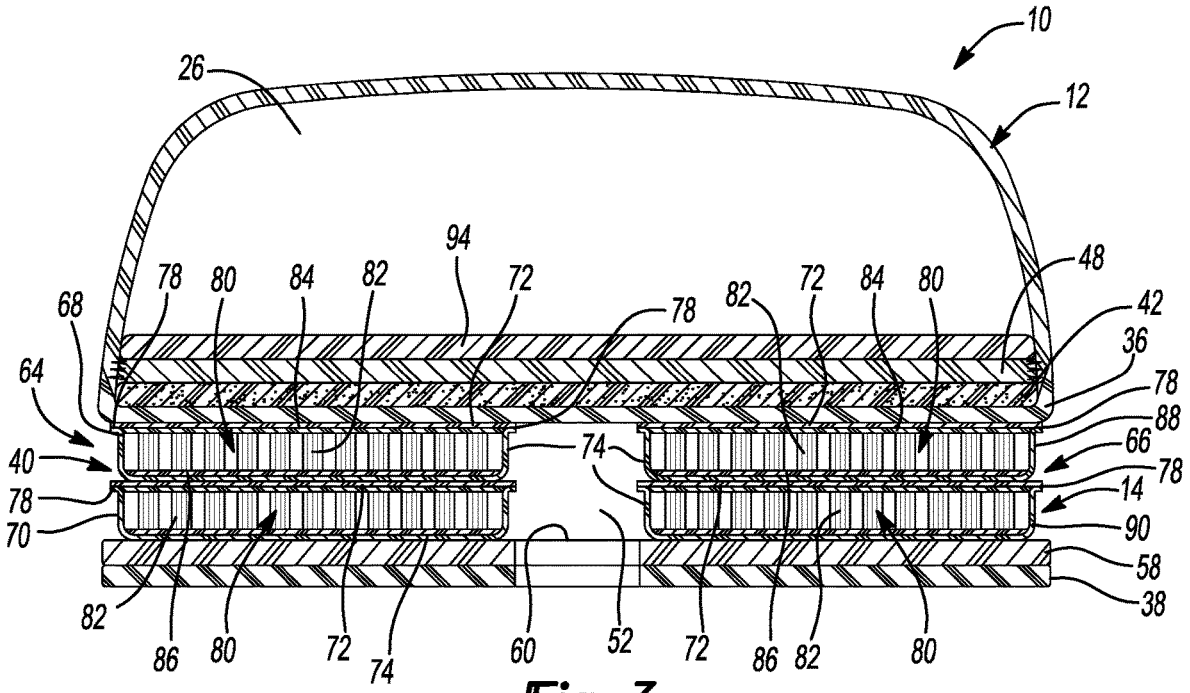
FIG. 3 is a cross-sectional view of the article of footwear of FIG. 1 taken along Line 3-3 of FIG. 1.

With particular reference to FIGS. 1-3, the cushioning arrangement 40 is shown to include a medial cushion or cushioning arrangement 64 and a lateral cushion or cushioning arrangement 66. The medial cushioning arrangement 64 is disposed proximate to the medial side 22 of the sole structure 14 while the lateral cushioning arrangement 66 is disposed proximate to the lateral side 24 of the sole structure 14. As shown in FIG. 3, the medial cushioning arrangement 64 includes a first fluid-filled chamber 68 and a second fluid-filled chamber 70. With continued reference to FIG. 3, the lateral cushioning arrangement 66 likewise includes the third fluid-filled chamber 72 and the fourth fluid-filled chamber 74.

The first fluid-filled chamber 68 is disposed generally between the upper 12 and the second fluid-filled chamber 70 while the second fluid-filled chamber 70 is disposed between the outsole plate 58 and the first fluid-filled chamber 68. Specifically, the first fluid-filled chamber 68 is attached to the midsole 36 at a first side and is attached to the second fluid-filled chamber 70 at a second side. The second fluid-filled chamber 70 is attached at a first side to the surface 60 of the outsole plate 58 and is attached to the first fluid-filled chamber 68 at a second side. The fluid-filled chambers 68, 70 may be attached to one another and to the midsole 36 and the outsole plate 58, respectively, via a suitable adhesive. Additionally or alternatively, the first fluid-filled chamber 68 may be attached to the second fluid-filled chamber 70 by melding a material of the first fluid-filled chamber 68 and a material of the second fluid-filled chamber 70 at a junction of the first fluid-filled chamber 68 and the second fluid-filled chamber 70.

The first fluid-filled chamber 68 and the second fluid-filled chamber 70 may include a first barrier element 76 and a second barrier element 78. The first barrier element 76 and the second barrier element 78 may be formed from a sheet of thermoplastic polyurethane (TPU). Specifically, the first barrier element 76 may be formed from a sheet of TPU material and may include a substantially planar shape. The second barrier element 78 may likewise be formed from a sheet of TPU material and may be formed into the configuration shown in FIG. 3 to define an interior void 80. The first barrier element 76 may be joined to the second barrier element 78 by applying heat and pressure at a perimeter of the first barrier element 76 and the second barrier element 78 to define a peripheral seam 82. The peripheral seam 82 seals the internal interior void 80, thereby defining a volume of the first fluid-filled chamber 68 and the second fluid-filled chamber 70.

The interior void 80 of the first barrier element 76 and the second barrier element 78 may receive a tensile element 84 therein. Each tensile element 84 may include a series of tensile strands 86 extending between an upper tensile sheet 88 and a lower tensile sheet 90. The upper tensile sheet 88 may be attached to the first barrier element 76 while the lower tensile sheet 90 may be attached to the second barrier element 78. In this manner, when the first fluid-filled chamber 68 and the second fluid-filled chamber 70 receives a pressurized fluid, the tensile strands 86 of the tensile elements 84 are placed in tension. Because the upper tensile sheet 88 is attached to the first barrier element 76 and the lower tensile sheet 90 is attached to the second barrier element 78, the tensile strands 86 retain a desired shape of the first fluid-filled chamber 68 and a desired shape of the second fluid-filled chamber 70 when the pressurized fluid is injected into the interior void 80.

With continued reference to FIG. 3, the lateral cushioning arrangement 66 likewise includes the third fluid-filled chamber 72 and the fourth fluid-filled chamber 74. As with the medial cushioning arrangement 64, the third fluid-filled chamber 72 is disposed between the upper 12 and the fourth fluid-filled chamber 74, and the fourth fluid-filled chamber 74 is disposed between the outsole plate 58 and the third fluid-filled chamber 72. The third fluid-filled chamber 72 is attached to the midsole 36 at a first side and is attached to the fourth fluid-filled chamber 74 at a second side located on an opposite side of the third fluid-filled chamber 72 than the first side. The fourth fluid-filled chamber 74 is attached at a first side to the surface 60 of the outsole plate 58 and is attached at a second side located on an opposite side of the fourth fluid-filled chamber 74 than the first side to the third fluid-filled chamber 72. The third fluid-filled chamber 72 and the fourth fluid-filled chamber 74 may be identical to the first fluid-filled chamber 68 and the second fluid-filled chamber 70. Accordingly, the third fluid-filled chamber 72 and the fourth fluid-filled chamber 74 may each include a first barrier element 76, a second barrier element 78, an interior void 80, a peripheral seam 82, and a tensile element 84 disposed within the interior void 80.

As described, the medial cushioning arrangement 64 and the lateral cushioning arrangement 66 each include a pair of fluid-filled chambers 68, 70, 72, 74 that are received between the upper 12 and the outsole 38. In one configuration, the first fluid-filled chamber 68 is fluidly isolated from the second fluid-filled chamber 70 and the third fluid-filled chamber 72 is fluidly isolated from the fourth fluid-filled chamber 74. Further yet, the medial cushioning arrangement 64 (i.e., the first fluid-filled chamber 68 and the second fluid-filled chamber 70) is fluidly isolated from the lateral cushioning arrangement 66 (i.e., the third fluid-filled chamber 72 and the fourth fluid-filled chamber 74).

While the medial cushioning arrangement 64 and the lateral cushioning arrangement 66 are described and shown as including stacked pairs of fluid-filled chambers, the medial cushioning arrangement 64 and the lateral cushioning arrangement 66 could alternatively include other cushioning elements. For example, and with reference to FIG. 4, the medial cushioning arrangement 64 and the lateral cushioning arrangement 66 may each include a foam block 92 that replaces the second fluid-filled chamber 70 and the fourth fluid-filled chamber 74, respectively. The foam blocks 92 may be received within the interior void 80 defined by the first barrier element 76 and the second barrier element 78. Positioning the foam blocks 92 within the interior void 80 defined by the first barrier element 76 and the second barrier element 78 allows the barrier elements 76, 78 to restrict expansion of the foam blocks 92 beyond a predetermined amount when subjected to a predetermined load. Accordingly, the overall shape and, thus, the performance of the foam blocks 92 may be controlled by allowing the foam blocks 92 to interact with the barrier elements 76, 78 during loading. While the foam blocks 92 are described and shown as being received within the interior void 80 of the barrier elements 76, 78, the foam blocks 92 could alternatively be positioned within the cavity 52 absent the barrier elements 76, 78. In such a configuration, the foam blocks 92 would be directly attached to the surface 60 of the outsole plate 58 and to the second barrier element 78 of the first fluid-filled chamber 68 and the third fluid-filled chamber 72, respectively.

Figure 4:
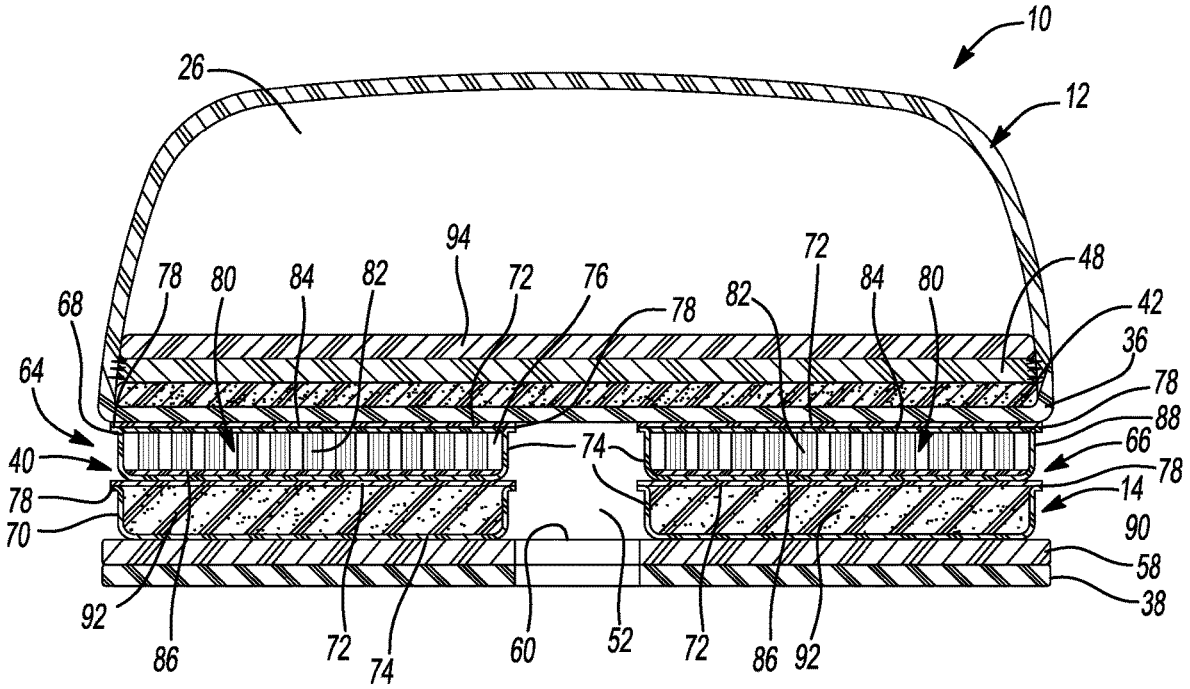
FIG. 4 is a cross-sectional view of the article of footwear of FIG. 1 taken along Line 3-3 of FIG. 1 showing an alternate construction of a cushion.
Figure 5:
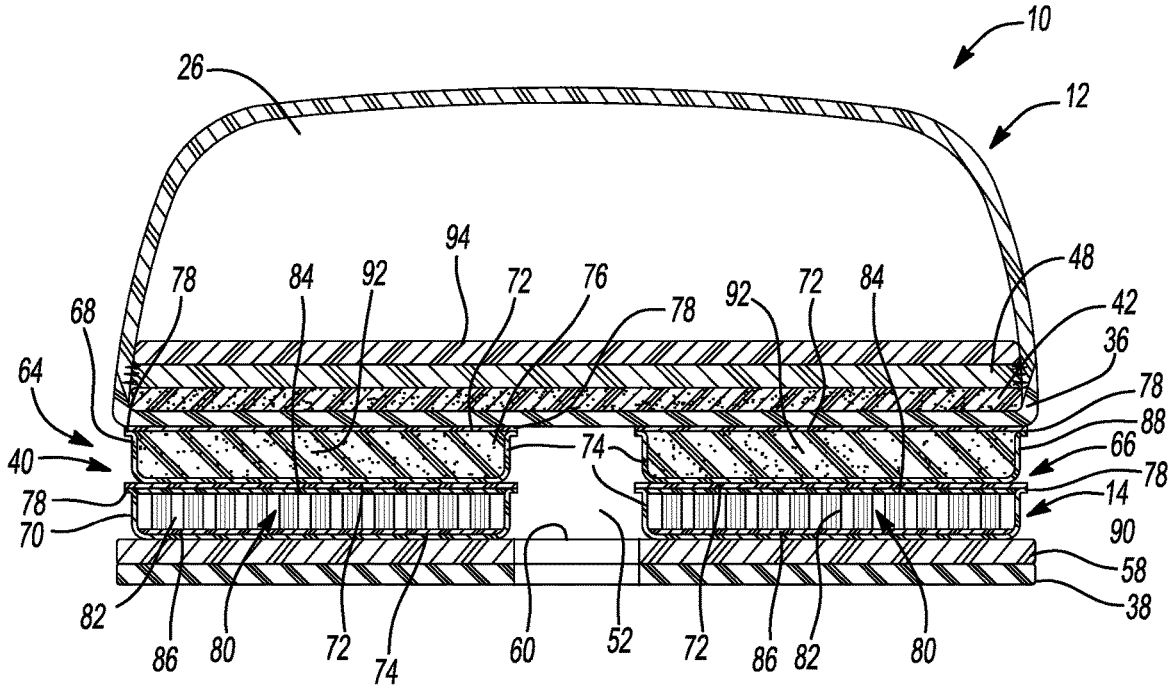
FIG. 5 is a cross-sectional view of the article of footwear of FIG. 1 taken along Line 3-3 of FIG. 1 showing an alternate construction of a cushion.

While the second fluid-filled chamber 70 and the fourth fluid-filled chamber 74 are described and shown as being replaced with a foam block 92, the first fluid-filled chamber 68 and the third fluid-filled chamber 72 could alternatively be replaced with a different cushioning element, such as the foam blocks 92 shown in FIG. 4. Replacement of the first fluid-filled chamber 68 with a foam block 92 and replacement of the third fluid-filled chamber 72 with a foam block 92 is shown in FIG. 5.

Figure 6:
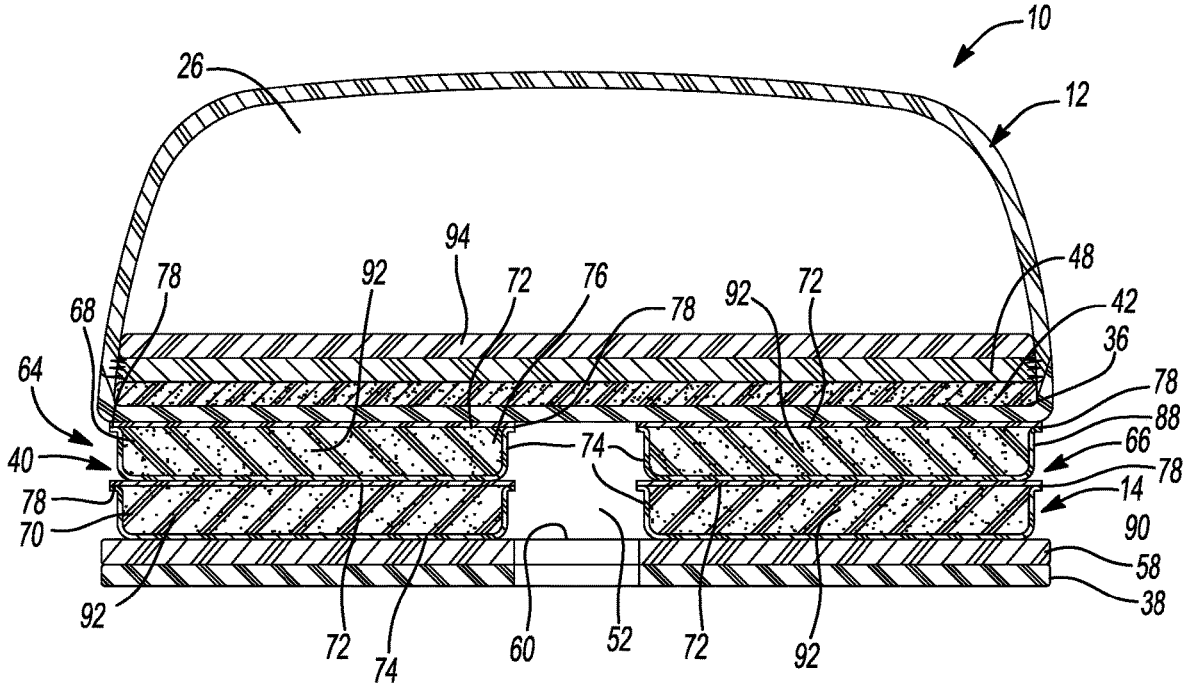
FIG. 6 is a cross-sectional view of the article of footwear of FIG. 1 taken along Line 3-3 of FIG. 1 showing an alternate construction of a cushion.

Finally, each of the first fluid-filled chamber 68, the second fluid-filled chamber 70, the third fluid-filled chamber 72, and the fourth fluid-filled chamber 74 could be replaced with a foam block 92, as shown in FIG. 6. The particular construction of the medial cushioning arrangement 64 and the lateral cushioning arrangement 66 (i.e., use of foam blocks, fluid-filled chambers, or a combination thereof) may be dictated by the amount of cushioning required at the medial side 22 and the lateral side 24.

Figure 7:
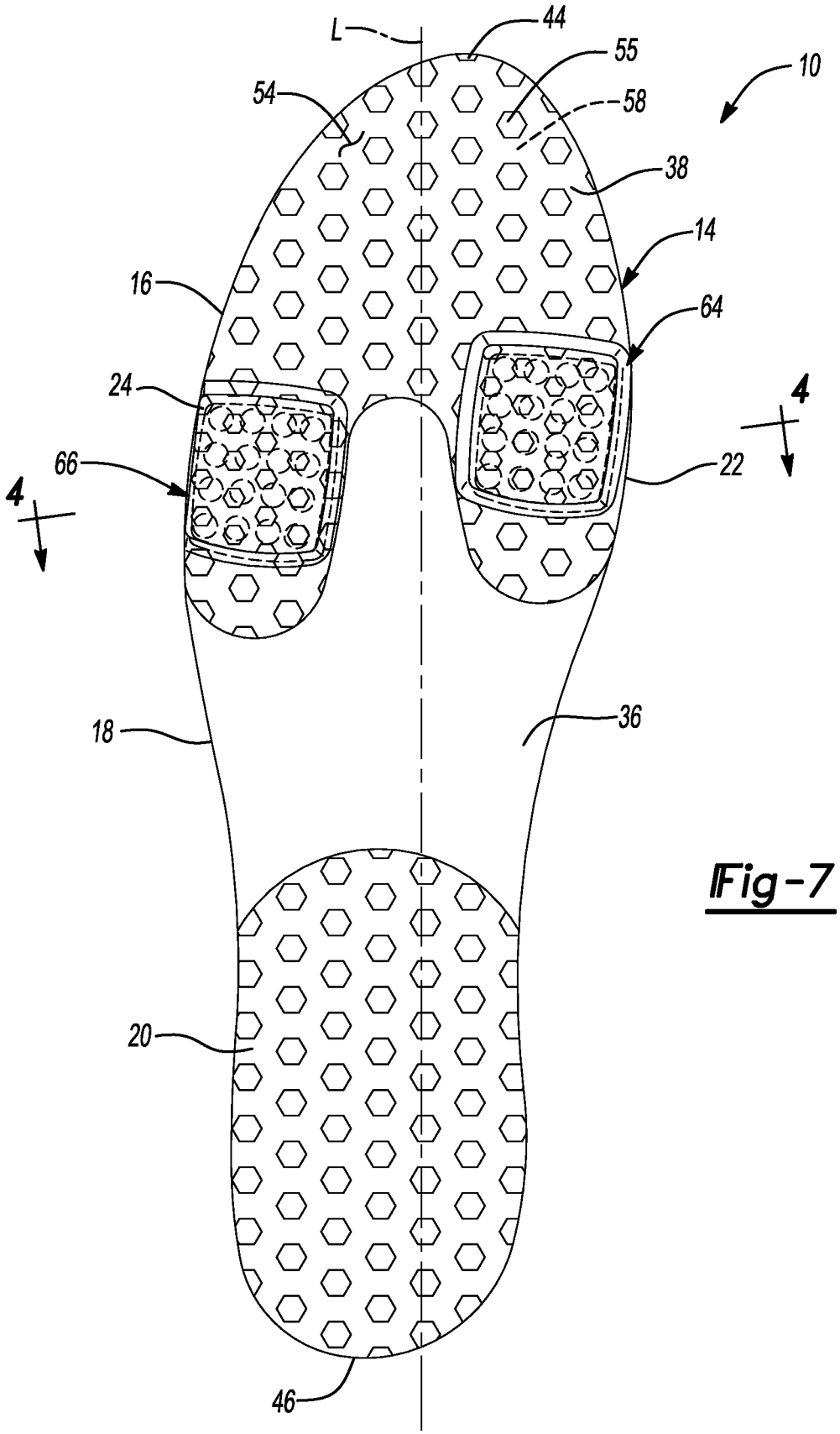
FIG. 7 is a bottom view of the article of footwear of FIG. 1.
Figure 8:
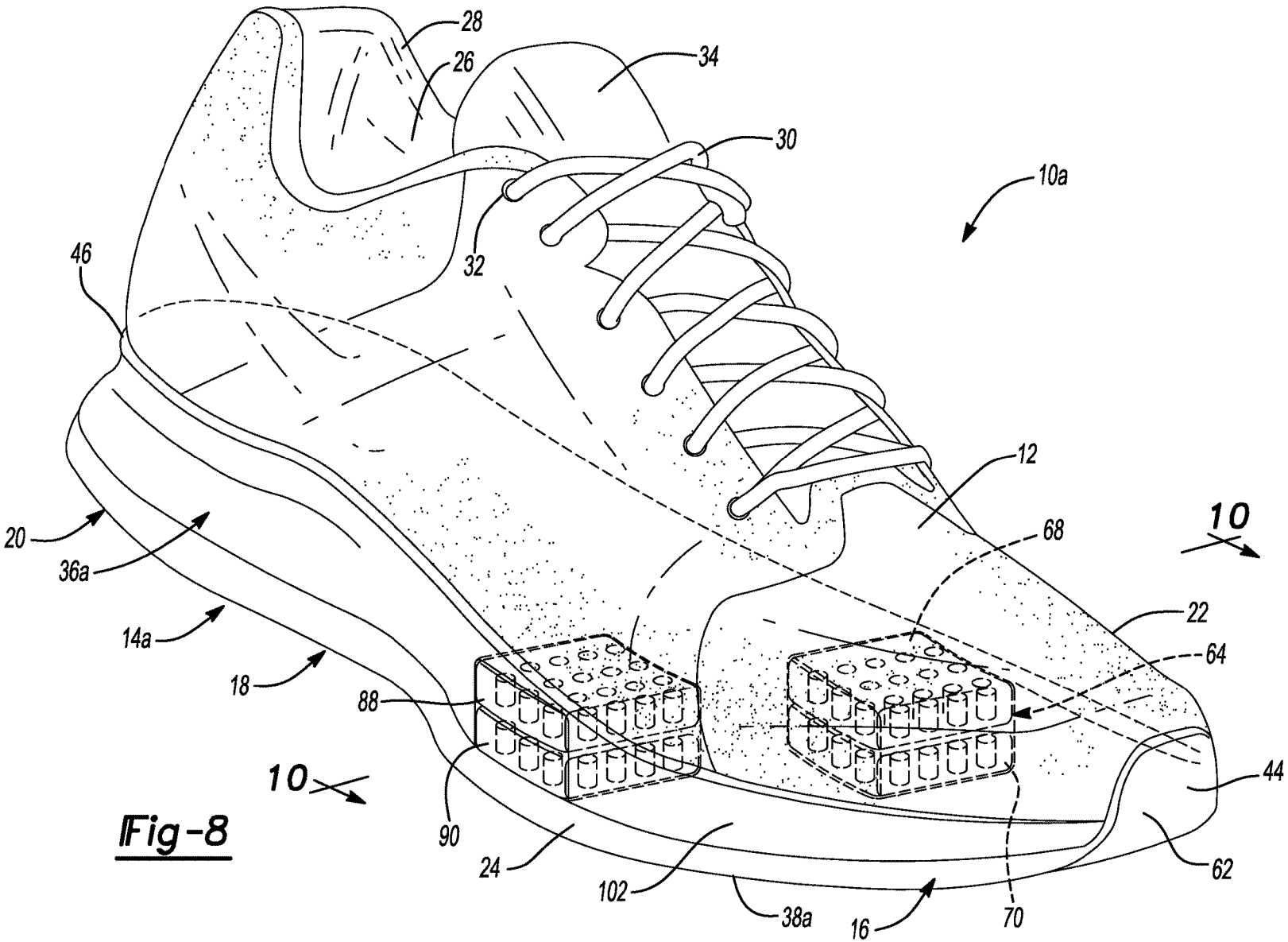
FIG. 8 is a perspective view of an article of footwear incorporating a sole structure in accordance with the principles of the present disclosure.

Regardless of the particular construction of the medial cushioning arrangement 64 and the lateral cushioning arrangement 66, the medial cushioning arrangement 64 may be positioned forward of the lateral cushioning arrangement 66 in a direction extending along a longitudinal axis (L) of the sole structure 14, as shown in FIG. 7. Namely, the medial cushioning arrangement 64 is disposed closer to the anterior end 44 of the sole structure 14 than is the lateral cushioning arrangement 66. While the medial cushioning arrangement 64 is disposed closer to the anterior end 44 than the lateral cushioning arrangement 66, the medial cushioning arrangement 64 overlaps the lateral cushioning arrangement 66 such that the medial cushioning arrangement 64 at least partially opposes the lateral cushioning arrangement 66 in a direction extending between the medial side 22 and the lateral side 24 of the sole structure 14.

As described, the medial cushioning arrangement 64 and the lateral cushioning arrangement 66 each provide a pair of stacked cushioning elements disposed at discrete locations on the sole structure 14. In one configuration, the medial cushioning arrangement 64 and the lateral cushioning arrangement 66 each provide a pair of stacked, fluid-filled chambers (i.e. 68, 70, 72, 74) that cooperate to provide cushioning at the medial side 22 and the lateral side 24, respectively. The individual fluid-filled chambers 68, 70, 72, 74 may include the same volume and, further, may be at the same pressure. For example, the individual fluid-filled chambers 68, 70, 72, 74 may be at a pressure within a range of 15-30 pounds per square inch (psi) and preferably at a pressure within a range of 20-25 psi. Alternatively, the pressures of the various fluid-filled chambers 68, 70, 72, 74 may vary between the cushioning arrangements 64, 66 and/or within each cushioning arrangement 64, 66). For example, the first fluid-filled chamber 68 may include the same pressure as the second fluid-filled chamber 70 or, alternatively, the first fluid-filled chamber 68 may include a different pressure than the second fluid-filled chamber 70. Likewise, the third fluid-filled chamber 72 may include the same or different pressure than the fourth fluid-filled chamber 74 and may include a different pressure than the first fluid-filled chamber 68 and/or the second fluid-filled chamber 70.

During operation, when the ground-engaging surface 54 contacts the ground, a force is transmitted via the outsole plate 58 to the medial cushioning arrangement 64 and the lateral cushioning arrangement 66. Namely, the force is transmitted to the first fluid-filled chamber 68, the second fluid-filled chamber 70, the third fluid-filled chamber 72, and the fourth fluid-filled chamber 74. The applied force causes the individual fluid-filled chambers 68, 70, 72, 74 to compress, thereby absorbing the forces associated with the outsole 38 contacting the ground. The force is transmitted to the midsole 36 and the plate 42 but is not experienced by the user as a point or localized load. Namely, and as described above, the plate 42 is described as being formed from a rigid material. Accordingly, even though the medial cushioning arrangement 64 and the lateral cushioning arrangement 66 are located at discrete locations along the sole structure 14, the forces exerted on the plate 42 by the medial cushioning arrangement 64 and the lateral cushioning arrangement 66 are dissipated over a length of the plate 42 such that neither applied force is applied at individual, discrete locations to a user's foot. Rather, the forces applied at the locations of the medial cushioning arrangement 64 and the lateral cushioning arrangement 66 are dissipated along a length of the plate 42 due to the rigidity of the plate 42 and, as such, point loads are not experienced by the user's foot when the foot is in contact with an insole 94 disposed within the interior void 26.

With particular reference to FIGS. 8-14, an article of footwear **10*a* is provided and includes an upper 12 and a sole structure 14*a* attached to the upper 12. In view of the substantial similarity in structure and function of the components associated with the article of footwear 10 with respect to the article of footwear 10*a***, like reference numerals are used hereinafter and in the drawings to identify like components while like reference numerals containing letter extensions are used to identify those components that have been modified.

Figure 9:
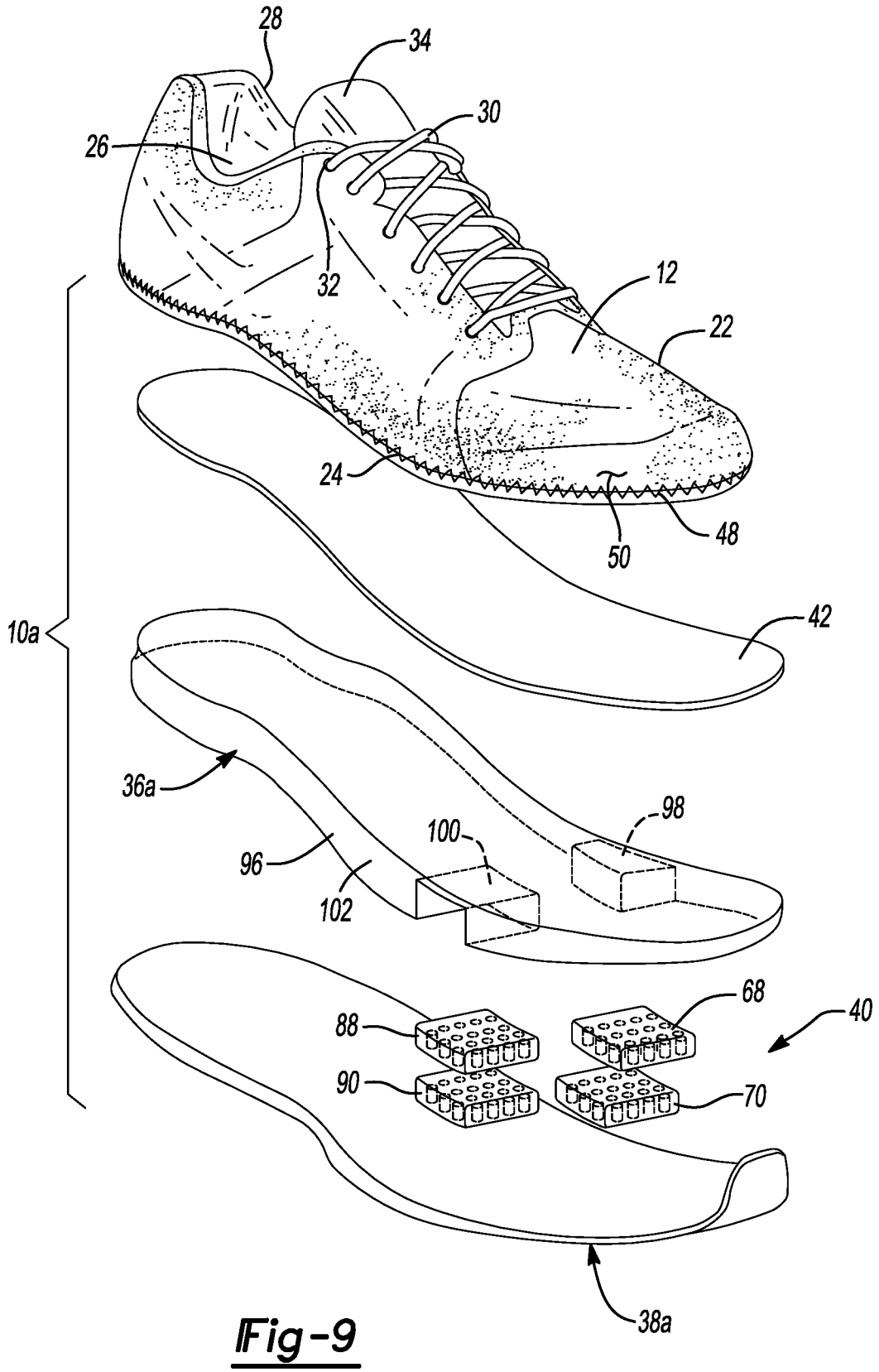
FIG. 9 is an exploded view of the article of footwear of FIG. 8.
Figure 10:
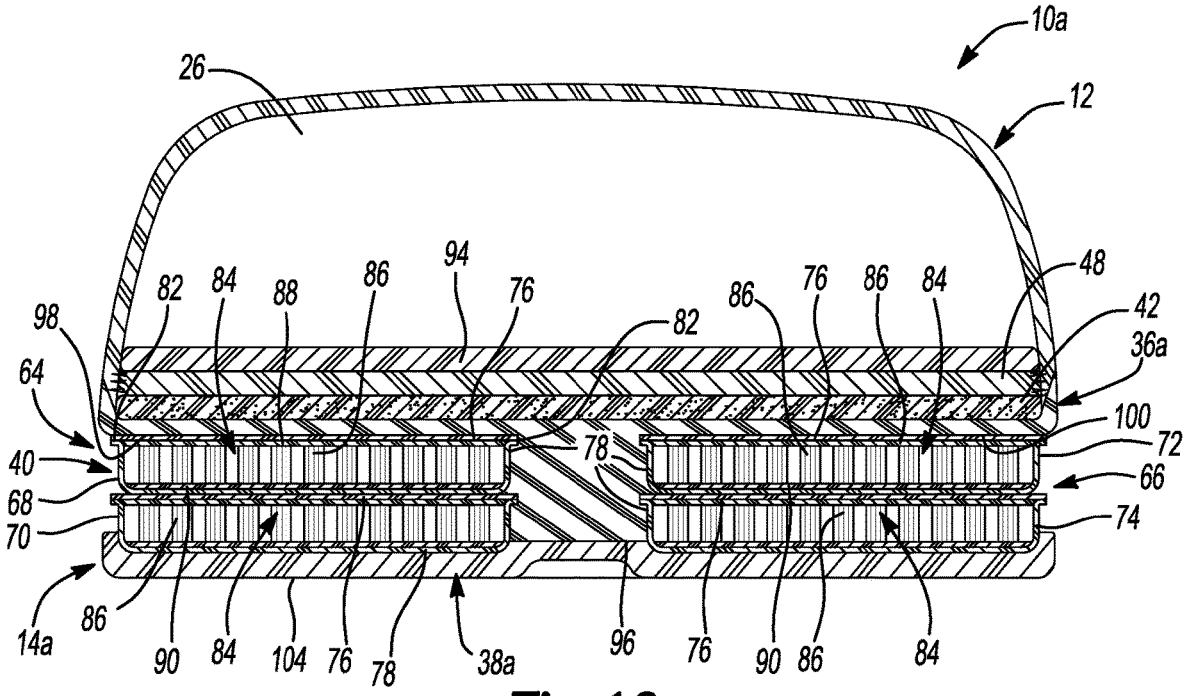
FIG. 10 is a cross-sectional view of the article of footwear of FIG. 8 taken along Line 10-10 of FIG. 8.

With particular reference to FIGS. 9-13, the sole structure **14*a* is shown to include a midsole 36*a*, an outsole 38*a*, a cushioning arrangement 40 disposed between the midsole 36*a* and the outsole 38*a*, and a plate 42. As shown in FIG. 10, the plate 42 is disposed between the midsole 36*a* and the strobel 48 associated with the upper 12. As with the article footwear 10 described above, the plate 42 could be directly attached to the upper 12, thereby obviating the need for the strobel 48. While the strobel 48 may be removed and the plate 42 attached directly to the upper 12, the sole structure 14*a* will be described and shown hereinafter as including a strobel 48 disposed between the upper 12 and the plate 42. In addition, while the plate 42 will be described and shown as being disposed between the midsole 36*a* and the strobel 48, the plate 42 could be at least partially embedded within the material of the midsole 36*a* such that a portion of the midsole 36*a* extends between the strobel 48 and the plate 42**.

The midsole **36*a* may be formed from a foamed polymer material in a similar fashion as the midsole 36 associated with the article of footwear 10 described above. However, the midsole 36*a* may include a different shape than the midsole 36 of the article of footwear 10 in that the midsole 36*a* is thicker in an area of the heel region 20 of the sole structure 14*a* as compared to the midsole 36. Specifically, the midsole 36*a* may include a thickness at the heel region 20 and at the mid-foot region 18 that provides the midsole 36*a* with a substantially continuous surface 96 that extends from the forefoot region 16 to the heel region 20**.

While the midsole **36*a* includes a substantially continuous surface 96, the continuous surface 96 may be interrupted at a medial recess 98 and at a lateral recess 100. As shown in FIG. 9, the medial recess 98 may be disposed at the medial side 22 of the sole structure 14*a* and the lateral recess 100 may be disposed at the lateral side 24 of the sole structure 14*a*. In one configuration, the medial recess 98 and the lateral recess 100 are formed into a material of the midsole 36*a* such that at least one of the medial recess 98 and the lateral recess 100 extend through a sidewall 102 of the midsole 36*a*. While the medial recess 98 and the lateral recess 100 will be shown and described hereinafter as extending through the sidewall 102 of the midsole 36*a*, the medial recess 98 and/or the lateral recess 100 could alternatively be spaced apart from the sidewall 102 such that the medial recess 98 and/or the lateral recess 100 are hidden from view. In such a configuration, the sidewall 102 would include a substantially constant outer surface extending from the forefoot region 16 to the heel region 20**.

Figure 12:
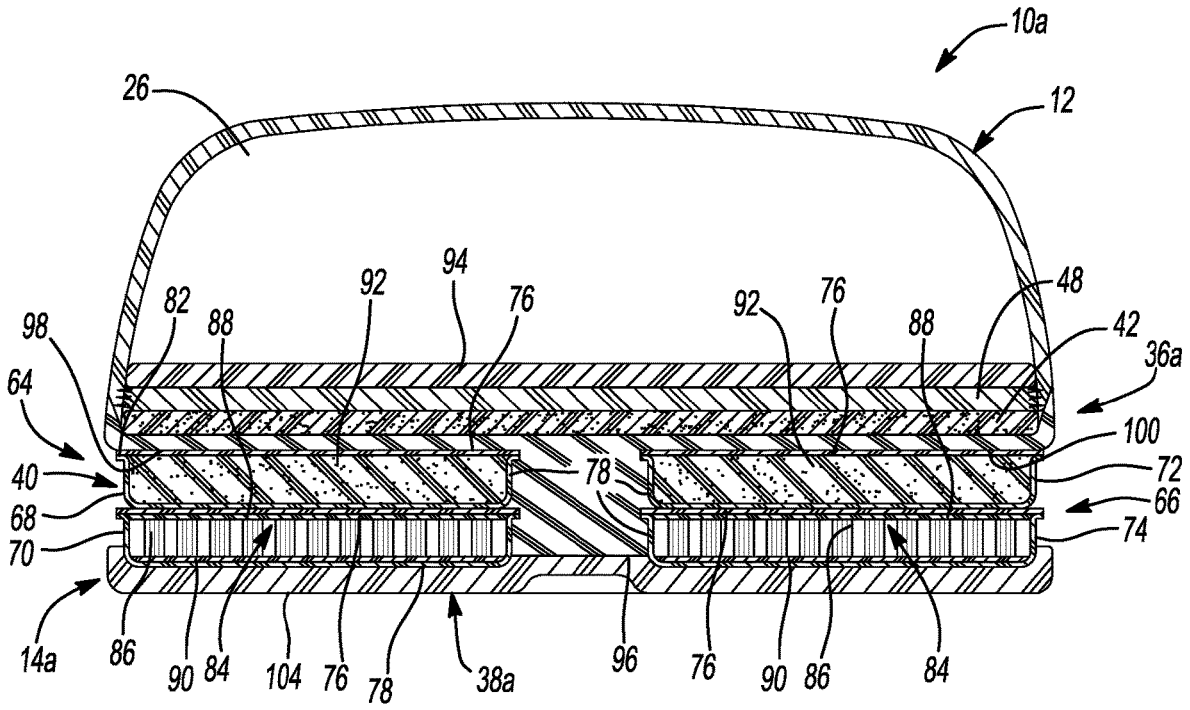
FIG. 12 is a cross-sectional view of the article of footwear of FIG. 8 taken along Line 10-10 of FIG. 8 showing an alternate construction of a cushion.
Figure 13:
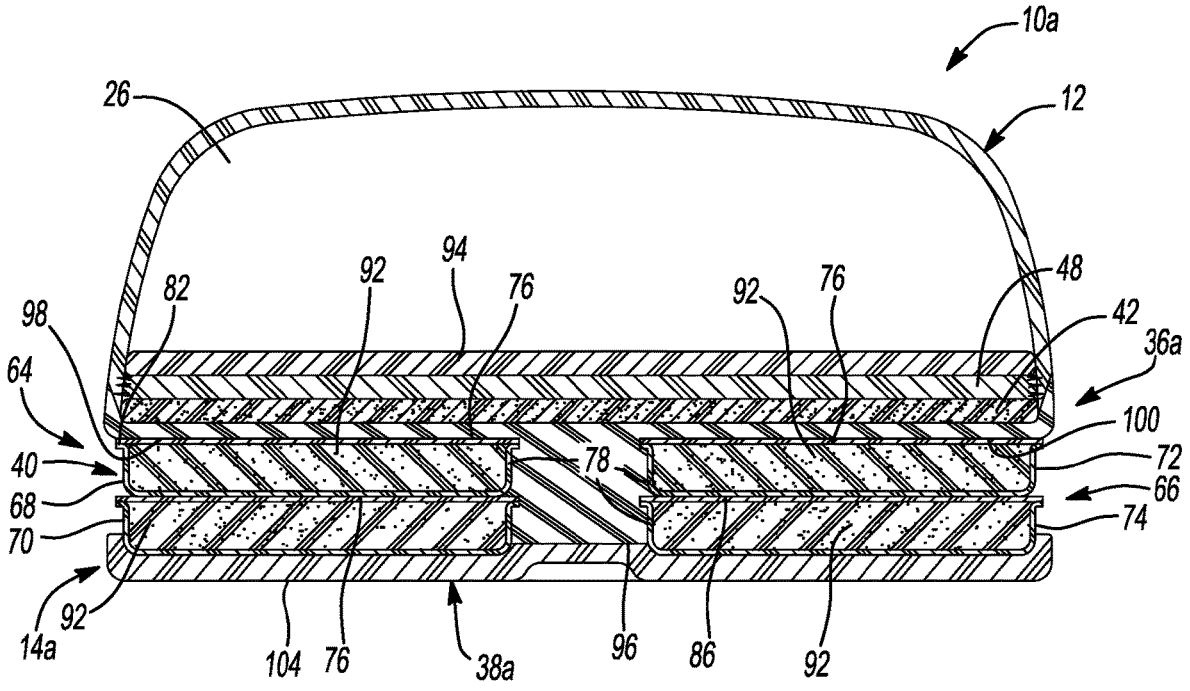
FIG. 13 is a cross-sectional view of the article of footwear of FIG. 8 taken along Line 10-10 of FIG. 8 showing an alternate construction of a cushion.
Figure 14:
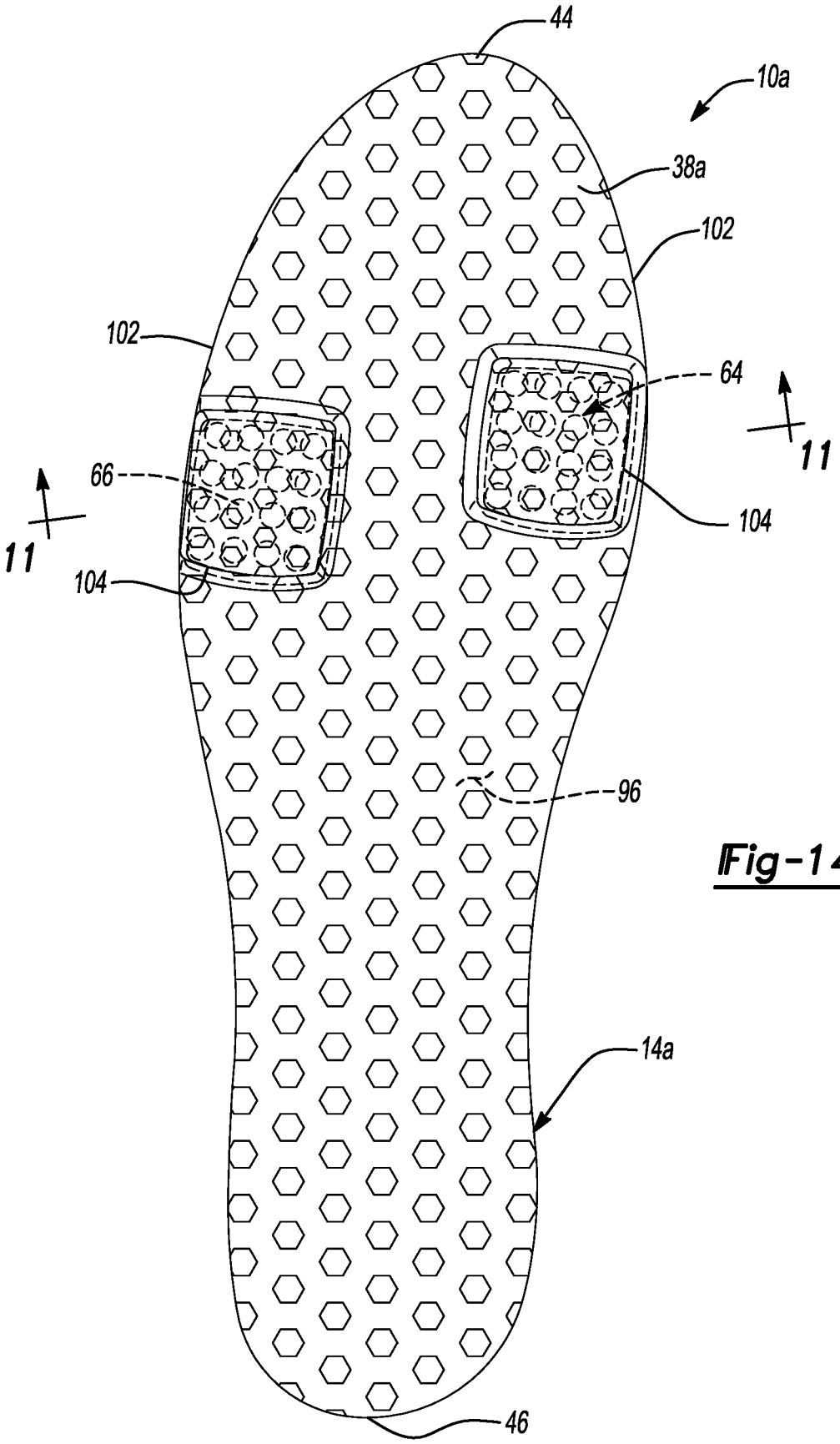
FIG. 14 is a bottom view of the article of footwear of FIG. 8.

With particular reference to FIGS. 10-13, the medial recess 98 and the lateral recess 100 receive respective portions of the cushioning arrangement 40 therein. Namely, the medial recess 98 receives the medial cushioning arrangement 64 and the lateral recess 100 receives the lateral cushioning arrangement 66. The medial cushioning arrangement 64 and the lateral cushioning arrangement 66 are identical to those incorporated into the sole structure 14 of the article of footwear 10 described above. Accordingly, the medial cushioning arrangement 64 is disposed closer to the anterior end 44 of the sole structure 14*a* than the lateral cushioning arrangement 66, as shown in FIG. 14.

With continued reference to FIGS. 10-13, the medial cushioning arrangement 64 and the lateral cushioning arrangement 66 are shown as being respectively disposed within the medial recess 98 and the lateral recess 100 and are exposed at the sidewall 102. Further, the medial cushioning arrangement 64 and the lateral cushioning arrangement 66 are shown as protruding from the substantially continuous surface 96 of the midsole 36*a*. As such, when the medial cushioning arrangement 64 and the lateral cushioning arrangement 66 are respectively received within the medial recess 98 and the lateral recess 100 of the midsole 36*a*, and the outsole 38*a* is attached to the substantially continuous surface 96, a pair of bulges 104 are visible at the outsole 38*a* at the locations of the medial cushioning arrangement 64 and the lateral cushioning arrangement 66, as shown in FIG. 14. The bulges 104 stand proud of a nominal plane defined by the outsole 38*a* at other regions of the outsole 38*a* where the medial cushioning arrangement 64 and the lateral cushioning arrangement 66 are absent.

Figure 11:
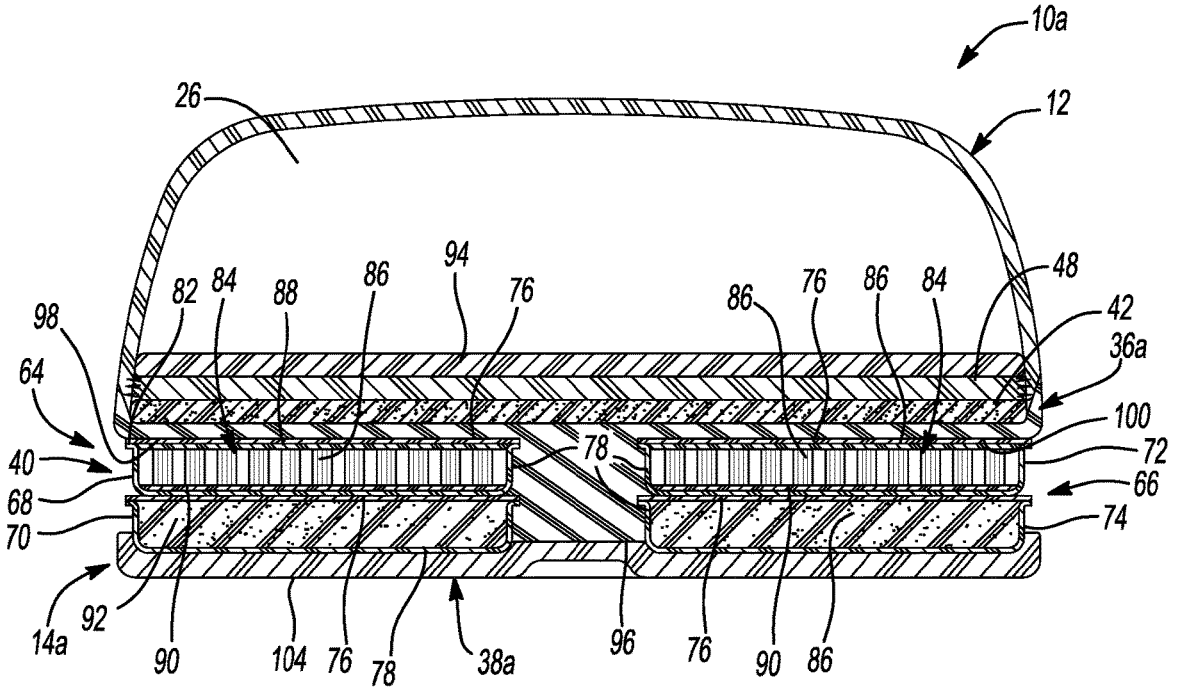
FIG. 11 is a cross-sectional view of the article of footwear of FIG. 8 taken along Line 10-10 of FIG. 8 showing an alternate construction of a cushion.

The medial cushioning arrangement 64 and the lateral cushioning arrangement 66 may include the fluid-filled chambers 68, 70, 72, 74 described above with respect to the sole structure 14. Further, the medial cushioning arrangement 64 and the lateral cushioning arrangement 66 could alternatively include foam blocks 92 in place of any or all of the fluid-filled chambers 68, 70, 72, 74. For example, and as shown in FIGS. 11-13, the sole structure 14*a* may include the first fluid-filled chamber 68 and the third fluid-filled chamber 72 along with a pair of foam blocks 92 respectively associated with the medial cushioning arrangement 64 and the lateral cushioning arrangement 66. Alternatively, the foam blocks 92 could replace the first fluid-filled chamber 68 and the third fluid-filled chamber 72 (FIG. 12), or, alternatively, the foam blocks 92 could replace each of the fluid-filled chambers 68, 70, 72, 74 (FIG. 13). Regardless of the particular configuration of the medial cushioning arrangement 64 and the lateral cushioning arrangement 66, the medial cushioning arrangement 64 and the lateral cushioning arrangement 66 protrude from the normal plane defined by the outsole 38*a* such that the bulges 104 are formed in the outsole 38*a* at the locations of the medial cushioning arrangement 64 and the lateral cushioning arrangement 66.

Extending the medial cushioning arrangement 64 and the lateral cushioning arrangement 66 from the substantially continuous surface 96 of the midsole 36*a* and, thus, forming the bulges 104 in the outsole 38*a* at the locations of the medial cushioning arrangement 64 and the lateral cushioning arrangement 66 allows the sole structure 14*a* to provide a degree of cushioning and protection during use of the article of footwear 10*a*. Namely, when the article of footwear 10*a* contacts a ground surface during use, the forces associated with contacting the ground surface are absorbed by the medial cushioning arrangement 64 and the lateral cushioning arrangement 66, thereby protecting and supporting a foot of a user.

In addition to the medial cushioning arrangement 64 and the lateral cushioning arrangement 66, the midsole 36 provides a degree of protection and cushioning to the user's foot during use of the article of footwear 10*a* due to the substantially continuous surface 96 of the midsole 36*a* extending from the forefoot region 16 to the heel region 20. Further, the material of the midsole 36*a* extends between the medial cushioning arrangement 64 and the lateral cushioning arrangement 66, as shown in FIGS. 10-13. This portion of the midsole 36*a* disposed between the medial cushioning arrangement 64 and the lateral cushioning arrangement 66 extends to the substantially continuous surface 96 and, thus, during use of the article of footwear 10*a* likewise absorbs impact forces associated with the article of footwear 10*a* contacting a ground surface.

The portion of the midsole 36*a* disposed between the medial cushioning arrangement 64 and the lateral cushioning arrangement 66 likewise serves to maintain a shape of the fluid-filled chambers 68, 70, 72, 74 when a force is applied to the fluid-filled chambers 68, 70, 72, 74. For example, when a force is applied to the fluid-filled chambers 68, 70, 72, 74, the applied force causes the fluid-filled chambers 68, 70, 72, 74 to expand in a direction generally perpendicular to the applied force. By providing a material of the midsole 36*a* in an area between the medial cushioning arrangement 64 and the lateral cushioning arrangement 66, such movement of the fluid-filled chambers 68, 70, 72, 74 is restricted and, thus, a desired shape of the fluid-filled chambers 68, 70, 72, 74 is maintained.

With particular reference to FIGS. 15-22, an article of footwear 10*b* is provided. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

The article of footwear 10*b* includes an upper 12 and a sole structure 14*b* attached to the upper 12. The sole structure 14*b* includes a plate 42 attached to the upper 12, an outsole 38*b*, and a cushioning arrangement 40*b* disposed generally between the plate 42 and the outsole 38*b*. The plate 42 extends from the anterior end 44 to the posterior end 46 and spans the article of footwear 10*b* from the forefoot region 16 to the heel region 20. The plate 42 is formed from a relatively rigid material such as, for example, a non-foamed polymer or a composite material containing fibers such as carbon fibers.

As shown in FIGS. 17-20, the plate 42 is attached directly to the upper 12 at a perimeter of the plate 42. As such, the article of footwear 10*b* is not shown or described as including a strobel. While the article of footwear 10*b* is not shown or described as including a strobel, the article of footwear 10*b* could include a strobel in a similar fashion as the articles of footwear 10, 10*a* described above. Such a strobel could be disposed between the upper 12 and the plate 42 or, alternatively, the plate 42 could be disposed within the interior void 26 such that the strobel is disposed between the plate 42 and the outsole 38*b*. While the article of footwear 10*b* could be provided with a strobel, the article of footwear 10*b* will be described hereinafter as including a plate 43 that is directly attached to the upper 12.

Figure 22:
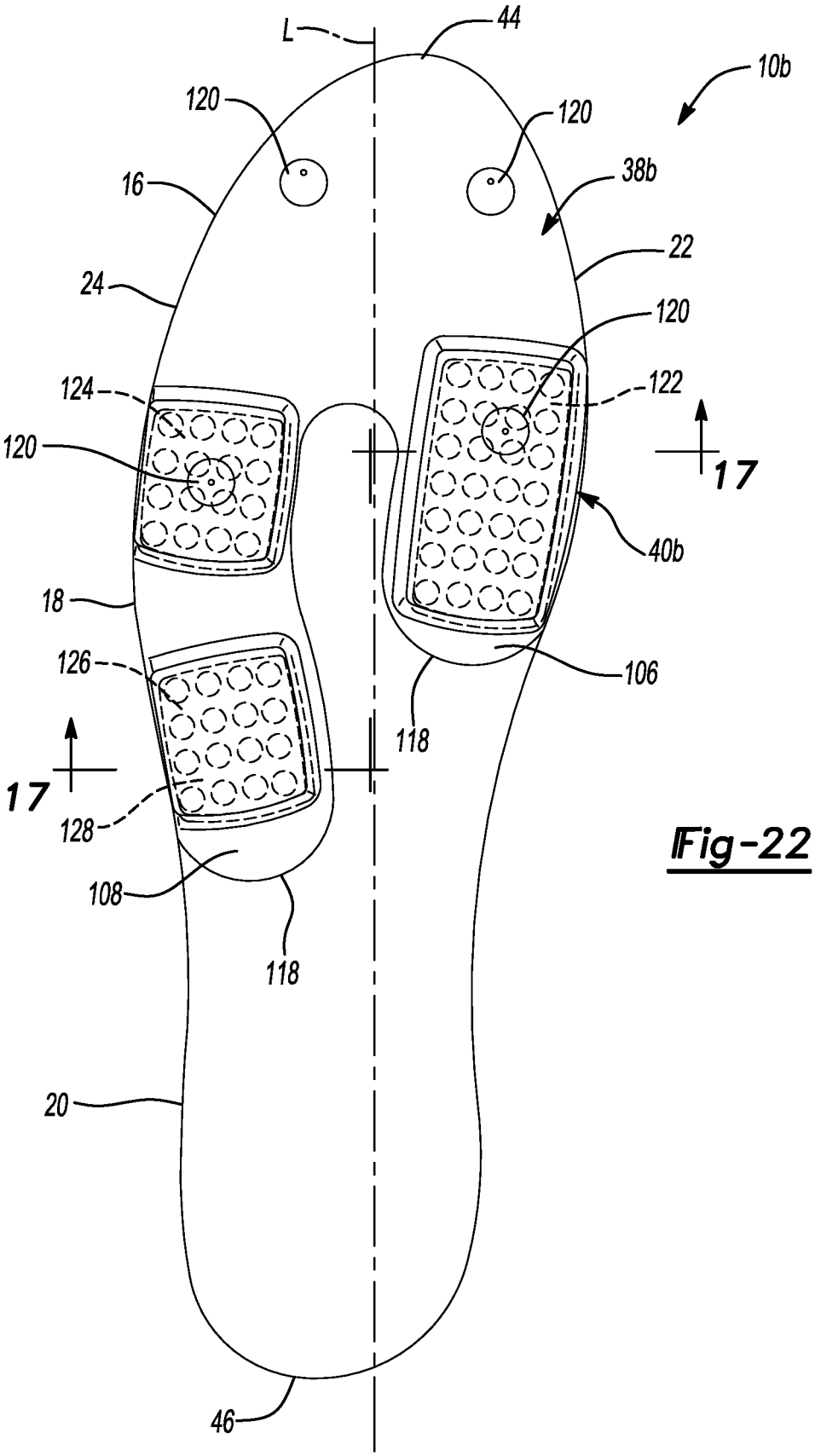
FIG. 22 is a bottom view of the article of footwear of FIG. 15.

The outsole 38*b* may be substantially J-shaped, having a medial leg 106 extending along the medial side 22 of the sole structure 14*b* and a lateral leg 108 extending along the lateral side 24 of the sole structure 14*b* (FIG. 22). The outsole 38*b* may additionally include a forefoot portion 110 extending along the anterior end 44 and connecting the medial leg 106 and the lateral leg 108.

The outsole 38*b* may be formed from a relatively rigid material such as, for example, a none-foamed polymer material or a composite material containing fibers such as carbon fiber. Regardless of the particular construction of the outsole 38*b*, the outsole 38*b* cooperates with the plate 42 to define a cavity 112 extending between the outsole 38*b* and the plate 42 in which the cushion or cushioning arrangement 40*b* is disposed.

As best shown in FIGS. 15-20, the cavity 112 may include varying heights at different locations along a length of the outsole 38*b*. For example, the cavity 112 may include a first height ($H_1$) at the lateral leg 108 and may include a second height ($H_2$) at the medial leg 106, whereby the second height ($H_2$) is less than the first height ($H_1$). Additionally, the lateral leg 108 may include a first portion that is disposed a distance away from the plate 42 equal to the second height ($H_2$) and may include a second portion that is disposed a distance away from the plate 42 that is substantially equal to the first height ($H_1$). Because the lateral leg 108 includes a first portion and second portion that are disposed at different distances from the plate 42, the lateral leg 108 includes a substantially arcuate portion 114 joining the first portion at the second height ($H_2$) and the second portion at the first height ($H_1$). As will be described in greater detail below, the difference in the heights ($H_1$, $H_2$) of the medial leg 106 and the lateral leg 108 accommodates the varying thicknesses of the cushioning arrangement 40*b* disposed within the cavity 112 and between the outsole 38*b* and the plate 42.

Figure 15:
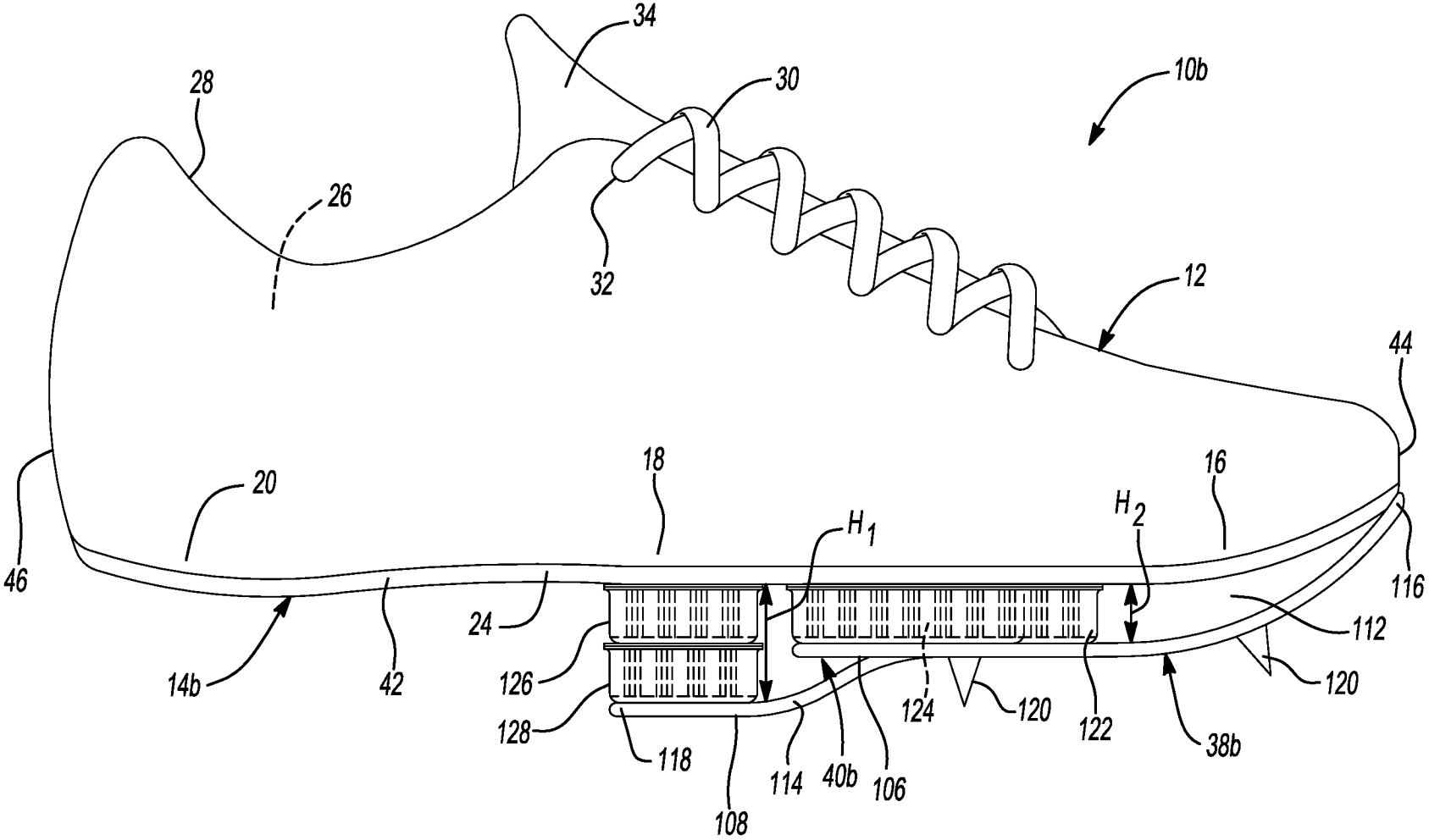
FIG. 15 is a side view of an article of footwear incorporating a sole structure in accordance with the principles of the present disclosure.
Figure 16:
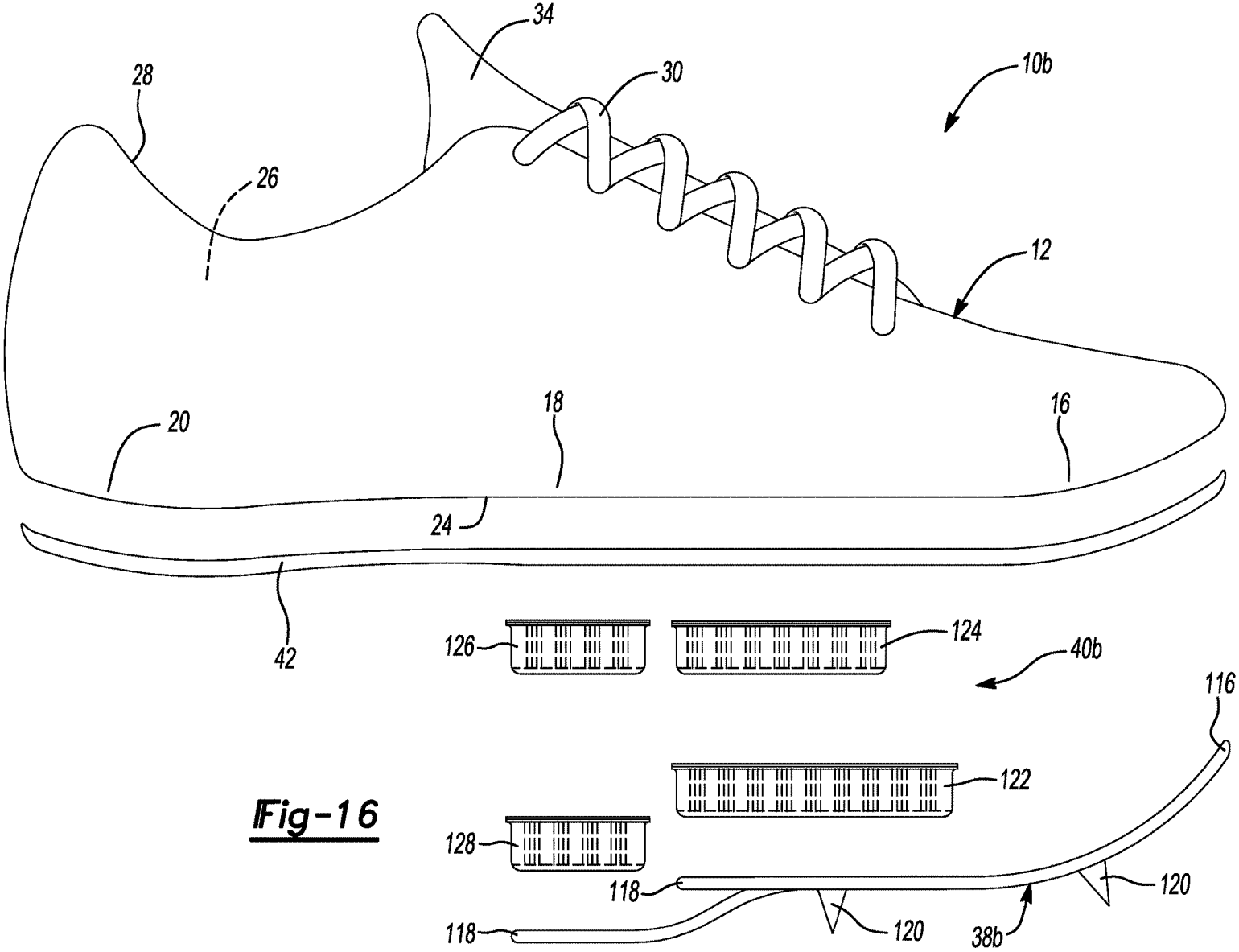
FIG. 16 is an exploded view of the article of footwear of FIG. 15.
Figure 17:
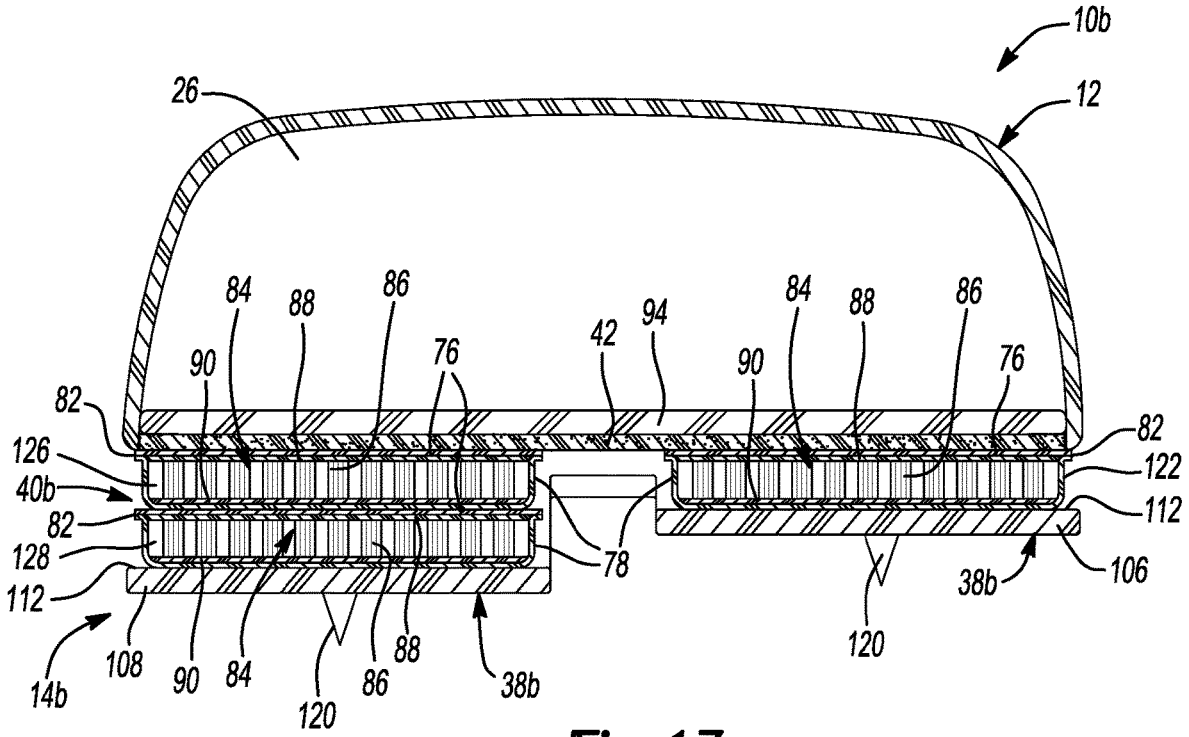
FIG. 17 is a cross-sectional view of the article of footwear of FIG. 15 taken along Line 17-17 of FIG. 22.
Figure 21:
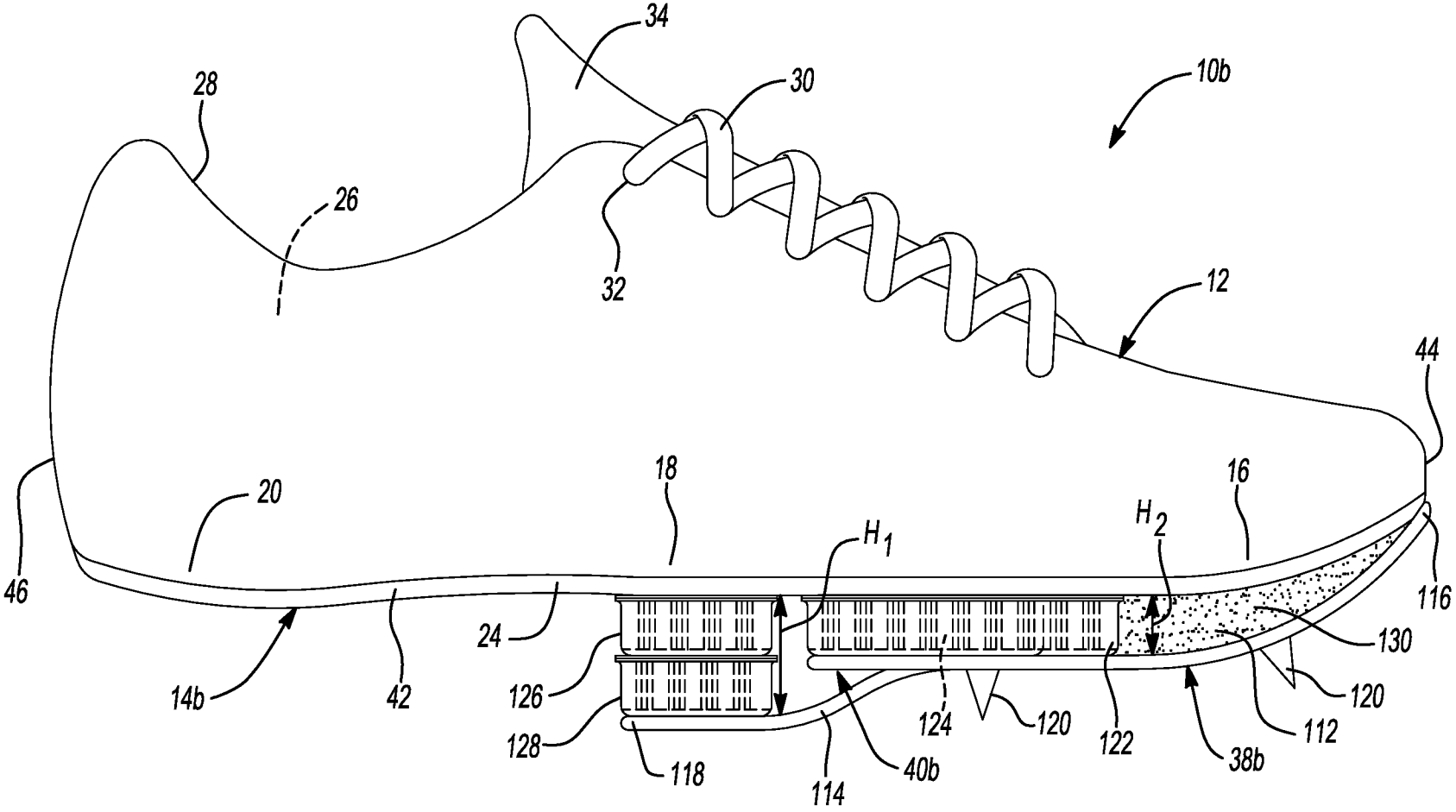
FIG. 21 is a side view the article of footwear of FIG. 15 incorporating an alternate sole structure in accordance with the principles of the present disclosure.

The outsole 38*b* may be attached to the upper 12 and/or the plate 42 at an anterior end 116. The cushioning arrangement 40*b* may be located rearward of the anterior end 116 and forward of posterior ends 118 of the U-shaped outsole 38*b*. As best shown in FIGS. 15, 16, and 21, the posterior ends 118 of the outsole 38*b* are defined generally by a terminal end of the medial leg 106 and a terminal end of the lateral leg 108 of the outsole 38*b*. As best shown in FIG. 22, the posterior ends 118 of the outsole 38*b* are located at a different distance from the anterior end 116 at the medial leg 106 and the lateral leg 108 in a direction extending substantially parallel to a longitudinal axis (L) of the sole structure 14*b*. As shown, the lateral leg 108 includes a greater length than the medial leg 106 such that the posterior end 118 of the lateral leg 108 is disposed a greater distance from the anterior end 116 than the posterior end 118 of the medial leg 106. As best shown in FIGS. 15, 16, and 21, the outsole 38*b* may include a series of traction elements 120 extending from the outsole 38*b* in an area between the anterior end 116 and the posterior end 118. The traction elements 120 allow the sole structure 14*b* to better grip a ground surface during use of the article of footwear 10*b*.

The cushioning arrangement 40*b* is disposed between the outsole 38*b* and the plate 42 and includes a first fluid-filled chamber 122, a second fluid-filled chamber 124, a third fluid-filled chamber 126, and a fourth fluid-filled chamber 128. The first fluid-filled chamber 122 is disposed between the medial leg 106 and the plate 42. Similarly, the second fluid-filled chamber 124 is disposed between the second portion of the lateral leg 108 and the plate 42. The third fluid-filled chamber 126 and the fourth fluid-filled chamber 128 are stacked on top of one another and are disposed between the first portion of the lateral leg 108 and the plate 42. Specifically, the third fluid-filled chamber 126 includes a first side attached to the plate 42 and a second side that is disposed on an opposite side of the third fluid-filled chamber 126 than the first side and is attached to the fourth fluid-filled chamber 128. The fourth fluid-filled chamber 128 includes a first side attached to the third fluid-filled chamber 126 and a second side disposed on an opposite of the fourth fluid-filled chamber 128 than the first side and is attached to the lateral leg 108. Accordingly, the third fluid-filled chamber 126 is disposed between the fourth fluid-filled chamber 128 and the plate 42 and the fourth fluid-filled chamber 128 is disposed between the third fluid-filled chamber 126 and the lateral leg 108 of the outsole 38*b*.

While the first fluid-filled chamber 122 and the second fluid-filled chamber 124 are described as being individual, fluid-filled chambers, these chambers 122, 124 could each be replaced with a stacked pair of individual fluid-filled chambers that are fluidly isolated from one another in a similar fashion as the third fluid-filled chamber 126 and the fourth fluid-filled chamber 128. Such a configuration would include fluid-filled chambers each having the same thickness but having a combined thickness that equals the dimension ($H_2$) such that each stacked arrangement of fluid-filled chambers includes a thickness that is substantially equal to the first fluid-filled chamber 122 and the second fluid-filled chamber 124, respectively.

With reference to FIG. 22, the first fluid-filled chamber 122 is shown as being disposed closer to the anterior end 44 of the sole structure 14*b* than the second fluid-filled chamber 124. Likewise, the stacked third fluid-filled chamber 126 and the fourth fluid-filled chamber 128 are shown as being disposed closer to the posterior end 46 of the sole structure 14*b* than either the first fluid-filled chamber 122 or the second fluid-filled chamber 124. Finally, the first fluid-filled chamber 122 is shown as overlapping the second fluid-filled chamber 124 such that the first fluid-filled chamber 122 opposes the second fluid-filled chamber 124 in a direction extending between the medial side 22 and the lateral side 24 of the sole structure 14*b*.

Each of the first fluid-filled chamber 122, the second fluid-filled chamber 124, the third fluid-filled chamber 126, and the fourth fluid-filled chamber 128 may include a tensile element 84 disposed therein as described above with respect to the cushioning arrangement 40 of the article of footwear 10 and the article of footwear 10*a*. Each tensile element 84 may include a series of tensile strands 86 that extend between a first tensile sheet 88 and a second tensile sheet 90, as shown in FIGS. 17-20. As with the cushioning arrangements 40 of the articles of footwear 10, 10*a*, the first tensile sheet 88 may be attached to the first barrier element 76 and the second tensile sheet 90 may be attached to the second barrier element 78 such that when the fluid-filled chambers 122, 124, 126, 128 are pressurized, the tensile elements 84 respectively associated with the fluid-filled chambers 122, 124, 126, 128 maintain a desired shape of each chamber 122, 124, 126, 128.

As shown in FIG. 15, the first fluid-filled chamber 122 and the second fluid-filled chamber 124 may include substantially the same thickness such that the thickness of each chamber 122, 124 is substantially equal to the dimension ($H_2$) extending between the medial leg 106 and the plate 42 and the second portion of the lateral leg 108 and the plate 42. Likewise, the combined height of the stacked third fluid-filled chamber 126 and the fourth fluid-filled chamber 128 may be substantially equal to the dimension ($H_1$) that extends between the first portion of the lateral leg 108 and the plate 42.

The first fluid-filled chamber 122 and the second fluid-filled chamber 124 may include substantially the same pressure. Alternatively, the first fluid-filled chamber 122 and the second fluid-filled chamber 124 may include different pressures. The fluid-filled chambers 122, 124 may be at a pressure within a range of 15-30 psi and preferably at a pressure within a range of 20-25 psi. Regardless of the pressures contained within the first fluid-filled chamber 122 and the second fluid-filled chamber 124, the first fluid-filled chamber 122 may be fluidly isolated from the second fluid-filled chamber 124. Likewise, the third fluid-filled chamber 126 may include the same or different pressure as the fourth fluid-filled chamber 128 and may likewise be fluidly isolated from the fourth fluid-filled chamber 128. In short, each of the first fluid-filled chamber 122, the second fluid-filled chamber 124, the third fluid-filled chamber 126, and the fourth fluid-filled chamber 128 may include the same or different pressure and may be fluidly isolated from one another.

While the cushioning arrangement 40*b* is described as including a series of fluid-filled chambers 122, 124, 126, 128, one or more of the chambers 122, 124, 126, 128 may include a foam block 92 in place of the tensile element 84 and pressurized fluid in a similar fashion as described above with respect to the articles of footwear 10, 10*a*. For example, the first fluid-filled chamber 122 and the fourth fluid-filled chamber 128 could be replaced with a foam block 92 disposed within the interior void 80 created by the first barrier element 76 and the second barrier element 78. Alternatively, the first fluid-filled chamber 122 and the fourth fluid-filled chamber 128 could be replaced by a foam block 92 without locating the foam block 92 within an interior void 80 defined by a first barrier element 76 and a second barrier element 78. While the fluid-filled chambers 122, 128 could be replaced with a foam block 92 without positioning the foam block 92 within an interior void 80 defined by barrier elements 76, 78, the foam blocks 92 are shown in FIG. 18 as being received within the interior void 80 defined by the barrier elements 76, 78.

Figure 18:
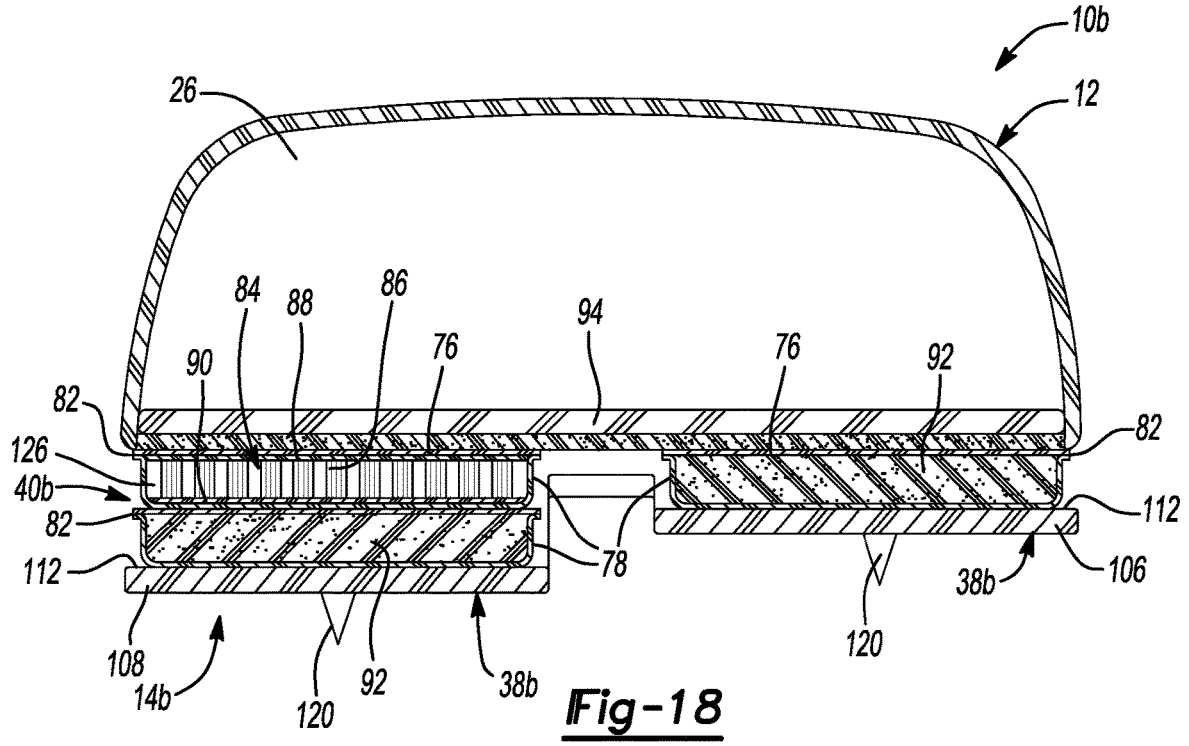
FIG. 18 is a cross-sectional view of the article of footwear of FIG. 15 taken along Line 17-17 of FIG. 22 showing an alternate construction of a cushion.
Figure 19:
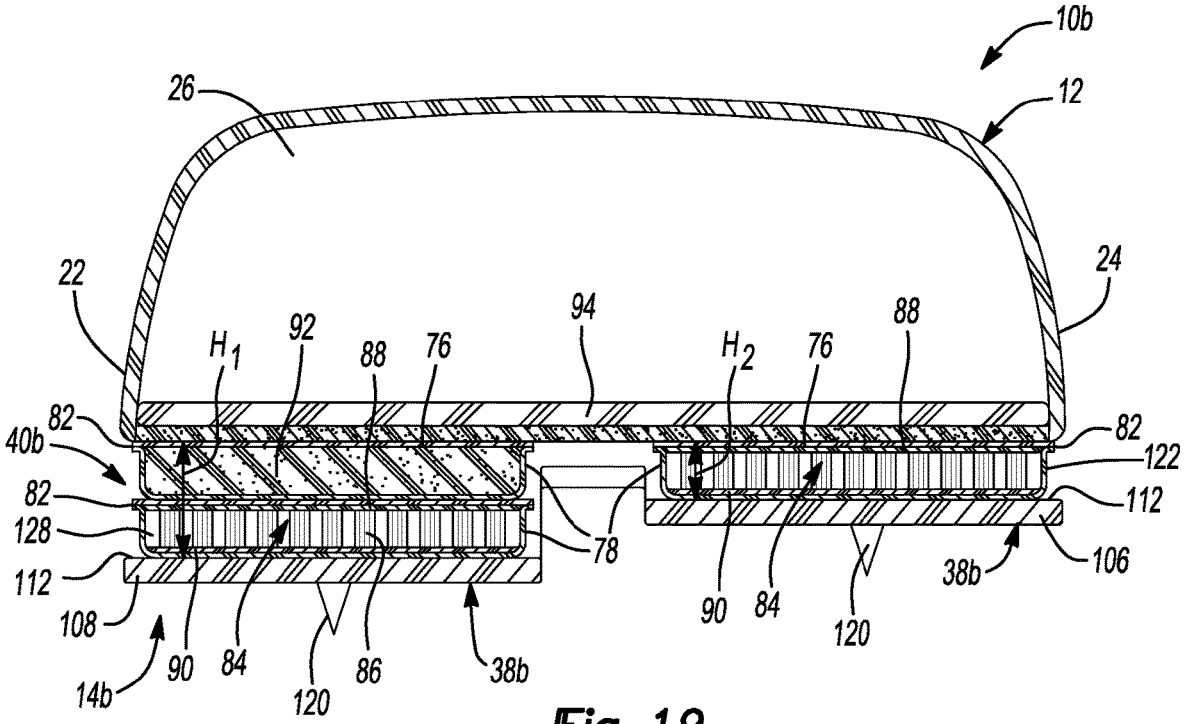
FIG. 19 is a cross-sectional view of the article of footwear of FIG. 15 taken along Line 17-17 of FIG. 22 showing an alternate construction of a cushion.
Figure 20:
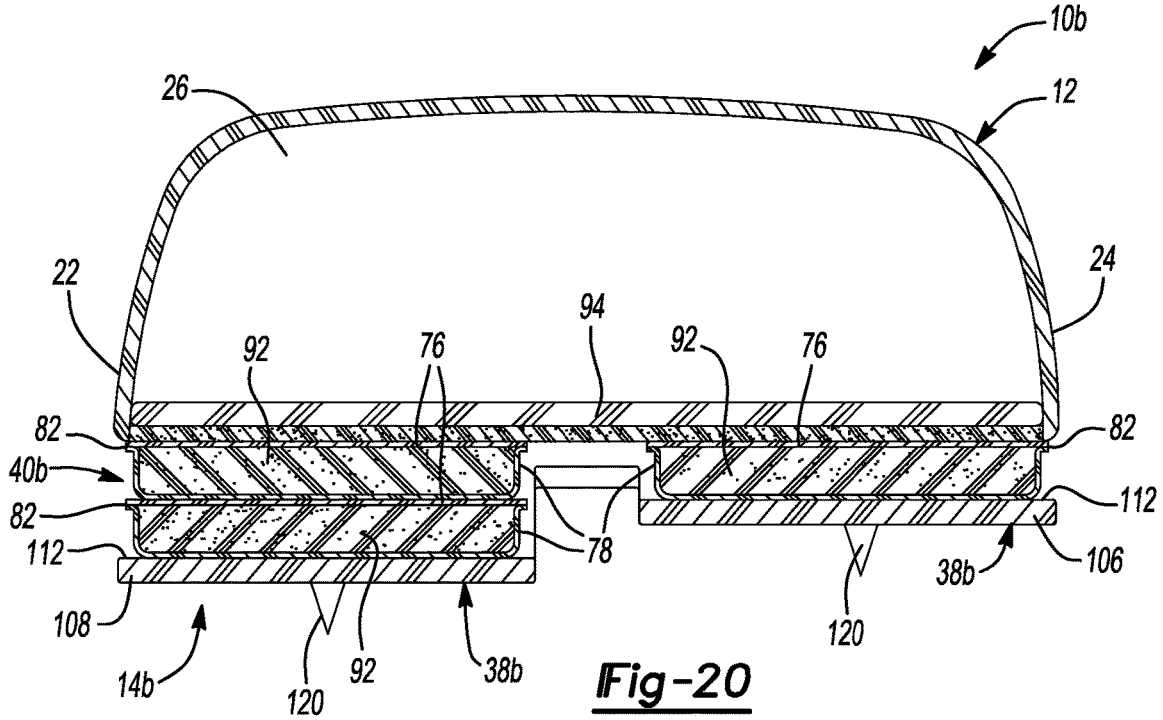
FIG. 20 is a cross-sectional view of the article of footwear of FIG. 15 taken along Line 17-17 of FIG. 22 showing an alternate construction of a cushion.

In addition to the configuration shown in FIG. 18, the third fluid-filled chamber 126 could be replaced with a foam block 92 either as a stand-alone foam block 92 or by a foam block disposed within an interior void 80 defined by a first barrier element 76 and a second barrier element 78. Such a configuration is shown in FIG. 19. Finally, each of the first fluid-filled chamber 122, the second fluid-filled chamber 124, the third fluid-filled chamber 126, and the fourth fluid-filled chamber 128 could be replaced with a foam block 92 either as a stand-alone foam block 92 or a foam block 92 disposed within an interior void 80 defined by a first barrier element 76 and a second barrier element 78, as shown in FIG. 20.

With particular reference to FIG. 21, the sole structure 14*b* is shown as including an additional cushioning element 130 disposed proximate to the anterior end 44 of the sole structure 14*b*. The additional cushioning element 130 may be formed from a foam material and may substantially fill the cavity 112 between the outsole 38*b* and the plate 42 in an area of the forefoot region 16. Namely, the cushioning element 130 may be positioned between the outsole 38*b* and the plate 42 in an area forward of the first fluid-filled chamber 122 and the second fluid-filled chamber 124. The cushioning element 130 provides an additional degree of cushioning to a foot of a user during use when the sole structure 14 contacts a ground surface.

During operation, when the sole structure 14*b* contacts a ground surface at the outsole 38*b*, a force is transmitted to the outsole 38*b*. Because the outsole 38*b* is formed from a relatively rigid material that is supported by the fluid-filled chambers 122, 124, 126, 128 and, in some configurations, by the cushioning element 130 relative to the plate 42, the applied force at the outsole 38*b* causes the outsole 38*b* to move in a direction toward the plate 42. In so doing, the fluid-filled chambers 122, 124, 126, 128 and the cushioning element 130 are compressed, thereby attenuating the forces caused by the sole structure 14*b* contacting the ground surface. As such, the forces are absorbed by the fluid-filled chambers 122, 124, 126, 128 and, if present, additionally by the cushioning element 130. As such, the cushioning arrangement 40*b* serves to provide the user with a degree of comfort and protection during use of the article of footwear 10*b*.

Figure 23:
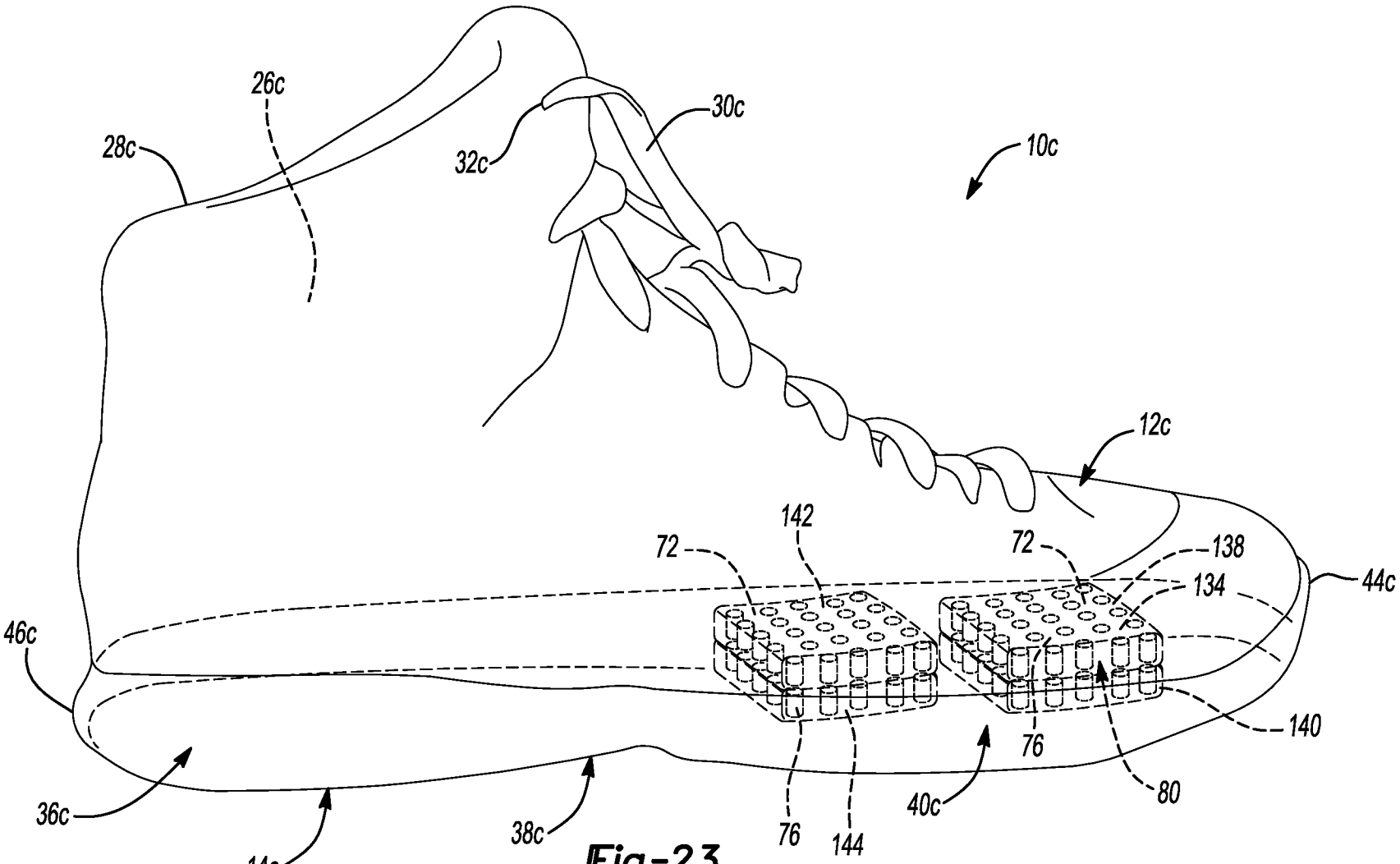
FIG. 23 is a perspective view of an article of footwear incorporating a sole structure in accordance with the principles of the present disclosure.
Figure 24:
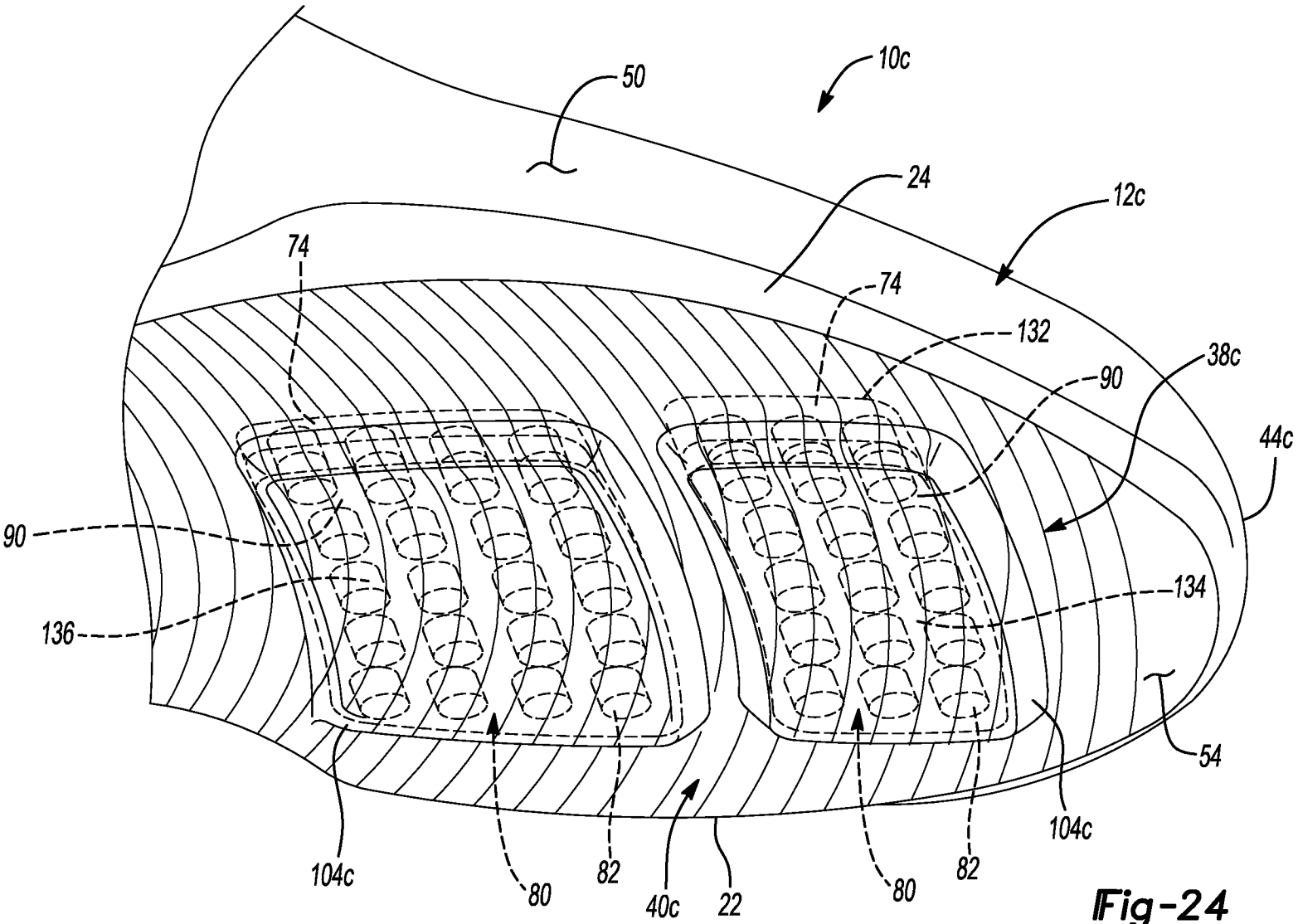
FIG. 24 is a partial perspective view of the sole structure of FIG. 23.
Figure 25:
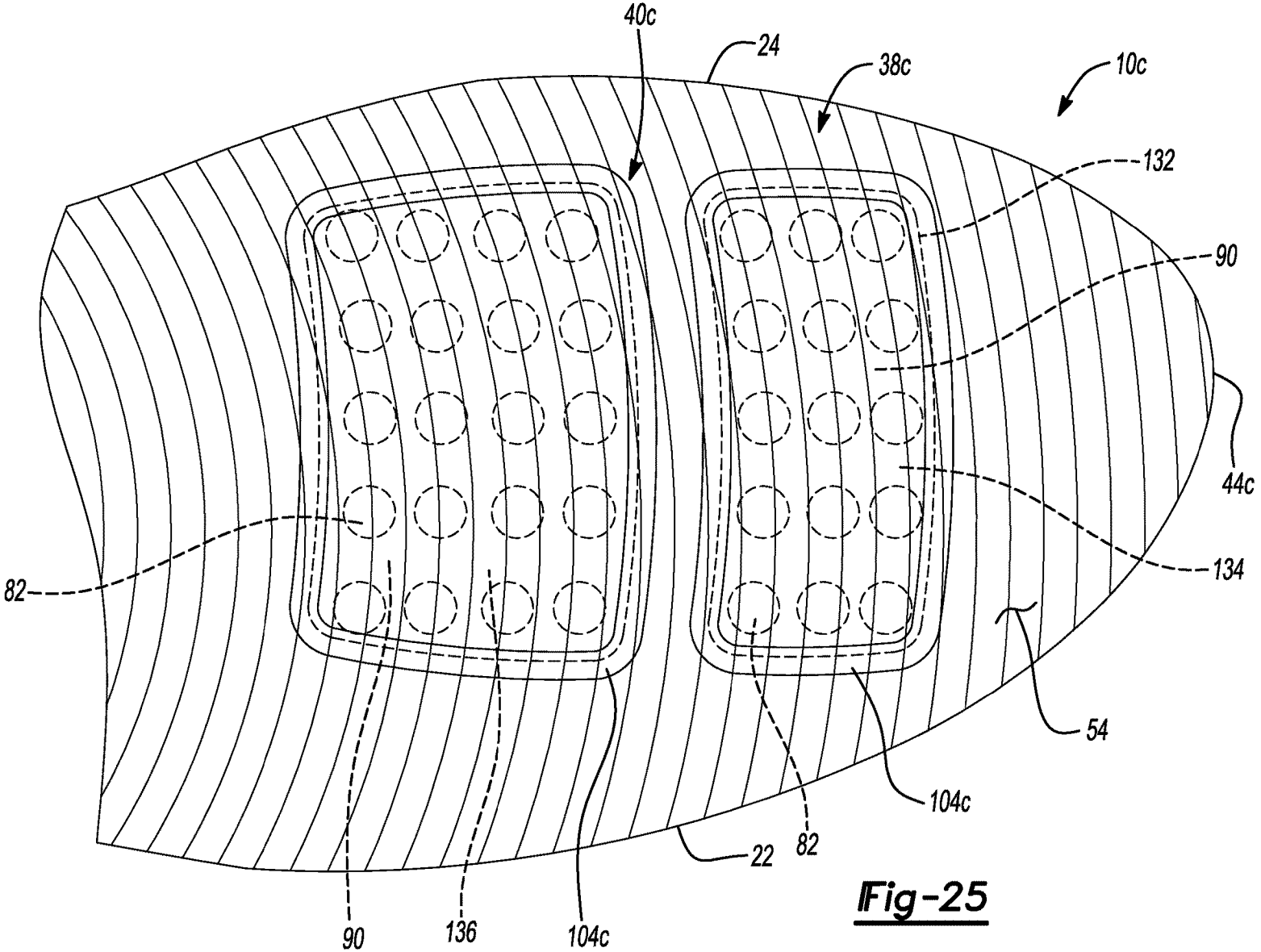
FIG. 25 is a partial bottom view of the article of footwear of FIG. 23.

With reference to FIGS. 23-25, an article of footwear 10*c* is provided. In view of the substantial similarity in structure and function of the components associated with the article of footwear 10 with respect to the article of footwear 10*c*, like reference numerals are used hereinafter and in the drawings to identify like components while like reference numerals containing letter extensions are used to identify those components that have been modified.

The article of footwear 10*c* is shown as including an upper 12*c* defining an interior void 26*c* that is accessible via an ankle opening 28*c*. Additionally, the upper 12*c* is shown as including a series of fasteners 30*c* such as lacing that may be attached to the upper 12*c* via a series of apertures or eyelets 32 in a similar fashion as described above with respect to the articles of footwear 10, 10*a*, 10*b*.

The upper 12*c* is attached to a sole structure 14*c* having a midsole 36*c*, an outsole 38*c*, and a cushion or cushioning arrangement 40*c*. As shown in FIG. 23, the midsole 36*c* extends generally between an anterior end 44*c* and a posterior end 46*c* located on opposite ends of the sole structure 14*c*.

The midsole 36*c* may include a pair of recesses 132 that respectively receive portions of the cushioning arrangement 40*c*. For example, the cushioning arrangement 40*c* may include a forward cushion or cushioning arrangement 134 and a rearward cushion or cushioning arrangement 136. The forward cushioning arrangement 134 is disposed closer to the anterior end 44*c* of the sole structure 14*c* than the rearward cushioning arrangement 136 while the rearward cushioning arrangement 136 is disposed closer to the posterior end 46*c* than the forward cushioning arrangement 134.

The forward cushioning arrangement 134 and the rearward cushioning arrangement 136 may each include a pair of stacked, fluid-filled chambers in a similar fashion as the articles of footwear 10, 10*a*, 10*b*. Namely, the forward cushioning arrangement 134 may include a first fluid-filled chamber 138 and a second fluid-filled chamber 140. Likewise, the rearward cushioning arrangement 136 may include a third fluid-filled chamber 142 and a fourth fluid-filled chamber 144. Each of the fluid-filled chambers 138, 140, 142, 144 may include a tensile element 84 disposed within an interior void 80 defined by a first barrier element 76 and a second barrier element 78. The first fluid-filled chamber 138 may include the same or different pressure as the second fluid-filled chamber 140. Similarly, the third fluid-filled chamber 142 may include the same or different pressure as the fourth fluid-filled chamber 144. The fluid-filled chambers 138, 140, 142, 144 may be at a pressure within a range of 15-30 psi and preferably at a pressure within a range of 20-25 psi. Regardless of the pressures of the fluid-filled chambers 138, 140, 142, 144, the fluid-filled chambers 138, 140, 142, 144 may be fluidly isolated from one another and may include a pressure within a range of 15-30 psi and preferably at a pressure within a range of 20-25 psi.

As shown in FIG. 23, the first fluid-filled chamber 138 may be disposed closer to the upper 12*c* than the second fluid-filled chamber 140 such that the second fluid-filled chamber 140 is disposed between the first fluid-filled chamber 138 and the outsole 38*c*. Similarly, the third fluid-filled chamber 142 may be disposed closer to the upper 12*c* than the fourth fluid-filled chamber 144 such that the fourth fluid-filled chamber 144 is disposed between the third fluid-filled chamber 142 and the outsole 38*c*.

With particular reference to FIGS. 24 and 25, the forward cushioning arrangement 134 and the rearward cushioning arrangement 136 may impart a pair of bulges 104*c* at the outsole 38*c*. Namely, the outsole 38*c* may include bulges 104*c* in the areas of the forward cushioning arrangement 134 and the rearward cushioning arrangement 136, whereby the bulges 104*c* stand proud of a nominal plane defined by the outsole 38*c*. As such, when the article of footwear 10*c* is in use, the bulges 104*c* may contact a ground surface before other portions of the outsole 38*c*, thereby allowing the forward cushioning arrangement 134 and the rearward cushioning arrangement 136 to absorb forces caused by contact with the outsole 38*c* and the ground surface.

With particular reference to FIGS. 26-29, an article of footwear 10*d* is provided and includes an upper 12 and a sole structure 14*d* attached to the upper 12. In view of the substantial similarity in structure and function of the components associated with the article of footwear 10 with respect to the article of footwear 10*d*, like reference numerals are used hereinafter and in the drawings to identify like components while like reference numerals containing letter extensions are used to identify those components that have been modified.

With reference to FIGS. 26-29, the sole structure 14*d* is shown to include a midsole 36*d*, an outsole 38*d*, a cushion or cushioning arrangement 40*d* disposed between the midsole 36*d* and the outsole 38*d*, and a plate 42*d*. The plate 42*d* is formed from a relatively rigid material such as, for example, a non-foamed polymer or a composite material containing fibers such as carbon fibers.

Figure 26:
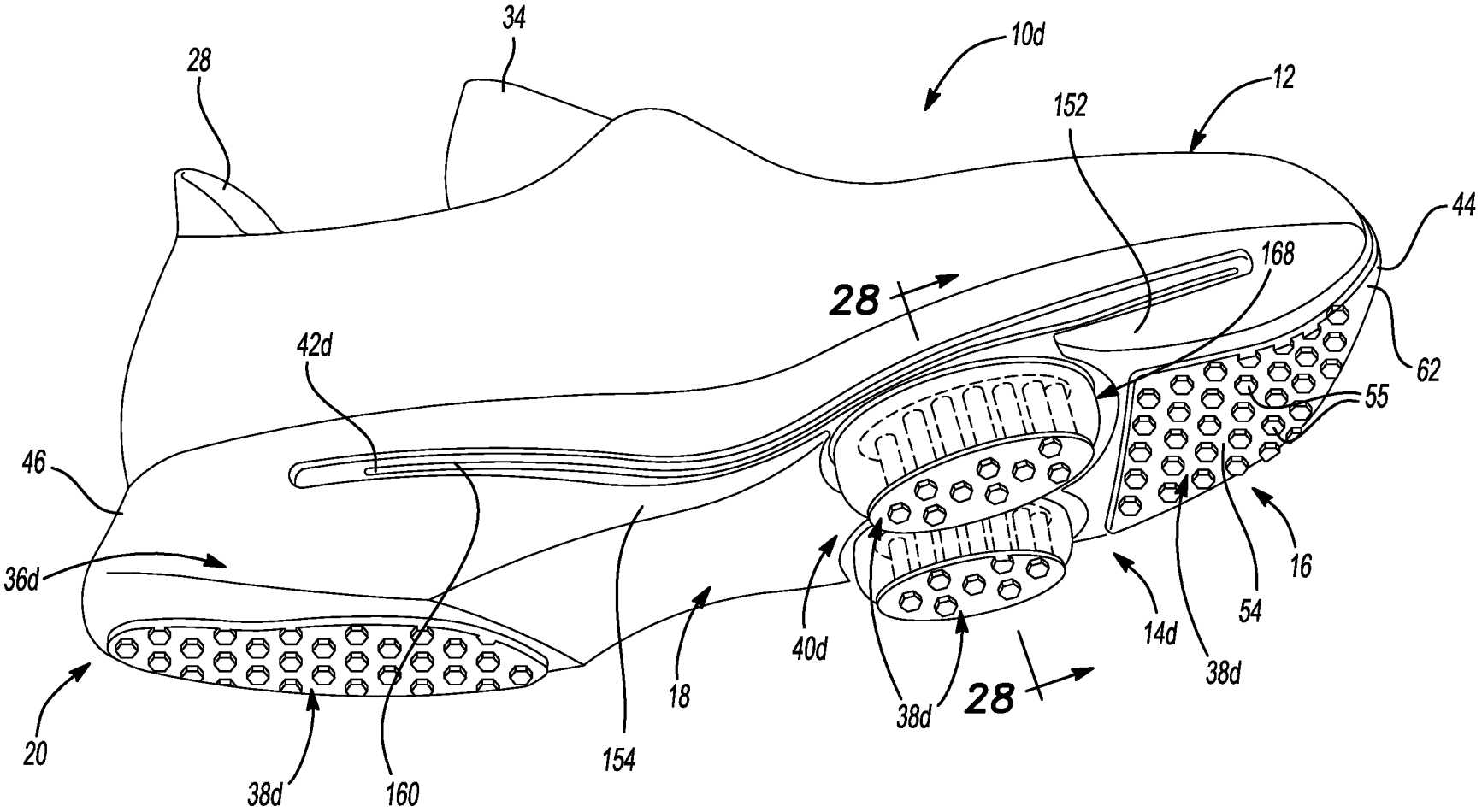
FIG. 26 is a perspective view of an article of footwear incorporating a sole structure in accordance with the principles of the present disclosure.
Figure 27:
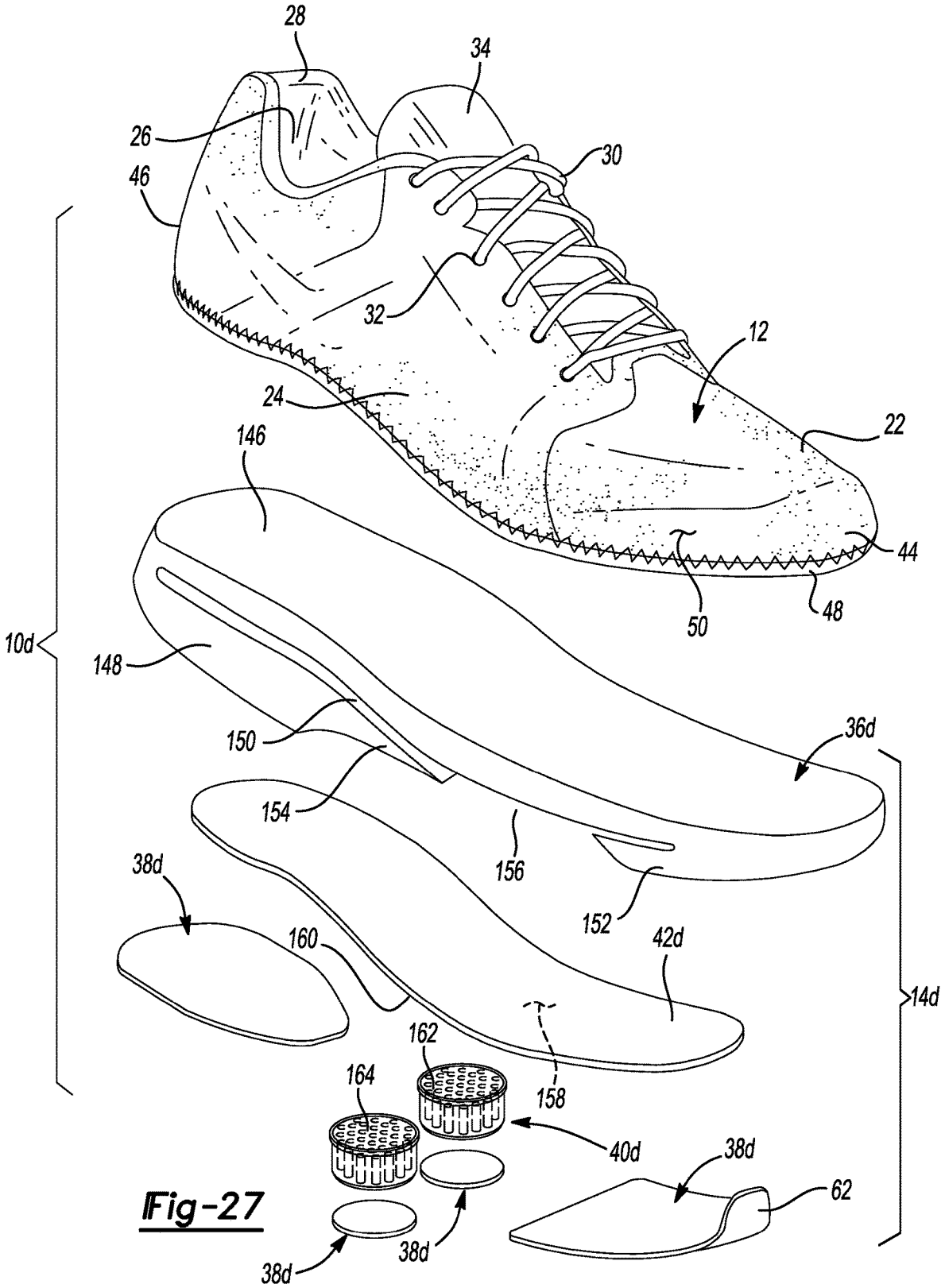
FIG. 27 is an exploded view of the article of footwear of FIG. 26.

As shown in FIGS. 26 and 27, the midsole 36*d* extends generally between an anterior end 44 and a posterior end 46 located on opposite ends of the sole structure 14*d*. The midsole 36*d* may be formed from an energy absorbing material such as, for example, polymer foam. In one configuration, the midsole 36*d* opposes the strobel 48 of the upper 12. The midsole 36*d* may extend at least partially onto an upper surface 50 of the upper 12 such that the midsole 36*d* covers a junction of the upper 12 and the strobel 48.

Figure 29:
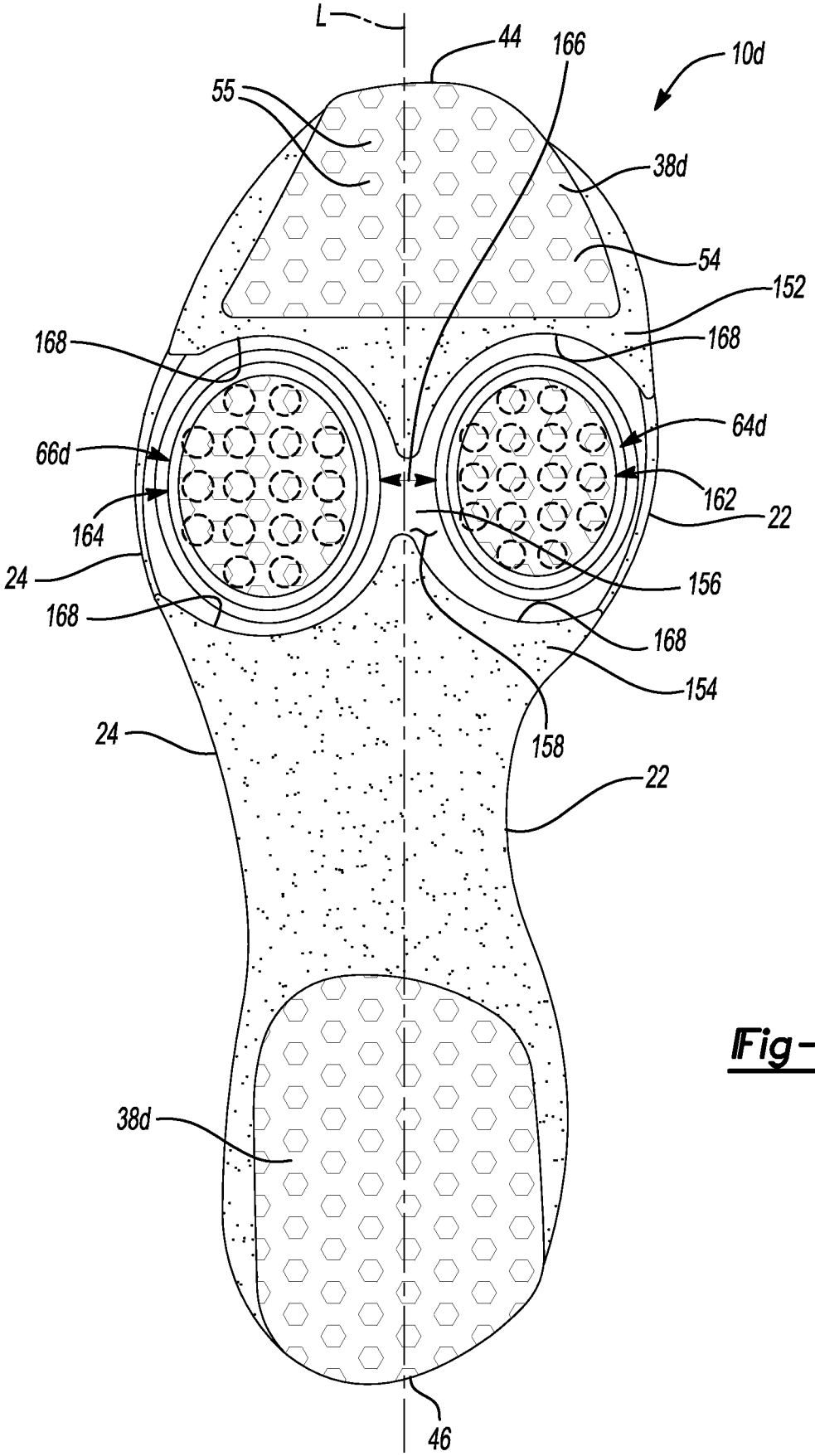
FIG. 29 is a bottom view of the article of footwear of FIG. 26.

The midsole 36*d* includes an upper portion 146 and a lower portion 148 defining a channel 150 therebetween. As shown in FIGS. 27 and 29, the lower portion 148 includes a first segment 152 extending from the forefoot region 16 in a direction toward the heel region 20 and a second segment 154 extending from the heel region 20 in a direction toward the forefoot region 16. The first segment 152 is spaced apart from the second segment 154 to define a gap 156 therebetween. As will be described in greater detail below, the plate 42*d* may be visible at the gap 156 once assembled into the midsole 36*d*.

As shown in FIG. 26, the plate 42*d* is embedded within a material of the midsole 36*d* such that the upper portion 146 of the midsole 36*d* extends between the plate 42*d* and the upper 12, and the lower portion 148 of the midsole 36*d* extends between the plate 42*d* and the outsole 38*d*. As shown, a ground-facing surface 158 of the plate 42*d* may be visible at the gap 156 defined between the first segment 152 and the second segment 154. Further, an outer perimeter edge 160 of the plate 42*d* may be visible at the medial side 22 of the sole structure 14*d* and/or at the lateral side 24 of the sole structure 14*d*.

The plate 42*d* may be a so-called "partial-length plate" that extends from an intermediate portion of the forefoot region 16 to an intermediate portion of the heel region 20. Accordingly, the plate 42*d* may extend from the forefoot region 16 of the article of footwear 10*d* to the mid-foot region 18 without extending fully through the mid-foot region 18 and into the heel region 20. While the plate 42*d* may be a partial-length plate that extends from the intermediate portion of the forefoot region 16 to the intermediate portion of the heel region 20, the plate 42*d* could alternatively be a full-length plate, as described above with respect to the article of footwear 10.

Regardless of the particular size and configuration of the plate 42*d*, the plate 42*d* may be formed from a relatively rigid material. For example, the plate 42*d* may be formed from a non-foamed polymer material or, alternatively, from a composite material containing fibers such as carbon fibers.

With particular reference to FIGS. 26-29, the cushioning arrangement 40*d* is shown to include a medial cushion or cushioning arrangement 64*d* and a lateral cushion or cushioning arrangement 66*d*. The medial cushioning arrangement 64*d* is disposed proximate to the medial side 22 of the sole structure 14*d* while the lateral cushioning arrangement 66*d* is disposed proximate to the lateral side 24 of the sole structure 14*d*.

Figure 28:
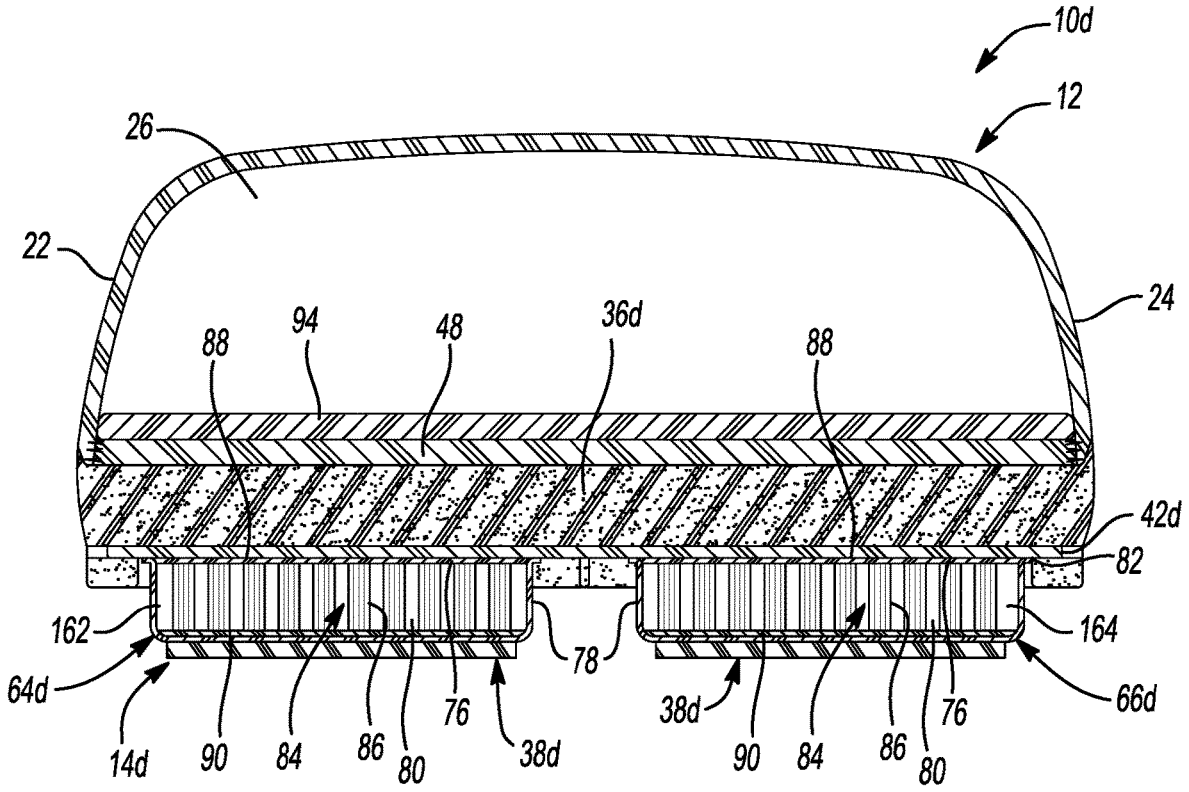
FIG. 28 is a cross-sectional view of the article of footwear of FIG. 26 taken along Line 28-28 of FIG. 26.

As shown in FIG. 28, the medial cushioning arrangement 64*d* includes a first fluid-filled chamber 162 disposed generally between the plate 42*d* and the outsole 38*d*. Specifically, the first fluid-filled chamber 162 is attached to the plate 42*d* proximate to an exposed surface 158 of the plate 42*d* at a first side and is attached to the outsole 38*d* at a second side.

The first fluid-filled chamber 162 may be attached to the plate 42*d* and to the outsole 38*d*, respectively, via a suitable adhesive. Additionally or alternatively, the first fluid-filled chamber 162 may be attached to the outsole 38*d* by melding a material of the first fluid-filled chamber 162 and a material of the outsole 38*d* at a junction of the first fluid-filled chamber 162 and the outsole 38*d*.

The first fluid-filled chamber 162 may include a first barrier element 76 and a second barrier element 78. The first barrier element 76 and the second barrier element 78 may be formed from a sheet of thermoplastic polyurethane (TPU). Specifically, the first barrier element 76 may be formed from a sheet of TPU material and may include a substantially planar shape. The second barrier element 78 may likewise be formed from a sheet of TPU material and may be formed into the configuration shown in FIG. 28 to define an interior void 80. The first barrier element 76 may be joined to the second barrier element 78 by applying heat and pressure at a perimeter of the first barrier element 76 and the second barrier element 78 to define a peripheral seam 82. The peripheral seam 82 seals the interior void 80, thereby defining a volume of the first fluid-filled chamber 162.

The interior void 80 of the first fluid-filled chamber 162 may receive a tensile element 84 therein. The tensile element 84 may include a series of tensile strands 86 extending between an upper tensile sheet 88 and a lower tensile sheet 90. The upper tensile sheet 88 may be attached to the first barrier element 76 while the lower tensile sheet 90 may be attached to the second barrier element 78. In this manner, when the first fluid-filled chamber 162 receives a pressurized fluid, the tensile strands 86 of the tensile element 84 are placed in tension. Because the upper tensile sheet 88 is attached to the first barrier element 76 and the lower tensile sheet 90 is attached to the second barrier element 78, the tensile strands 86 retain a desired shape of the first fluid-filled chamber 162 when the pressurized fluid is injected into the interior void 80.

With continued reference to FIG. 26, the lateral cushioning arrangement 66*d* likewise includes a second fluid-filled chamber 164. As with the medial cushioning arrangement 64*d*, the second fluid-filled chamber 164 is disposed between the plate 42*d* and the outsole 38*d*. The second fluid-filled chamber 164 may be identical to the first fluid-filled chamber 162. Accordingly, the second fluid-filled chamber 164 may include a first barrier element 76, a second barrier element 78, an interior void 80, a peripheral seam 82, and a tensile element 84 disposed within the interior void 80.

In one configuration, the medial cushioning arrangement 64*d* (i.e., the first fluid-filled chamber 162) is fluidly isolated from the lateral cushioning arrangement 66*d* (i.e., the second fluid-filled chamber 164). As such, the medial cushioning arrangement 64*d* is spaced apart and separated from the lateral cushioning arrangement 66*d* by a distance 166 (FIG. 29). While the medial cushioning arrangement 64*d* is described and shown as being spaced apart from the lateral cushioning arrangement 66*d*, the cushioning arrangements 64*d*, 66*d* could alternatively be in contact with one another while still being fluidly isolated.

While the medial cushioning arrangement 64*d* and the lateral cushioning arrangement 66*d* are described and shown as including fluid-filled chambers 162, 164, the medial cushioning arrangement 64*d* and/or the lateral cushioning arrangement 66*d* could alternatively include alternative or additional cushioning elements. For example, the medial cushioning arrangement 64*d* and/or the lateral cushioning arrangement 66*d* may each include a foam block (not shown) that replaces one or both of the fluid-filled chambers 162, 164. The foam block(s) may be received within the interior void 80 defined by the first barrier element 76 and the second barrier element 78. Positioning the foam block(s) within the interior void 80 defined by the first barrier element 76 and the second barrier element 78 allows the barrier elements 76, 78 to restrict expansion of the foam block(s) beyond a predetermined amount when subjected to a predetermined load. Accordingly, the overall shape and, thus, the performance of the foam blocks may be controlled by allowing the foam block(s) to interact with the barrier elements 76, 78 during loading.

Regardless of the particular construction of the medial cushioning arrangement 64*d* and the lateral cushioning arrangement 66, the medial cushioning arrangement 64*d* may be aligned with the lateral cushioning arrangement 66*d* in a direction extending along a longitudinal axis (L) of the sole structure 14*d*, as shown in FIG. 29. Additionally or alternatively, the medial cushioning arrangement 64*d* may be aligned with the lateral cushioning arrangement 66*d* in a direction extending from the medial side 22 to the lateral side 24 such that both cushioning arrangements 64*d*, 66*d* are approximately equally spaced from the anterior end 44 of the sole structure 14*d* and/or from the posterior end 46 of the sole structure 14*d*, as shown in FIG. 29. Alternatively, the medial cushioning arrangement 64*d* may be offset from the lateral cushioning arrangement 66*d* in the direction extending along the longitudinal axis (L). Namely, the medial cushioning arrangement 64*d* may be disposed closer to or farther from the anterior end 44 of the sole structure 14*d* than the lateral cushioning arrangement 66*d*, similar to the example shown in FIG. 14.

As shown in FIG. 29, the cushioning arrangements 64*d*, 66*d* may include substantially oval shapes. As such, the surrounding segments 152, 154 of the midsole 36*d* may include a complimentary shape such that the material of the midsole 36*d* is substantially evenly spaced from an outer perimeter of each cushioning arrangement 64*d*, 66*d*. As such, the portion 152, 154 of the midsole 36*d* that opposes the cushioning arrangements 64*d*, 66*d* may include an arcuate surface 168 that mimics an outer perimeter shape of the cushioning arrangements 64*d*, 66*d*. While the surfaces 168 are described as mimicking a shape of the cushioning arrangements 64*d*, 66*d* such that the surfaces 168 are substantially evenly spaced apart from the outer perimeter of the cushioning arrangements 64*d*, 66*d* along their length, the surfaces 168 could include different shapes, thereby varying a distance between one or more of the surfaces 168 and the outer perimeter of the cushioning arrangements 64*d*, 66*d*.

Regardless of whether the surfaces 168 are evenly spaced from the cushioning arrangements 64*d*, 66*d*, providing a gap between the surfaces 168 of the midsole 36*d* and the cushioning arrangements 64*d*, 66*d* allows the cushioning arrangements 64*d*, 66*d* to outwardly expand when subjected to a load. Namely, the cushioning arrangements 64*d*, 66*d* are permitted to extend into the gap disposed between the cushioning arrangements 64*d*, 66*d* and the surfaces 168 when the cushioning arrangements 64*d*, 66*d* are subjected to a load. The width of this gap may be designed to control the degree to which the cushioning arrangements 64*d*, 66*d* are permitted to expand when subjected to a load. For example, the larger the gap, the more the cushioning arrangements 64*d*, 66*d* must expand before contacting the surfaces 168—if at all. Conversely, if the surfaces 168 are disposed in close proximity to the cushioning arrangements 64*d*, 66*d*, minimal expansion of the cushioning arrangements 64*d*, 66*d*, will be permitted before the cushioning arrangements 64*d*, 66*d* contact the surfaces 168 of the midsole 36*d*, thereby allowing the midsole 36*d* to restrain the cushioning arrangements 64*d*, 66*d* from expanding beyond a predetermined amount.

As described, the medial cushioning arrangement 64*d* and the lateral cushioning arrangement 66*d* each provide a cushioning element disposed at discrete locations on the sole structure 14*d*. In one configuration, the medial cushioning arrangement 64*d* and the lateral cushioning arrangement 66*d* each provide a fluid-filled chamber (i.e. elements 162, 164) that cooperate to provide cushioning at the medial side 22 and the lateral side 24, respectively. The individual, discrete fluid-filled chambers 162, 164 may include the same volume and, further, may be at the same pressure. Alternatively, the pressures of the various fluid-filled chambers 162, 164 may vary between the cushioning arrangements 64*d*, 66*d*. For example, the first fluid-filled chamber 162 may include the same pressure as the second fluid-filled chamber 164 or, alternatively, the first fluid-filled chamber 162 may include a different pressure than the second fluid-filled chamber 164. The fluid-filled chambers 162, 164 may be at a pressure within a range of 15-30 psi and preferably at a pressure within a range of 20-25 psi As shown in FIG. 26, the outsole 38*d* is joined to the midsole 36*d* and the cushioning arrangement 40*d*. More specifically, the outsole 38*d* is fragmentary, whereby portions of the outsole 38*d* are separately formed from each other, and are joined to each of the midsole 36*d*, the first fluid-filled chamber 162, and the second fluid-filled chamber 164.

The outsole 38*d* may be formed from a resilient material such as, for example, rubber that provides the article of footwear 10*d* with a ground-engaging surface 54 that provides traction and durability. As described above, the ground-engaging surface 54 may include traction elements 55 to enhance engagement of the sole structure 14*d* with a ground surface.

During operation, when the sole structure 14*d* contacts the ground, a force is transmitted to the medial cushioning arrangement 64*d* and the lateral cushioning arrangement 66*d*. Namely, the force is transmitted to the first fluid-filled chamber 162 and the second fluid-filled chamber 164. The applied force causes the individual fluid-filled chambers 162, 164 to compress, thereby absorbing the forces associated with the outsole 38*d* contacting the ground. The force is transmitted to the midsole plate 42*d* and the midsole 36*d*, but is not experienced by the user as a point or localized load. Namely, and as described above, the plate 42*d* is formed from a rigid material. Accordingly, even though the medial cushioning arrangement 64*d* and the lateral cushioning arrangement 66*d* are located at discrete locations along the sole structure 14*d*, the forces exerted on the plate 42*d* by the medial cushioning arrangement 64*d* and the lateral cushioning arrangement 66*d* are dissipated over a length of the plate 42*d* such that neither applied force is applied at individual, discrete locations to a user's foot. Rather, the forces applied at the locations of the medial cushioning arrangement 64*d* and the lateral cushioning arrangement 66*d* are dissipated along a length of the plate 42*d* due to the rigidity of the plate 42*d* and, as such, point loads are not experienced by the user's foot when the foot is in contact with an insole 94 disposed within the interior void 26.

With reference to FIGS. 30-33, an article of footwear 10*e* is provided and includes an upper 12 and a sole structure 14*e* attached to the upper 12. In view of the substantial similarity in structure and function of the components associated with the article of footwear 10 with respect to the article of footwear 10*e*, like reference numerals are used hereinafter and in the drawings to identify like components while like reference numerals containing letter extensions are used to identify those components that have been modified.

The sole structure 14*e* is attached to the upper 12 and provides the article of footwear 10*e* with support and cushioning during use. Namely, the sole structure 14*e* attenuates ground-reaction forces caused by the article of footwear 10*e* striking the ground during use. Accordingly, and as set forth below, the sole structure 14*e* may incorporate one or more materials having energy absorbing characteristics to allow the sole structure 14*e* to reduce the impact experienced by a user when wearing the article of footwear 10*e*.

Figure 30:
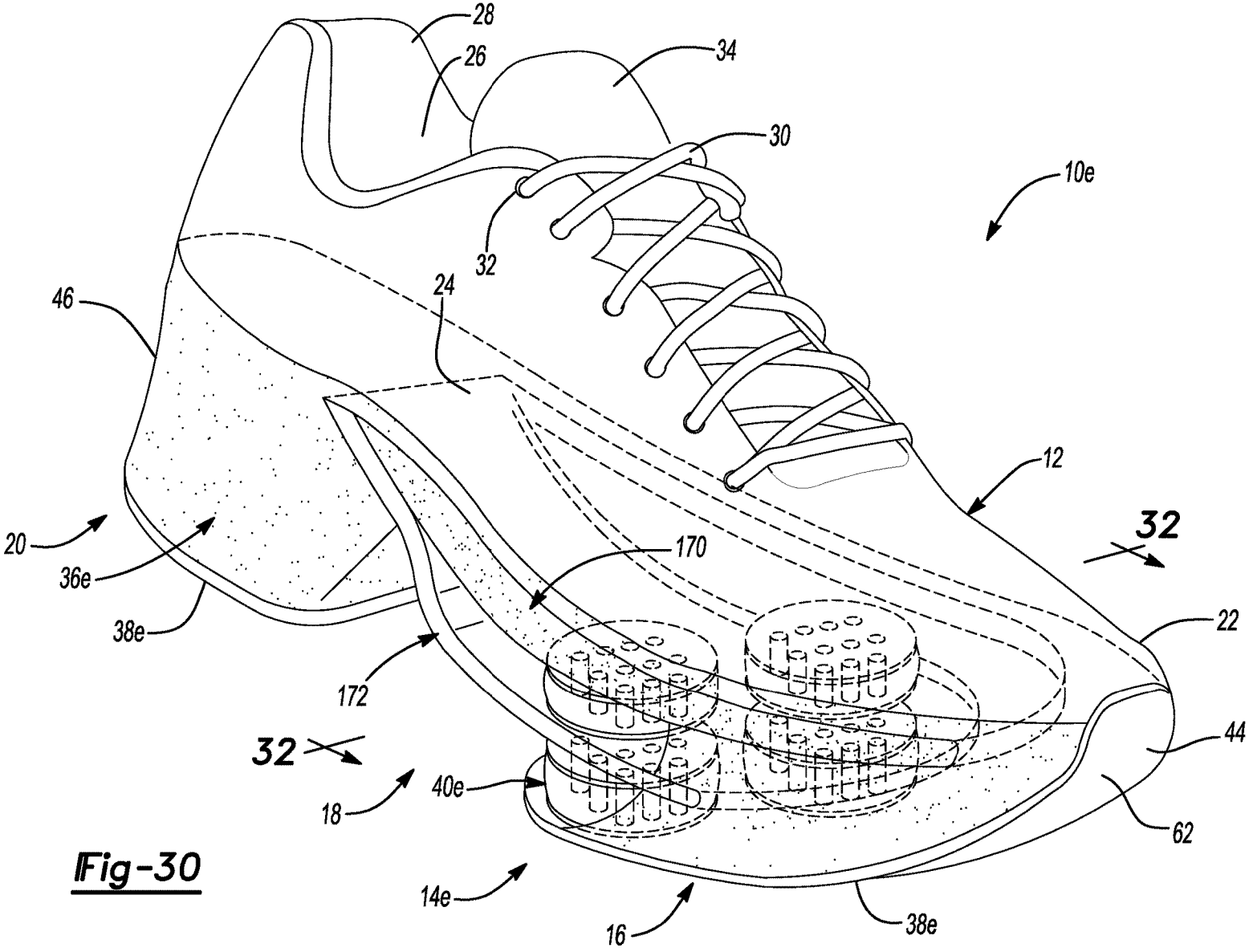
FIG. 30 is a perspective view of an article of footwear incorporating a sole structure in accordance with the principles of the present disclosure.

The sole structure 14*e* may include a midsole 36*e*, an outsole 38*e*, and a cushion or cushioning arrangement 40*e* disposed generally between the midsole 36*e* and the outsole 38*e*. In addition, the sole structure 14*e* may include a first plate 170 and a second plate 172 that extend from the forefoot region 16 of the article of footwear 10*e* towards the posterior end 46. As shown in FIG. 30, the first plate 170 is disposed intermediate the midsole 36*e* and the cushioning arrangement 40*e*, while the second plate 172 is disposed within the midsole 36*e* and separates the cushioning arrangement 40*e* into an upper portion and a lower portion.

Figure 31:
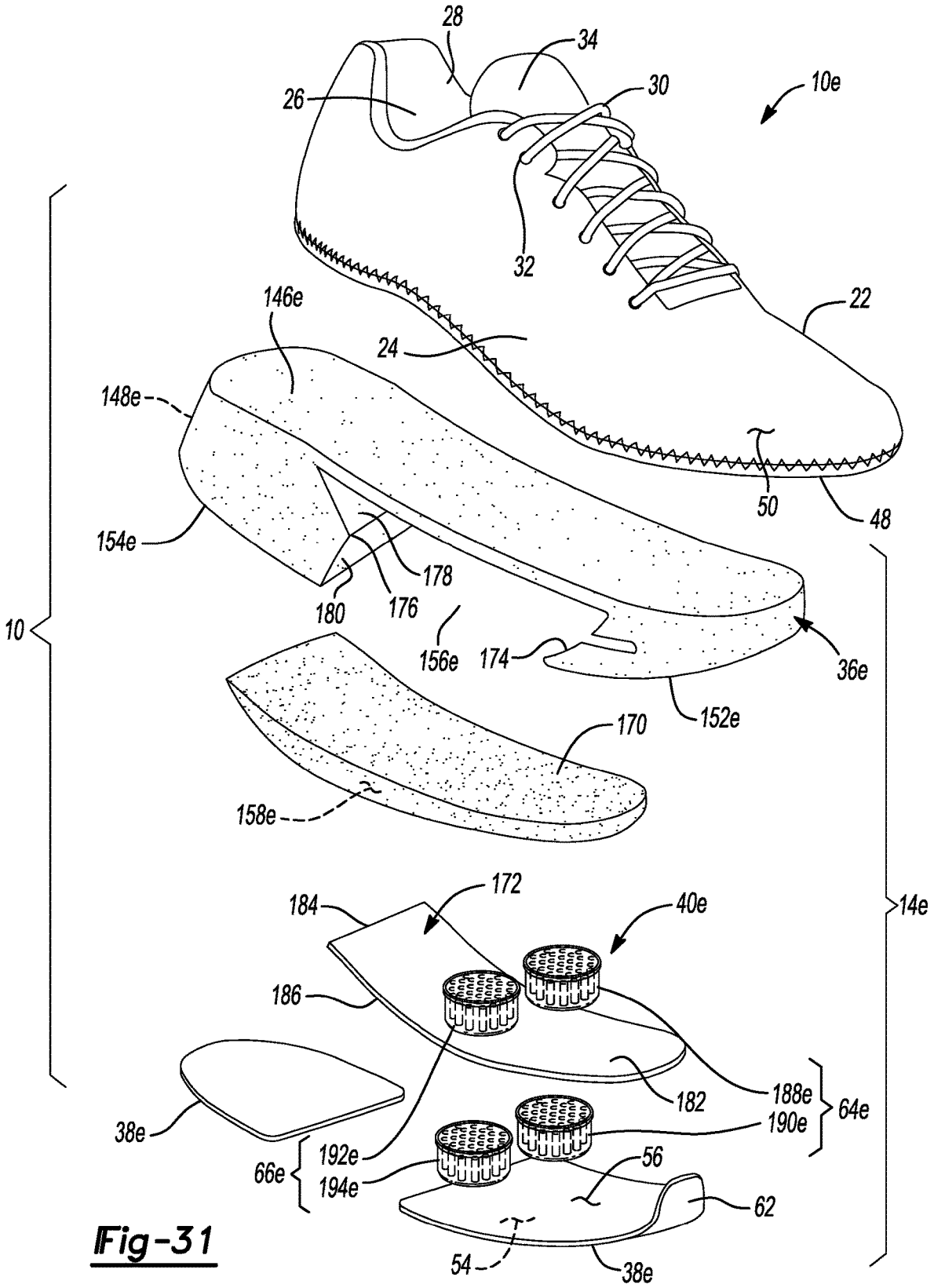
FIG. 31 is an exploded view of the article of footwear of FIG. 30.

With continued reference to FIG. 31, the midsole 36*e* may include a continuously formed upper portion 146*e* and a segmented lower portion 148*e*. The upper portion 146*e* is shown as extending from the anterior end 44 of the article of footwear 10*e* to the posterior end 46. In one configuration, the upper portion 146*e* opposes the strobel 48 of the upper 12 and joins the sole structure 14*e* to the upper 12. The upper portion 146*e* of the midsole 36*e* may extend at least partially onto an upper surface 50 of the upper 12 (FIG. 32) such that the midsole 36*e* covers a junction of the upper 12 and the strobel 48.

The lower portion 148*e* of the midsole 36*e* may include a first segment 152*e* extending downwardly from the forefoot region 16 of the upper portion 146*e* and a second segment 154*e* extending downwardly from the heel region 20 of the upper portion 146*e*. A heel-facing sidewall 174 of the first segment 152*e* is spaced apart from a forefoot-facing sidewall 176 of the second segment 154*e* to define a gap 156*e* between the first segment 152*e* and the second segment 154*e*. The forefoot-facing sidewall 176 of the second segment 154*e* may be tapered, as shown in FIG. 31. The forefoot-facing sidewall 176 may include a top surface 178 and a bottom surface 180 that converge with each other in a direction from the heel region 20 to the forefoot region 16. Furthermore, the top surface 178 of the forefoot-facing sidewall 176 may diverge from the upper portion 146*e*, thereby forming a space (not labeled) therebetween.

The midsole 36*e* may be formed from an energy absorbing material such as, for example, polymer foam. Forming the midsole 36*e* from an energy-absorbing material such as polymer foam allows the midsole 36*e* to attenuate ground-reaction forces caused by movement of the article of footwear 10*e* over ground during use.

The first plate 170 may be disposed within the midsole 36*e* such that the upper portion 146*e* of the midsole 36*e* extends between the first plate 170 and the upper 12. As shown, the first plate 170 may be disposed intermediate the upper portion 146*e* and the lower portion 148*e*. More particularly, a first end of the first plate 170 is embedded within the midsole 36*e* between the upper portion 146*e* and the first segment 152*e*, and a second end of the first plate 170 is embedded within the midsole 36*e* between the upper portion 146*e* and the second segment 154*e*. An intermediate portion of the first plate 170 is disposed between the upper portion 146*e* and the cushioning arrangement 40*e*, whereby a ground-facing surface 158*e* of the first plate 170 is exposed within the gap 156*e* formed intermediate the first segment 152*e* and the second segment 154*e*.

The first plate 170 may be visible at the medial side 22 of the sole structure 14*e* and/or at the lateral side 24 of the sole structure 14*e*. Alternatively, the first plate 170 may be encapsulated within the upper portion 146*e* of the midsole 36*e*. In some examples, the first plate 170 may be disposed between the upper 12 and the midsole 36*e*, whereby the first plate 170 is attached directly to the strobel 48 and/or the upper 12.

As shown, the second plate 172 is spaced apart from the first plate 170, and is disposed generally between the first plate 170 and the outsole 38*e*. A first end 182 of the second plate 172 is joined to the first segment 152*e* of the lower portion 148*e* of the midsole 36*e*, while an opposing second end 184 is joined to the second segment 154*e* of the lower portion 148*e* of the midsole 36*e*. In the illustrated example, the first end 182 of the second plate 172 is embedded within the first segment 152*e*, and the second end 184 is bonded to the top surface 178 of the forefoot-facing sidewall 176 of the second segment 154*e*. Alternatively, the second end 184 of the second plate 172 may be embedded within the second segment 154*e*, or may be joined to the bottom surface 180 of the forefoot-facing sidewall 176. An intermediate portion 186 of the second plate 172 spans the gap 156*e* formed between the first segment 152*e* and the second segment 154*e*, and separates the cushioning arrangement 40*e* into an upper portion and a lower portion, as discussed in greater detail below.

Either one or both of the plates 170, 172 may be so-called "partial-length" plates that extend along only a portion of the sole structure 14*e*. Accordingly, one or both of the plates 170, 172 could extend from an intermediate portion of the forefoot region 16 to an intermediate portion of the heel region 20. While the plates 170, 172 may be partial-length plates, the first plate 170 and/or the second plate 172 could alternatively be full-length plates, as described above, which extend from the anterior end 44 to the posterior end 46 of the sole structure 14*e*.

Regardless of the particular size and location of the first plate 170 and the second plate 172, the first plate 170 and/or the second plate 172 may be formed from a relatively rigid material. For example, the first plate 170 and/or the second plate 172 may be formed from a non-foamed polymer material or, alternatively, from a composite material containing fibers, such as carbon fibers. Forming the first plate 170 and the second plate 172 from a relatively rigid material allows the first plate 170 and the second plate 172 to distribute forces associated with use of the article footwear 10*e* when the article of footwear 10*e* strikes a ground surface, as will be described in greater detail below.

Referring still to FIGS. 30-33, the cushioning arrangement 40*e* is disposed within the gap 156*e* of the midsole 36*e*, and is shown to include a medial cushion or cushioning arrangement 64*e* and a lateral cushion or cushioning arrangement 66*e*. The medial cushioning arrangement 64*e* is disposed proximate to the medial side 22 of the sole structure 14*e* while the lateral cushioning arrangement 66*e* is disposed proximate to the lateral side 24 of the sole structure 14*e*.

Figure 32:
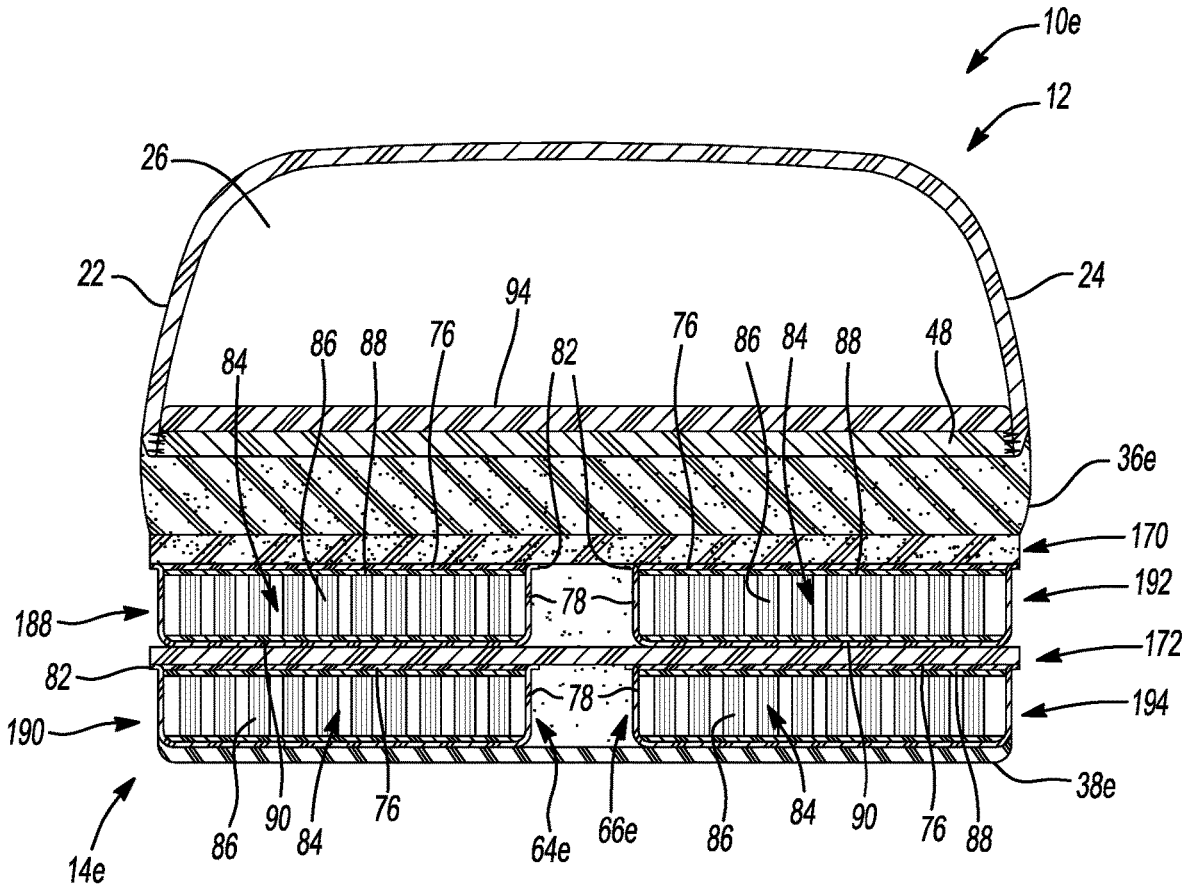
FIG. 32 is a cross-sectional view of the article of footwear of FIG. 30, taken along Line 32-32 of FIG. 30.
Figure 33:
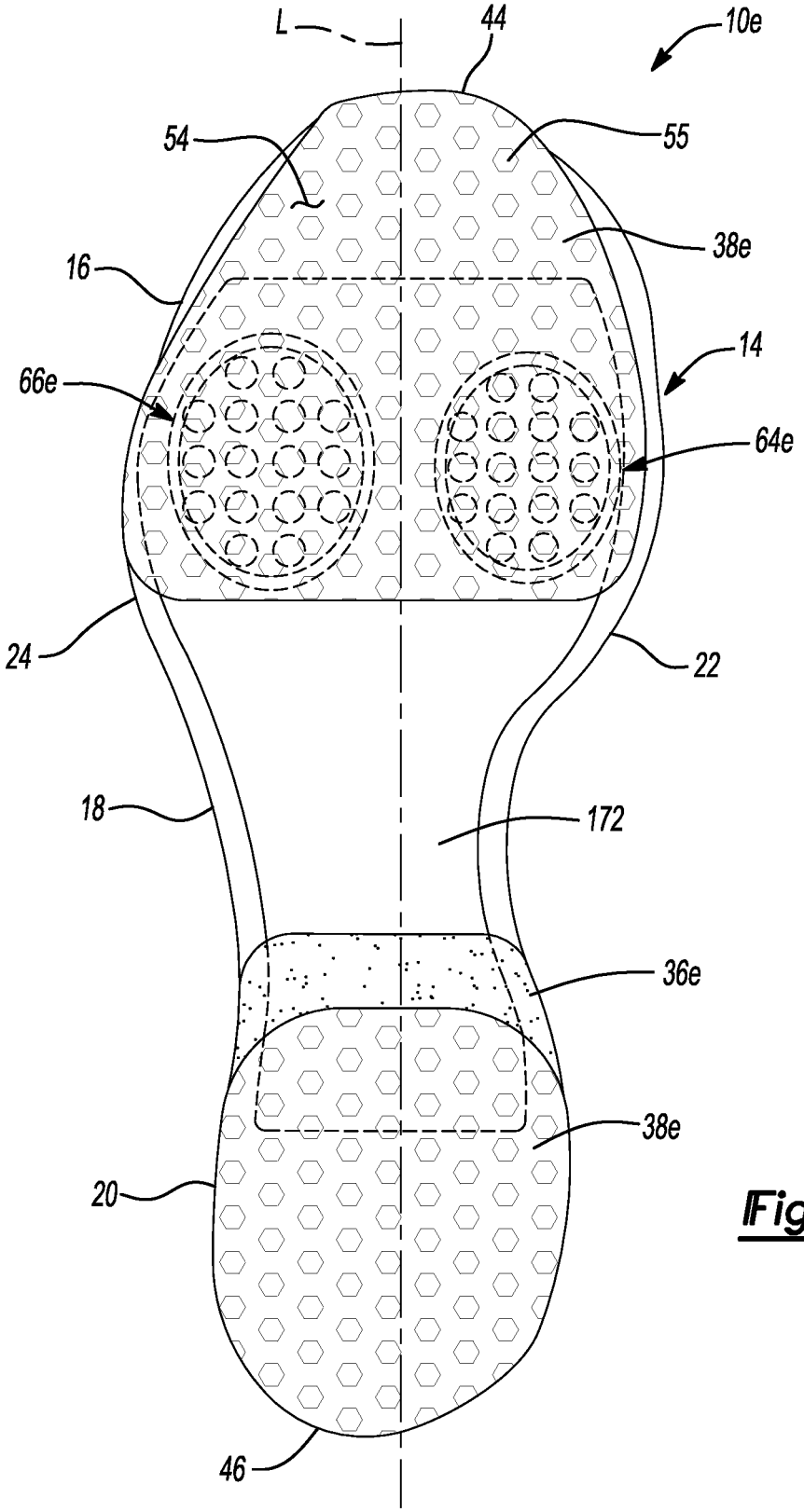
FIG. 33 is a bottom view of the article of footwear of FIG. 30.

As shown in FIGS. 31 and 32, the medial cushioning arrangement 64*e* includes a first fluid-filled chamber 188*e* and a second fluid-filled chamber 190*e*. Similarly, the lateral cushioning arrangement 66*e* includes a third fluid-filled chamber 192*e* and a fourth fluid-filled chamber 194*e*. The first fluid-filled chamber 188*e* and the third fluid-filled chamber 192*e* are disposed generally between the first plate 170 and the second plate 172, while the second fluid-filled chamber 190*e* and the fourth fluid-filled chamber 194*e* are disposed between second plate 172 and the outsole 38*e*. Specifically, the first fluid-filled chamber 188*e* and the third fluid-filled chamber 192*e* are attached to the first plate 170 at respective first sides, and are attached to the second plate 172 at respective second sides. Likewise, the second fluid-filled chamber 190*e* and the fourth fluid-filled chamber 194*e* are attached to the second plate 172 at respective first sides, and are attached to the outsole 38*e* at respective second sides.

With reference to FIGS. 30 and 32, the intermediate portion 186 of the second plate 172 extends through the cushioning arrangement 40*e*. More specifically, the intermediate portion 186 of the second plate 172 is disposed between the first fluid-filled chamber 188*e* and the second fluid-filled chamber 190*e* of the medial cushioning arrangement 64*e*, and between the third fluid-filled chamber 192*e* and the fourth fluid-filled chamber 194*e* of the lateral cushioning arrangement 66*e*. In other words, the first fluid-filled chamber 188*e* and the third fluid-filled chamber 192*e* are disposed above the second plate 172 (i.e., between the second plate 172 and the upper 12), while the second fluid-filled chamber 190*e* and the fourth fluid-filled chamber 194*e* are disposed between the second plate 172 and the outsole 38*e*.

The fluid-filled chambers 188*e*, 190*e*, 192*e*, 194*e* may be attached to the outsole 38*e*, the first plate 170, and/or the second plate 172, respectively, via a suitable adhesive. Additionally or alternatively, the fluid-filled chambers 188*e*, 190*e*, 192*e*, 194*e* may be joined to any one or more of the outsole 38*e*, the first plate 170, and the second plate 172 by melding a material of at least one of the fluid-filled chambers 188*e*, 190*e*, 192*e*, 194*e*, the outsole 38*e*, the first plate 170, and the second plate 172.

The fluid-filled chambers 188*e*, 190*e*, 192*e*, 194*e* may each include a first barrier element 76 and a second barrier element 78. The first barrier element 76 and the second barrier element 78 may be formed from a sheet of thermoplastic polyurethane (TPU). Specifically, the first barrier element 76 may be formed from a sheet of TPU material and may include a substantially planar shape. The second barrier element 78 may likewise be formed from a sheet of TPU material and may be formed into the configuration shown in FIG. 3 to define an interior void 80. The first barrier element 76 may be joined to the second barrier element 78 by applying heat and pressure at a perimeter of the first barrier element 76 and the second barrier element 78 to define a peripheral seam 82. The peripheral seam 82 seals the internal interior void 80, thereby defining a volume of the first fluid-filled chamber 188*e* and the second fluid-filled chamber 190*e*.

The interior void 80 of the first barrier element 76 and the second barrier element 78 may receive a tensile element 84 therein. Each tensile element 84 may include a series of tensile strands 86 extending between an upper tensile sheet 88 and a lower tensile sheet 90. The upper tensile sheet 88 may be attached to the first barrier element 76 while the lower tensile sheet 90 may be attached to the second barrier element 78. In this manner, when the fluid-filled chambers 188*e*, 190*e*, 192*e*, 194*e* receive a pressurized fluid, the tensile strands 86 of the tensile elements 84 are placed in tension. Because the upper tensile sheet 88 is attached to the first barrier element 76 and the lower tensile sheet 90 is attached to the second barrier element 78, the tensile strands 86 retain a desired shape of each of the first fluid-filled chamber 188*e*, the second fluid-filled chamber 190*e*, the third fluid-filled chamber 192*e*, and the fourth fluid-filled chamber 194*e*, respectively, when the pressurized fluid is injected into the interior void 80.

As described, the medial cushioning arrangement 64*e* and the lateral cushioning arrangement 66*e* each include a pair of fluid-filled chambers 188*e*, 190*e*, 192*e*, 194*e* that are received generally between the upper 12 and the outsole 38*e*. In one configuration, the first fluid-filled chamber 188*e* and the third fluid-filled chamber 192*e* are fluidly respectively isolated from the second fluid-filled chamber and the fourth fluid-filled chamber 194*e* by the second plate 172.

In some configurations, the medial cushioning arrangement 64*e* (i.e., the first fluid-filled chamber 188*e* and the second fluid-filled chamber 190*e*) is fluidly isolated from the lateral cushioning arrangement 66*e* (i.e., the third fluid-filled chamber 192*e* and the fourth fluid-filled chamber 194*e*). While the medial cushioning arrangement 64*e* is described and shown as being spaced apart from the lateral cushioning arrangement 66*e*, the cushioning arrangements 64*e*, 66*e* could alternatively be in contact with one another while still being fluidly isolated.

While the medial cushioning arrangement 64*e* and the lateral cushioning arrangement 66*e* are described and shown as including stacked pairs of fluid-filled chambers, the medial cushioning arrangement 64*e* and the lateral cushioning arrangement 66*e* could alternatively include other cushioning elements. For example, the medial cushioning arrangement 64*e* and the lateral cushioning arrangement 66*e* may each include a foam block (see e.g., 92 in FIGS. 4-6) that replaces any one or more of the fluid-filled chambers 188*e*, 190*e*, 192*e*, 194*e*. The foam blocks may be received within the interior void 80 defined by the first barrier element 76 and the second barrier element 78. Positioning the foam blocks within the interior void 80 defined by the first barrier element 76 and the second barrier element 78 allows the barrier elements 76, 78 to restrict expansion of the foam blocks beyond a predetermined amount when subjected to a predetermined load. Accordingly, the overall shape and, thus, the performance of the foam blocks may be controlled by allowing the foam blocks to interact with the barrier elements 76, 78 during loading. While the foam blocks are described as being received within the interior void 80 of the barrier elements 76, 78, the foam blocks could alternatively be positioned within the cushioning arrangement 40*e* absent the barrier elements 76, 78. In such a configuration, the foam blocks would be directly attached to any one or more of the outsole 38*e*, the first plate 170, the second plate 172, and/or one of the fluid-filled chambers 188*e*, 190*e*, 192*e*, 194*e*, respectively. The particular construction of the medial cushioning arrangement 64*e* and the lateral cushioning arrangement 66*e* (i.e., use of foam blocks, fluid-filled chambers, or a combination thereof) may be dictated by the amount of cushioning required at the medial side 22 and the lateral side 24.

Regardless of the particular construction of the medial cushioning arrangement 64*e* and the lateral cushioning arrangement 66*e*, the medial cushioning arrangement 64*e* and the lateral cushioning arrangement 66*e* may be substantially aligned with each other along a direction extending between the medial side 22 and the lateral side 24 of the sole structure 14*e*. Alternatively, the medial cushioning arrangement 64*e* and the lateral cushioning arrangement 66*e* may be offset from each other.

As described, the medial cushioning arrangement 64*e* and the lateral cushioning arrangement 66*e* each provide a pair of stacked cushioning elements disposed at discrete locations on the sole structure 14*e*. In one configuration, the medial cushioning arrangement 64*e* and the lateral cushioning arrangement 66*e* each provide a pair of stacked, fluid-filled chambers (i.e. elements 188*e*, 190*e*, 192*e*, 194*e*) that cooperate to provide cushioning at the medial side 22 and the lateral side 24, respectively. The individual fluid-filled chambers 188*e*, 190*e*, 192*e*, 194*e* may include the same volume and, further, may be at the same pressure. Alternatively, the volumes and the pressures of the various fluid-filled chambers 188*e*, 190*e*, 192*e*, 194*e* may vary between the cushioning arrangements 64*e*, 66*e* and/or within each cushioning arrangement 64*e*, 66*e*). For example, the first fluid-filled chamber 188*e* may include the same pressure as the second fluid-filled chamber 190*e* or, alternatively, the first fluid-filled chamber 188*e* may include a different pressure than the second fluid-filled chamber 190*e*. Likewise, the third fluid-filled chamber 192*e* may include the same or different pressure than the fourth fluid-filled chamber 194*e*, and may include a different pressure than the first fluid-filled chamber 188*e* and/or the second fluid-filled chamber 190*e*. The fluid-filled chambers 188*e*, 190*e*, 192*e*, 194*e* may be at a pressure within a range of 15-30 psi and preferably at a pressure within a range of 20-25 psi.

As shown in FIG. 30, the outsole 38*e* is joined to the midsole 36*e* and the cushioning arrangement 40*e*. More specifically, the outsole 38*e* is fragmentary, whereby a first portion of the outsole 38*e* is joined to the first segment 152*e* of the midsole 36*e* and the cushioning arrangement 40*e*, and a separately formed second portion of the outsole 38*e* is joined to the second segment 154*e* of the midsole 36*j*. Alternatively, the outsole 38*e* may be continuously formed, and extend from the anterior end 44 to the posterior end 46.

The outsole 38*e* may be formed from a resilient material such as, for example, rubber that provides the article of footwear 10*e* with a ground-engaging surface 54 that provides traction and durability. As described above, the ground-engaging surface 54 may include traction elements 120 to enhance engagement of the sole structure 14*e* with a ground surface.

During operation, when the ground-engaging surface 54 contacts the ground, a force is transmitted via the outsole 38*e* to the medial cushioning arrangement 64*e* and the lateral cushioning arrangement 66*e*. Namely, the force is transmitted to the second plate 172 through the second fluid-filled chamber 190*e* and the fourth fluid-filled chamber 194*e*, through the second plate 172 to the first fluid-filled chamber 188*e* and the third fluid-filled chamber 192*e*, and to the first plate 170 through the first fluid-filled chamber 188*e* and the third fluid-filled chamber 192*e*. The applied force causes the individual fluid-filled chambers 188*e*, 190*e*, 192*e*, 194*e* to compress, thereby absorbing the forces associated with the outsole 38*e* contacting the ground. The force is transmitted to the midsole 36*e* via the first plate 170 and the second plate 172, but is not experienced by the user as a point or localized load. Namely, and as described above, the first plate 170 and the second plate 172 are described as being formed from a rigid material. Accordingly, even though the medial cushioning arrangement 64*e* and the lateral cushioning arrangement 66*e* are located at discrete locations along the sole structure 14*e*, the forces exerted on the first plate 170 and the second plate 172 by the medial cushioning arrangement 64*e* and the lateral cushioning arrangement 66*e* are dissipated over a length of the midsole 36*e* such that neither applied force is applied at individual, discrete locations to a user's foot. Rather, the forces applied at the locations of the medial cushioning arrangement 64*e* and the lateral cushioning arrangement 66*e* are dissipated along a length of the first plate 170 and the second plate 172 due to the rigidity of the plates 170, 172 and, as such, point loads are not experienced by the user's foot when the foot is in contact with an insole 94 disposed within the interior void 26. Furthermore, by extending the second plate 172 between the first fluid-filled chamber 188*e* and the second fluid-filled chamber 190*e* of the medial cushioning arrangement 64*e* and between the third fluid-filled chamber 192*e* and the fourth fluid-filled chamber 194*e* of the lateral cushioning arrangement 66*e*, additional stability is provided to the cushioning arrangement 40*e* by distributing the applied force between the cushioning arrangements 64*e*, 66*e*, the first segment 152*e*, and the second segment 154*e*.

With particular reference to FIGS. 34-37, an article of footwear 10*f* is provided and includes an upper 12 and a sole structure 14*f* attached to the upper 12. In view of the substantial similarity in structure and function of the components associated with the article of footwear 10, with respect to the article of footwear 10*f*, like reference numerals are used hereinafter and in the drawings to identify like components, while like reference numerals containing letter extensions are used to identify those components that have been modified.

Figure 34:
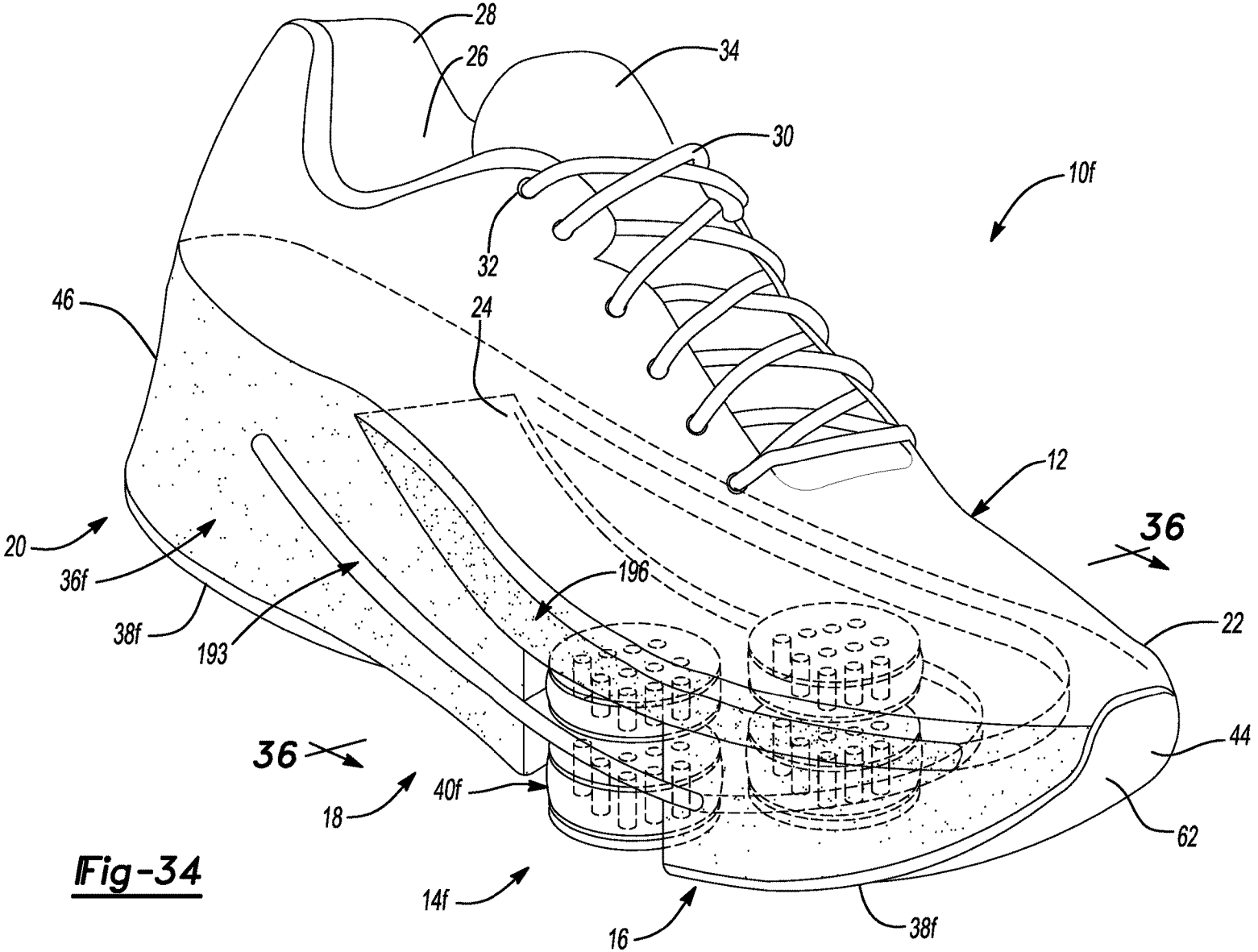
FIG. 34 is a perspective view of an article of footwear incorporating a sole structure in accordance with the principles of the present disclosure.
Figure 35:
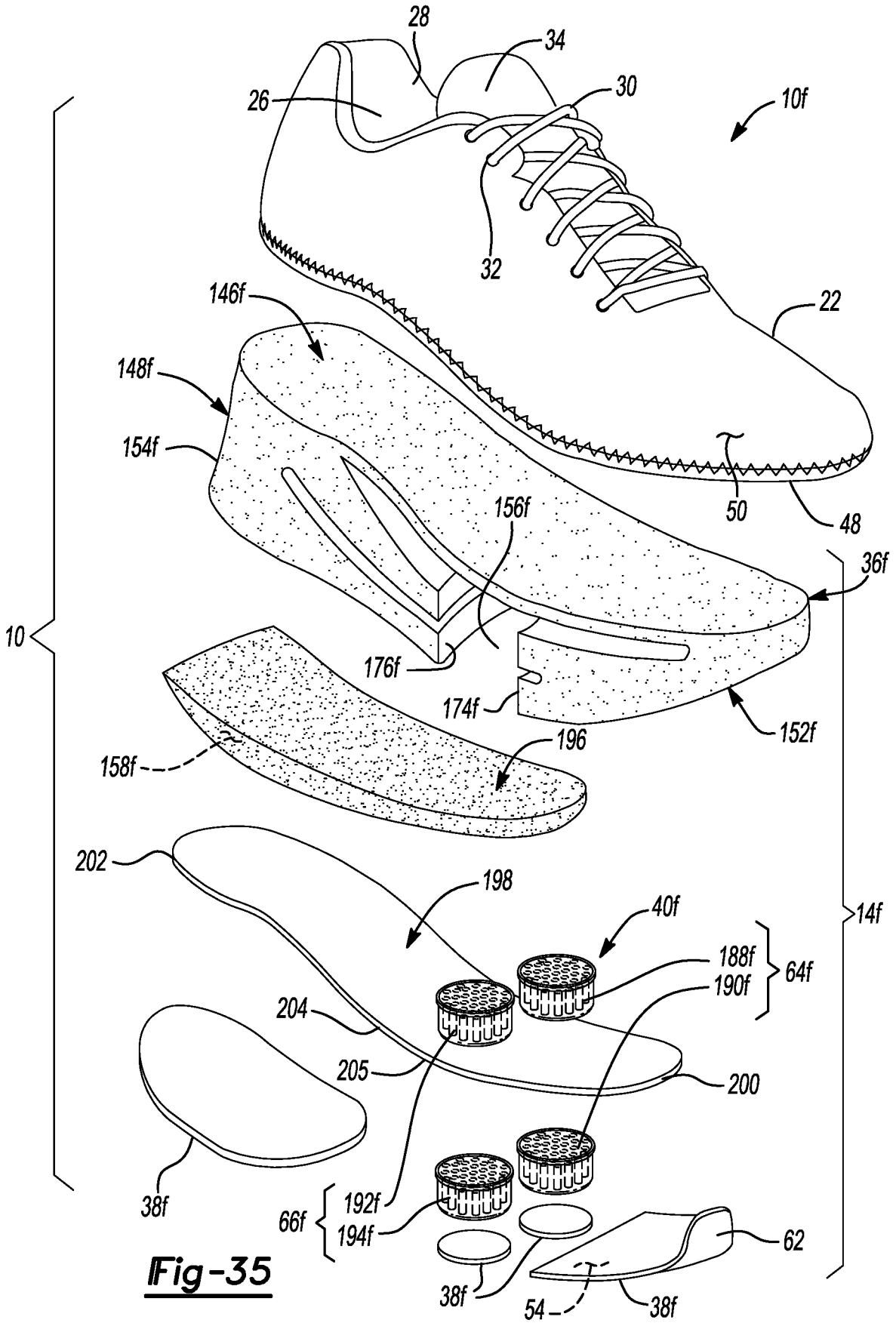
FIG. 35 is an exploded view of the article of footwear of FIG. 34.
Figure 36:
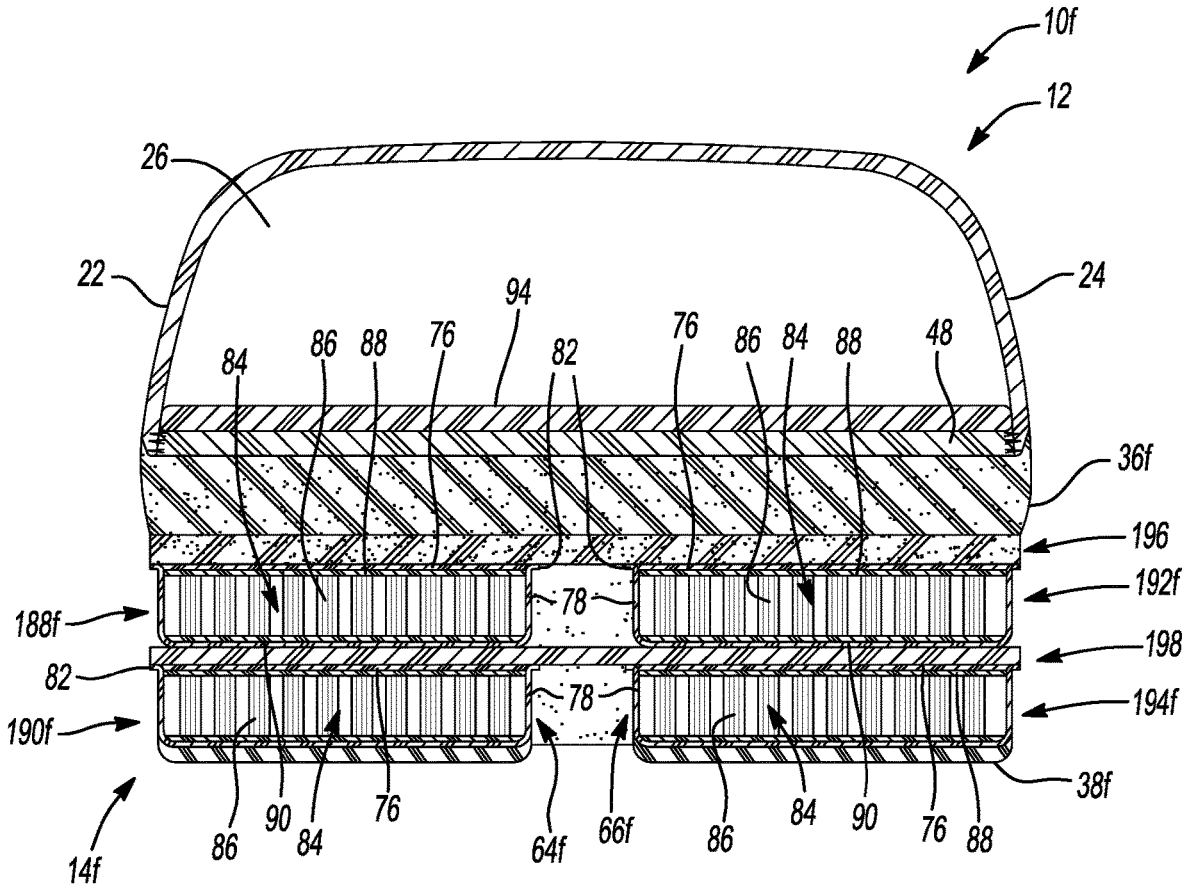
FIG. 36 is a cross-sectional view of the article of footwear of FIG. 34, taken along Line 36-36 of FIG. 34.

With continued reference to FIGS. 34-37, the sole structure 14*f* is shown to include a midsole 36*f*, an outsole 38*f*, a cushion or cushioning arrangement 40*f* disposed between the midsole 36*f* and the outsole 38*f* In addition, the sole structure 14*f* may include a first plate 196 and a second plate 198 that extend from the forefoot region 16 of the article of footwear 10*f* towards the posterior end 46. As shown in FIG. 34, the first plate 196 is disposed intermediate the midsole 36*f* and the cushioning arrangement 40*f*, while the second plate 198 is disposed within the midsole 36*f* and separates the cushioning arrangement 40*f* into an upper portion and a lower portion.

Figure 37:
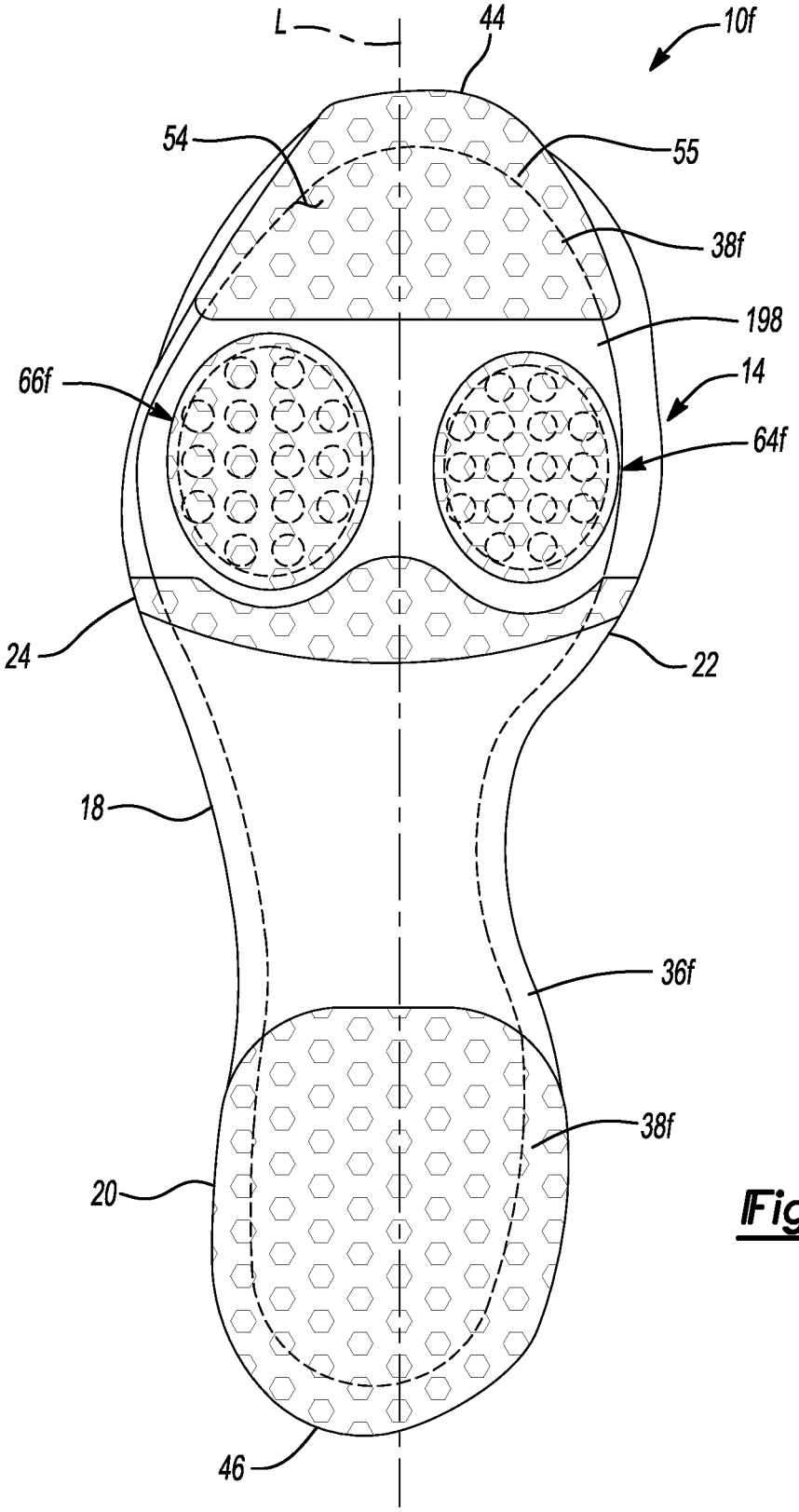
FIG. 37 is a bottom view of the article of footwear of FIG. 34.

The midsole 36*f* may be formed in a similar manner to the midsole 36*e* associated with the article of footwear 10*e* above, in that the midsole 36*f* includes a continuously formed upper portion 146*f* and a segmented lower portion 148*f* However, the segmented lower portion 148*f* of the midsole 36*f* of FIGS. 34-37 may include a different configuration. As shown in FIG. 34, the lower portion 148*f* of the midsole 36*f* includes a first segment 152*f* extending downwardly from the forefoot region 16 of the upper portion 146*f*, and a second segment 154*f* extending downwardly from the heel region 20 of the upper portion 146*f*. A heel-facing sidewall 174*f* of the first segment 152*f* is spaced apart from a forefoot-facing sidewall 176*f* of the second segment 154*f* to define a gap 156*f* between the first segment 152*f* and the second segment 154*f*, in which the cushioning arrangement 40*f* may be received. Further, the sidewalls 174*f*, 176*f* may be adjacent to and evenly spaced from the cushioning arrangement 40*f*. At least one of the sidewalls 174*f*, 176*f* may include a complimentary shape to an outer perimeter of the cushioning arrangement 40*f* (FIG. 37).

While the midsole 36*f* is shown and described as having the upper portion 146*f* integrally formed with the first segment 152*f* and the second segment 154*f*, one or both of the first segment 152*f* and the second segment 154*f* could be formed separately from the upper portion 146*f*. For example, the upper portion 146*f* could be separate and distinct from both of the first segment 152*f* and the second segment 154*f* such that the upper portion 146*f* is spaced apart and separated from the first segment 152*f* and the second segment 154*f* by the second plate 198. In this configuration, the upper portion 146*f* would be disposed on an opposite side of the second plate 198 than both of the first segment 152*f* and the second segment 154*f* and wouldn't be in contact with either segment 152*f*, 154*f*.

As with the midsole 36 described above with respect to the article of footwear 10, the midsole 36*f* may be formed from an energy absorbing material such as, for example, polymer foam.

The first plate 196 is disposed between the upper portion 146*f* and each of the lower portion 148*f* and the cushioning arrangement 40*f*. More specifically, a first end of the first plate 196 is disposed between the upper portion 146*f* and the first segment 152*f*, and an opposing second end of the first plate 196 is disposed between the upper portion 146*f* and the second segment 154*f*. An intermediate portion is disposed between the upper portion 146*f* and the cushioning arrangement 40*f*, whereby a ground-facing surface 158*f* of the first plate 196 is exposed within the gap 156*f* formed intermediate the first segment 152*f* and the second segment 154*f*.

The first plate 196 may be visible at the medial side 22 of the sole structure 14*f* and/or at the lateral side 24 of the sole structure 14*f*. While the first plate 196 is described and shown as being embedded within the material of the midsole 36*f*, the first plate 196 may be disposed between the upper 12 and the midsole 36*f*, whereby the first plate 196 is attached directly to the strobel 48 and/or the upper 12. The first plate 196 may be a partial-length plate or a full-length plate, as discussed above with respect to the article of footwear 10.

As shown, the second plate 198 is spaced apart from the first plate 196, and is disposed between the first plate 196 and the outsole 38*f*. The second plate 198 is joined to each of the first segment 152*f* and the second segment 154*f*, and extends through the cushioning arrangement 40*f*. More specifically, a first end 200 of the second plate 198 is embedded within the first segment 152*f* and an opposing second end 202 is embedded within the second segment 154*f* Accordingly, an intermediate portion 204 of the second plate 198 spans the gap 156*f* formed between the first segment 152*f* and the second segment 154*f*, and separates the cushioning arrangement 40*f* into an upper portion and a lower portion, as discussed further below.

An anterior-most point of the first end 200 of the second plate 198 is disposed in the forefoot region 16 of the sole structure 14*f*, while a posterior-most point of the second end 202 is disposed closer to the heel region 20 of the sole structure 14*f* than the anterior-most point. The intermediate portion 204 comprises a concave portion 205 extending between the anterior-most point and the posterior-most point. The concave portion 205 includes a constant radius of curvature from the anterior-most point to a metatarsophalangeal (MTP) point of the sole structure 14*f* that opposes an MTP joint of a foot during use. One example of the second plate 198 is provided in U.S. application Ser. No. 15/248,051 and U.S. application Ser. No. 15/248,059, which are hereby incorporated by reference in their entireties.

The first plate 196 and the second plate 198 may be formed from a non-foamed polymer material or, alternatively, from a composite material containing fibers such as carbon fibers. Forming the first plate 196 and the second plate 198 from a relatively rigid material allows the first plate 196 to distribute forces associated with use of the article footwear 10*f* when the article of footwear 10*f* strikes a ground surface, as will be described in greater detail below.

With continued reference to FIGS. 34-37, the cushioning arrangement 40*f* of the article of footwear 10*f* is the same as the cushioning arrangement 40*f* described above with respect to the article of footwear 10*e*. Accordingly, the cushioning arrangement 40*f* may include the medial cushioning arrangement 64*f* comprising the first fluid-filled chamber 188*f* and the second fluid-filled chamber 190*f* in a stacked arrangement, and the lateral cushioning arrangement 66*f* comprising the third fluid-filled chamber 192*f* and the fourth fluid-filled chamber 192*f* in a stacked arrangement.

As introduced above, the intermediate portion 204 of the second plate 198 extends through and separates the cushioning arrangement 40*f*, similar to the intermediate portion 186 of the second plate 172 discussed above with respect to the article of footwear 10*e*.

As shown in FIG. 34, the outsole 38*f* is joined to the midsole 36*f* and the cushioning arrangement 40*f* More specifically, the outsole 38*f* is fragmentary, whereby portions of the outsole 38*f* are separately formed from each other, and are joined to each of the first segment 152*f*, the second segment 154*f*, the medial cushioning arrangement 64*f*, and the lateral cushioning arrangement 66*f*.

During operation, when the ground-engaging surface 54 contacts the ground, a force is transmitted via the outsole 38*f* to the medial cushioning arrangement 64*f* and the lateral cushioning arrangement 66*f* Namely, the force is transmitted to the second plate 198 through the second fluid-filled chamber 190*f* and the fourth fluid-filled chamber 194*f*, through the second plate 198 to the first fluid-filled chamber 188*f* and the third fluid-filled chamber 192*f*, and to the first plate 196 through the first fluid-filled chamber 188*f* and the third fluid-filled chamber 192*f*. The applied force causes the individual fluid-filled chambers 188*f*, 190*f*, 192*f*, 194*f* to compress, thereby absorbing the forces associated with the outsole 38*f* contacting the ground. The force is transmitted to the midsole 36*f* via the first plate 196 and the second plate 196, but is not experienced by the user as a point or localized load. Namely, and as described above, the first plate 196 and the second plate 198 are described as being formed from a rigid material. Accordingly, even though the medial cushioning arrangement 64*f* and the lateral cushioning arrangement 66*f* are located at discrete locations along the sole structure 14*f*, the forces exerted on the first plate 196 and the second plate 198 by the medial cushioning arrangement 64*f* and the lateral cushioning arrangement 66*f* are dissipated over a length of the midsole 36*f* such that neither applied force is applied at individual, discrete locations to a user's foot. Rather, the forces applied at the locations of the medial cushioning arrangement 64*f* and the lateral cushioning arrangement 66*f* are dissipated along a length of the first plate 196 and the second plate 198 due to the rigidity of the plates 196, 198 and, as such, point loads are not experienced by the user's foot when the foot is in contact with an insole 94 disposed within the interior void 26. Furthermore, by extending the second plate 196 between the first fluid-filled chamber 188*f* and the second fluid-filled chamber 190*f* of the medial cushioning arrangement 64*f* and between the third fluid-filled chamber 192*f* and the fourth fluid-filled chamber 194*f* of the lateral cushioning arrangement 66*f*, additional stability is provided to the cushioning arrangement 40*f* by distributing the applied force between the cushioning arrangements 64*f*, 66*f*, the first segment 152*f*, and the second segment 154*f*.

With particular reference to FIGS. 38-41, an article of footwear 10*g* is provided and includes an upper 12 and a sole structure 14*g* attached to the upper 12. In view of the substantial similarity in structure and function of the components associated with the article of footwear 10, with respect to the article of footwear 10*g*, like reference numerals are used hereinafter and in the drawings to identify like components while like reference numerals containing letter extensions are used to identify those components that have been modified.

With continued reference to FIGS. 38-41, the sole structure 14*g* is shown to include a midsole 36*g*, an outsole 38*g*, and a cushion or cushioning arrangement 40*g* disposed between the midsole 36*g* and the outsole 38*g*, a first plate 206 disposed between the midsole 36*g* and the cushioning arrangement 40*g*, and a second plate 208 disposed between the cushioning arrangement 40*g* and the outsole 38*g*.

The midsole 36*g* may be formed in a similar manner to the midsole 36*e* associated with the article of footwear 10*e* above, in that the midsole 36*g* includes a continuously formed upper portion 146*g* and a segmented lower portion 148*g*. The lower portion 148*g* of the midsole 36*g* may include a first segment 152*g* extending downwardly from the forefoot region 16 of the upper portion 146*g*, and a second segment 154*g* extending downwardly from the heel region 20 of the upper portion 146*g*. A heel-facing sidewall 174*g* of the first segment 152*g* is spaced apart from a forefoot-facing sidewall 176*g* of the second segment 154*g* to define a gap 156*g* between the first segment 152*g* and the second segment 154*g*. A thickness of the second segment 154*g* may be tapered, whereby the forefoot-facing sidewall 176*g* converges with the upper portion 146*g* in a direction from the heel region 20 to the forefoot region 16.

The first plate 206 is disposed between the upper portion 146*g* and each of the lower portion 148*g* and the cushioning arrangement 40*g*. More specifically, a first end of the first plate 206 is disposed between the upper portion 146*g* and the first segment 152*g*, an opposing second end of the first plate 206 is disposed between the upper portion 146*g* and the second segment 154*g*, and an intermediate portion is disposed between the upper portion 146*g* and the cushioning arrangement 40*g*, whereby a ground-facing surface 158*g* of the first plate 206 is exposed within the gap 156*g* formed intermediate the first segment 152*g* and the second segment 154*g*. Alternatively, the first plate 206 could be at least partially encapsulated within the upper portion 146*g* of the midsole 36*g*. Further, the first plate 206 may be visible at the medial side 22 of the sole structure 14*g* and/or at the lateral side 24 of the sole structure 14*g*. While the first plate 206 is described and shown as being partially embedded within the material of the midsole 36*g*, the first plate 206 may be disposed between the upper 12 and the midsole 36*g*, whereby the first plate 206 is attached directly to the strobel 48 and/or the upper 12. The first plate 206 may be a partial-length plate or a full-length plate, as discussed above with respect to the article of footwear 10.

The second plate 208 is spaced apart from the first plate 206 and extends from the first segment 152*g* to the second segment 154*g*. Particularly, the second plate 208 includes a first end 210 joined to the anterior end 44 of the midsole 36*g*, and an opposing second end 212 joined to the forefoot-facing sidewall 176*g* of the second segment 154*g*. The second end 212 may be embedded within the second segment 154*g*. An intermediate portion 214 of the second plate 208 spans the gap 156*g* formed between the first segment 152*g* and the second segment 154*g*, and is disposed between the cushioning arrangement 40*g* and the outsole 38*g*. Further, the intermediate portion 214 of the second plate 208 is curved upward and, more specifically, a ground-facing surface of the intermediate portion 214 is convex. Accordingly, the intermediate portion 214 of the second plate 208 is disposed between the cushioning arrangement 40*g* and the ground when the article of footwear 10*g* is used, as discussed in greater detail below.

With continued reference to FIGS. 38-41, the cushioning arrangement 40*g* of the article of footwear 10*g* is the same as the cushioning arrangement 40*e* described above with respect to the article of footwear 10*e*. Accordingly, the cushioning arrangement 40*g* may include the medial cushioning arrangement 64*g* comprising the first fluid-filled chamber 188*g* and the second fluid-filled chamber 190*g* in a stacked arrangement, and the lateral cushioning arrangement 66*g* comprising the third fluid-filled chamber 192*g* and the fourth fluid-filled chamber 194*g* in a stacked arrangement.

Referring still to FIGS. 38-41, the cushioning arrangement 40*g* is disposed between the first plate 206 and the second plate 208. The first fluid-filled chamber 188*g* and the third fluid-filled chamber 192*g* are attached to the first plate 206 at respective first sides, and are attached to the second fluid-filled chamber 190*g* and the fourth fluid-filled chamber 194*g*, respectively, at respective second sides. Likewise, the second fluid-filled chamber 190*g* and the fourth fluid-filled-chamber 194*g* are attached to the first fluid-filled chamber 188*g* and the third fluid-filled chamber 192*g*, respectively, at respective first sides, and to the second plate 208 at respective second sides.

Figure 38:
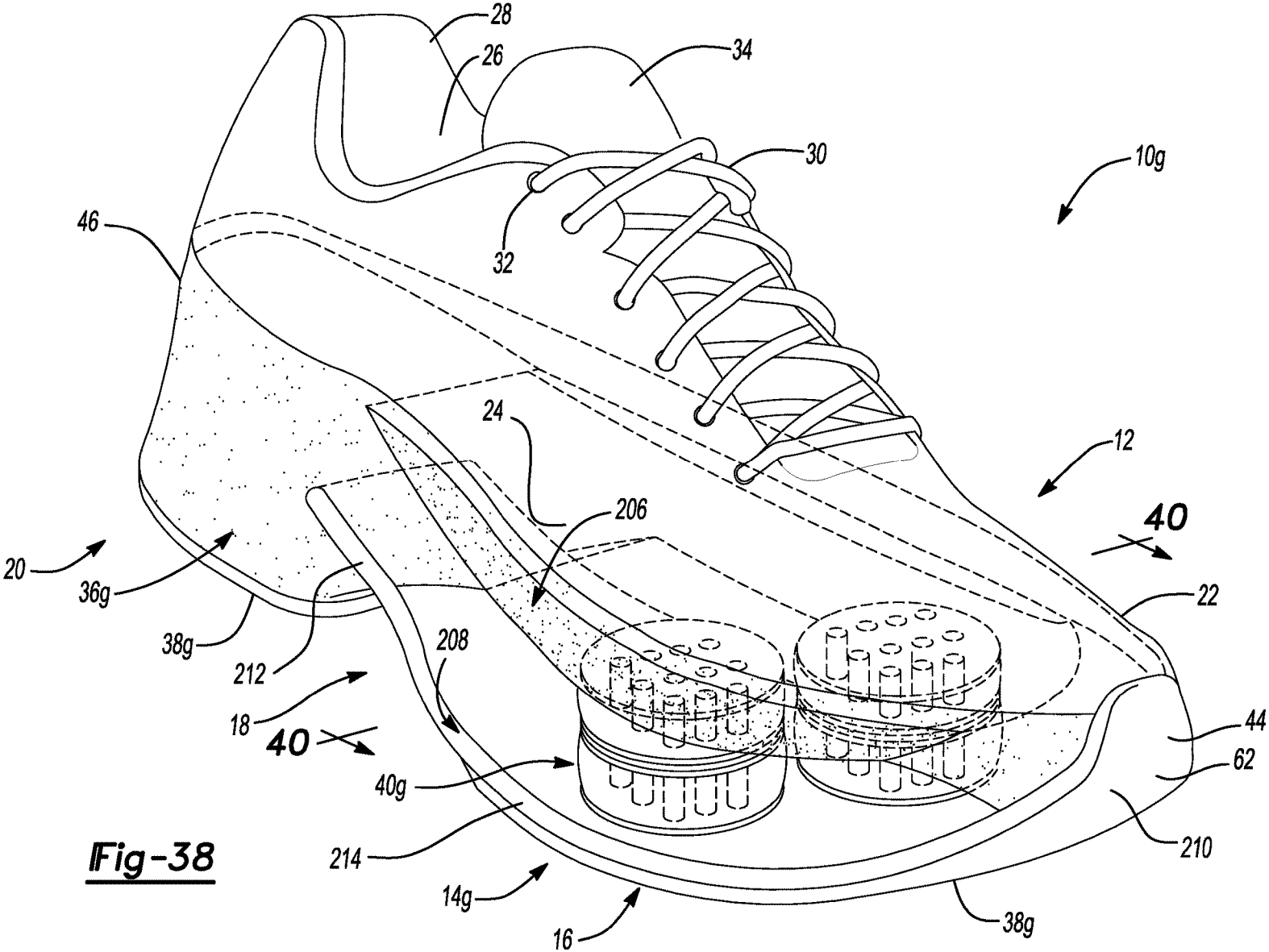
FIG. 38 is a perspective view of an article of footwear incorporating a sole structure in accordance with the principles of the present disclosure.
Figure 39:
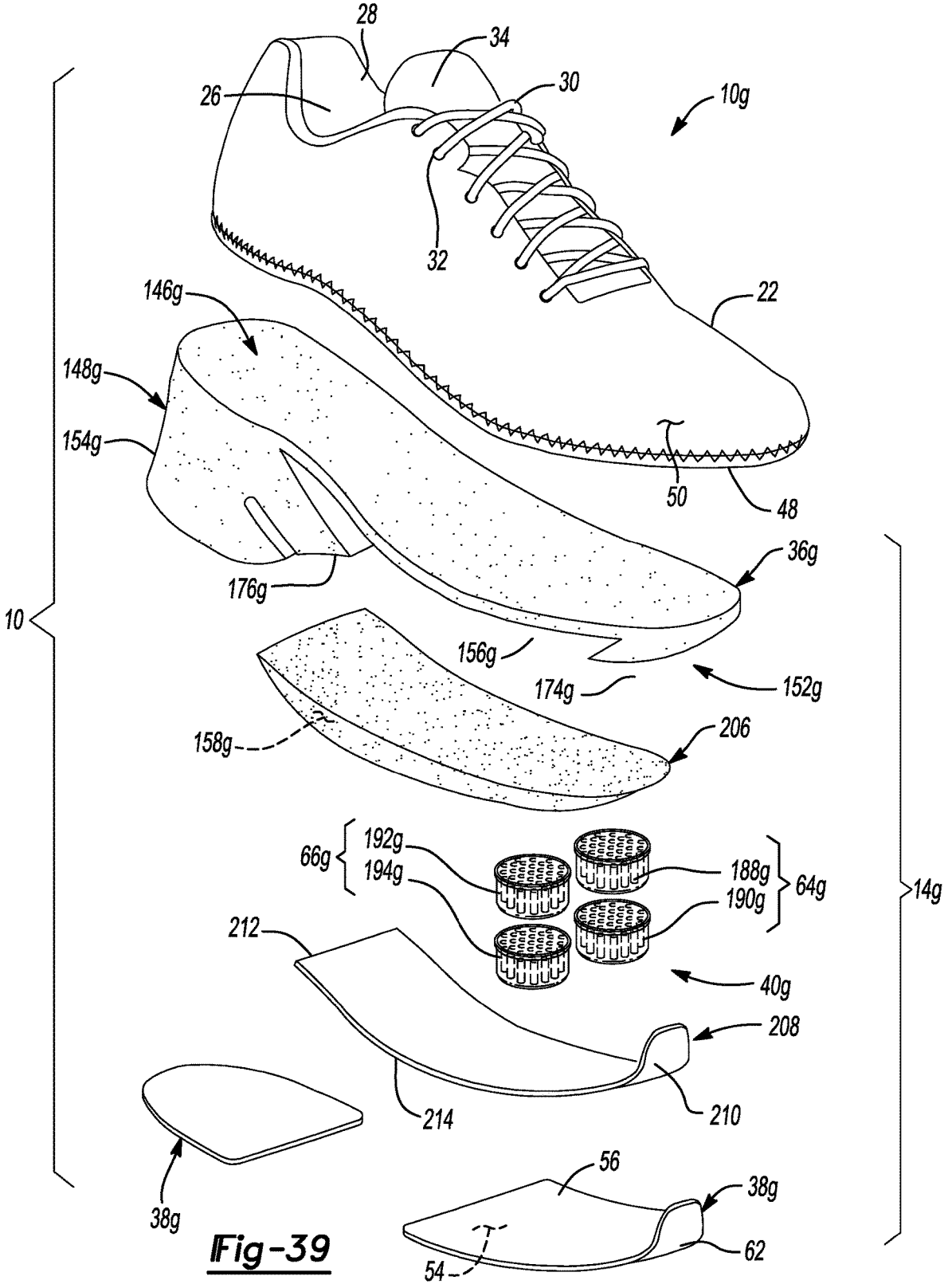
FIG. 39 is an exploded view of the article of footwear of FIG. 38.
Figure 40:
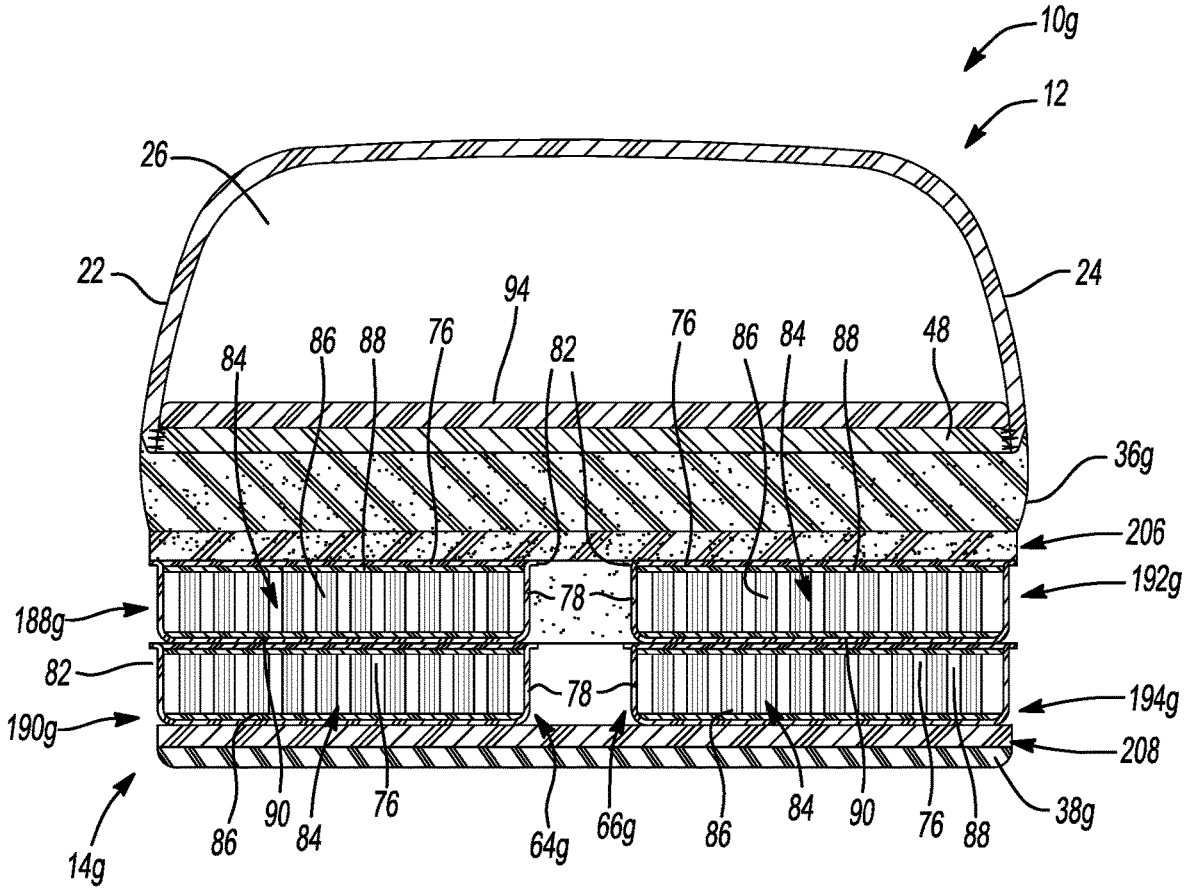
FIG. 40 is a cross-sectional view of the article of footwear of FIG. 38, taken along Line 40-40 of FIG. 38.
Figure 41:
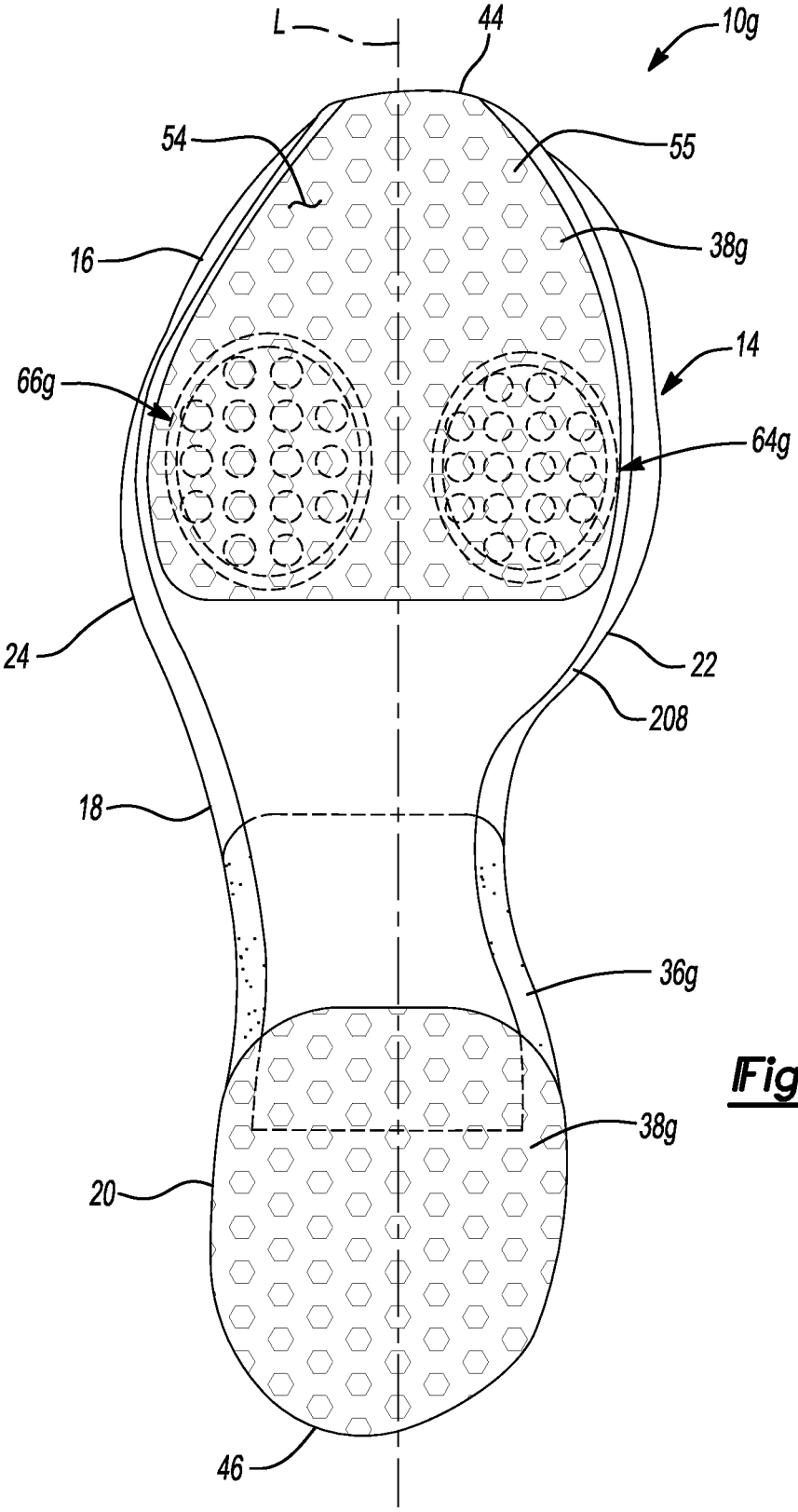
FIG. 41 is a bottom view of the article of footwear of FIG. 38.
Figure 42:
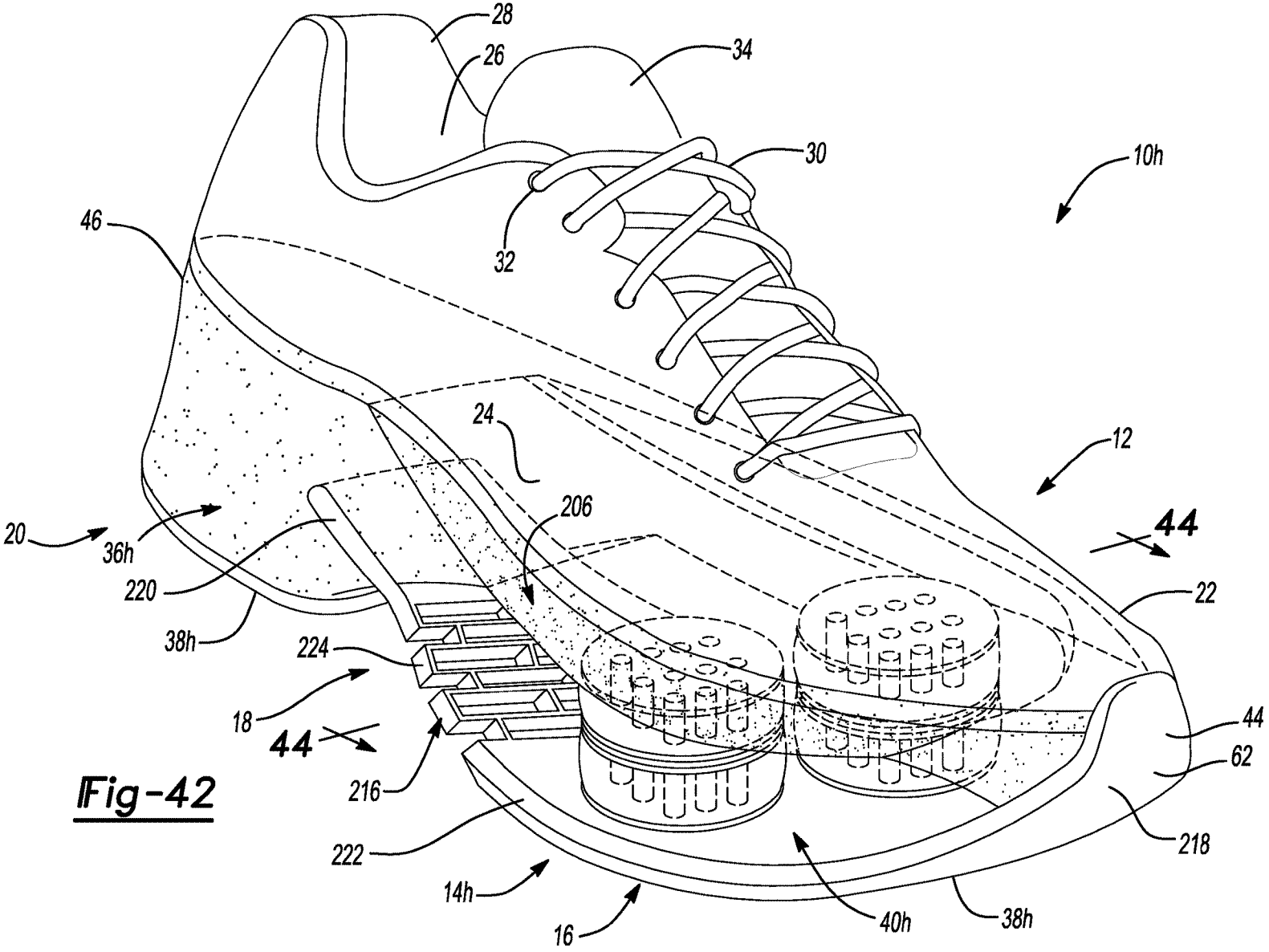
FIG. 42 is a perspective view of an article of footwear incorporating a sole structure in accordance with the principles of the present disclosure.
Figure 43:
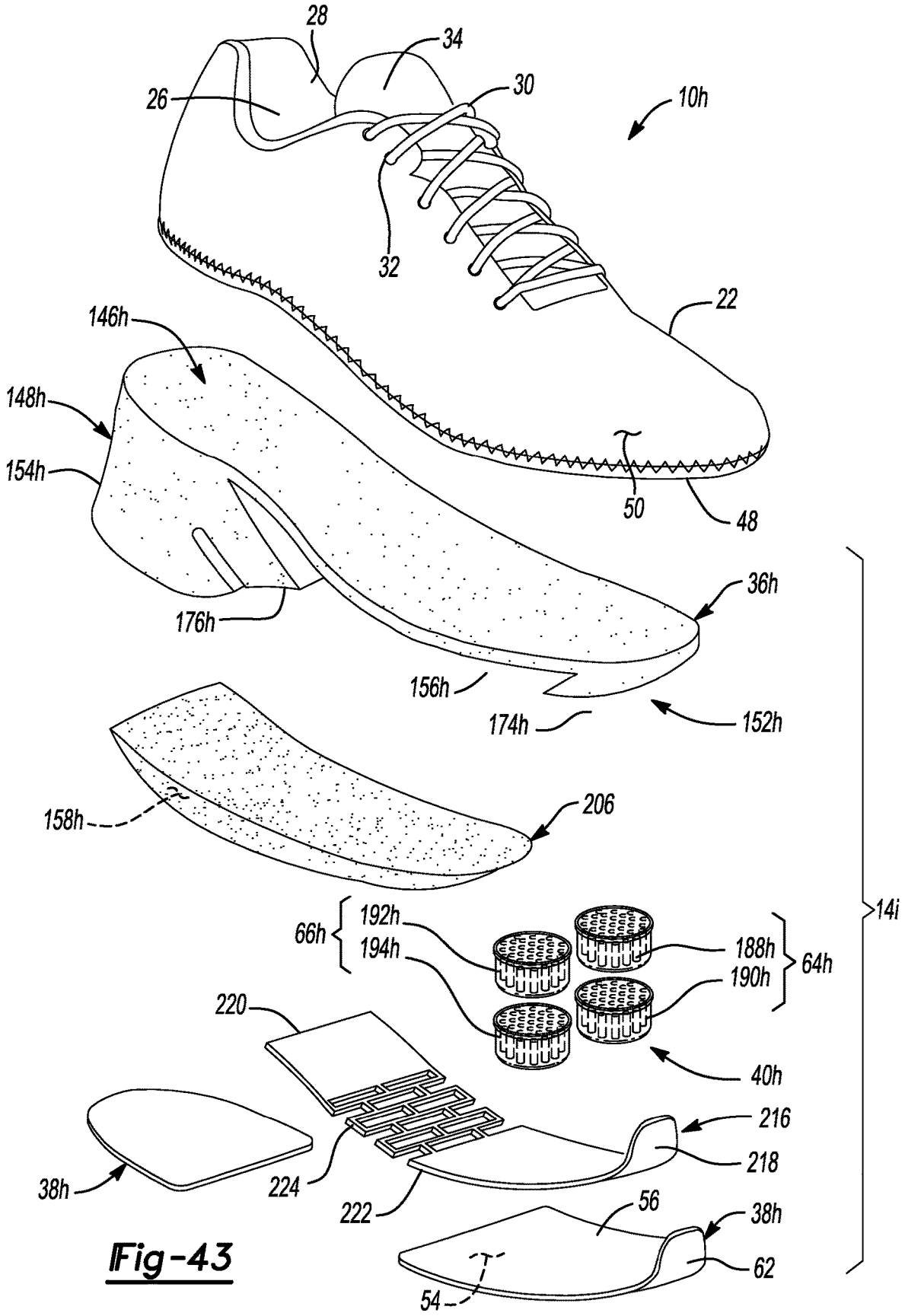
FIG. 43 is an exploded view of the article of footwear of FIG. 42.
Figure 44:
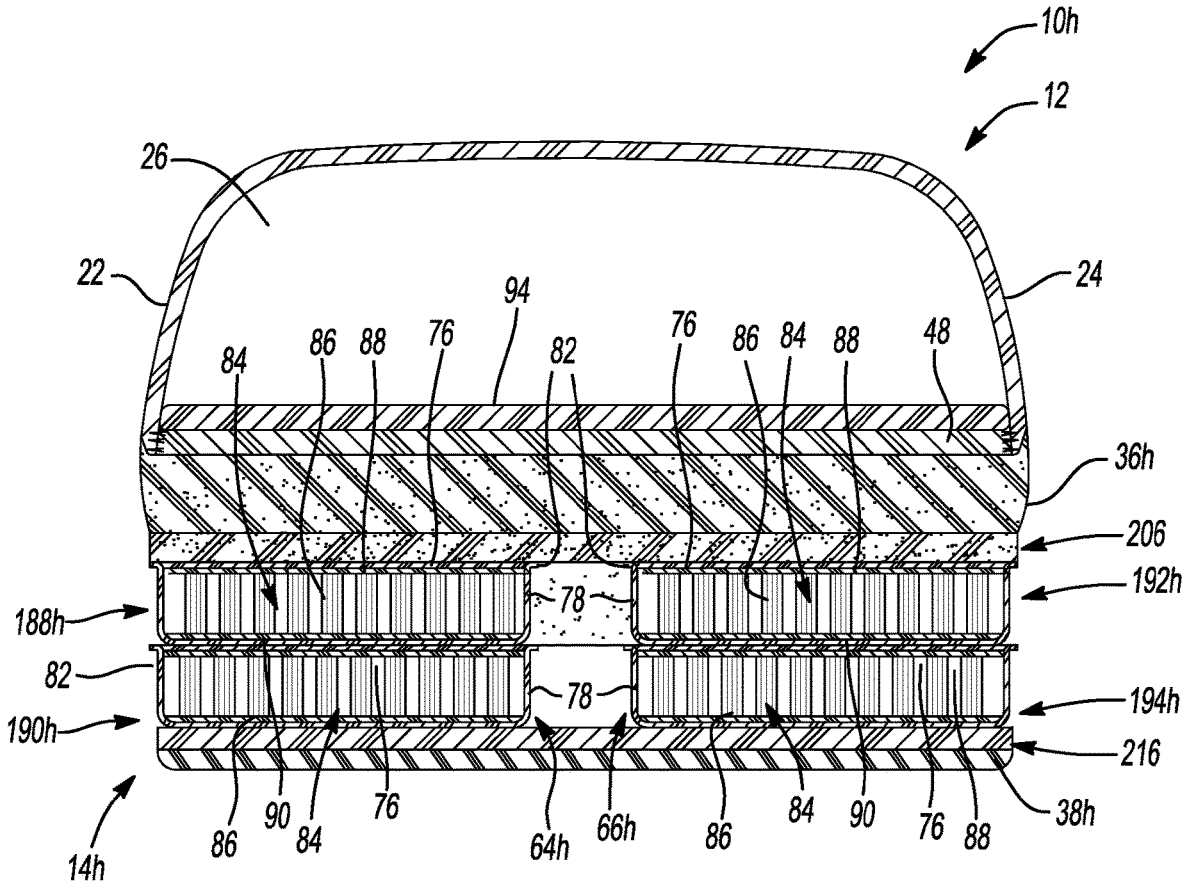
FIG. 44 is a cross-sectional view of the article of footwear of FIG. 42, taken along Line 44-44 of FIG. 42.
Figure 45:
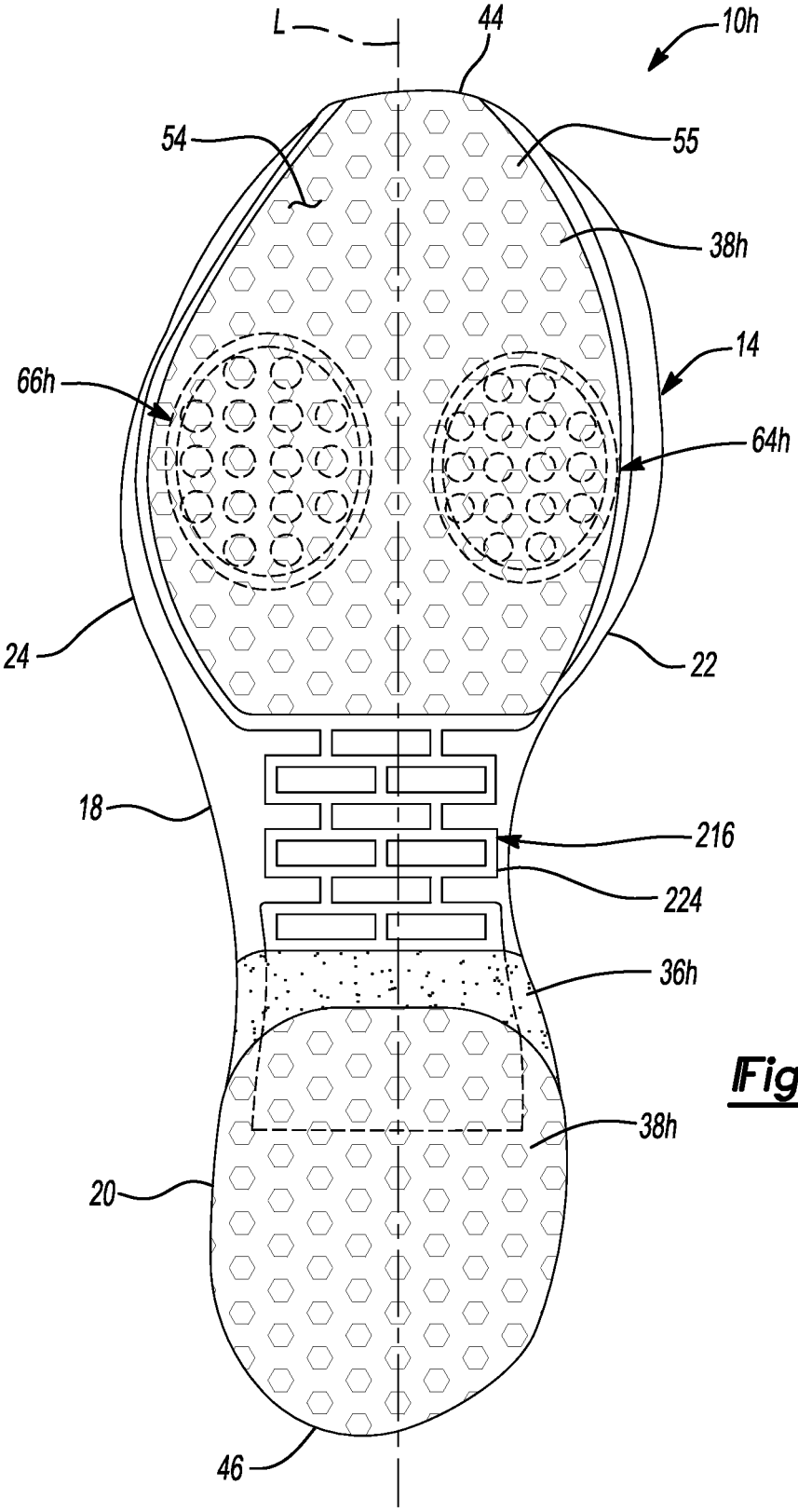
FIG. 45 is a bottom view of the article of footwear of FIG. 42.

As shown in FIG. 38, the outsole 38*g* is joined to the second segment 154*g* of the midsole 36*g* and the second plate 208. More specifically, the outsole 38*g* is fragmentary, whereby portions of the outsole 38*g* are separately formed from each other, and are joined to each of the second segment 154*g* and the second plate 208.

During operation, when the ground-engaging surface 54 contacts the ground, a first bending force is transmitted via the outsole 38*g* to the second plate 208. With the first end 210 and the second end 212 of the second plate 208 fixed to the first segment 152*g* and the second segment 154*g* of the midsole 36*g*, respectively, the first bending force is partially axially transmitted along a length of the second plate 208 to each of the first segment 152*g* and the second segment 154*g*. The first bending force is further transferred to the medial cushioning arrangement 64*g* and the lateral cushioning arrangement 66*g* as a compressive force which, in turn, transfer the compressive force to the first plate 196 as a second bending force. The compressive force causes the individual fluid-filled chambers 188*g*, 190*g*, 192*g*, 194*g* to compress, thereby absorbing the first bending force associated with the outsole 38*g* contacting the ground. The compressive force is then transmitted from the cushioning arrangement 40*g* to the first plate 206. Accordingly, the first bending force is transmitted to the midsole 36*g* by the first plate 206, the second plate 208, and the cushioning arrangement 40*g*, but is not experienced by the user as a point or localized load. Namely, and as described above, the first plate 206 and the second plate 208 are described as being formed from a rigid material. Accordingly, even though the medial cushioning arrangement 64*g* and the lateral cushioning arrangement 66*g* are located at discrete locations along the sole structure 14*g*, the forces exerted on the first plate 206 by the medial cushioning arrangement 64*g* and the lateral cushioning arrangement 66*g* are dissipated over a length of the midsole 36*g* such that the compressive force is not applied at individual, discrete locations to a user's foot. Rather, the forces applied at the locations of the medial cushioning arrangement 64*g* and the lateral cushioning arrangement 66*g* are dissipated along a length of the first plate 206 and the second plate 208 due to the rigidity of the plates 206, 208 and, as such, point loads are not experienced by the user's foot when the foot is in contact with an insole 94 disposed within the interior void 26.

With particular reference to FIGS. 42-45, an article of footwear 10*h* is provided and includes an upper 12 and a sole structure 14*h* attached to the upper 12. In view of the substantial similarity in structure and function of the components associated with the article of footwear 10, with respect to the article of footwear 10*h*, like reference numerals are used hereinafter and in the drawings to identify like components while like reference numerals containing letter extensions are used to identify those components that have been modified.

With continued reference to FIGS. 42-45, the sole structure 14*h* is shown to include a midsole 36*h*, an outsole 38*h*, and a cushion or cushioning arrangement 40*h* disposed between the midsole 36*h* and the outsole 38*h*, a first plate 206 disposed between the midsole 36*h* and the cushioning arrangement 40*h*, and a second plate 216 disposed between the cushioning arrangement 40*h* and the outsole 38*h*.

The midsole 36*h*, the outsole 38*h*, the cushioning arrangement 40*h*, and the first plate 206 are constructed and arranged similar to the respective midsole 36*g*, outsole 38*g*, cushioning arrangement 40*g*, and first plate 206 of the article of footwear 10*g* described above.

The second plate 216 is spaced apart from the first plate 206 and extends from the first segment 152*h* to the second segment 154*h*. Particularly, the second plate 216 includes a first end 218 joined to the anterior end 44 of the midsole 36*h*, and an opposing second end 220 joined to the forefoot-facing sidewall 176*h* of the second segment 154*h*. The second end 220 may be embedded within the second segment 154*h*. An intermediate portion 222 of the second plate 216 spans the gap 156*h* formed between the first segment 152*h* and the second segment 154*h*, and is disposed between the cushioning arrangement 40*h* and the outsole 38*h*. Accordingly, the intermediate portion 222 of the second plate 216 is disposed between the cushioning arrangement 40*h* and the ground when the article of footwear 10*h* is used, as discussed in greater detail below.

The intermediate portion 222 of the second plate 216 is curved upward and, more specifically, a ground-facing surface of the intermediate portion 222 is convex. Further, the intermediate portion 222 includes a damper 224 integrally formed therein. As shown, the damper 224 is formed in the intermediate portion 222 between the cushioning arrangement 40*h* and the second segment 154*h*. The damper 224 is configured to minimize a transfer of torsional forces from the intermediate portion 222 to the second segment 154*h*, while facilitating the transfer of axial forces from the intermediate portion 222 to the second segment 154*h*. In some examples, the damper 224 is defined by a plurality of sidewalls arranged as integrally-formed, staggered shapes such as, for example, rectangles. In some examples, the damper 224 may have a honeycomb pattern, a wave shape, or other shapes configured to minimize the transfer of torsional force.

During operation, when the ground-engaging surface 54 contacts the ground, a first bending force is transmitted via the outsole 38*h* to the second plate 216. With the first end 218 and the second end 220 of the second plate 216 fixed to the first segment 152*h* and the second segment 154*h* of the midsole 36*h*, respectively, the first bending force is partially distributed through the second plate 216 to each of the first segment 152*h* and the second segment 154*h* as an axial force. As provided above, the damper 224 of the second plate 216 minimizes the transfer of torsional forces to the second segment 154*h*, while facilitating the transfer of the axial force. The first bending force is further transferred to the medial cushion or cushioning arrangement 64*h* and the lateral cushion or cushioning arrangement 66*h* as a compressive force which, in turn, transfer the compressive force to the first plate 196 as a second bending force. The compressive force causes the individual fluid-filled chambers 188*h*, 190*h*, 192*h*, 194*h* to compress, thereby absorbing the first bending force associated with the outsole 38*h* contacting the ground. The compressive force is then transmitted from the cushioning arrangement 40*h* to the first plate 206. Accordingly, the first bending force is transmitted to the midsole 36*h* by the first plate 206, the second plate 216, and the cushioning arrangement 40*h*, but is not experienced by the user as a point or localized load. Namely, and as described above, the first plate 206 and the second plate 216 are described as being formed from a rigid material. Accordingly, even though the medial cushioning arrangement 64*h* and the lateral cushioning arrangement 66*h* are located at discrete locations along the sole structure 14*h*, the forces exerted on the first plate 206 by the medial cushioning arrangement 64*h* and the lateral cushioning arrangement 66*h* are dissipated over a length of the midsole 36*h* such that the compressive force is not applied at individual, discrete locations to a user's foot. Rather, the forces applied at the locations of the medial cushioning arrangement 64*h* and the lateral cushioning arrangement 66*h* are dissipated along a length of the first plate 206 and the second plate 216 due to the rigidity of the plates 206, 208 and, as such, point loads are not experienced by the user's foot when the foot is in contact with an insole 94 disposed within the interior void 26.

With particular reference to FIGS. 46-49, an article of footwear 10*i* is provided and includes an upper 12 and a sole structure 14*i* attached to the upper 12. In view of the substantial similarity in structure and function of the components associated with the article of footwear 10, with respect to the article of footwear 10*i*, like reference numerals are used hereinafter and in the drawings to identify like components while like reference numerals containing letter extensions are used to identify those components that have been modified.

With continued reference to FIGS. 46-49, the sole structure 14*i* is shown to include a midsole 36*i*, an outsole 38*i*, and a cushion or cushioning arrangement 40*i* disposed between the midsole 36*i* and the outsole 38*i*, a first plate 226 disposed generally between the midsole 36*i* and the cushioning arrangement 40*i*, and a second plate 228 disposed generally between the cushioning arrangement 40*i* and the outsole 38*i*.

The midsole 36*i* includes an upper portion 146*i* and a lower portion 148*i*. As shown, the upper portion 146*i* is continuously formed and is joined to the upper 12. The lower portion 148*i* of the midsole 36*i* includes a first segment 152*i* extending downwardly from the forefoot region 16 of the upper portion 146*i*, a second segment 154*i* extending downwardly from the heel region 20 of the upper portion 146*i*, and a rib 230 extending between the first segment 152*i* and the second segment 154*i*. A heel-facing sidewall 174*i* of the first segment 152*i* is spaced apart from a forefoot-facing sidewall 176*i* of the second segment 154*i* to define a gap 156*i* between the first segment 152*i* and the second segment 154*i*. Accordingly, the rib 230 spans the gap 156*i* between the first segment 152*i* and the second segment 154*i*, and laterally bisects the cushioning arrangement 40*i*.

The first plate 226 is disposed between the upper portion 146*i* and each of the lower portion 148*i* and the cushioning arrangement 40*i*. More specifically, a first end of the first plate 226 is disposed between the upper portion 146*i* and the first segment 152*i*, an opposing second end of the first plate 226 is disposed between the upper portion 146*i* and the second segment 154*i*, and an intermediate portion is disposed between the upper portion 146*i* on one side and the cushioning arrangement 40*i* and rib 230 on an opposite side. Alternatively, the first plate 226 could be at least partially encapsulated within the upper portion 146*i* of the midsole 36*i*. Further, the first plate 226 may be visible at the medial side 22 of the sole structure 14*i* and/or at the lateral side 24 of the sole structure 14*i*. While the first plate 226 is described and shown as being embedded within the material of the midsole 36*i*, the first plate 226 may be disposed between the upper 12 and the midsole 36*i*, whereby the first plate 226 is attached directly to the strobel 48 and/or the upper 12. The first plate 226 may be a partial-length plate or a full-length plate, as discussed above with respect to the article of footwear 10.

The second plate 228 is spaced apart from the first plate 226 and extends from the first segment 152*i* to the cushioning arrangement 40*i*. Particularly, the second plate 228 includes a first end 232 joined to the anterior end 44 of the midsole 36*i*, and an opposing second end 234 joined to the cushioning arrangement 40*i*.

With continued reference to FIGS. 46-49, the cushioning arrangement 40*i* of the article of footwear 10*i* is the same as the cushioning arrangement 40*e* described above with respect to the article of footwear 10*e*. Accordingly, the cushioning arrangement 40*i* may include the medial cushion or cushioning arrangement 64*i* comprising the first fluid-filled chamber 188*i* and the second fluid-filled chamber 190*i* in a stacked arrangement, and the lateral cushion or cushioning arrangement 66*i* comprising the third fluid-filled chamber 192*i* and the fourth fluid-filled chamber 194*i* in a stacked arrangement.

Referring still to FIGS. 46-49, the cushioning arrangement 40*i* is disposed between the first plate 226 and the second plate 228. The first fluid-filled chamber 188*i* and the third fluid-filled chamber 192*i* are attached to the first plate 226 at respective first sides, and are attached to the second fluid-filled chamber 190*i* and the fourth fluid-filled chamber 194*i*, respectively, at respective second sides. Likewise, the second fluid-filled chamber 190*i* and the fourth fluid-filled-chamber 194*i* are attached to the first fluid-filled chamber 188*i* and the third fluid-filled chamber 192*i*, respectively, at respective first sides, and to the second plate 228 at respective second sides.

Figure 46:
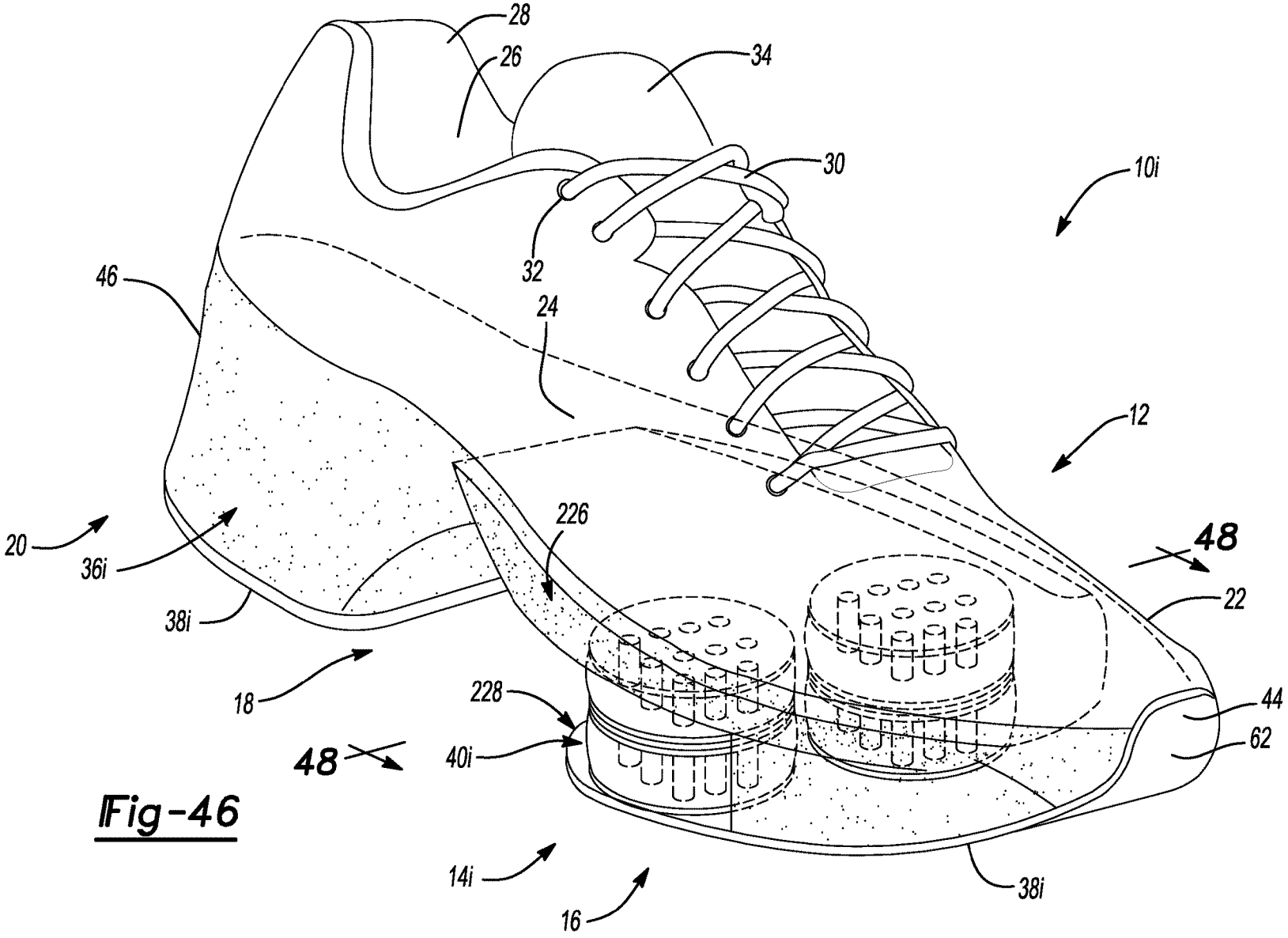
FIG. 46 is a perspective view of an article of footwear incorporating a sole structure in accordance with the principles of the present disclosure.
Figure 47:
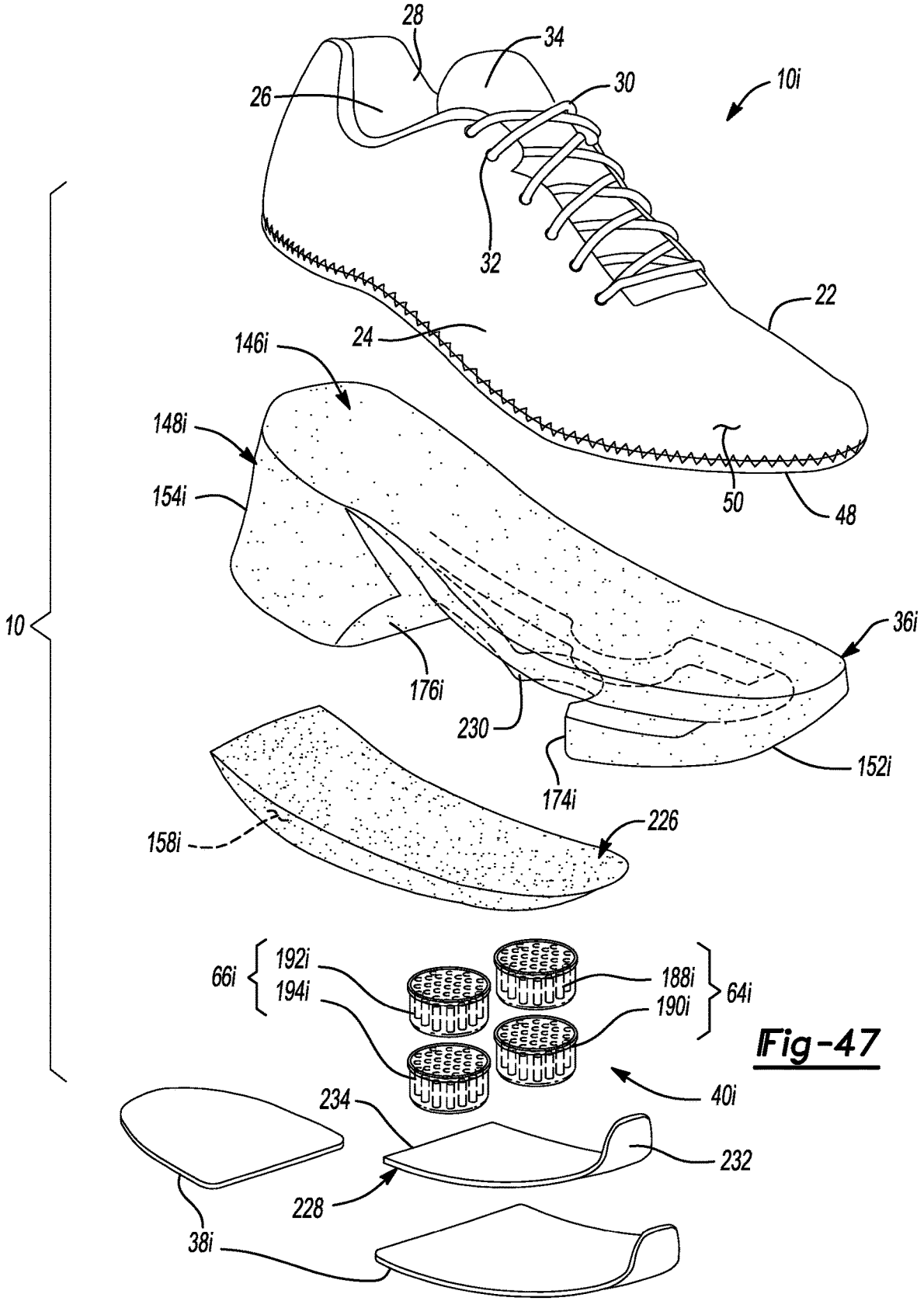
FIG. 47 is an exploded view of the article of footwear of FIG. 46.
Figure 48:
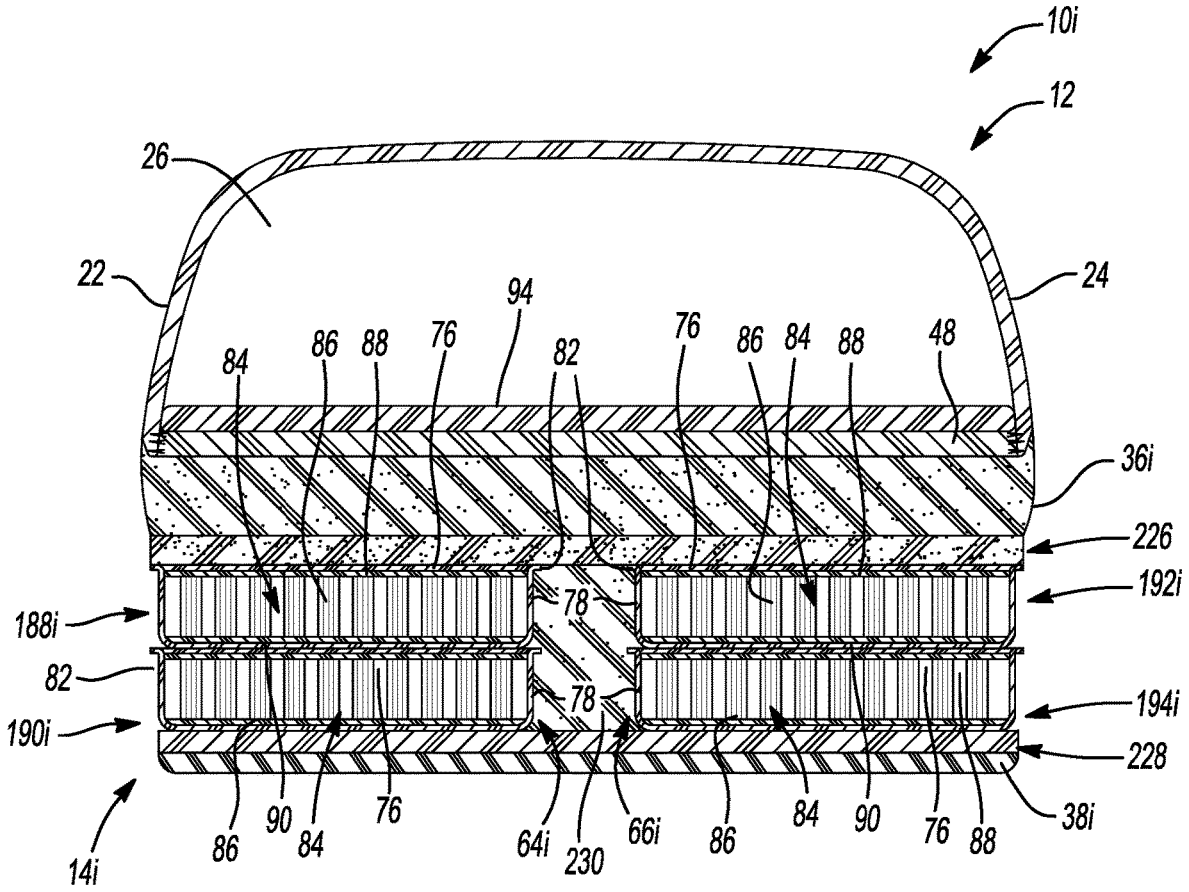
FIG. 48 is a cross-sectional view of the article of footwear of FIG. 46, taken along Line 48-48 of FIG. 46.
Figure 49:
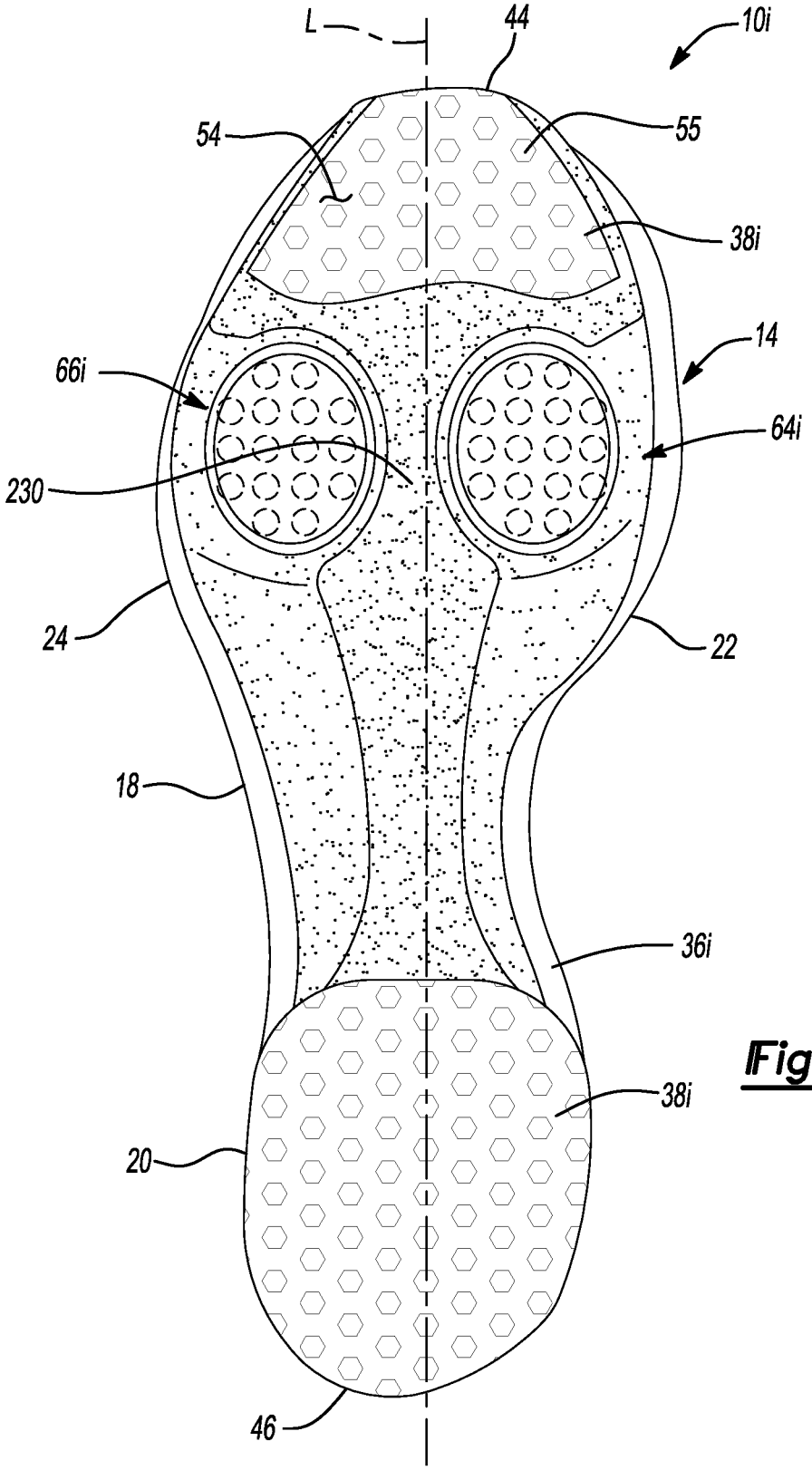
FIG. 49 is a bottom view of the article of footwear of FIG. 46.

As shown in FIG. 46, the outsole 38*i* is joined to the second segment 154*i* of the midsole 36*i* and to the second plate 228. More specifically, the outsole 38*i* is fragmentary, whereby portions of the outsole 38*i* are separately formed from each other, and are joined to each of the second segment 154*i* and the second plate 228.

During operation, when the ground-engaging surface 54 contacts the ground, a force is transmitted via the second plate 228 to the medial cushioning arrangement 64*i* and the lateral cushioning arrangement 66*i*. Namely, the force is transmitted to the first fluid-filled chamber 188*i*, the second fluid-filled chamber 190*i*, the third fluid-filled chamber 192*i*, and the fourth fluid-filled chamber 194*i*. The applied force causes the individual fluid-filled chambers 188*i*, 190*i*, 192*i*, 194*i* to compress, thereby absorbing the forces associated with the outsole 38*i* contacting the ground. The force is transmitted to the midsole 36*i* and the first plate 226 but is not experienced by the user as a point or localized load. Namely, and as described above, the first plate 226 is described as being formed from a rigid material. Accordingly, even though the medial cushioning arrangement 64*i* and the lateral cushioning arrangement 66*i* are located at discrete locations along the sole structure 14*i*, the forces exerted on the first plate 226 by the medial cushioning arrangement 64*i* and the lateral cushioning arrangement 66*i* are dissipated over a length of the first plate 226 such that neither applied force is applied at individual, discrete locations to a user's foot. Rather, the forces applied at the locations of the medial cushioning arrangement 64*i* and the lateral cushioning arrangement 66*i* are dissipated along a length of the first plate 226 due to the rigidity of the first plate 226 and, as such, point loads are not experienced by the user's foot when the foot is in contact with an insole 94 disposed within the interior void 26.

With reference to FIGS. 50-53B, an article of footwear 10*j* is provided and includes an upper 12 and a sole structure 14*j* attached to the upper 12. In view of the substantial similarity in structure and function of the components associated with the article of footwear 10 with respect to the article of footwear 10*j*, like reference numerals are used hereinafter and in the drawings to identify like components while like reference numerals containing letter extensions are used to identify those components that have been modified.

The sole structure 14*j* is attached to the upper 12 and provides the article of footwear 10*j* with support and cushioning during use. Namely, the sole structure 14*j* attenuates ground-reaction forces caused by the article of footwear 10*j* striking the ground during use. Accordingly, and as set forth below, the sole structure 14*j* may incorporate one or more materials having energy absorbing characteristics to allow the sole structure 14*j* to reduce the impact experienced by a user when wearing the article of footwear 10*j*.

Figure 50:
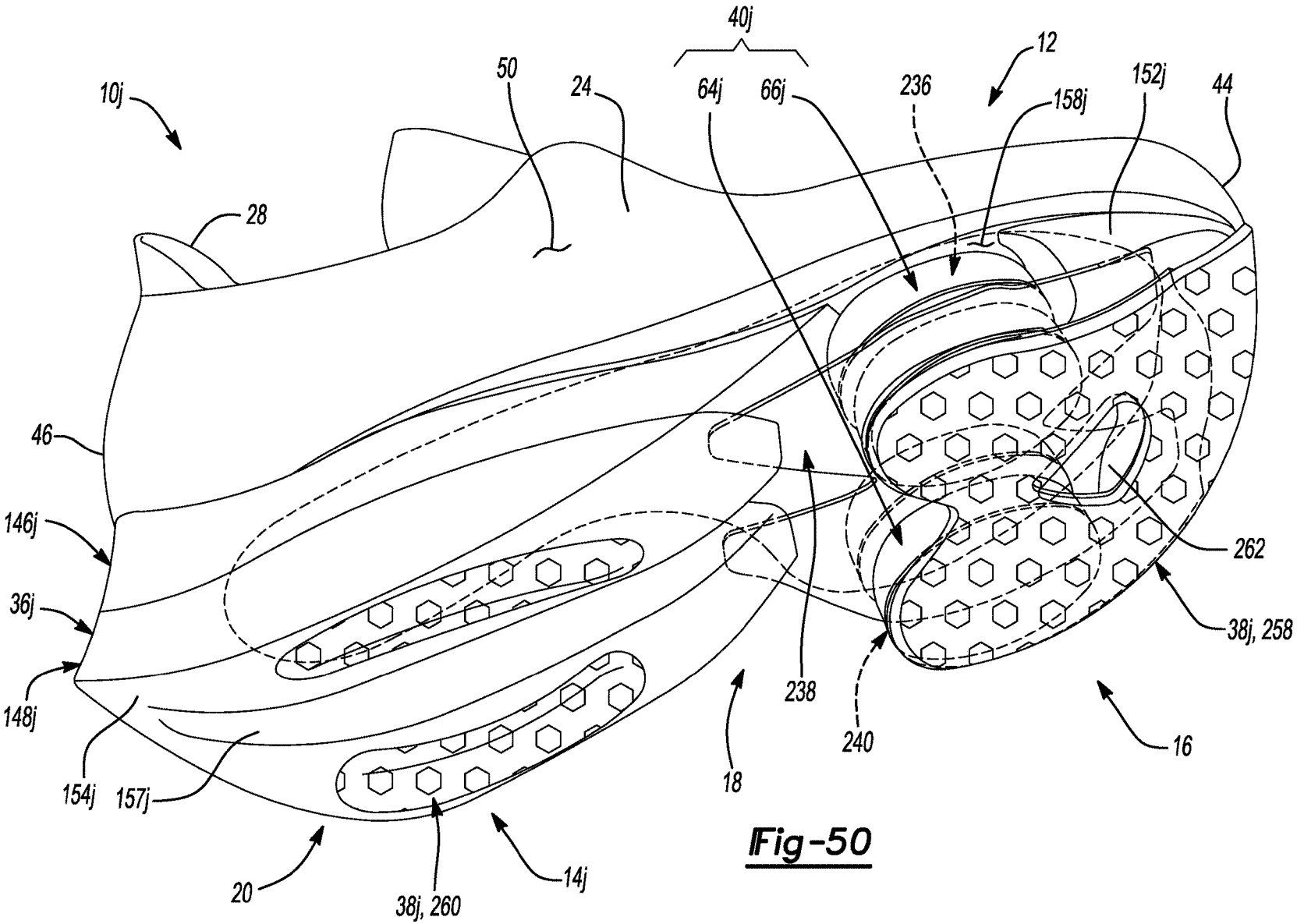
FIG. 50 is a perspective view of an article of footwear incorporating a sole structure in accordance with the principles of the present disclosure.
Figure 53A:
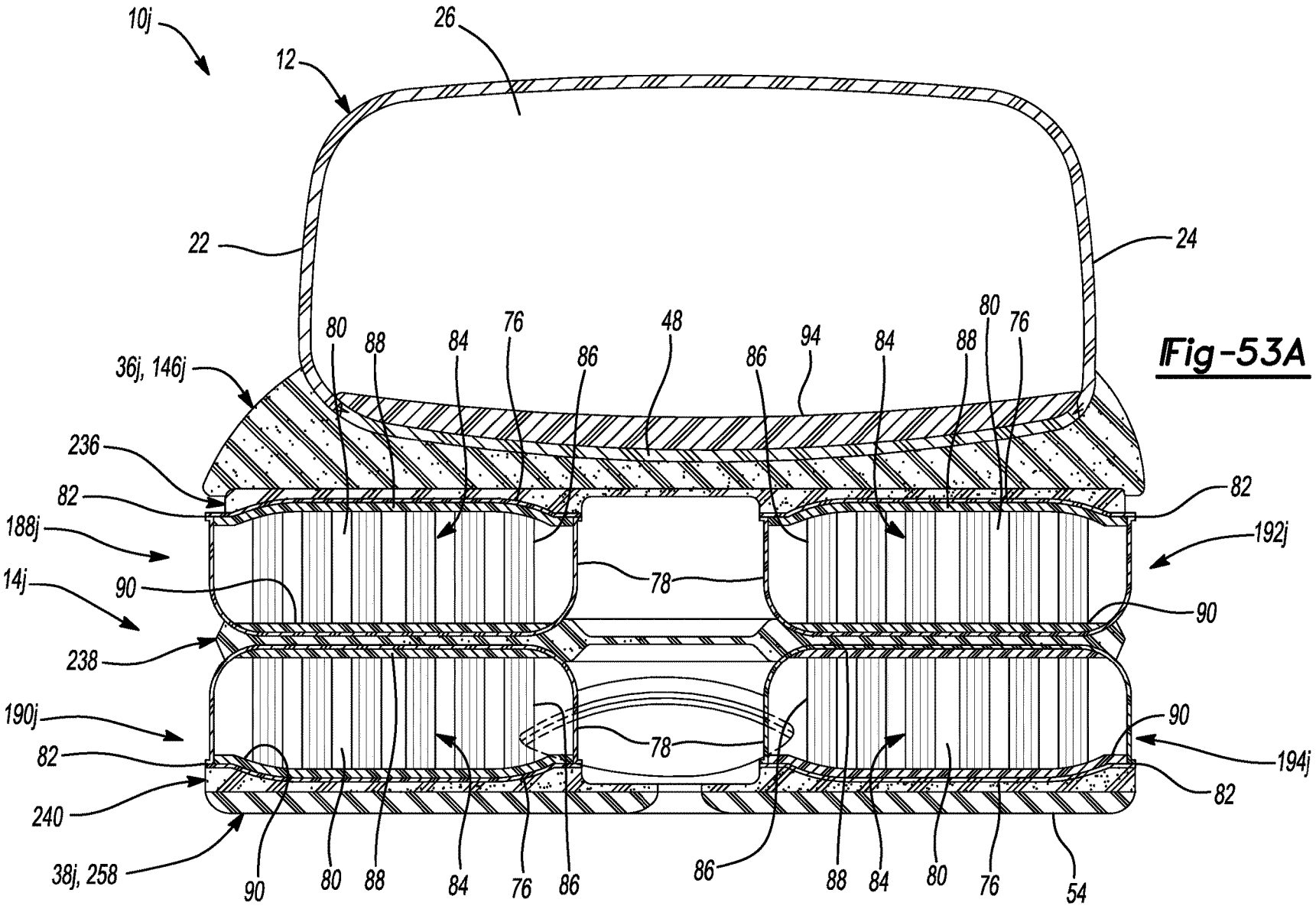
FIG. 53A is a cross-sectional view of the article of footwear of FIG. 50, taken along Line 53A-53A of FIG. 52.
Figure 53B:
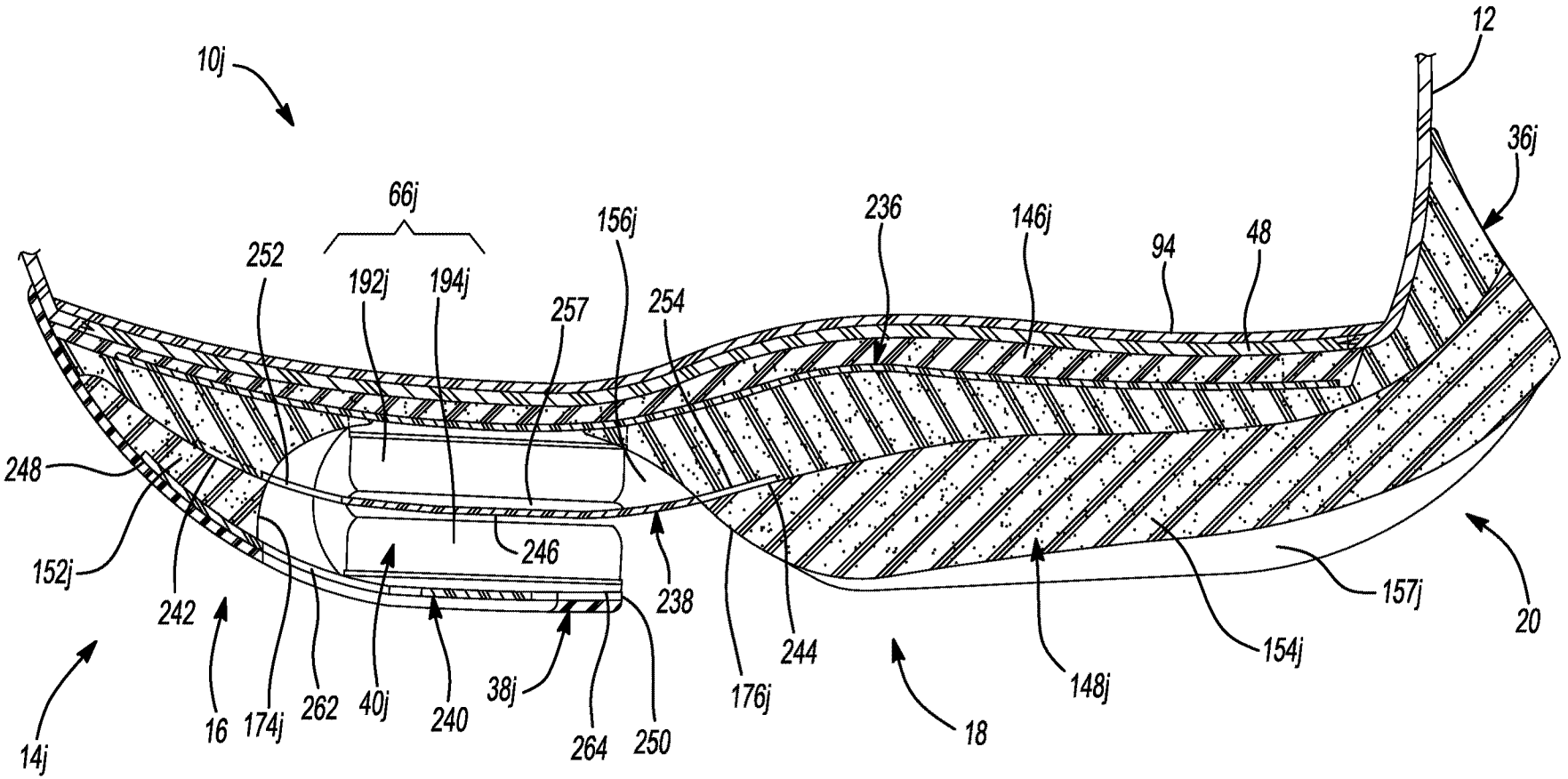
FIG. 53B is a cross-sectional view of the article of footwear of FIG. 50, taken along Line 53B-53B of FIG. 52.

The sole structure 14*j* may include a midsole 36*j*, an outsole 38*j*, and a cushion or cushioning arrangement 40*j* disposed generally between the midsole 36*j* and the outsole 38*j*. In addition, the sole structure 14*j* may include a first plate 236, a second plate 238, and a third plate 240 that extend from the forefoot region 16 of the article of footwear 10*j* towards the posterior end 46. As shown in FIGS. 50 and 53B, the first plate 236 is disposed intermediate the midsole 36*j* and the cushioning arrangement 40*j*, while the second plate 238 is disposed within the midsole 36*j* and separates the cushioning arrangement 40*j* into an upper portion and a lower portion. The third plate 240 is disposed intermediate the cushioning arrangement 40*j* and the outsole 38*j*.

Figure 51:
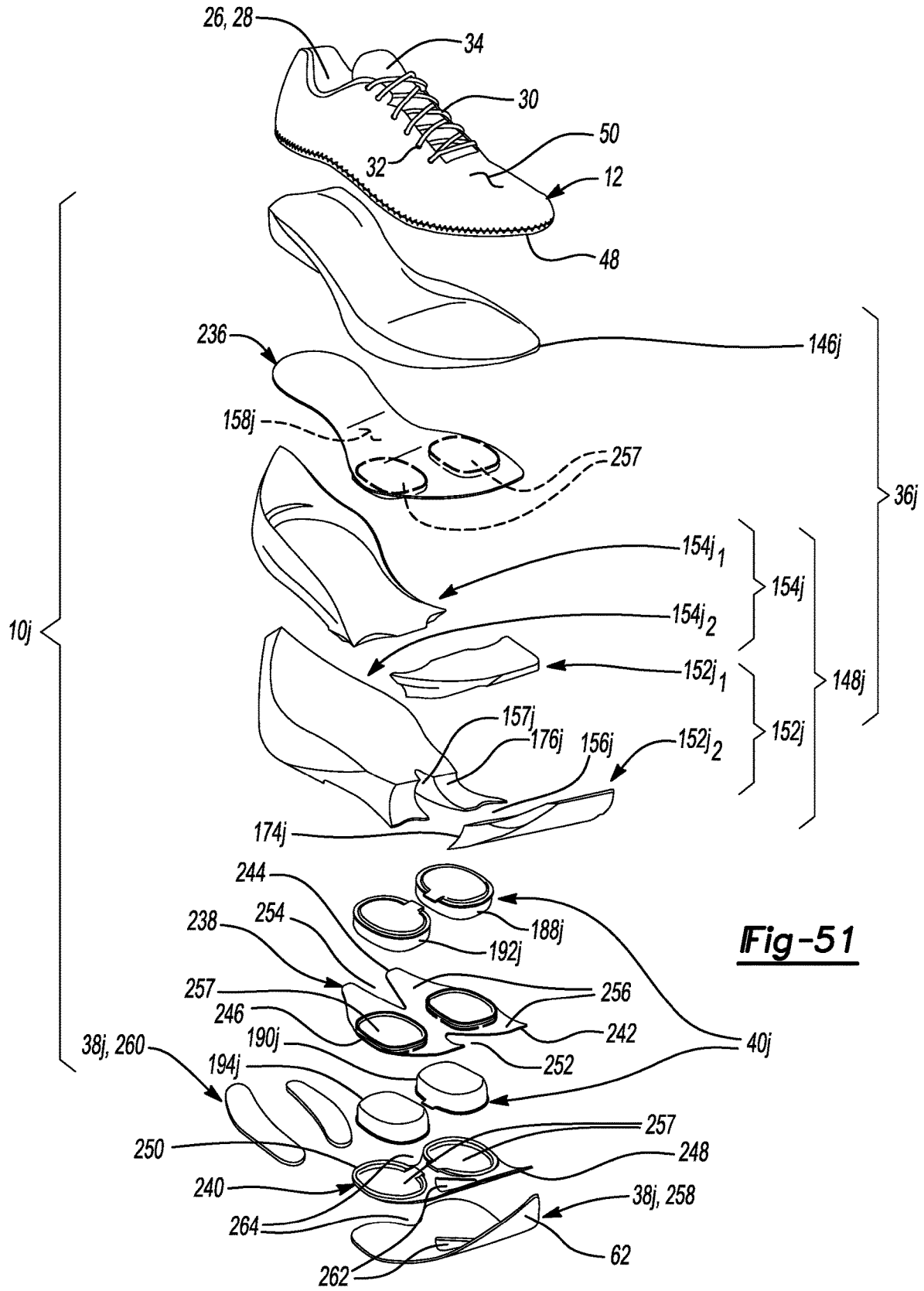
FIG. 51 is an exploded view of the article of footwear of FIG. 50.

With reference to FIGS. 50, 51, and 53B, the midsole 36*j* may include a continuously formed upper portion 146*j* and a segmented lower portion 148*j*. The upper portion 146*j* is shown as extending from the anterior end 44 of the article of footwear 10*j* to the posterior end 46. In one configuration, the upper portion 146*j* opposes the strobel 48 of the upper 12 and joins the sole structure 14*j* to the upper 12. The upper portion 146*j* of the midsole 36*j* may extend at least partially onto an upper surface 50 of the upper 12 such that the midsole 36*j* covers a junction of the upper 12 and the strobel 48, as shown in FIG. 53A.

The lower portion 148*j* of the midsole 36*j* may include a first segment 152*j* extending downwardly from the forefoot region 16 of the upper portion 146*j* and a second segment 154*j* extending downwardly from the heel region 20 of the upper portion 146*j*. A heel-facing sidewall 174*j* of the first segment 152*j* is spaced apart from a forefoot-facing sidewall 176*j* of the second segment 154*j* to define a gap 156*j* between the first segment 152*j* and the second segment 154*j*. The forefoot-facing sidewall 176*j* of the second segment 154*j* may be tapered, as shown in FIGS. 51 and 53B. Generally, the gap 156*j* is defined to provide sufficient clearance for uninhibited expansion and contraction of the cushioning arrangement 40*j* during use. For example, on initial impact with the ground surface, a width of the cushioning arrangement 40*j* may expand laterally as the cushioning arrangement 40*j* is vertically compressed. By providing the gap 156*j*, the shock absorption capacity of the cushioning arrangement 40*j* is maximized.

Figure 52:
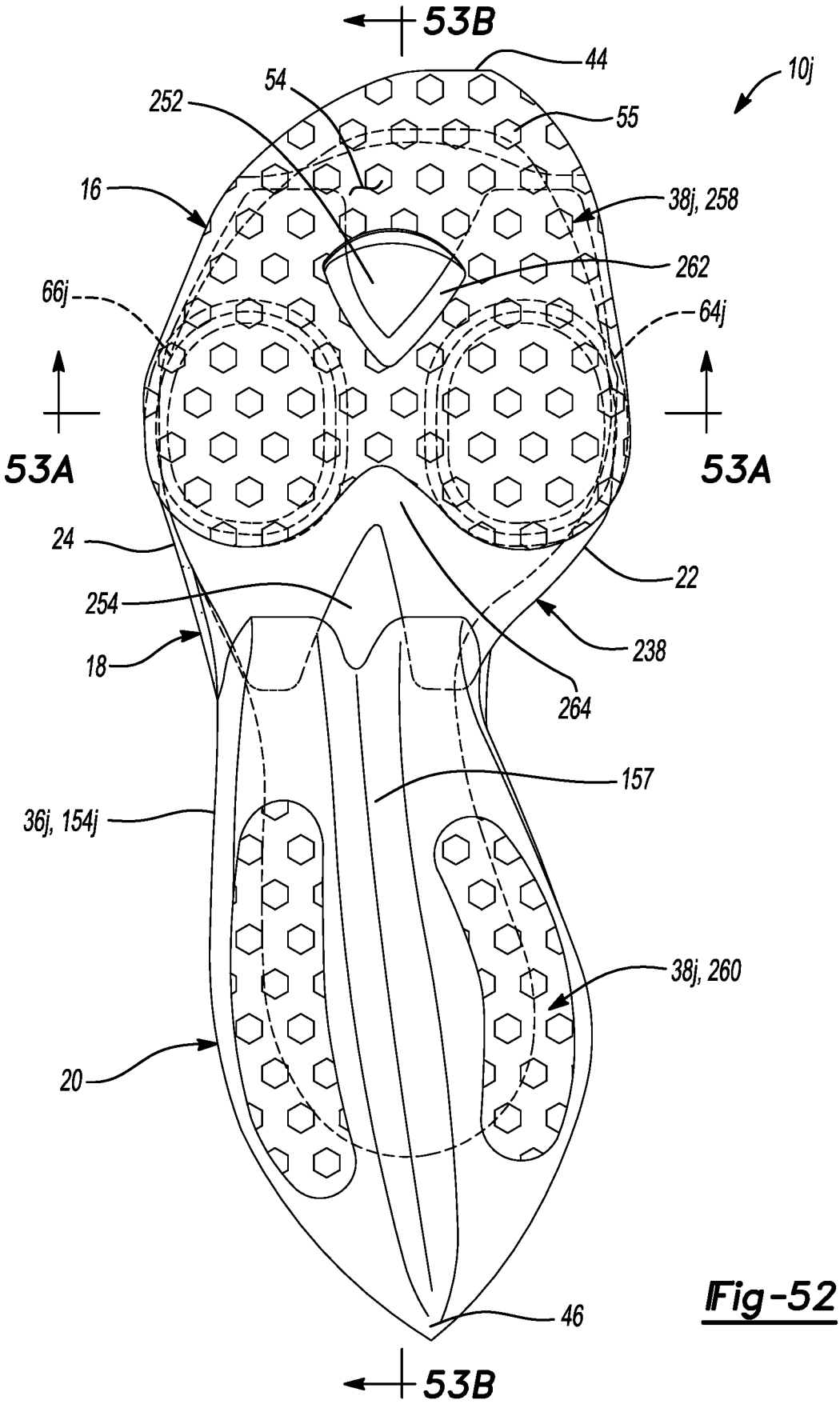
FIG. 52 is a bottom view of the article of footwear of FIG. 50.

With reference to FIGS. 50-52, the second segment 154*j* of the midsole 36*j* may include a channel 157*j* extending continuously from the forefoot-facing sidewall 176*j* to the posterior end 46. As shown, a width of the channel 157*j* may flare from the forefoot-facing sidewall 176*j* to an intermediate portion, and taper from the intermediate portion to a second vertex adjacent the posterior end 46 of the sole structure 14*j*. In some examples, the channel 157*j* extends through the forefoot-facing sidewall 176*j* of the second segment 154*j*.

The midsole 36*j* may be formed from an energy absorbing material such as, for example, polymer foam. Forming the midsole 36*j* from an energy-absorbing material such as polymer foam allows the midsole 36*j* to attenuate ground-reaction forces caused by movement of the article of footwear 10*j* over ground during use. In some examples, the upper portion 146*j* may be formed of a first material and the lower portion 148*j* may be formed of a second material. Additionally or alternatively, one or both of the segments 152*j*, 154*j* may be compositely formed, and include an upper portion 152*j*1, 154*j*1 formed of a first foam material and a lower portion 152*j*2, 154*j*2 formed of a second foam material, as illustrated in FIG. 51.

As provided above, the sole structure 14*j* includes a plurality of plates 236, 238, 240 configured to provide rigid or semi-rigid interfaces between the midsole 36*j* and the cushioning arrangement 40*j*, thereby providing increased stability to the cushioning arrangement 40*j* and distributing loads throughout the sole structure 14*j*. The first plate 236 may be disposed within the midsole 36*j* such that the upper portion 146*j* of the midsole 36*j* extends between the first plate 236 and the upper 12. As shown, the first plate 236 may be disposed intermediate the upper portion 146*j* and the lower portion 148*j*. More particularly, a first end of the first plate 236 is embedded within the midsole 36*j* between the upper portion 146*j* and the first segment 152*j* of the lower portion 148*j*, and an opposing second end of the first plate 236 is embedded within the midsole 36*j* between the upper portion 146*j* and the second segment 154*j* of the lower portion 148*j*. An intermediate portion of the first plate 236 traverses the gap 156*j*, whereby a ground-facing surface 158*j* of the first plate 236 is exposed within the gap 156*j* and is joined to a proximal end of the cushioning arrangement 40*j*.

The first plate 236 may be visible at the medial side 22 of the sole structure 14*j* and/or at the lateral side 24 of the sole structure 14*j*. Alternatively, the first plate 236 may be encapsulated within the upper portion 146*j* of the midsole 36*j*. In some examples, the first plate 236 may be disposed between the upper 12 and the midsole 36*j*, whereby the first plate 236 is attached directly to the strobel 48 and/or the upper 12.

As shown, the second plate 238 is spaced apart from the first plate 236, and is disposed generally between the first plate 236 and the outsole 38*j*. A first end 242 of the second plate 238 is joined to the first segment 152*j* of the lower portion 148*j* of the midsole 36*j*, while an opposing second end 244 is joined to the second segment 154*j* of the lower portion 148*j* of the midsole 36*j*. In the illustrated example, the first end 242 of the second plate 238 is embedded within the first segment 152*j* and the second end 244 is embedded within the second segment 154*j*. An intermediate portion 246 of the second plate 238 spans the gap 156*j* formed between the first segment 152*j* and the second segment 154*j*, and separates the cushioning arrangement 40*j* into an upper portion and a lower portion, as discussed in greater detail below.

With reference to FIG. 51, the second plate 238 includes a pair of cutouts 252, 254 formed at opposing ends 242, 244. In the illustrated example, the first cutout is a first notch 252 formed in the first end 242 and the second cutout is a second notch 254 formed in the second end 244. As shown, each of the notches 252, 254 is formed through the thickness of the second plate 238 and tapers in width to a vertex disposed in the intermediate portion 246 of the second plate 238. Accordingly, each of the notches 252, 254 effectively defines a pair of tabs 256 at each end 242, 244 of the second plate 238. The tabs 256 of the first end 242 extend through the heel-facing sidewall 174*j* into the first segment 152*j* of the midsole 36*j*, and the tabs 256 of the second end 244 extend through the forefoot-facing sidewall 176*j* into second segment 154*j* of the midsole 36*j*.

The tabs 256 are configured to act as flexures at each of the first and second ends 242, 244 of the second plate 238 during use of the footwear 10*j*. For example, the first notch 252 may be sized and positioned to minimize a stiffness of the second plate 238 within the forefoot region. Likewise, by providing the tabs 256, the second notch 254 allows the second end 244 of the second plate 238 to twist and/or bend within the mid-foot region 18. In some examples, one or more of the cutouts may be an aperture formed within the intermediate portion 246 of the second plate 238.

The third plate 240 is spaced apart from the second plate 238, and is disposed between the cushioning arrangement 40*j* and the outsole 38*j*. As shown, the third plate 240 extends from a first end 248 attached to the first segment 152*j* of the midsole 36*j* to a second end 250 attached to the cushioning arrangement 40*j*. More specifically, the first end 248 of the third plate 240 is disposed between a distal end of the first segment 152*j* and the outsole 38*j*, while the second end 250 of the third plate is joined to the cushioning arrangement 40*j* and does not extend to the second segment 154*j*. Accordingly, the second end 250 of the third plate 240 is free to move with the cushioning arrangement 40*j*. As described in greater detail below, at least a portion of the outsole 38*j* may be attached to or formed integrally with the third plate 238.

With reference the FIGS. 51 and 53B, the first plate 236 is a full-length plate and extends substantially along an entire length of the sole structure 14*j* from the forefoot region 16 to the heel region 20. The second plate 238 and the third plate 240 may be so-called "partial-length" plates that extend along only a portion of the sole structure 14*j*. In the illustrated example, the second plate 238 extends from the forefoot region 16 to the mid-foot region 18, while the third plate 240 is disposed substantially within the forefoot region 16. In some examples, any one or more of the plates 236, 238, 240 could extend from an intermediate portion of the forefoot region 16 to an intermediate portion of the heel region 20. Additionally or alternatively, any one or more of the plates 236, 238, 240 may be full-length plates, as described above, which extend from the anterior end 44 to the posterior end 46 of the sole structure 14*j*.

Additionally, each of the plates 236, 238, 240 may include one or more sockets 257 configured to receive the cushioning arrangement 40*j* therein. As shown in FIG. 51, the sockets 257 may be defined by a rib, protrusion, or recess formed on one or more surfaces of each of the respective plates 236, 238, 240 and configured to interface with the cushioning arrangement 40*j*. Accordingly, the sockets 257 receive respective ends of the cushioning arrangement 40*j* to secure a position of the cushioning arrangement 40*j* with respect to each plate 236, 238, 240.

Regardless of the particular size, location, and features, one or more of the plates 236, 238, 240 may be formed from a relatively rigid material. For example, one or more of the plates 236, 238, 240 may be formed from a non-foamed polymer material or, alternatively, from a composite material containing fibers, such as carbon fibers. For example, carbon fiber plates have been found to provide maximum performance due to the relatively low weight and desirable force distribution properties compared to polymeric materials. However, polymeric plates may provide suitable weight and force distribution properties in other implementations of the sole structure. Forming the plates 236, 238, 240 from a relatively rigid material allows forces associated with use of the article footwear 10*j* when the article of footwear 10*j* strikes a ground surface to be distributed throughout the entire sole structure 14*j*, as will be described in greater detail below.

Referring still to FIGS. 50-53B, the cushioning arrangement 40*j* is disposed within the gap 156*j* of the midsole 36*j*, and is shown to include a medial cushion or cushioning arrangement 64*j* and a lateral cushion or cushioning arrangement 66*j*. The medial cushioning arrangement 64*j* is disposed proximate to the medial side 22 of the sole structure 14*j* while the lateral cushioning arrangement 66*j* is disposed proximate to the lateral side 24 of the sole structure 14*j*.

As shown in FIGS. 52 and 53A, the medial cushioning arrangement 64*j* includes a first fluid-filled chamber 188*j* and a second fluid-filled chamber 190*j*. Similarly, the lateral cushioning arrangement 66*j* includes a third fluid-filled chamber 192*j* and a fourth fluid-filled chamber 194*j*. The first fluid-filled chamber 188*j* and the third fluid-filled chamber 192*j* are disposed generally between the first plate 236 and the second plate 238, while the second fluid-filled chamber 190*j* and the fourth fluid-filled chamber 194*j* are disposed between second plate 238 and the third plate 240. Specifically, the first fluid-filled chamber 188*j* and the third fluid-filled chamber 192*j* are attached to the first plate 236 at respective first sides, and are attached to the second plate 238 at respective second sides. Likewise, the second fluid-filled chamber 190*j* and the fourth fluid-filled chamber 194*j* are attached to the second plate 238 at respective first sides, and are attached to the third plate 240 at respective second sides.

With reference to FIGS. 50 and 53B, the intermediate portion 246 of the second plate 238 intersects the cushioning arrangement 40*j*. More specifically, the intermediate portion 246 of the second plate 238 is disposed between the first fluid-filled chamber 188*j* and the second fluid-filled chamber 190*j* of the medial cushioning arrangement 64*j*, and between the third fluid-filled chamber 192*j* and the fourth fluid-filled chamber 194*j* of the lateral cushioning arrangement 66*j*. In other words, the first fluid-filled chamber 188*j* and the third fluid-filled chamber 192*j* are disposed above the second plate 238 (i.e., between the second plate 238 and the upper 12), while the second fluid-filled chamber 190*j* and the fourth fluid-filled chamber 194*j* are disposed beneath the second plate 238 (i.e., between the second plate 238 and the outsole 38*j*).

The fluid-filled chambers 188*j*, 190*j*, 192*j*, 194*j* may be attached to the first plate 236, the second plate 238, and/or the third plate 240, respectively, via a suitable adhesive. Additionally or alternatively, the fluid-filled chambers 188*j*, 190*j*, 192*j*, 194*j* may be joined to any one or more of the plates 236, 238, 240 by melding a material of at least one of the fluid-filled chambers 188*j*, 190*j*, 192*j*, 194*j*, the first plate 236, the second plate 238, and/or the third plate 240. As discussed above, opposing ends of each of fluid-filled chambers 188*j*, 190*j*, 192*j*, 194*j* may be received in a respective socket 257 formed in or on each of the plates 236, 238, 240, thereby mechanically securing a position of one or more of the fluid-filled chambers 188*j*, 190*j*, 192*j*, 194*j*.

Referring to FIG. 53A, the fluid-filled chambers 188*j*, 190*j*, 192*j*, 194*j* may each include a first barrier element 76 and a second barrier element 78. The first barrier element 76 and the second barrier element 78 may be formed from a sheet of thermoplastic polyurethane (TPU). Specifically, the first barrier element 76 may be formed from a sheet of TPU material and may include a substantially planar shape. The second barrier element 78 may likewise be formed from a sheet of TPU material and may be formed into the configuration shown in FIG. 53A to define an interior void 80. The first barrier element 76 may be joined to the second barrier element 78 by applying heat and pressure at a perimeter of the first barrier element 76 and the second barrier element 78 to define a peripheral seam 82. The peripheral seam 82 seals the interior void 80, thereby defining a volume of each of the fluid-filled chambers 188*j*, 190*j*, 192*j*, 194*j*.

The interior void 80 of the fluid-filled chambers 188*j*, 190*j*, 192*j*, 194*j* may receive a tensile element 84 therein. Each tensile element 84 may include a series of tensile strands 86 extending between an upper tensile sheet 88 and a lower tensile sheet 90. The upper tensile sheet 88 may be attached to the first barrier element 76 while the lower tensile sheet 90 may be attached to the second barrier element 78. In this manner, when the fluid-filled chambers 188*j*, 190*j*, 192*j*, 194*j* receive a pressurized fluid, the tensile strands 86 of the tensile elements 84 are placed in tension. Because the upper tensile sheet 88 is attached to the first barrier element 76 and the lower tensile sheet 90 is attached to the second barrier element 78, the tensile strands 86 retain a desired shape of each of the first fluid-filled chamber 188*j*, the second fluid-filled chamber 190*j*, the third fluid-filled chamber 192*j*, and the fourth fluid-filled chamber 194*j*, respectively, when pressurized fluid is injected into the interior void 80.

As described, the medial cushioning arrangement 64*j* and the lateral cushioning arrangement 66*j* each include a pair of fluid-filled chambers 188*j*, 190*j*, 192*j*, 194*j* that are received generally between the upper 12 and the outsole 38*j*. In one configuration, the first fluid-filled chamber 188*j* and the third fluid-filled chamber 192*j* are, respectively, fluidly isolated from the second fluid-filled chamber 192*j* and the fourth fluid-filled chamber 194*j* by the second plate 238.

In some configurations, the medial cushioning arrangement 64*j* (i.e., the first fluid-filled chamber 188*j* and the second fluid-filled chamber 190*j*) is fluidly isolated from the lateral cushioning arrangement 66*j* (i.e., the third fluid-filled chamber 192*j* and the fourth fluid-filled chamber 194*j*). While the medial cushioning arrangement 64*j* is described and shown as being spaced apart from the lateral cushioning arrangement 66*j*, the cushioning arrangements 64*j*, 66*j* could alternatively be in contact with one another while still being fluidly isolated.

While the medial cushioning arrangement 64*j* and the lateral cushioning arrangement 66*j* are described and shown as including stacked pairs of fluid-filled chambers, the medial cushioning arrangement 64*j* and the lateral cushioning arrangement 66*j* could alternatively include other cushioning elements. For example, the medial cushioning arrangement 64*j* and the lateral cushioning arrangement 66*j* may each include a foam block (see e.g., 92 in FIGS. 4-6) that replaces any one or more of the fluid-filled chambers 188*j*, 190*j*, 192*j*, 194*j*. The foam blocks may be received within the interior void 80 defined by the first barrier element 76 and the second barrier element 78. Positioning foam blocks within the interior void 80 defined by the first barrier element 76 and the second barrier element 78 allows the barrier elements 76, 78 to restrict expansion of the foam blocks beyond a predetermined amount when subjected to a predetermined load.

Accordingly, the overall shape and, thus, the performance of the foam blocks may be controlled by allowing the foam blocks to interact with the barrier elements 76, 78 during loading. While the foam blocks are described as being received within the interior void 80 of the barrier elements 76, 78, the foam blocks could alternatively be positioned within the cushioning arrangement 40*j* absent the barrier elements 76, 78. In such a configuration, the foam blocks would be directly attached to any one or more of the first plate 236, the second plate 238, the third plate 240, and/or one of the fluid-filled chambers 188*j*, 190*j*, 192*j*, 194*j*, respectively. The particular construction of the medial cushioning arrangement 64*j* and the lateral cushioning arrangement 66*j* (i.e., use of foam blocks, fluid-filled chambers, or a combination thereof) may be dictated by the amount of cushioning required at the medial side 22 and the lateral side 24.

Regardless of the particular construction of the medial cushioning arrangement 64*j* and the lateral cushioning arrangement 66*j*, the medial cushioning arrangement 64*j* and the lateral cushioning arrangement 66*j* may be substantially aligned with each other along a direction extending between the medial side 22 and the lateral side 24 of the sole structure 14*j*. Alternatively, the medial cushioning arrangement 64*j* and the lateral cushioning arrangement 66*j* may be offset from each other.

As described, the medial cushioning arrangement 64*j* and the lateral cushioning arrangement 66*j* each provide a pair of stacked cushioning elements disposed at discrete locations on the sole structure 14*j*. In one configuration, the medial cushioning arrangement 64*j* and the lateral cushioning arrangement 66*j* each provide a pair of stacked, fluid-filled chambers (i.e. elements 188*j*, 190*j*, 192*j*, 194*j*) that cooperate to provide cushioning at the medial side 22 and the lateral side 24, respectively. The individual fluid-filled chambers 188*j*, 190*j*, 192*j*, 194*j* may include the same volume and, further, may be at the same pressure. Alternatively, the volumes and the pressures of the various fluid-filled chambers 188*j*, 190*j*, 192*j*, 194*j* may vary between the cushioning arrangements 64*j*, 66*j* and/or within each cushioning arrangement 64*j*, 66*j*). For example, the first fluid-filled chamber 188*j* may include the same pressure as the second fluid-filled chamber 190*j* or, alternatively, the first fluid-filled chamber 188*j* may include a different pressure than the second fluid-filled chamber 190*j*. Likewise, the third fluid-filled chamber 192*j* may include the same or different pressure than the fourth fluid-filled chamber 194*j*, and may include a different pressure than the first fluid-filled chamber 188*j* and/or the second fluid-filled chamber 190*j*. The fluid-filled chambers 188*j*, 190*j*, 192*j*, 194*j* may be at a pressure within a range of 15-30 psi and preferably at a pressure within a range of 20-25 psi.

As shown in FIGS. 50 and 53B, the outsole 38*j* is joined to the midsole 36*j* and the third plate 240. More specifically, the outsole 38*j* is fragmentary, whereby a forefoot segment 258 of the outsole 38*j* is joined to the first segment 152*j* of the midsole 36*j* and the third plate 240, and one or more heel segments 260 of the outsole 38*j* are joined to the second segment 154*j* of the midsole 36*j*. Alternatively, the outsole 38*j* may be continuously formed, and extend from the anterior end 44 to the posterior end 46. The outsole 38*j* may be formed from a resilient material such as, for example, rubber that provides the article of footwear 10*j* with a ground-engaging surface 54 that provides traction and durability.

As shown, the third plate 240 cooperates with the forefoot segment 258 of the outsole 38*j* to define a cutout 262. The cutout 262 extends through each of the third plate 240 and the forefoot segment 258 and tapers in width along the longitudinal axis L to a vertex disposed between the medial cushioning arrangement 64*j* and the lateral cushioning arrangement 66*j*. Similarly, outer peripheries of the third plate 240 and the forefoot segment 258 of the outsole 38*j* may correspond to a profile of the cushioning arrangement 40*j*, and cooperate to define a notch 264 extending between the medial cushioning arrangement 64*j* and the lateral cushioning arrangement 66*j*, and opposing the cutout 262.

During operation, when the ground-engaging surface 54 contacts the ground, a force is distributed to the first segment 152*j* and the cushioning arrangement 40*j* by the third plate 240. The force received by the cushioning arrangement 40*j* through the third plate 240 is transmitted to the second plate 238 through the second fluid-filled chamber 190*j* and the fourth fluid-filled chamber 194*j*, through the second plate 238 to the first fluid-filled chamber 188*j* and the third fluid-filled chamber 192*j*, and to the first plate 236 through the first fluid-filled chamber 188*j* and the third fluid-filled chamber 192*j*. The applied force causes the individual fluid-filled chambers 188*j*, 190*j*, 192*j*, 194*j* to compress, thereby absorbing the forces associated with the outsole 38*j* contacting the ground. The force is transmitted to the midsole 36*j* via the first plate 236, the second plate 238, and the third plate 240, but is not experienced by the user as a point or localized load. As described above, one or more of the first plate 236, the second plate, 238, and the third plate 240 are formed from a rigid material. Accordingly, even though the medial cushioning arrangement 64*j* and the lateral cushioning arrangement 66*j* are located at discrete locations along the sole structure 14*j*, the forces exerted the first plate 236 and the second plate 238 by the medial cushioning arrangement 64*j* and the lateral cushioning arrangement 66*j* are dissipated over a length of the midsole 36*j* such that neither applied force is applied at individual, discrete locations to a user's foot. Rather, the forces applied at the locations of the medial cushioning arrangement 64*j* and the lateral cushioning arrangement 66*j* are dissipated along a length of the first plate 236 and the second plate 238 due to the rigidity of the plates 236, 238 and, as such, point loads are not experienced by the user's foot when the foot is in contact with an insole 94 disposed within the interior void 26. Furthermore, by attaching the third plate 240 to the distal ends of each of the medial cushioning arrangement 64*j* and the lateral cushioning arrangement 66*j*, and extending the second plate 238 between the first fluid-filled chamber 188*j* and the second fluid-filled chamber 190*j* of the medial cushioning arrangement 64*j* and between the third fluid-filled chamber 192*j* and the fourth fluid-filled chamber 194*j* of the lateral cushioning arrangement 66*j*, additional stability is provided to the cushioning arrangement 40*j* by distributing the applied force between the cushioning arrangements 64*j*, 66*j*, the first segment 152*j*, and the second segment 154*j*.

With reference to FIGS. 54-57B, an article of footwear 10*k* is provided and includes an upper 12 and a sole structure 14*k* attached to the upper 12. In view of the substantial similarity in structure and function of the components associated with the article of footwear 10 with respect to the article of footwear 10*k*, like reference numerals are used hereinafter and in the drawings to identify like components while like reference numerals containing letter extensions are used to identify those components that have been modified.

The sole structure 14*k* is attached to the upper 12 and provides the article of footwear 10*k* with support and cushioning during use. Namely, the sole structure 14*k* attenuates ground-reaction forces caused by the article of footwear 10*k* striking the ground during use. Accordingly, and as set forth below, the sole structure 14*k* may incorporate one or more materials having energy absorbing characteristics to allow the sole structure 14*k* to reduce the impact experienced by a user when wearing the article of footwear 10*k*.

Figure 54:
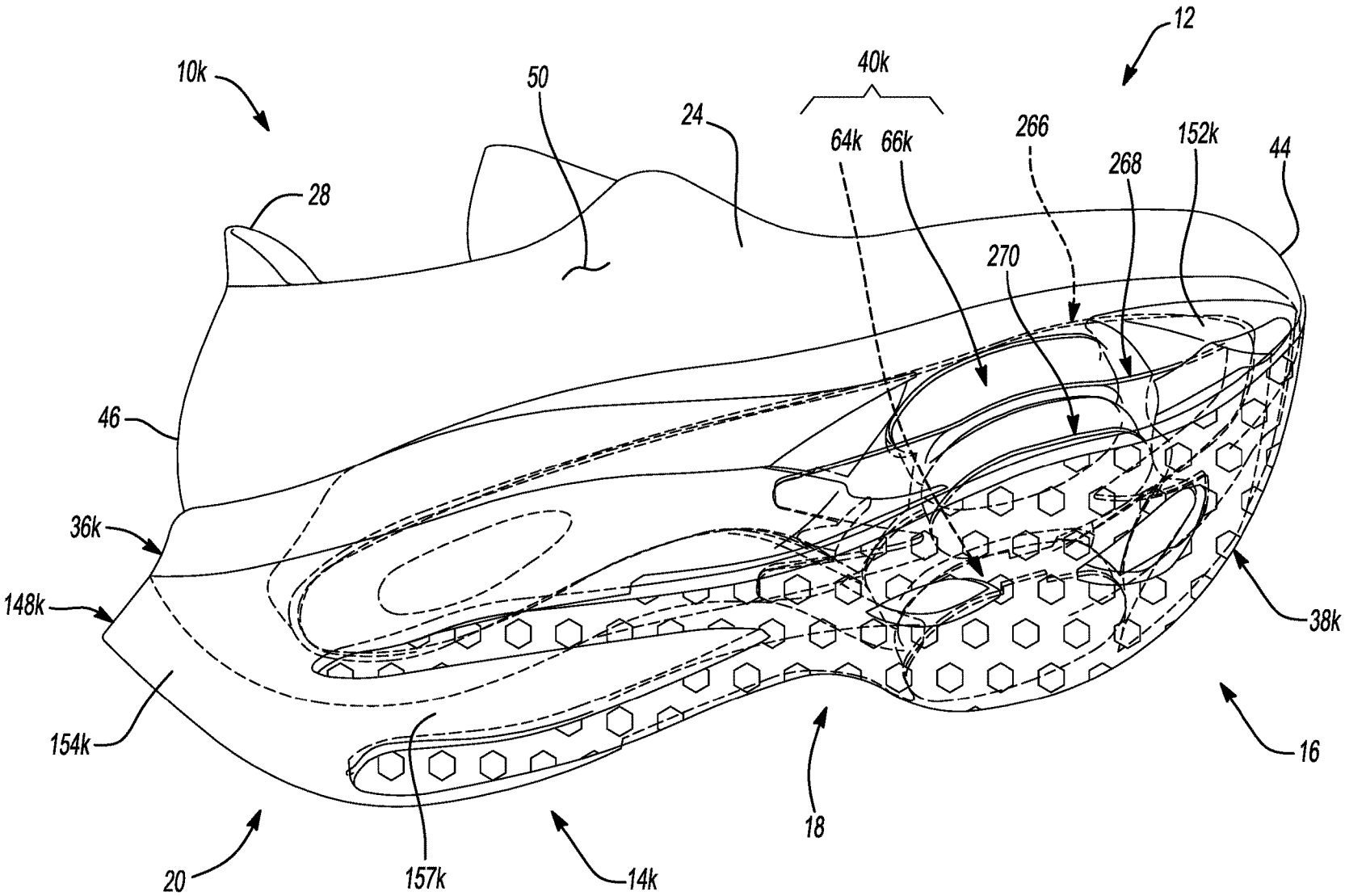
FIG. 54 is a perspective view of an article of footwear incorporating a sole structure in accordance with the principles of the present disclosure.
Figure 57A:
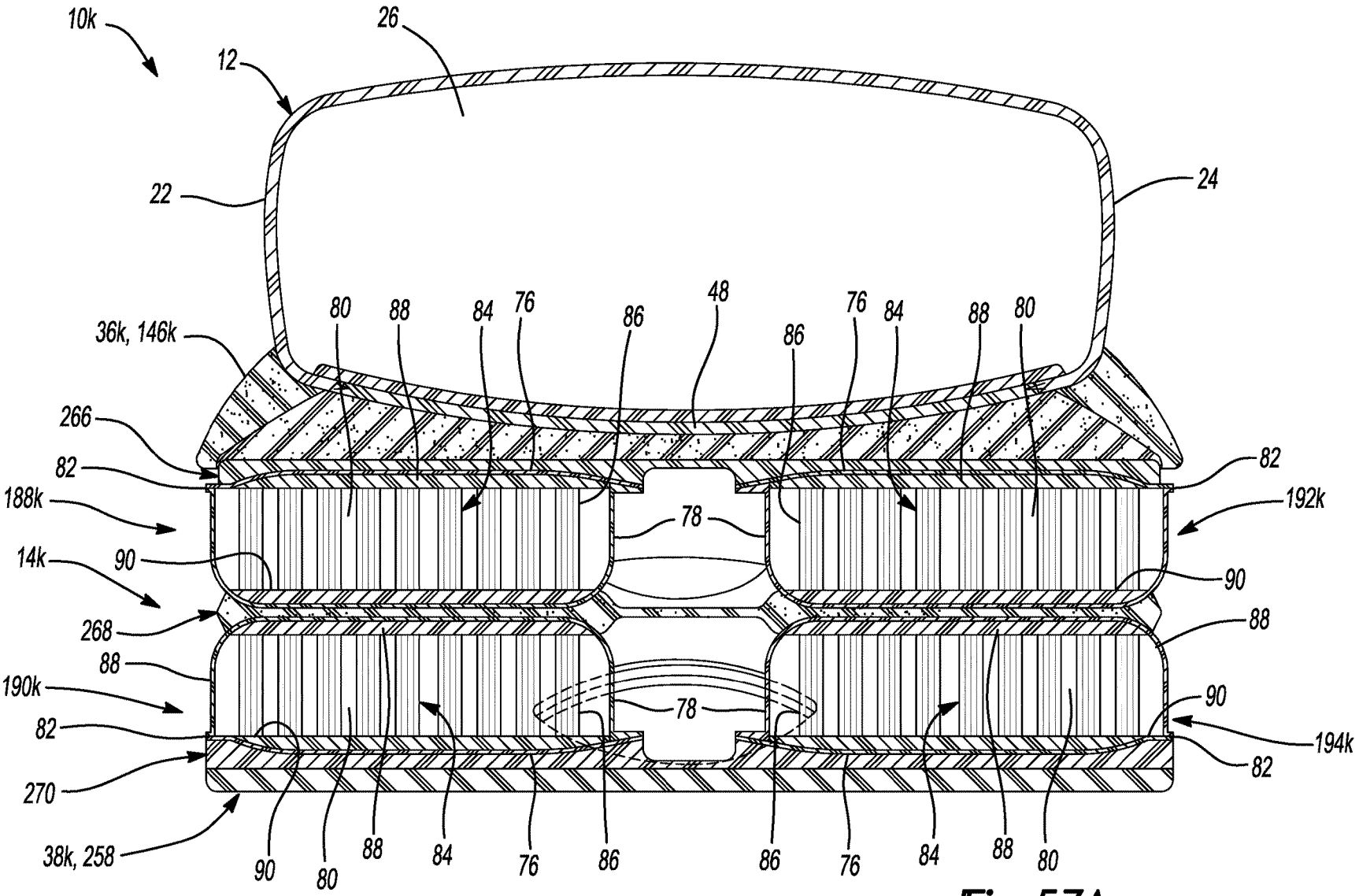
FIG. 57A is a cross-sectional view of the article of footwear of FIG. 54, taken along Line 57A-57A of FIG. 56.
Figure 57B:
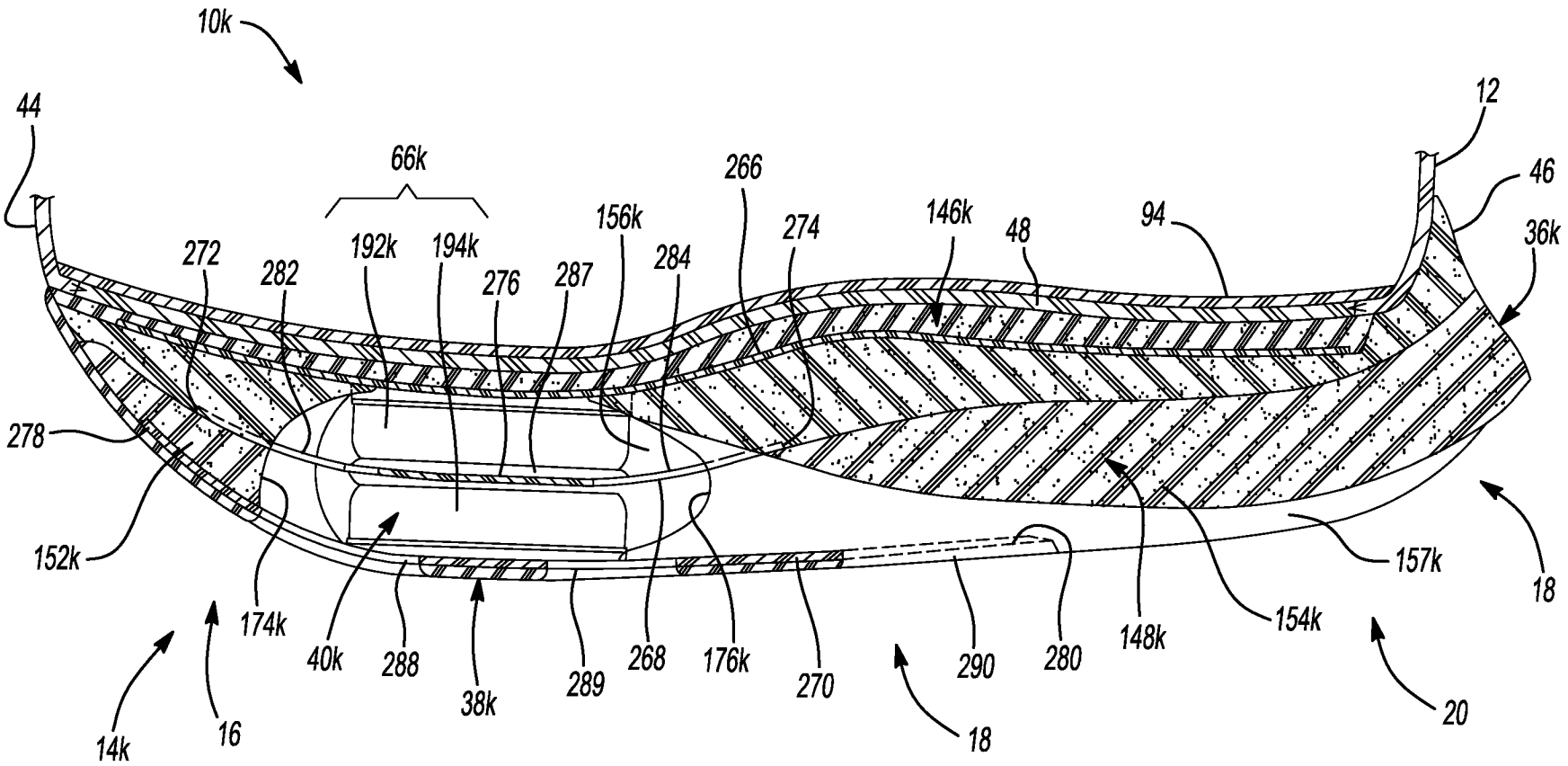
FIG. 57B is a cross-sectional view of the article of footwear of FIG. 54, taken along Line 57B-57B of FIG. 56.

The sole structure 14*k* may include a midsole 36*k*, an outsole 38*k*, and a cushion or cushioning arrangement 40*k* disposed generally between the midsole 36*k* and the outsole 38*k*. In addition, the sole structure 14*k* may include a first plate 266, a second plate 268, and a third plate 270 that extend from the forefoot region 16 of the article of footwear 10*k* towards the posterior end 46. As shown in FIGS. 54 and 57B, the first plate 266 is disposed intermediate the midsole 36*k* and the cushioning arrangement 40*k*, while the second plate 268 is disposed within the midsole 36*k* and separates the cushioning arrangement 40*k* into an upper portion and a lower portion. The third plate 270 is disposed intermediate the cushioning arrangement 40*k* and the outsole 38*k*.

Figure 55:
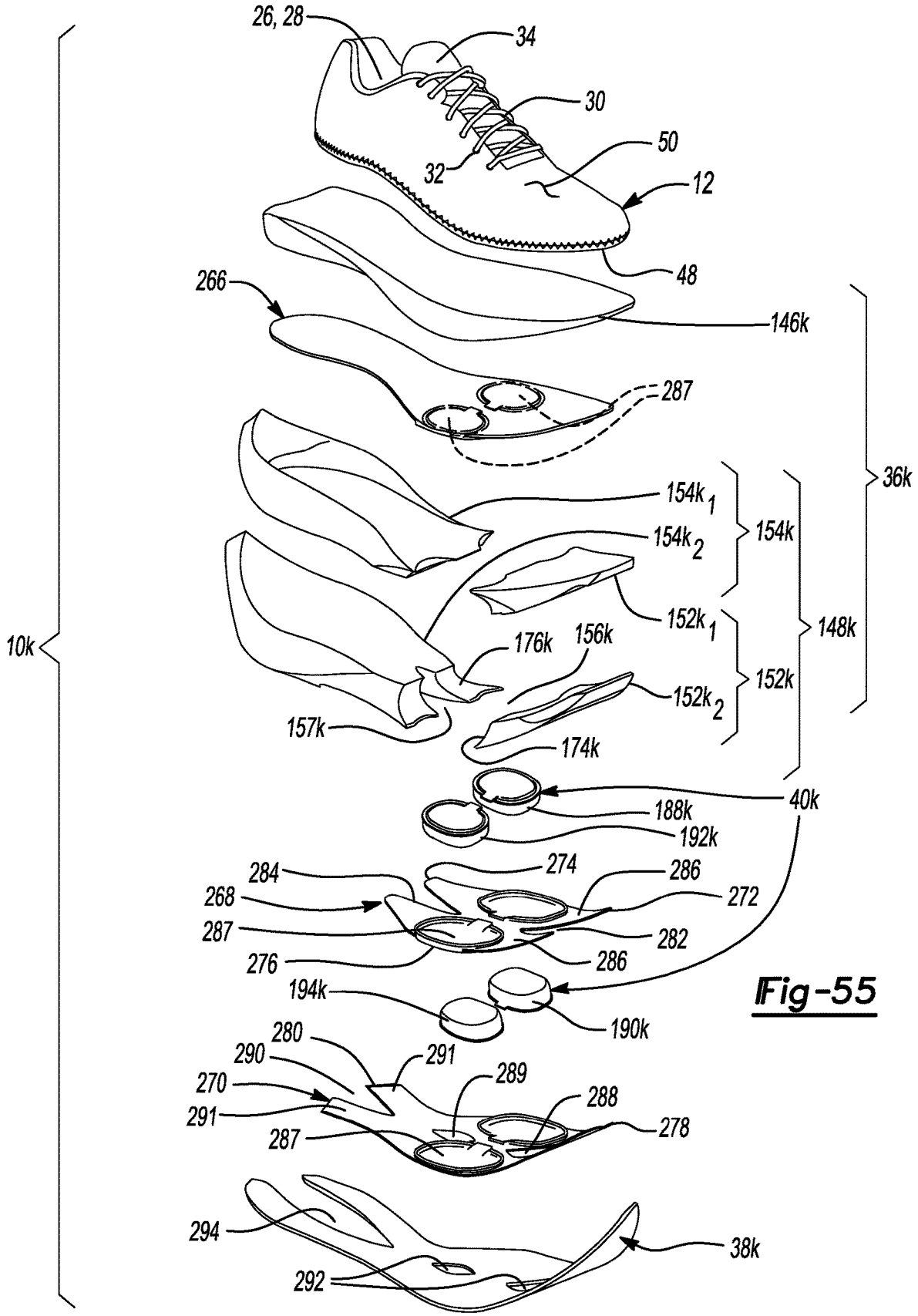
FIG. 55 is an exploded view of the article of footwear of FIG. 54.

With reference to FIGS. 55 and 57B, the midsole 36*k* may include a continuously formed upper portion 146*k* and a segmented lower portion 148*k*. The upper portion 146*k* is shown as extending from the anterior end 44 of the article of footwear 10*k* to the posterior end 46. In one configuration, the upper portion 146*k* opposes the strobel 48 of the upper 12 and joins the sole structure 14*k* to the upper 12. The upper portion 146*k* of the midsole 36*k* may extend at least partially onto an upper surface 50 of the upper 12, such that the midsole 36*k* covers a junction of the upper 12 and the strobel 48, as shown in FIG. 57A.

The lower portion 148*k* of the midsole 36*k* may include a first segment 152*k* extending downwardly from the forefoot region 16 of the upper portion 146*k* and a second segment 154*k* extending downwardly from the heel region 20 of the upper portion 146*k*. A heel-facing sidewall 174*k* of the first segment 152*k* is spaced apart from a forefoot-facing sidewall 176*k* of the second segment 154*k* to define a gap 156*k* between the first segment 152*k* and the second segment 154*k*. The forefoot-facing sidewall 176*k* of the second segment 154*k* may be tapered, as shown in FIGS. 55 and 57B. Generally, the gap 156*k* is defined to provide sufficient clearance for uninhibited expansion and contraction of the cushioning arrangement 40*k* during use. For example, on initial impact with the ground surface, a width of the cushioning arrangement 40*k* may expand as the cushioning arrangement 40*k* is compressed. By providing the gap 156*k*, the shock absorption capacity of the cushioning arrangement 40*k* is maximized.

Figure 56:
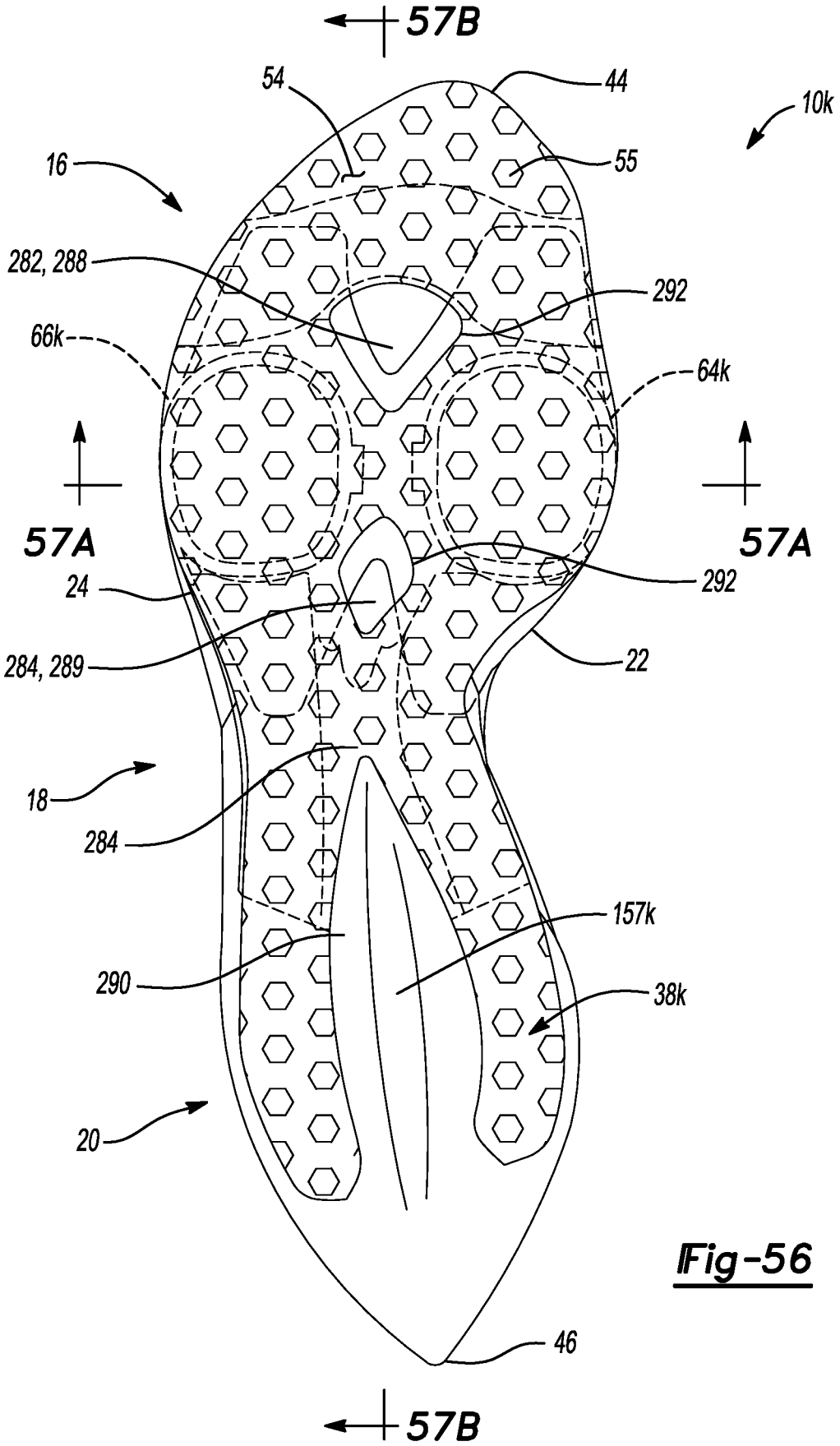
FIG. 56 is a bottom view of the article of footwear of FIG. 54.

With reference to FIGS. 54 and 56, the second segment 154*k* of the midsole 36*k* may include a channel 157*k* extending continuously from the forefoot-facing sidewall 176*k* to the posterior end 46. As shown, a width of the channel 157*k* may flare from the forefoot-facing sidewall 176*k* to an intermediate portion, and taper from the intermediate portion to a second vertex adjacent the posterior end 46 of the sole structure 14*k*.

The midsole 36*k* may be formed from an energy absorbing material such as, for example, polymer foam. Forming the midsole 36*k* from an energy-absorbing material such as polymer foam allows the midsole 36*k* to attenuate ground-reaction forces caused by movement of the article of footwear 10*k* over ground during use.

As provided above, the sole structure 14*k* includes a plurality of plates 266, 268, 270 configured to provide rigid or semi-rigid interfaces between the midsole 36*k* and the cushioning arrangement 40*k*, thereby providing increased stability to the cushioning arrangement 40*k* and distributing loads throughout the sole structure 14*k*. The first plate 266 may be disposed within the midsole 36*k* such that the upper portion 146*k* of the midsole 36*k* extends between the first plate 266 and the upper 12. As shown, the first plate 266 may be disposed intermediate the upper portion 146*k* and the lower portion 148*k*. More particularly, a first end of the first plate 266 is embedded within the midsole 36*k* between the upper portion 146*k* and the first segment 152*k*, and a second end of the first plate 266 is embedded within the midsole 36*k* between the upper portion 146*k* and the second segment 154*k*. An intermediate portion of the first plate 266 traverses the gap 156*k*, whereby a ground-facing surface 158*k* of the first plate 266 is exposed within the gap 156*k* and is joined to a proximal end of the cushioning arrangement 40*k*.

The first plate 266 may be visible at the medial side 22 of the sole structure 14*k* and/or at the lateral side 24 of the sole structure 14*k*. Alternatively, the first plate 266 may be encapsulated within the upper portion 146*k* of the midsole 36*k*. In some examples, the first plate 266 may be disposed between the upper 12 and the midsole 36*k*, whereby the first plate 266 is attached directly to the strobel 48 and/or the upper 12.

As shown, the second plate 268 is spaced apart from the first plate 266, and is disposed generally between the first plate 266 and the outsole 38*k*. A first end 272 of the second plate 268 is joined to the first segment 152*k* of the lower portion 148*k* of the midsole 36*k*, while an opposing second end 274 is joined to the second segment 154*k* of the lower portion 148*k* of the midsole 36*k*. In the illustrated example, the first end 272 of the second plate 268 is embedded within the first segment 152*k* and the second end 274 embedded within the second segment 154*k*. An intermediate portion 276 of the second plate 268 spans the gap 156*k* formed between the first segment 152*k* and the second segment 154*k*, and separates the cushioning arrangement 40*k* into an upper portion and a lower portion, as discussed in greater detail below.

With reference to FIG. 55, the second plate 268 includes cutouts 282, 284 formed therethrough for controlling flexibility and stability characteristics. As shown, the cutouts 282, 284 include a first notch 282 extending from the first end 272 of the second plate 268, and a second notch 284 extending from the second end 274 of the second plate 268. Each of the first notch 282 and the second notch 284 extend to respective vertices adjacent opposing sides of the cushioning arrangement 40*k*. As shown, the notches 282, 284 may extend partially between portions of the cushioning arrangement 40*k*, as discussed below. Accordingly, each of the notches 282, 284 effectively defines a pair of tabs 286 at each end 272, 274 of the second plate 268. The tabs 286 of the first end 272 extend through the heel-facing sidewall 174*k* into the first segment 152*k* of the midsole 36*k*, and the tabs 286 of the second end 274 extend through the forefoot-facing sidewall 176*k* into second segment 154*k* of the midsole 36*k*.

The tabs 286 are configured to act as flexures at each of the first and second ends 272, 274 of the second plate 268 during use of the footwear 10*k*. For example, the first notch 282 may be sized and positioned to minimize a stiffness of the second plate 268 within the forefoot region 16, adjacent the cushioning arrangement 40*k*. Likewise, by forming the tabs 286, the second notch 284 allows the second end 274 of the second plate 268 to twist and bend within the mid-foot region 18. Size and position of the notches 282, 284 may be modified depending on desired characteristics of flexibility and stability.

The third plate 270 is spaced apart from the second plate 268, and is disposed between the cushioning arrangement 40*k* and the outsole 38*k*. As shown, the third plate 270 extends from a first end 278 attached to the first segment 152*k* of the midsole 36*k* to a second end 280 attached to the cushioning arrangement 40*k*. More specifically, the first end 278 of the third plate 270 is disposed between a distal end of the first segment 152*k* and the outsole 38*k*, while the second end 280 of the third plate 270 is received between a distal end of the second segment 154*k* and the outsole 38*k*. Accordingly, at least a portion of the outsole 38*k* may be attached to or formed integrally with the third plate 270, as described in greater detail below.

Like the second plate 268, the third plate 270 includes a plurality of cutouts 288, 289, 290 formed therethrough. In the illustrated example, the first cutout is a first notch 288 formed in the first end 278 and the second cutout is a second notch 290 formed in the second end 280. As shown, each of the notches 288, 290 are formed through the thickness of the third plate 270 and taper in width to a vertex disposed in an intermediate portion of the third plate 270. Accordingly, each of the notches 288, 290 effectively defines a pair of tabs 291 at each end 278, 280 of the third plate 270. The tabs 291 of the first end 278 are received between the first segment 152*k* and the outsole 38*k*, and the tabs 291 of the second end 280 are received between the second segment 154*k* and the outsole 38*k*. The third plate 270 further includes an aperture 289 formed through the intermediate portion on an opposing side of the cushioning arrangement 40*k* from the first notch 288. Like the tabs 286 of the second plate 268, the tabs 291 of the third plate 270 may be configured to provide desired flexibility and stability.

With reference the FIGS. 55 and 57B, the first plate 266 is a full-length plate and extends substantially along an entire length of the sole structure 14*k* from the forefoot region 16 to the heel region 20. The second plate 268 and the third plate 270 may be so-called "partial-length" plates that extend along only a portion of the sole structure 14*k*. In the illustrated example, the second plate 268 and the third plate extend from the forefoot region 16 to the mid-foot region 18. In some examples, any one or more of the plates 266, 268, 270 could extend from an intermediate portion of the forefoot region 16 to an intermediate portion of the mid-foot region 18 or the heel region 20. Additionally or alternatively, any one or more of the plates 266, 268, 270 may be full-length plates, as described above, which extend from the anterior end 44 to the posterior end 46 of the sole structure 14*k*.

Regardless of the particular size, location, and features, one or more of the plates 266, 268, 270 may be formed from a relatively rigid material. For example, the plates 266, 268, 270 may be formed from a non-foamed polymer material or, alternatively, from a composite material containing fibers, such as carbon fibers. Carbon fiber plates have been found to provide maximum performance due to the relatively low weight and desirable force distribution properties compared to polymeric materials. However, polymeric plates may provide suitable weight and force distribution properties in other implementations of the sole structure. Forming the plates 266, 268, 270 from a relatively rigid material allows forces associated with use of the article footwear 10*k* when the article of footwear 10*k* strikes a ground surface to be distributed throughout the entire sole structure 14*k*, as will be described in greater detail below.

Referring still to FIGS. 54-57B, the cushioning arrangement 40*k* is disposed within the gap 156*k* of the midsole 36*k*, and is shown to include a medial cushion or cushioning arrangement 64*k* and a lateral cushion or cushioning arrangement 66*k*. The medial cushioning arrangement 64*k* is disposed proximate to the medial side 22 of the sole structure 14*k* while the lateral cushioning arrangement 66*k* is disposed proximate to the lateral side 24 of the sole structure 14*k*.

As shown in FIGS. 55 and 57A, the medial cushioning arrangement 64*k* includes a first fluid-filled chamber 188*k* and a second fluid-filled chamber 190*k*. Similarly, the lateral cushioning arrangement 66*k* includes a third fluid-filled chamber 192*k* and a fourth fluid-filled chamber 194*k*. The first fluid-filled chamber 188*k* and the third fluid-filled chamber 192*k* are disposed generally between the first plate 266 and the second plate 268, while the second fluid-filled chamber 190*k* and the fourth fluid-filled chamber 194*k* are disposed between second plate 268 and the third plate 270. Specifically, the first fluid-filled chamber 188*k* and the third fluid-filled chamber 192*k* are attached to the first plate 266 at respective first sides, and are attached to the second plate 268 at respective second sides. Likewise, the second fluid-filled chamber 190*k* and the fourth fluid-filled chamber 194*k* are attached to the second plate 268 at respective first sides, and are attached to the third plate 270 at respective second sides.

With reference to FIGS. 54 and 57B, the intermediate portion 276 of the second plate 268 extends through the cushioning arrangement 40*k*. More specifically, the intermediate portion 276 of the second plate 268 is disposed between the first fluid-filled chamber 188*k* and the second fluid-filled chamber 190*k* of the medial cushioning arrangement 64*k*, and between the third fluid-filled chamber 192*k* and the fourth fluid-filled chamber 194*k* of the lateral cushioning arrangement 66*k*. In other words, the first fluid-filled chamber 188*k* and the third fluid-filled chamber 192*k* are disposed above the second plate 268 (i.e., between the second plate 268 and the upper 12), while the second fluid-filled chamber 190*k* and the fourth fluid-filled chamber 194*k* are disposed between the second plate 268 and the outsole 38*k*.

The fluid-filled chambers 188*k*, 190*k*, 192*k*, 194*k* may be attached to the first plate 266, the second plate 268, and/or the third plate 270, respectively, via a suitable adhesive. Additionally or alternatively, the fluid-filled chambers 188*k*, 190*k*, 192*k*, 194*k* may be joined to any one or more of the plates 266, 268, 270 by melding a material of at least one of the fluid-filled chambers 188*k*, 190*k*, 192*k*, 194*k*, the first plate 266, the second plate 268, and/or the third plate 270. As discussed above, opposing ends of each of fluid-filled chambers 188*k*, 190*k*, 192*k*, 194*k* may be received in a corresponding socket 287 formed in or on each of the plates 266, 268, 270, thereby mechanically securing a position of each end.

The fluid-filled chambers 188*k*, 190*k*, 192*k*, 194*k* may each include a first barrier element 76 and a second barrier element 78. The first barrier element 76 and the second barrier element 78 may be formed from a sheet of thermoplastic polyurethane (TPU). Specifically, the first barrier element 76 may be formed from a sheet of TPU material and may include a substantially planar shape. The second barrier element 78 may likewise be formed from a sheet of TPU material and may be formed into the configuration shown in FIG. 57A to define an interior void 80. The first barrier element 76 may be joined to the second barrier element 78 by applying heat and pressure at a perimeter of the first barrier element 76 and the second barrier element 78 to define a peripheral seam 82. The peripheral seam 82 seals the internal interior void 80, thereby defining a volume of each of the chambers 188*k*, 190*k*, 192*k*, 194*k*.

The interior void 80 of each of the fluid-filled chambers 188*k*, 190*k*, 192*k*, 194*k* may receive a tensile element 84 therein. Each tensile element 84 may include a series of tensile strands 86 extending between an upper tensile sheet 88 and a lower tensile sheet 90. The upper tensile sheet 88 may be attached to the first barrier element 76 while the lower tensile sheet 90 may be attached to the second barrier element 78. In this manner, when the fluid-filled chambers 188*k*, 190*k*, 192*k*, 194*k* receive a pressurized fluid, the tensile strands 86 of the tensile elements 84 are placed in tension. Because the upper tensile sheet 88 is attached to the first barrier element 76 and the lower tensile sheet 90 is attached to the second barrier element 78, the tensile strands 86 retain a desired shape of each of the first fluid-filled chamber 188*k*, the second fluid-filled chamber 190*k*, the third fluid-filled chamber 192*k*, and the fourth fluid-filled chamber 194*k*, respectively, when the pressurized fluid is injected into the interior void 80.

As described, the medial cushioning arrangement 64*k* and the lateral cushioning arrangement 66*k* each include a pair of fluid-filled chambers 188*k*, 190*k*, 192*k*, 194*k* that are received generally between the upper 12 and the outsole 38*k*. In one configuration, the first fluid-filled chamber 188*k* and the third fluid-filled chamber 192*k* are, respectively, fluidly isolated from the second fluid-filled chamber 190*k* and the fourth fluid-filled chamber 194*k* by the second plate 268.

In some configurations, the medial cushioning arrangement 64*k* (i.e., the first fluid-filled chamber 188*k* and the second fluid-filled chamber 190*k*) is fluidly isolated from the lateral cushioning arrangement 66*k* (i.e., the third fluid-filled chamber 192*k* and the fourth fluid-filled chamber 194*k*). While the medial cushioning arrangement 64*k* is described and shown as being spaced apart from the lateral cushioning arrangement 66*k*, the cushioning arrangements 64*k*, 66*k* could alternatively be in contact with one another while still being fluidly isolated.

While the medial cushioning arrangement 64*k* and the lateral cushioning arrangement 66*k* are described and shown as including stacked pairs of fluid-filled chambers, the medial cushioning arrangement 64*k* and the lateral cushioning arrangement 66*k* could alternatively include other cushioning elements. For example, the medial cushioning arrangement 64*k* and the lateral cushioning arrangement 66*k* may each include a foam block (see e.g., 92 in FIGS. 4-6) that replaces any one or more of the fluid-filled chambers 188*k*, 190*k*, 192*k*, 194*k*. The foam blocks may be received within the interior void 80 defined by the first barrier element 76 and the second barrier element 78. Positioning the foam blocks within the interior void 80 defined by the first barrier element 76 and the second barrier element 78 allows the barrier elements 76, 78 to restrict expansion of the foam blocks beyond a predetermined amount when subjected to a predetermined load. Accordingly, the overall shape and, thus, the performance of the foam blocks may be controlled by allowing the foam blocks to interact with the barrier elements 76, 78 during loading. While the foam blocks are described as being received within the interior void 80 of the barrier elements 76, 78, the foam blocks could alternatively be positioned within the cushioning arrangement 40*k* absent the barrier elements 76, 78. In such a configuration, the foam blocks would be directly attached to any one or more of the first plate 266, the second plate 268, the third plate 270, and/or one of the fluid-filled chambers 188*k*, 190*k*, 192*k*, 194*k*, respectively. The particular construction of the medial cushioning arrangement 64*k* and the lateral cushioning arrangement 66*k* (i.e., use of foam blocks, fluid-filled chambers, or a combination thereof) may be dictated by the amount of cushioning required at the medial side 22 and the lateral side 24.

Regardless of the particular construction of the medial cushioning arrangement 64*k* and the lateral cushioning arrangement 66*k*, the medial cushioning arrangement 64*k* and the lateral cushioning arrangement 66*k* may be substantially aligned with each other along a direction extending between the medial side 22 and the lateral side 24 of the sole structure 14*k*. Alternatively, the medial cushioning arrangement 64*k* and the lateral cushioning arrangement 66*k* may be offset from each other.

As described, the medial cushioning arrangement 64*k* and the lateral cushioning arrangement 66*k* each provide a pair of stacked cushioning elements disposed at discrete locations on the sole structure 14*k*. In one configuration, the medial cushioning arrangement 64*k* and the lateral cushioning arrangement 66*k* each provide a pair of stacked, fluid-filled chambers (i.e. elements 188*k*, 190*k*, 192*k*, 194*k*) that cooperate to provide cushioning at the medial side 22 and the lateral side 24, respectively. The individual fluid-filled chambers 188*k*, 190*k*, 192*k*, 194*k* may include the same volume and, further, may be at the same pressure. Alternatively, the volumes and the pressures of the various fluid-filled chambers 188*k*, 190*k*, 192*k*, 194*k* may vary between the cushioning arrangements 64*k*, 66*k* and/or within each cushioning arrangement 64*k*, 66*k*. For example, the first fluid-filled chamber 188*k* may include the same pressure as the second fluid-filled chamber 190*k* or, alternatively, the first fluid-filled chamber 188*k* may include a different pressure than the second fluid-filled chamber 190*k*. Likewise, the third fluid-filled chamber 192*k* may include the same or different pressure than the fourth fluid-filled chamber 194*k*, and may include a different pressure than the first fluid-filled chamber 188*k* and/or the second fluid-filled chamber 190*k*. For example, the first fluid-filled chamber 188*k* may include a higher or lower pressure than the second fluid-filled chamber 190*k* and the third fluid-filled chamber 192*k* may include a higher or lower pressure than the fourth fluid-filled chamber 194*k*. The fluid-filled chambers 188*k*, 190*k*, 192*k*, 194*k* may be at a pressure within a range of 15-30 psi and preferably at a pressure within a range of 20-25 psi.

As shown in FIG. 54, the outsole 38*k* is joined to the midsole 36*k* and the third plate 270 and extends from the anterior end 44 through the heel region 20. The outsole 38*k* may include cutouts 292, 294 formed therethrough that have complementary profiles to the cutouts 288, 290 of the third plate 270 and/or the channel 157*k* of the midsole 36*k*. The outsole 38*k* may be formed from a resilient material such as, for example, rubber that provides the article of footwear 10*k* with a ground-engaging surface 54 that provides traction and durability.

During operation, when the ground-engaging surface 54 contacts the ground, a force is distributed to the first segment 152*k* and the cushioning arrangement 40*k* by the third plate 270. The force received by the cushioning arrangement 40*k* through the third plate 270 is transmitted to the second plate 268 through the second fluid-filled chamber 190*k* and the fourth fluid-filled chamber 194*k*, through the second plate 268 to the first fluid-filled chamber 188*k* and the third fluid-filled chamber 192*k*, and to the first plate 266 through the first fluid-filled chamber 188*k* and the third fluid-filled chamber 192*k*. The applied force causes the individual fluid-filled chambers 188*k*, 190*k*, 192*k*, 194*k* to compress, thereby absorbing the forces associated with the outsole 38*k* contacting the ground. The force is transmitted to the midsole 36*k* via the first plate 266, the second plate 268, and the third plate 270, but is not experienced by the user as a point or localized load. As described above, one or more of the first plate 266, the second plate, 268, and the third plate 270 are formed from a rigid material. Accordingly, even though the medial cushioning arrangement 64*k* and the lateral cushioning arrangement 66*k* are located at discrete locations along the sole structure 14*k*, the forces exerted on the first plate 266 and the second plate 268 by the medial cushioning arrangement 64*k* and the lateral cushioning arrangement 66*k* are dissipated over a length of the midsole 36*k* such that neither applied force is applied at individual, discrete locations to a user's foot. Rather, the forces applied at the locations of the medial cushioning arrangement 64*k* and the lateral cushioning arrangement 66*k* are dissipated along a length of the first plate 266 and the second plate 268 due to the rigidity of the plates 266, 268, 270 and, as such, point loads are not experienced by the user's foot when the foot is in contact with an insole 94 disposed within the interior void 26. Furthermore, by attaching the third plate 270 to the distal ends of each of the medial cushioning arrangement 64*k* and the lateral cushioning arrangement 66*k*, and extending the second plate 268 between the first fluid-filled chamber 188*k* and the second fluid-filled chamber 190*k* of the medial cushioning arrangement 64*k* and between the third fluid-filled chamber 192*k* and the fourth fluid-filled chamber 194*k* of the lateral cushioning arrangement 66*k*, additional stability is provided to the cushioning arrangement 40*k* by distributing the applied force between the cushioning arrangements 64*k*, 66*k*, the first segment 152*k*, and the second segment 154*k*.

With reference to FIGS. 58-61A, an article of footwear 10*m* is provided and includes an upper 12 and a sole structure 14*m* attached to the upper 12. In view of the substantial similarity in structure and function of the components associated with the article of footwear 10 with respect to the article of footwear 10*m*, like reference numerals are used hereinafter and in the drawings to identify like components while like reference numerals containing letter extensions are used to identify those components that have been modified.

With continued reference to FIGS. 58-61B, the sole structure 14*m* is shown to include a midsole 36*m*, an outsole 38*m*, a cushion or cushioning arrangement 40*m* disposed between the midsole 36*m* and the outsole 38*m*, and a plate 296 disposed between the midsole 36*m* and the cushioning arrangement 40*m*. The plate 296 is formed from a relatively rigid material such as, for example, a non-foamed polymer or a composite material containing fibers such as carbon fibers.

Figure 58:
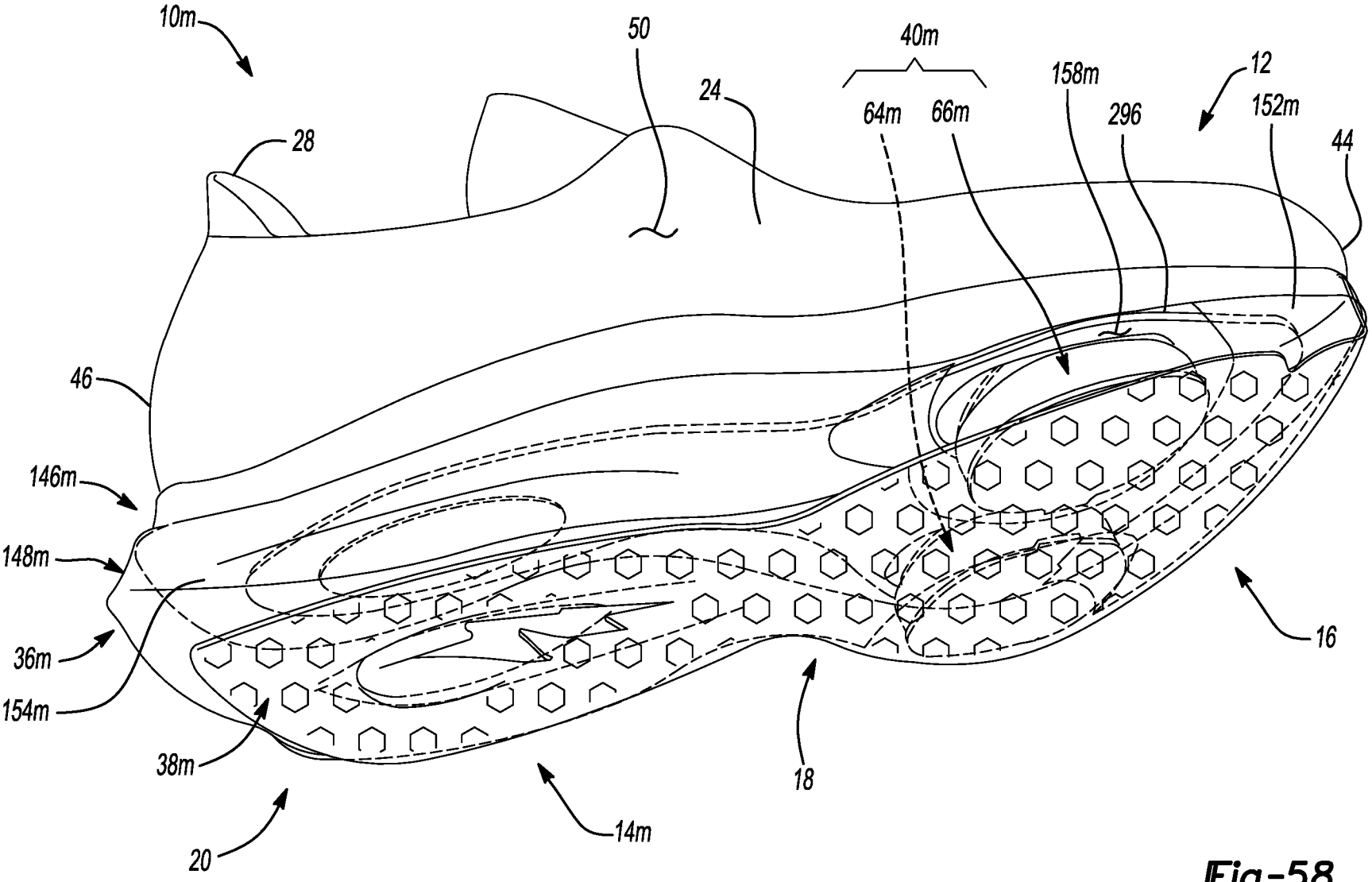
FIG. 58 is a perspective view of an article of footwear incorporating a sole structure in accordance with the principles of the present disclosure.
Figure 59:
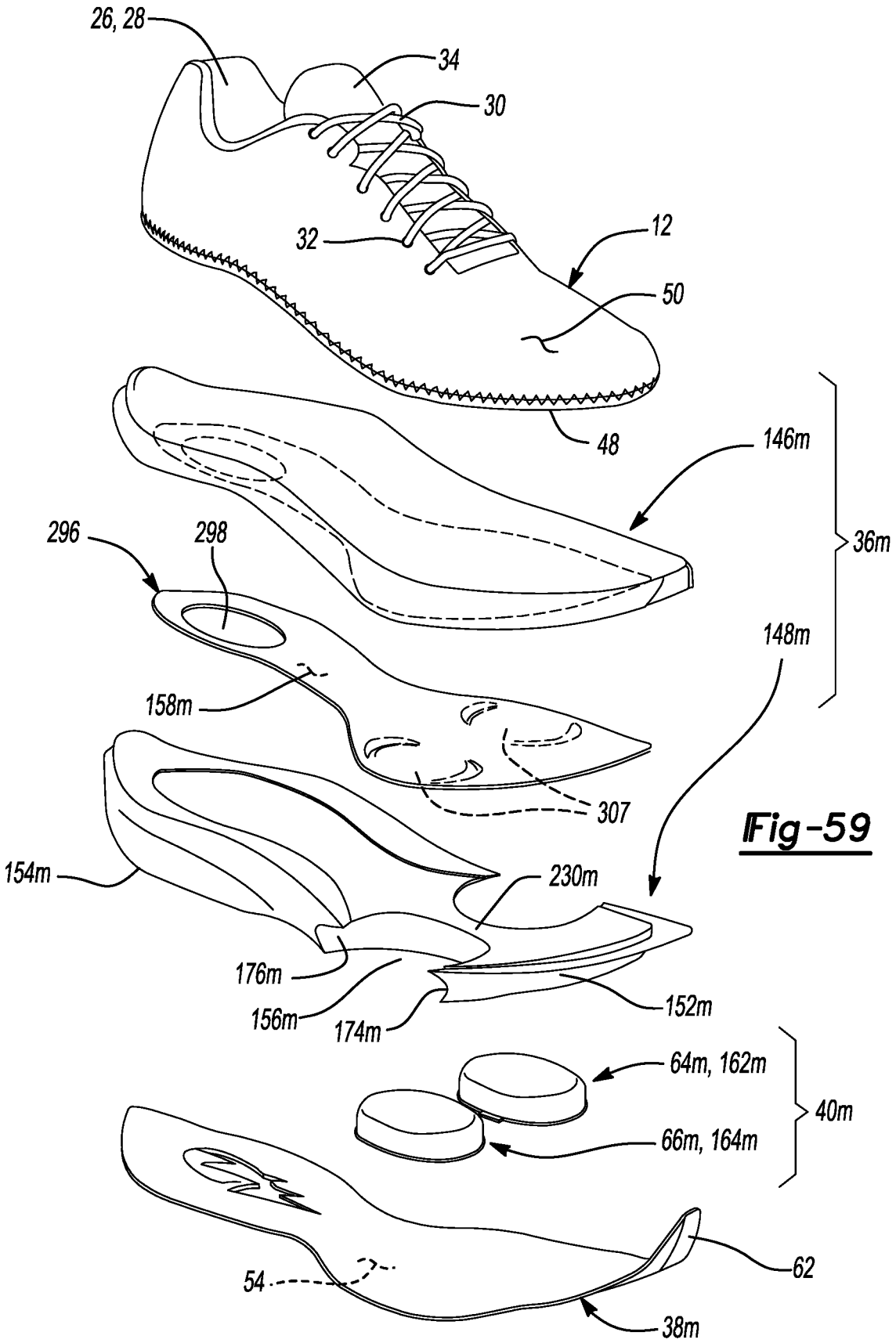
FIG. 59 is an exploded view of the article of footwear of FIG. 58.
Figure 60:
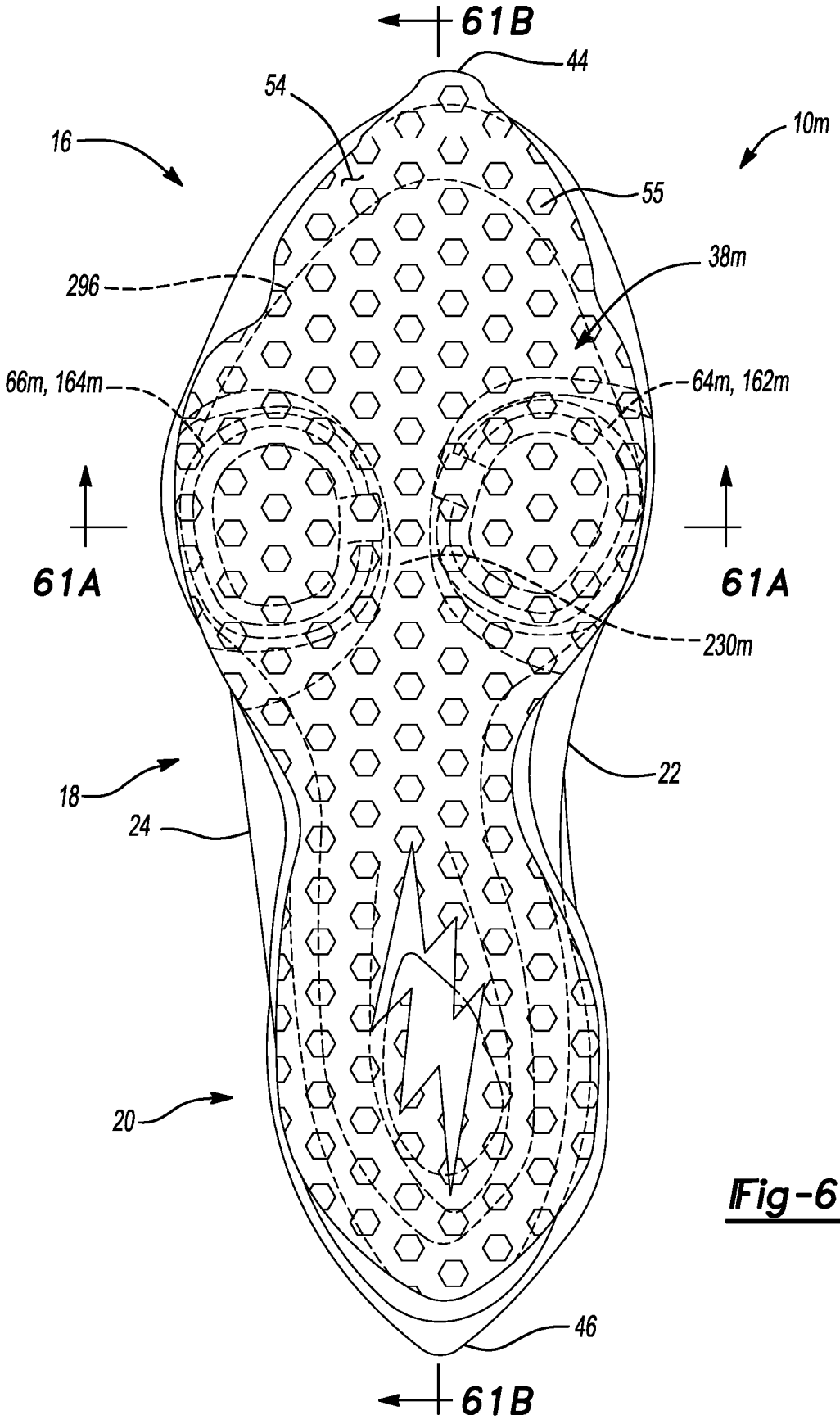
FIG. 60 is a bottom view of the article of footwear of FIG. 58.
Figure 61A:
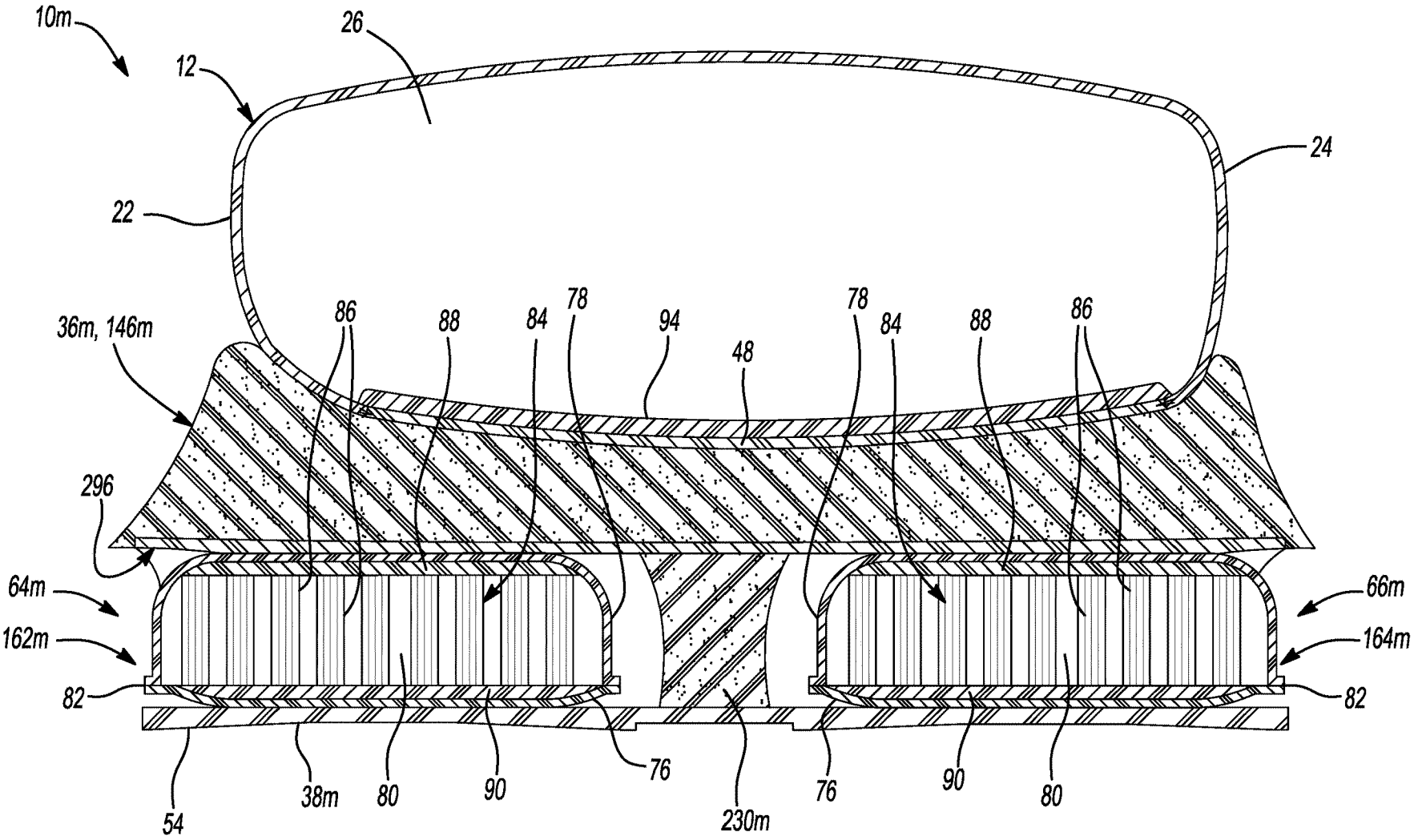
FIG. 61A is a cross-sectional view of the article of footwear of FIG. 58, taken along Line 61A-61A of FIG. 60.
Figure 61B:
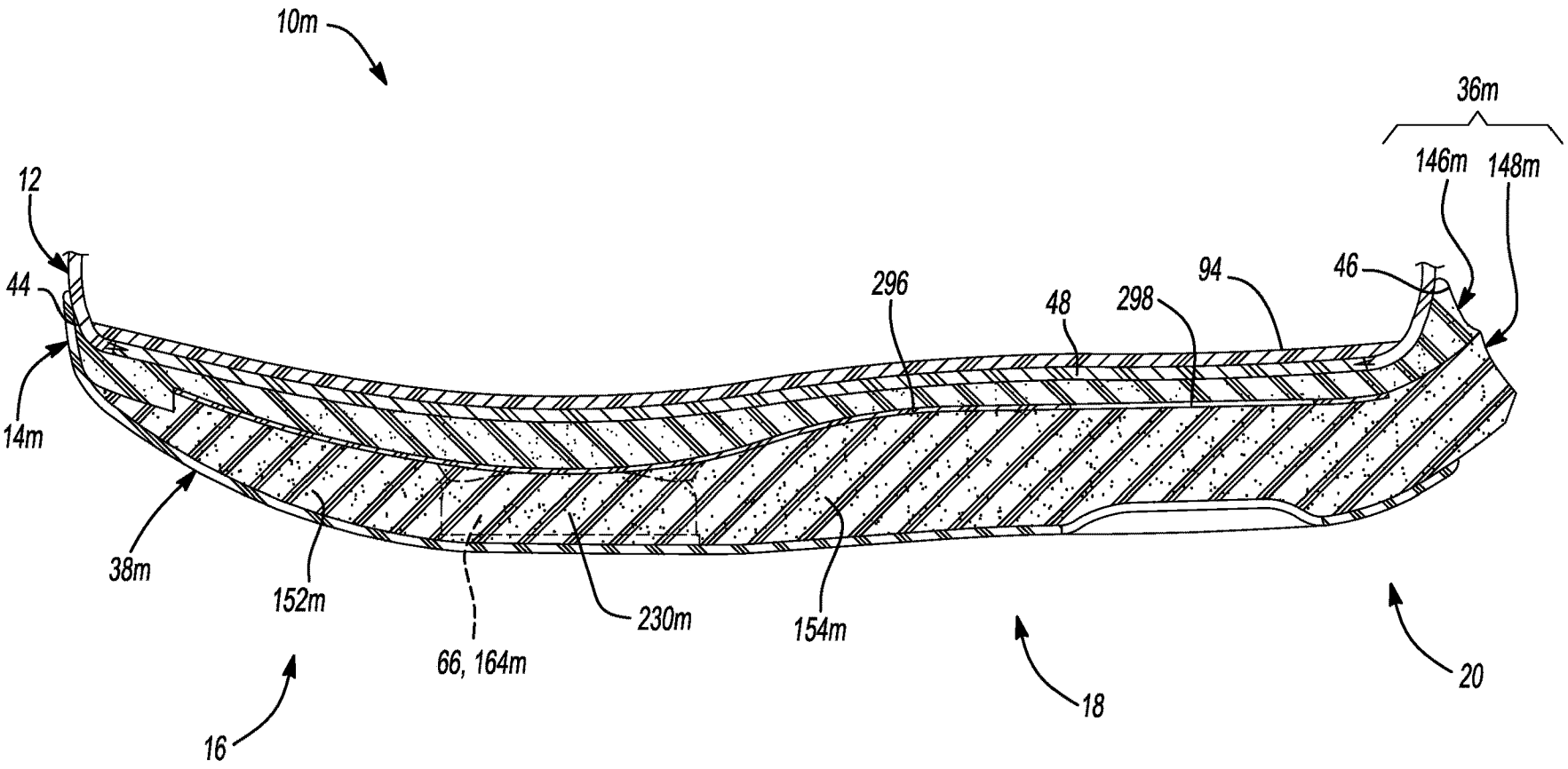
FIG. 61B is a partial cross-sectional view of the article of footwear of FIG. 58, taken along Line 61B-61B of FIG. 60.

With continued reference to FIGS. 58, 59, and 61B, the midsole 36*m* may include a continuously formed upper portion 146*m* and a lower portion 148*m*. The upper portion 146*m* is shown as extending from the anterior end 44 of the article of footwear 10*m* to the posterior end 46. In one configuration, the upper portion 146*m* opposes the strobel 48 of the upper 12 and joins the sole structure 14*m* to the upper 12. The upper portion 146*m* of the midsole 36*m* may extend at least partially onto an upper surface 50 of the upper 12, such that the midsole 36*m* covers a junction of the upper 12 and the strobel 48, as shown in FIG. 61B.

The lower portion 148*m* of the midsole 36*m* may include a first segment 152*m* extending downwardly from the forefoot region 16 of the upper portion 146*m*, a second segment 154*m* extending downwardly from the heel region 20 of the upper portion 146*m*, and a rib 230*m* extending between the first segment 152*m* and the second segment 154*m*. A heel-facing sidewall 174*m* of the first segment 152*m* is spaced apart from a forefoot-facing sidewall 176*m* of the second segment 154*m* to define a gap 156*m* between the first segment 152*m* and the second segment 154*m*. Accordingly, the rib 230*m* spans the gap 156*m* between the first segment 152*m* and the second segment 154*m*, and laterally bisects the cushioning arrangement 40*m*. As discussed below, each of the sidewalls 174*m*, 176*m* may be spaced apart from the cushioning arrangement 40*m*, In some examples, the sidewalls 174*m*, 176*m* may have a profile that is substantially complementary in shape to an outer profile of the cushioning arrangement 40*m*.

The plate 296 is disposed between the upper portion 146*m* and each of the lower portion 148*m* and the cushioning arrangement 40*m*. More specifically, a first end of the plate 296 is disposed between the upper portion 146*m* and the first segment 152*m*, an opposing second end of the plate 296 is disposed between the upper portion 146*m* and the second segment 154*m*, and an intermediate portion is disposed between the upper portion 146*m* on one side and the cushioning arrangement 40*m* and rib 230*m* on an opposite side, which defines a ground-facing surface 158*m* of the plate 296. Alternatively, the plate 296 could be at least partially encapsulated within the upper portion 146*m* of the midsole 36*m*. Further, the plate 296 may be visible at the medial side 22 of the sole structure 14*m* and/or at the lateral side 24 of the sole structure 14*m*. While the plate 296 is described and shown as being embedded within the material of the midsole 36*m*, the plate 296 may be disposed between the upper 12 and the midsole 36*m*, whereby the plate 296 is attached directly to the strobel 48 and/or the upper 12.

As shown, the plate 296 is a full-length plate and extends substantially continuously from the anterior end 44 to the posterior end 46, as discussed above with respect to the article of footwear 10. In some examples, the plate 296 may be a so-called "partial-length plate" that extends from an intermediate portion of the forefoot region 16 to an intermediate portion of the mid-foot region 16 or the heel region 20. Accordingly, the plate 296 may extend from the forefoot region 16 of the article of footwear 10*m* to the mid-foot region 18 without extending fully through the mid-foot region 18 and into the heel region 20.

Additionally, the plate 296 may include one or more sockets 307 configured to receive the cushioning arrangement 40*m* therein. As shown in FIG. 59, the sockets 307 may be defined by a rib, protrusion, or recess formed on the ground-facing surface 158*m* of the plate 296, and configured to interface with the cushioning arrangement 40*m*. Accordingly, the sockets 307 receive respective ends of the cushioning arrangement 40*m* to secure a position of the cushioning arrangement 40*m* with respect to the plate 296.

The plate 296 may include one or more cutouts 298 formed therethrough for controlling flex and stability characteristics. As shown, the plate 296 includes an aperture 298 formed through the heel region 20 of the plate 296. In some examples, the plate 296 may include notches or other cutouts to provide desired flexibility and stability.

Regardless of the particular size and configuration of the plate 296, the plate 296 may be formed from a relatively rigid material. For example, the plate 296 may be formed from a non-foamed polymer material or, alternatively, from a composite material containing fibers such as carbon fibers. Forming the plate 296 from a relatively rigid material allows the plate 296 to distribute forces associated with use of the article footwear 10*m* when the article of footwear 10*m* strikes a ground surface, as will be described in greater detail below.

With particular reference to FIGS. 58-61A, the cushioning arrangement 40*m* is shown to include a medial cushion or cushioning arrangement 64*m* and a lateral cushion or cushioning arrangement 66*m*. The medial cushioning arrangement 64*m* is disposed proximate to the medial side 22 of the sole structure 14*m* while the lateral cushioning arrangement 66*m* is disposed proximate to the lateral side 24 of the sole structure 14*m*.

As shown in FIG. 61A, the medial cushioning arrangement 64*m* includes a first fluid-filled chamber 162*m* disposed generally between the plate 296 and the outsole 38*m*. Similarly, the lateral cushioning arrangement 66*m* includes second fluid-filled chamber 164*m* disposed between the plate 296 and the outsole 38*m* at the lateral side 24. Specifically, the first fluid-filled chamber 162*m* is attached to the exposed surface 158*m* of the plate 296 at a first side and is attached to the outsole 38*m* at a second side. Likewise, the second fluid-filled chamber 164*m* is attached to the exposed surface 158*m* of the plate 296 at a first side and is attached to the outsole 38*m* at a second side.

The first fluid-filled chamber 162*m* may be attached to the plate 296 and to the outsole 38*m*, respectively, via a suitable adhesive. Additionally or alternatively, the first fluid-filled chamber 162*m* may be attached to the outsole 38*m* by melding a material of the first fluid-filled chamber 162*m* and a material of the outsole 38*m* at a junction of the first fluid-filled chamber 162*m* and the outsole 38*m*. As discussed above, first ends of each of the fluid-filled chambers 162*m*, 164*m* may be received in a corresponding socket 307 formed in the plate 296, thereby mechanically securing a position of the fluid-filled chambers 162*m*, 164*m*. In some examples, the outsole 38*m* may also include sockets 307 for receiving second ends of the fluid-filled chambers 162*m*, 164*m*.

The first fluid-filled chamber 162*m* and the second fluid-filled chamber 164*m* may each include a first barrier element 76 and a second barrier element 78. The first barrier element 76 and the second barrier element 78 may be formed from a sheet of thermoplastic polyurethane (TPU). Specifically, the first barrier element 76 may be formed from a sheet of TPU material and may include a substantially planar shape. The second barrier element 78 may likewise be formed from a sheet of TPU material and may be formed into the configuration shown in FIG. 28 to define an interior void 80. The first barrier element 76 may be joined to the second barrier element 78 by applying heat and pressure at a perimeter of the first barrier element 76 and the second barrier element 78 to define a peripheral seam 82. The peripheral seam 82 seals the interior void 80, thereby defining a volume of the first fluid-filled chamber 162*m*.

The interior void 80 of each of the first fluid-filled chamber 162*m* and the second fluid-filled chamber 164*m* may receive a tensile element 84 therein. The tensile element 84 may include a series of tensile strands 86 extending between an upper tensile sheet 88 and a lower tensile sheet 90. The upper tensile sheet 88 may be attached to the first barrier element 76 while the lower tensile sheet 90 may be attached to the second barrier element 78. In this manner, when the first fluid-filled chamber 162*m* receives a pressurized fluid, the tensile strands 86 of the tensile element 84 are placed in tension. Because the upper tensile sheet 88 is attached to the first barrier element 76 and the lower tensile sheet 90 is attached to the second barrier element 78, the tensile strands 86 retain a desired shape of the first fluid-filled chamber 162*m* when the pressurized fluid is injected into the interior void 80.

With continued reference to FIG. 61A, the lateral cushioning arrangement 66*m* likewise includes a second fluid-filled chamber 164*m*. As with the medial cushioning arrangement 64*m*, the second fluid-filled chamber 164*m* is disposed between the plate 296 and the outsole 38*m*. The second fluid-filled chamber 164*m* may be identical to the first fluid-filled chamber 162*m*. Accordingly, the second fluid-filled chamber 164*m* may include a first barrier element 76, a second barrier element 78, an interior void 80, a peripheral seam 82, and a tensile element 84 disposed within the interior void 80.

In one configuration, the medial cushioning arrangement 64*m* (i.e., the first fluid-filled chamber 162*m*) is fluidly isolated from the lateral cushioning arrangement 66*m* (i.e., the second fluid-filled chamber 164*m*). As such, the medial cushioning arrangement 64*m* is spaced apart and separated from the lateral cushioning arrangement 66*m* by a distance 166 (FIG. 29). While the medial cushioning arrangement 64*m* is described and shown as being spaced apart from the lateral cushioning arrangement 66*m*, the cushioning arrangements 64*m*, 66*m* could alternatively be in contact with one another while still being fluidly isolated.

While the medial cushioning arrangement 64*m* and the lateral cushioning arrangement 66*m* are described and shown as including fluid-filled chambers 162*m*, 164*m*, the medial cushioning arrangement 64*m* and/or the lateral cushioning arrangement 66*m* could alternatively include alternative or additional cushioning elements. For example, the medial cushioning arrangement 64*m* and/or the lateral cushioning arrangement 66*m* may each include a foam block (not shown) that replaces one or both of the fluid-filled chambers 162*m*, 164*m*. The foam block(s) may be received within the interior void 80 defined by the first barrier element 76 and the second barrier element 78. Positioning the foam block(s) within the interior void 80 defined by the first barrier element 76 and the second barrier element 78 allows the barrier elements 76, 78 to restrict expansion of the foam block(s) beyond a predetermined amount when subjected to a predetermined load. Accordingly, the overall shape and, thus, the performance of the foam blocks may be controlled by allowing the foam block(s) to interact with the barrier elements 76, 78 during loading.

Regardless of the particular construction of the medial cushioning arrangement 64*m* and the lateral cushioning arrangement 66*m*, the medial cushioning arrangement 64*m* may be aligned with the lateral cushioning arrangement 66*m* in a direction extending along a longitudinal axis (L) of the sole structure 14*m*, as shown in FIG. 61A. Additionally or alternatively, the medial cushioning arrangement 64*m* may be aligned with the lateral cushioning arrangement 66*m* in a direction extending from the medial side 22 to the lateral side 24 such that both cushioning arrangements 64*m*, 66*m* are approximately equally spaced from the anterior end 44 of the sole structure 14*m* and/or from the posterior end 46 of the sole structure 14*m*, as shown in FIG. 61A. Alternatively, the medial cushioning arrangement 64*m* may be offset from the lateral cushioning arrangement 66*m* in the direction extending along the longitudinal axis (L). Namely, the medial cushioning arrangement 64*m* may be disposed closer to or farther from the anterior end 44 of the sole structure 14*m* than the lateral cushioning arrangement 66*m*, similar to the example shown in FIG. 14.

As discussed above, sidewalls 174*m*, 176*m* of the midsole 36*m* are spaced apart from the cushioning arrangements 64*m*, 66*m*. The spacing allows the cushioning arrangements 64*m*, 66*m* to outwardly expand when subjected to a load. Namely, the cushioning arrangements 64*m*, 66*m* are permitted to extend into the spaces disposed between the cushioning arrangements 64*m*, 66*m* and the sidewalls 174*m* 176*m* when the cushioning arrangements 64*m*, 66*m* are subjected to a load. The width of this gap 156*m* may be designed to control the degree to which the cushioning arrangements 64*m*, 66*m* are permitted to expand when subjected to a load. For example, the larger the gap 156*m*, the more the cushioning arrangements 64*m*, 66*m* must expand before contacting the sidewalls 174*m*, 176*m*—if at all. Conversely, if the sidewalls 174*m*, 176*m* are disposed in close proximity to the cushioning arrangements 64*m*, 66*m*, minimal expansion of the cushioning arrangements 64*m*, 66*m*, will be permitted before the cushioning arrangements 64*m*, 66*m* contact the surfaces 168 of the midsole 36*m*, thereby allowing the midsole 36*m* to restrain the cushioning arrangements 64*m*, 66*m* from expanding beyond a predetermined amount.

As described, the medial cushioning arrangement 64*m* and the lateral cushioning arrangement 66*m* each provide a cushioning element disposed at discrete locations on the sole structure 14*m*. In one configuration, the medial cushioning arrangement 64*m* and the lateral cushioning arrangement 66*m* each provide a fluid-filled chamber (i.e. elements 162*m*, 164*m*) that cooperate to provide cushioning at the medial side 22 and the lateral side 24, respectively. The individual, discrete fluid-filled chambers 162*m*, 164*m* may include the same volume and, further, may be at the same pressure (i.e., 20 psi). Alternatively, the pressures of the various fluid-filled chambers 162*m*, 164*m* may vary between the cushioning arrangements 64*m*, 66*m*. For example, the first fluid-filled chamber 162*m* may include the same pressure as the second fluid-filled chamber 164*m* or, alternatively, the first fluid-filled chamber 162*m* may include a different pressure than the second fluid-filled chamber 164*m*. The fluid-filled chambers 162*m*, 164*m* may be at a pressure within a range of 15-30 psi and preferably at a pressure within a range of 20-25 psi.

As shown in FIGS. 58 and 61B, the outsole 38*m* is joined to the midsole 36*m* and the cushioning arrangement 40*m*. The outsole 38*m* may be formed from a resilient material such as, for example, rubber that provides the article of footwear 10*m* with a ground-engaging surface 54 that provides traction and durability. As described above, the ground-engaging surface 54 may include traction elements 55 to enhance engagement of the sole structure 14*m* with a ground surface.

During operation, when the sole structure 14*m* contacts the ground, a force is transmitted to the medial cushioning arrangement 64*m* and the lateral cushioning arrangement 66*m*. Namely, the force is transmitted to the first fluid-filled chamber 162*m* and the second fluid-filled chamber 164*m*. The applied force causes the individual fluid-filled chambers 162*m*, 164*m* to compress, thereby absorbing the forces associated with the outsole 38*m* contacting the ground. The force is transmitted to the midsole plate 296 and the midsole 36*m*, but is not experienced by the user as a point or localized load. Namely, and as described above, the plate 296 is formed from a rigid material. Accordingly, even though the medial cushioning arrangement 64*m* and the lateral cushioning arrangement 66*m* are located at discrete locations along the sole structure 14*m*, the forces exerted on the plate 296 by the medial cushioning arrangement 64*m* and the lateral cushioning arrangement 66*m* are dissipated over a length of the plate 296 such that neither applied force is applied at individual, discrete locations to a user's foot. Rather, the forces applied at the locations of the medial cushioning arrangement 64*m* and the lateral cushioning arrangement 66*m* are dissipated along a length of the plate 296 due to the rigidity of the plate 296 and, as such, point loads are not experienced by the user's foot when the foot is in contact with an insole 94 disposed within the interior void 26.

Each of the foregoing articles of footwear 10-10*m* respectively incorporate a sole structure 14-14*i* that provides the articles of footwear 10-10*m* with a degree of cushioning and protection to a foot of a user during use of the particular article of footwear 10-10*m*. Accordingly, the articles of footwear 10-10*i* may be used for a variety of athletic activities such as running in the case of the articles of footwear 10, 10*a*, 10*d*, 10*e*, 10*f*, 10*g*, 10*h*, 10*i*, 10*j*, 10*k*, 10*m*, a track-and-field event in the case of the article of footwear 10*b*, or during a basketball game in the case of the article of footwear 10*c*.

The following Clauses provide configurations for an article of footwear described above.

Clause 1: A sole structure for an article of footwear having an upper, the sole structure comprising an outsole having a ground-engaging surface and an upper surface formed on an opposite side of the outsole than the ground-engaging surface, a midsole having an upper portion and a lower portion, the lower portion attached to the outsole and including a first segment extending from a forefoot region of the upper portion in a direction toward a heel region of the upper portion and a second segment extending from the heel region of the upper portion in a direction toward the forefoot region of the upper portion and spaced apart from the first segment along a longitudinal axis of the midsole by a gap, at least one plate extending from the midsole into the gap, and a cushion disposed in the gap of the midsole and joined to the plate.

Clause 2: The sole structure of Clause 1, wherein a first end of the plate is joined to the first segment of the midsole, a second end of the plate is joined to the second segment of the midsole, and an intermediate portion of the plate extends through the gap from the first end to the second end and is joined to the plate.

Clause 3: The sole structure of Clause 2, wherein the first end of the plate is embedded within the second segment of the midsole and the second end of the plate is embedded within the first segment of the midsole.

Clause 4: The sole structure of Clause 2, wherein the intermediate portion of the plate is disposed between the cushion and the upper portion of the midsole.

Clause 5: The sole structure of Clause 4, wherein the cushion comprises a first cushion disposed proximate to a medial side of the sole structure and including a first fluid-filled chamber disposed between the plate and the outsole, and a second cushion disposed proximate to a lateral side of the sole structure and including a second fluid-filled chamber disposed between the plate and the outsole, the second cushion being fluidly isolated from the first cushion.

Clause 6: The sole structure of Clause 2, wherein the cushion is disposed between intermediate portion of the plate and the upper portion of the midsole.

Clause 7: The sole structure of Clause 6, wherein the cushion comprises a first cushion disposed proximate to a medial side of the sole structure and including a first fluid-filled chamber disposed between upper portion midsole and the intermediate portion of the plate, and a second cushion disposed proximate to a lateral side of the sole structure and including a second fluid-filled chamber disposed between the upper portion of the midsole and the intermediate portion of the plate, the second cushion being fluidly isolated from the first cushion.

Clause 8: The sole structure of Clause 2, wherein a first end of the plate is disposed between the upper portion of the midsole and the first segment of the midsole, and a second end of the first plate is disposed between the upper portion of the midsole and the second segment of the midsole.

Clause 9: The sole structure of Clause 1, wherein the plate includes a first plate disposed between the upper portion of the midsole and the cushion and a second plate extending from the lower portion of the midsole and disposed between the cushion and the outsole.

Clause 10: The sole structure of Clause 1, wherein at least one of the first plate and the second plate is formed of carbon fiber.

Clause 11: A sole structure for an article of footwear having an upper, the sole structure comprising an outsole having a ground-engaging surface and an upper surface formed on an opposite side of the outsole than the ground-engaging surface, a midsole having an upper portion and a lower portion, the lower portion attached to the outsole and including a first segment extending from a forefoot region of the upper portion in a direction toward a heel region of the upper portion and a second segment extending from the heel region of the upper portion in a direction toward the forefoot region of the upper portion and spaced apart from the first segment along a longitudinal axis of the midsole by a gap; a cushion disposed in the gap of the midsole and including a first cushion disposed proximate to a medial side of the sole structure, and a second cushion disposed proximate to a lateral side of the sole structure, the second cushion being isolated from the first cushion; and a first plate joined to each of the first segment of the midsole, the second segment of the midsole, and the cushion.

Clause 12: The sole structure of Clause 11, wherein the cushion comprises the first cushion including a first fluid-filled chamber disposed between the first plate and the second plate and a second fluid-filled chamber disposed between the second plate and the outsole, and a second cushion disposed proximate to a lateral side of the sole structure and including a third fluid-filled chamber disposed between the first plate and the second plate and a fourth fluid-filled chamber disposed between the second plate and the outsole, the second cushion being fluidly isolated from the first cushion.

Clause 13: The sole structure of Clause 11, further comprising a second plate spaced apart from the first plate and having a first end joined to the first segment of the midsole, a second end joined to the second segment of the midsole, and an intermediate portion joined to the cushion, the cushion disposed between the first plate and the second plate.

Clause 14: The sole structure of Clause 13, wherein the cushion comprises the first cushion including a first fluid-filled chamber disposed between the first plate and the second plate and a second fluid-filled chamber disposed between the second plate and the outsole, and the second cushion including a third fluid-filled chamber disposed between the first plate and the second plate and a fourth fluid-filled chamber disposed between the second plate and the outsole, the second cushion being fluidly isolated from the first cushion.

Clause 15: The sole structure of Clause 14, further comprising a third plate disposed between the cushion and the outsole, the third plate extending from a first end joined to the first segment of the midsole to a terminal end between the cushion and the second segment.

Clause 16: The sole structure of Clause 14, wherein at least one of the second plate and the third plate includes a cutout formed between the first segment and the cushion.

Clause 17: The sole structure of Clause 13, wherein the first end of the second plate includes a first notch defining a first pair of tab and the second end of the second plate includes a second notch defining a second pair of tabs, the first pair of tabs embedded in the first segment and the second pair of tabs embedded in the second segment.

Clause 18: The sole structure of Clause 13, wherein at least one of the first fluid-filled chamber and the second fluid-filled chamber includes a tensile member disposed therein.

Clause 19: The sole structure of Clause 13, wherein the second plate is formed of carbon fiber.

Clause 20: The sole structure of Clause 13, wherein the first fluid-filled chamber is aligned with the second fluid-filled chamber in a direction extending from a medial side to a lateral side of the sole structure.

Clause 21: A sole structure for an article of footwear having an upper, the sole structure comprising an outsole having a ground-engaging surface and an upper surface formed on an opposite side of the outsole than the ground-engaging surface, a first cushion disposed proximate to a medial side of the sole structure and including a first fluid-filled chamber attached to the upper surface of the outsole and a second fluid-filled chamber attached to the first fluid-filled chamber and disposed between the first fluid-filled chamber and the upper, and a second cushion disposed proximate to a lateral side of the sole structure and including a third fluid-filled chamber attached to the upper surface of the outsole and a fourth fluid-filled chamber attached to the third fluid-filled chamber and disposed between the third fluid-filled chamber and the upper, the second cushion being fluidly isolated from the first cushion.

Clause 22: The sole structure of Clause 21, wherein the first fluid-filled chamber is fluidly isolated from the second fluid-filled chamber and the third fluid-filled chamber is fluidly isolated from the fourth fluid-filled chamber.

Clause 23: The sole structure of Clause 22, wherein the first cushion is spaced apart and separated from the second cushion.

Clause 24: The sole structure of Clause 21, wherein the first cushion is disposed closer to an anterior end of the sole structure than the second cushion.

Clause 25: The sole structure of Clause 21, further comprising a third cushion disposed between the second cushion and a posterior end of the sole structure.

Clause 26: The sole structure of Clause 25, wherein the third cushion includes a fifth fluid-filled chamber attached to the upper surface of the outsole and a sixth fluid-filled chamber attached to the fifth fluid-filled chamber and disposed between the fifth fluid-filled chamber and the upper.

Clause 27: The sole structure of Clause 21, wherein the outsole includes an outsole plate member forming the upper surface and a series of traction elements extending from the outsole plate member at the ground-engaging surface.

Clause 28: The sole structure of Clause 27, wherein the traction elements are formed from a resilient material.

Clause 29: The sole structure of Clause 27, wherein the traction elements are formed from a compressible material.

Clause 30: The sole structure of Clause 27, wherein the traction elements are formed from a rigid material.

Clause 31: The sole structure of Clause 27, wherein the outsole plate member is formed from a rigid material.

Clause 32: The sole structure of Clause 21, further comprising a plate member extending from an anterior end of the sole structure toward a posterior end, the first cushion and the second cushion disposed between the plate member and the upper surface of the outsole.

Clause 33: The sole structure of any of the preceding Clauses, wherein at least one of the first fluid-filled chamber, the second fluid-filled chamber, the third fluid-filled chamber, and the fourth fluid-filled chamber includes a tensile member disposed therein.

Clause 34: The sole structure of any of the preceding Clauses, wherein the first cushion forms a first bulge in the ground-engaging surface and the second cushion forms a second bulge in the ground-engaging surface.

Clause 35: The sole structure of Clause 34, wherein the first bulge is offset from the second bulge in a direction extending substantially parallel to a longitudinal axis of the sole structure.

Clause 36: The sole structure of any of the preceding Clauses, wherein the first fluid-filled chamber is aligned with the second fluid-filled chamber.

Clause 37: The sole structure of any of the preceding Clauses, wherein the third fluid-filled chamber is aligned with the fourth fluid-filled chamber.

Clause 38: The sole structure of any of the preceding Clauses, wherein the outsole extends from the second cushion to an anterior end of the sole structure.

Clause 39: The sole structure of Clause 38, further comprising a cushioning element disposed between the upper surface of the outsole and the upper, the cushioning element being disposed between the anterior end of the sole structure and the first cushion.

Clause 40: The sole structure of Clause 39, wherein the cushioning element is formed from foam.

Clause 41: The sole structure of Clause 40, wherein the cushioning element tapers in a direction toward the anterior end of the sole structure.

Clause 42: A sole structure for an article of footwear having an upper, the sole structure comprising an outsole having a ground-engaging surface and an upper surface formed on an opposite side of the outsole than the ground-engaging surface, a first cushion disposed proximate to a medial side of the sole structure and including a first fluid-filled chamber attached to the upper surface of the outsole and a second fluid-filled chamber attached to the first fluid-filled chamber and disposed between the first fluid-filled chamber and the upper, and a second cushion disposed proximate to a lateral side of the sole structure and including a third fluid-filled chamber attached to the upper surface of the outsole and a fourth fluid-filled chamber attached to the third fluid-filled chamber and disposed between the third fluid-filled chamber and the upper, the second cushion being offset from the first cushion in a direction extending substantially parallel to a longitudinal axis of the sole structure.

Clause 43: The sole structure of Clause 42, wherein the first fluid-filled chamber is fluidly isolated from the second fluid-filled chamber and the third fluid-filled chamber is fluidly isolated from the fourth fluid-filled chamber.

Clause 44: The sole structure of Clause 43, wherein the first cushion is spaced apart and separated from the second cushion.

Clause 45: The sole structure of Clause 42, wherein the first cushion is disposed closer to an anterior end of the sole structure than the second cushion.

Clause 46: The sole structure of Clause 42, further comprising a third cushion disposed between the second cushion and a posterior end of the sole structure.

Clause 47: The sole structure of Clause 46, wherein the third cushion includes a fifth fluid-filled chamber attached to the upper surface of the outsole and a sixth fluid-filled chamber attached to the fifth fluid-filled chamber and disposed between the fifth fluid-filled chamber and the upper.

Clause 48: The sole structure of Clause 42, wherein the outsole includes an outsole plate member forming the upper surface and a series of traction elements extending from the outsole plate member at the ground-engaging surface.

Clause 49: The sole structure of Clause 48, wherein the traction elements are formed from a resilient material.

Clause 530: The sole structure of Clause 48, wherein the traction elements are formed from a compressible material.

Clause 51: The sole structure of Clause 48, wherein the traction elements are formed from a rigid material.

Clause 52: The sole structure of Clause 48, wherein the outsole plate member is formed from a rigid material.

Clause 53: The sole structure of Clause 42, further comprising a plate member extending from an anterior end of the sole structure toward a posterior end, the first cushion and the second cushion disposed between the plate member and the upper surface of the outsole.

Clause 54: The sole structure of any of the preceding Clauses, wherein at least one of the first fluid-filled chamber, the second fluid-filled chamber, the third fluid-filled chamber, and the fourth fluid-filled chamber includes a tensile member disposed therein.

Clause 55: The sole structure of any of the preceding Clauses, wherein the first cushion forms a first bulge in the ground-engaging surface and the second cushion forms a second bulge in the ground-engaging surface.

Clause 56: The sole structure of any of the preceding Clauses, wherein the first fluid-filled chamber is aligned with the second fluid-filled chamber.

Clause 57: The sole structure of any of the preceding Clauses, wherein the third fluid-filled chamber is aligned with the fourth fluid-filled chamber.

Clause 58: The sole structure of any of the preceding Clauses, wherein the outsole extends from the second cushion to an anterior end of the sole structure.

Clause 59: The sole structure of Clause 58, further comprising a cushioning element disposed between the upper surface of the outsole and the upper, the cushioning element being disposed between the anterior end of the sole structure and the first cushion.

Clause 60: The sole structure of Clause 59, wherein the cushioning element is formed from foam.

Clause 61: The sole structure of Clause 60, wherein the cushioning element tapers in a direction toward the anterior end of the sole structure.

Clause 62: A sole structure for an article of footwear having an upper, the sole structure comprising a plate member attached to the upper, an outsole having a ground-engaging surface and an upper surface formed on an opposite side of the outsole than the ground-engaging surface, a first cushion disposed proximate to a medial side of the sole structure and including a first fluid-filled chamber, the first fluid-filled chamber attached at a first side to the upper surface of the outsole and attached at a second side opposite the first side to the plate member, a second cushion disposed proximate to a lateral side of the sole structure and including a second fluid-filled chamber, the second fluid-filled chamber attached at a first side to the upper surface of the outsole and attached at a second side opposite the first side to the plate member, and a third cushion including a third fluid-filled chamber attached to the upper surface of the outsole and a fourth fluid-filled chamber attached to the third fluid-filled chamber and to the plate member.

Clause 63: The sole structure of Clause 62, wherein the third cushion extends farther from the plate member than at least one of the first cushion and the second cushion.

Clause 64: The sole structure of Clause 62, wherein the third cushion is disposed closer to the lateral side than the medial side.

Clause 65: The sole structure of Clause 62, wherein the plate member includes an anterior end and a posterior end.

Clause 66: The sole structure of Clause 65, wherein the third cushion is disposed closer to the posterior end than the first cushion and the second cushion.

Clause 67: The sole structure of Clause 65, wherein the first cushion is disposed closer to the anterior end than the second cushion.

Clause 68: A sole structure for an article of footwear having an upper, the sole structure comprising an outsole having a ground-engaging surface and an upper surface formed on an opposite side of the outsole than the ground-engaging surface, the outsole extending between an anterior end and a posterior end, a first cushion including a first fluid-filled chamber attached to the upper surface of the outsole and a second fluid-filled chamber attached to the first fluid-filled chamber and disposed between the first fluid-filled chamber and the upper, and a second cushion including a third fluid-filled chamber attached to the upper surface of the outsole and a fourth fluid-filled chamber attached to the third fluid-filled chamber and disposed between the third fluid-filled chamber and the upper, the second cushion being disposed between the first cushion and the posterior end of the outsole.

Clause 69: The sole structure of Clause 68, wherein the outsole includes a first bulge and a second bulge that stand proud of a nominal plane defined by the outsole.

Clause 70: The sole structure of Clause 69, wherein the first bulge is aligned with the first cushion and the second bulge is aligned with the second cushion.

Clause 71: The sole structure of Clause 68, wherein the first cushion is aligned with the second cushion in a direction extending along a longitudinal axis of the outsole.

Clause 72: A sole structure for an article of footwear having an upper, the sole structure comprising a midsole having an upper portion in contact with the upper, a lower portion extending from the upper portion, and a channel formed between the upper portion and the lower portion, a plate member disposed within the channel of the midsole, and a cushion attached to the plate member at a first side.

Clause 73: The sole of Clause 72, wherein the cushion comprises a first cushion disposed proximate to a medial side of the sole structure and including a first fluid-filled chamber attached to the plate and a second cushion disposed proximate to a lateral side of the sole structure and including a second fluid-filled chamber attached to the plate.

Clause 74: The sole structure of Clause 73, wherein the first fluid-filled chamber is fluidly isolated from the second fluid-filled chamber.

Clause 75: The sole structure of Clause 73, wherein the first cushion is spaced apart and separated from the second cushion.

Clause 76: The sole structure of Clause 72, further comprising an outsole having a first portion joined to the midsole and a second portion joined to the cushion.

Clause 77: The sole structure of Clause 76, wherein the first portion of the outsole is separate from the second portion of the outsole.

Clause 78: The sole structure of Clause 72, wherein the lower portion of the midsole includes a recess in fluid communication with the channel.

Clause 79: The sole structure of Clause 78, wherein the plate is exposed at the recess.

Clause 80: The sole structure of Clause 79, wherein the cushion is disposed within the recess.

Clause 81: The sole structure of Clause 72, wherein plate member extends from an intermediate portion of a forefoot region to an intermediate portion of a heel region.

Clause 82: The sole structure of any of the preceding Clauses, wherein at least one of the first fluid-filled chamber and the second fluid-filled chamber includes a tensile member disposed therein.

Clause 83: The sole structure of any of the preceding Clauses, wherein the first fluid-filled chamber is aligned with the second fluid-filled chamber in a direction extending from a medial side to a lateral side of the sole structure.

Clause 84: A sole structure for an article of footwear having an upper, the sole structure comprising an outsole having a ground-engaging surface and an upper surface formed on an opposite side of the outsole than the ground-engaging surface, a midsole attached to the outsole and having an upper portion and a lower portion defining a gap, the lower portion including a first segment extending from a forefoot region of the upper portion and a second segment extending from a heel region of the upper portion, a cushion disposed in the gap of the midsole, a first plate disposed between the cushion and the upper portion of the midsole, and a second plate joined to the first segment of the midsole and to the cushion.

Clause 85: The sole structure of Clause 84, wherein the cushion comprises a first cushion disposed proximate to a medial side of the sole structure and including a first fluid-filled chamber disposed between the first plate and the second plate and a second fluid-filled chamber disposed between the second plate and the outsole, and a second cushion disposed proximate to a lateral side of the sole structure and including a third fluid-filled chamber disposed between the first plate and the second plate and a fourth fluid-filled chamber disposed between the second plate and the outsole, the second cushion being fluidly isolated from the first cushion.

Clause 86: The sole structure of Clause 84, wherein a first end of the second plate is joined to the first segment of the midsole and a second end of the second plate is joined to the second segment of the midsole.

Clause 87: The sole structure of Clause 86, wherein the first end of the second plate is embedded within the second segment of the midsole.

Clause 88: The sole structure of Clause 87, wherein the second end of the second plate is embedded within the first segment of the midsole.

Clause 89: The sole structure of Clause 87, wherein the second end of the second plate is joined to a forefoot-facing sidewall of the second segment.

Clause 90: The sole structure of Clause 84, wherein a first end of the first plate is disposed between the upper portion of the midsole and the first segment of the midsole, and a second end of the first plate is disposed between the upper portion of the midsole and the first segment of the midsole.

Clause 91: The sole structure of Clause 84, wherein the second plate includes a concave intermediate portion having a radius of constant curvature from an anterior-most point to a metatarsophalangeal point of the sole structure.

Clause 82: The sole structure of Clause 84, wherein the cushion comprises a first cushion disposed proximate to a medial side of the sole structure and including a first fluid-filled chamber attached to the first plate and a second fluid-filled chamber attached to the first fluid-filled chamber and disposed between the first fluid-filled chamber and the second plate, and a second cushion disposed proximate to a lateral side of the sole structure and including a third fluid-filled chamber attached to the first plate and a fourth fluid-filled chamber attached to the third fluid-filled chamber and disposed between the third fluid-filled chamber and the second plate, the second cushion being fluidly isolated from the first cushion.

Clause 93: The sole structure of Clause 92, wherein the second plate extends from the first segment of the midsole to the second segment of the midsole.

Clause 94: The sole structure of Clause 93, wherein a first end of the second plate is joined to an anterior end of the first segment and a second end of the second plate is embedded within the second segment of the midsole.

Clause 95: The sole structure of Clause 92, wherein an intermediate portion of the second plate is curved upward.

Clause 96: The sole structure of Clause 95, wherein the intermediate portion of the second plate includes a damper.

Clause 97: The sole structure of Clause 96, wherein the damper is disposed intermediate the cushion and the second segment of the midsole.

Clause 98: The sole structure of Clause 96, wherein the damper is configured to minimize a transfer of torsional forces from the intermediate portion to the second segment.

Clause 99: The sole structure of Clause 84, wherein the midsole includes a rib extending between the first segment and the second segment and laterally bisecting the cushion.

Clause 100: The sole structure of any of the preceding Clauses, wherein the fluid-filled chambers include a pressure within a range of 15-30 psi.

Clause 101: The sole structure of any of the preceding Clauses, wherein the fluid-filled chambers include a pressure within a range of 20-25 psi.

Clause 102: The sole structure of any of the preceding Clauses, wherein the fluid-filled chambers include a pressure of 20 psi.

Clause 103: The sole structure of any of Clauses 1-101, wherein the fluid-filled chambers include a pressure of 25 psi.

Clause 104: A sole structure for an article of footwear including an upper, the sole structure comprising a first midsole portion attached to the upper, a first plate member attached to the first midsole portion, a first cushion attached to the first plate member on an opposite side of the first plate member than the first midsole portion, a second plate member attached to the first cushion on an opposite side of the first cushion than the first plate member, a second cushion attached to the second plate member on an opposite side of the second plate member than the first cushion, and an outsole attached to the second cushion on an opposite side of the second cushion than the second plate member.

Clause 105: A sole structure for an article of footwear including an upper, the sole structure comprising a first midsole portion attached to the upper, a first plate member attached to the first midsole portion, a first cushion attached to the first plate member on an opposite side of the first plate member than the first midsole portion, a second plate member attached to the first cushion on an opposite side of the first cushion than the first plate member, a second cushion attached to the second plate member on an opposite side of the second plate member than the first cushion, and a third plate member attached to the second cushion on an opposite side of the second cushion than the second plate member.

Clause 106: A sole structure for an article of footwear including an upper, the sole structure comprising a first midsole portion attached to the upper, a first plate member attached to the first midsole portion, a first cushion attached to the first plate member on an opposite side of the first plate member than the first midsole portion, a second midsole portion disposed on an opposite side of the first plate member than the first midsole portion, and an outsole attached to the second midsole portion on an opposite side of the second midsole portion than the first plate member.

The foregoing description of the embodiments has been provided for purposes of illustration and description. It is not intended to be exhaustive or to limit the disclosure. Individual elements or feature of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a first plate;

a second plate including a first portion spaced apart from the first plate by a first distance in a forefoot region of the sole structure and a second portion spaced apart from the first plate by a second distance that is greater than the first distance in a mid-foot region of the sole structure, the second portion joined to the first portion by an arcuate segment extending between the mid-foot region and the forefoot region; and a cushioning arrangement including a first cushioning arrangement disposed between the first plate and the first portion of the second plate proximate to a medial side of the sole structure, a second cushioning arrangement disposed between the first plate and the first portion of the second plate proximate to a lateral side of the sole structure, and a third cushioning arrangement (i) extending from an anterior end in a midfoot region of the sole structure to a posterior end in the midfoot region of the sole structure, (ii) disposed between a heel region of the sole structure and at least one of the first cushioning arrangement and the second cushioning arrangement, and (iii) including a first cushion attached to the first plate and a second cushion attached to the first cushion and disposed between the first cushion and the second portion of the second plate.

2. The sole structure of claim 1, wherein at least one of the first cushioning arrangement, the second cushioning arrangement, and the third cushioning arrangement includes a fluid-filled bladder.

3. The sole structure of claim 2, further comprising plural tensile strands extending within the fluid-filled bladder.

4. The sole structure of claim 1, wherein the first cushioning arrangement is aligned with the second cushioning arrangement across a width of the sole structure.

5. The sole structure of claim 1, further comprising a midsole extending between an anterior end of the sole structure and at least one of the first cushioning arrangement and the second cushioning arrangement.

6. The sole structure of claim 1, wherein the third cushioning arrangement is pressurized.

7. An article of footwear incorporating the sole structure of claim 1.

8. A sole structure for an article of footwear, the sole structure comprising:

a first plate;

a second plate including a first portion spaced apart from the first plate by a first distance in a forefoot region of the sole structure and a second portion spaced apart from the first plate by a second distance that is greater than the first distance in a mid-foot region of the sole structure, the second portion joined to the first portion by an arcuate segment and extending to a terminal end in the mid-foot region; and a cushioning arrangement attached to the first plate and including a first cushioning arrangement having a first cushion disposed between the first plate and the first portion of the second plate proximate to a medial side of the sole structure, a second cushioning arrangement having a second cushion disposed between the first plate and the first portion of the second plate proximate to a lateral side of the sole structure, and a third cushioning arrangement disposed in a midfoot region of the sole structure, whereby the third cushioning arrangement includes a third cushion attached to the first plate and a fourth cushion attached to the third cushion and disposed between the third cushion and the second portion of the second plate.

9. The sole structure of claim 8, wherein at least one of the first cushioning arrangement, the second cushioning arrangement, and the third cushioning arrangement includes a fluid-filled bladder.

10. The sole structure of claim 9, further comprising plural tensile strands extending within the fluid-filled bladder.

11. The sole structure of claim 8, wherein the first cushioning arrangement is aligned with the second cushioning arrangement across a width of the sole structure.

12. The sole structure of claim 8, further comprising a midsole extending between an anterior end of the sole structure and at least one of the first cushioning arrangement and the second cushioning arrangement.

13. The sole structure of claim 8, further comprising a gap disposed between the third cushioning arrangement and at least one of the first cushioning arrangement and the second cushioning arrangement.

14. An article of footwear incorporating the sole structure of claim 8.

* * * * *